US008008892B2

(12) United States Patent
Kikuchi

(10) Patent No.: US 8,008,892 B2
(45) Date of Patent: Aug. 30, 2011

(54) IMAGE FORMING APPARATUS, POWER SUPPLY DEVICE, AND CONTROL METHOD

(75) Inventor: Hideo Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 618 days.

(21) Appl. No.: 11/681,520

(22) Filed: Mar. 2, 2007

(65) Prior Publication Data

US 2007/0212103 A1 Sep. 13, 2007

(30) Foreign Application Priority Data

Mar. 8, 2006 (JP) ..... 2006-063180
Jun. 15, 2006 (JP) ..... 2006-166567

(51) Int. Cl.
*H02J 7/00* (2006.01)
*H02J 7/04* (2006.01)

(52) U.S. Cl. ..... 320/134; 320/128; 320/127; 320/132

(58) Field of Classification Search ..... 320/134, 320/107, 110, 112, 113, 114, 115, 116, 121, 320/125, 127, 128, 132, 155, 162
See application file for complete search history.

(56) References Cited

U.S. PATENT DOCUMENTS 5,034,769 A * 7/1991 Takami et al. ..... 396/106
5,941,906 A * 8/1999 Barreras et al. ..... 607/66
6,738,271 B2 * 5/2004 Umeda ..... 363/60
2004/0149740 A1 * 8/2004 Kishi et al. ..... 219/660
2005/0169657 A1 * 8/2005 Hanamoto et al. ..... 399/88

FOREIGN PATENT DOCUMENTS

| | | |
|---|---|---|
| JP | 5-53421 | 3/1993 |
| JP | 2003-98900 | 4/2003 |
| JP | 2003-297526 | 10/2003 |
| JP | 2004-194408 | 7/2004 |
| JP | 2004-236492 | 8/2004 |
| JP | 2004-266984 | 9/2004 |
| JP | 2004-286881 | 10/2004 |
| JP | 2005-221674 | 8/2005 |
| JP | 2005-253290 | 9/2005 |
| JP | 2006-30611 | 2/2006 |

OTHER PUBLICATIONS

Office Action issued Mar. 29, 2011, in Japanese Patent Application No. 2006-166567.

* cited by examiner

*Primary Examiner* — Edward Tso
*Assistant Examiner* — Alexis Boateng
(74) *Attorney, Agent, or Firm* — Oblon, Spivak, McClelland, Maier & Neustadt, L.L.P.

(57) ABSTRACT

A step-down circuit lowers a voltage outputted from a commercial power supply. A step-down-output control and charge control circuit controls a step-down voltage and charges a capacitor bank based on a step-down voltage outputted. A constant-voltage generating circuit generates a constant voltage based on an output of the capacitor bank or an output of the step-down circuit. An image-forming-apparatus control circuit supplies the constant voltage to a load that performs an image forming operation.

8 Claims, 92 Drawing Sheets

| POWER OVER CONDITION | | ACCUMULATED POWER USE TIME |
|---|---|---|
| SHEET SIZE | NUMBER OF SHEETS | |
| A3 | 15 SHEETS | TIMER 15 SECONDS |
| A4 | 20 SHEETS | TIMER 10 SECONDS |
| ⋮ | ⋮ | ⋮ |

| POST-PROCESSING TYPE |
|---|
| FOLDING OPERATION |
| ⋮ |

| FIG. 20AA |
| --- |
| FIG. 20AB |

| FIG. 20BA |
| --- |
| FIG. 20BB |

| FIG. 26BA |
| --- |
| FIG. 26BB |

| FIG. 26CA |
| --- |
| FIG. 26CB |

| FIG. 45AA |
| --- |
| FIG. 45AB |

| FIG. 58AA |
| --- |
| FIG. 58AB |

| FIG. 58BA |
| --- |
| FIG. 58BB |

IMAGE FORMING APPARATUS, POWER SUPPLY DEVICE, AND CONTROL METHOD

CROSS-REFERENCE TO RELATED APPLICATIONS

The present document incorporates by reference the entire contents of Japanese priority documents, 2006-063180 filed in Japan on Mar. 8, 2006 and 2006-166567 filed in Japan on Jun. 15, 2006.

BACKGROUND OF THE INVENTION

1. Field of the Invention

The present invention relates to an image forming apparatus, a power supply device, and a control method. More particularly, the present invention relates to power control including charge accumulating means.

2. Description of the Related Art

In recent years, according to increasing environmental protection activities, energy saving for image forming apparatuses is demanded. An image forming apparatus including a fixing device of a heat roller system that presses and heats a sheet, a film, and the like having toner images formed thereon consumes a particularly large amount of electric power.

In an image forming apparatus with high image formation speed, to prevent a temperature fall in a fixing roller of a heating unit at the time of an image forming operation, a fixing roller with a large heat capacity may be adopted. In such a case, since a warm-up time as long as several minutes is necessary to raise the temperature of the fixing roller to a usable temperature, a copy waiting time is long. To reduce a heat-up time of the fixing roller, a fixing roller with a reduced heat capacity may be adopted. In such a case, a temperature fall of the fixing roller occurs at the time of the image forming operation. It is possible to solve these problems if the temperature of the fixing roller can be raised quickly by using a 200-volts power supply to increase a power capacity of a heating member such as a halogen heater and increase a transport current. However, as a general commercial power supply for offices in Japan, a power supply with 100 volts and 15 A is used. To adapt the power supply to the voltage at 200 volts, it is necessary to apply special work to a facility in which the power supply is installed. This does not provide a general solution for the problems.

As a method of reducing power consumption of the fixing device on standby, in general, the temperature of the fixing device on standby is kept at fixed temperature slightly lower than a fixing temperature and immediately raised to the usable temperature when the fixing device is used to reduce time for waiting for heat-up of the fixing roller. In this case, even when the fixing device is not used, since a certain degree of power is supplied, energy is consumed unnecessarily. The energy consumption of the fixing device on standby is as high as about 70% to 80% of energy consumption of the apparatus.

As a technology for solving such a problem, in a technology disclosed in Japanese Patent Application Laid-Open No. 2003-297526, an auxiliary heater is provided separately from a fixing heater driven by a commercial power supply and electric power accumulated in a capacitor with a large capacity is supplied to the auxiliary heater to input large power to the fixing heater, reduce a warm-up time of the fixing device, and reduce a temperature change of the fixing device.

In a technology disclosed in Japanese Patent Application Laid-Open No. 2004-266984, a charge accumulating unit (a capacitor) is charged by a voltage supplied from a commercial power supply and electric power is supplied to a load using the voltage charged.

However, in the technology disclosed in Japanese Patent Application Laid-Open No. 2003-297526, temperature detecting units corresponding to a plurality of heaters and a control unit that controls the heaters according to a result of temperature detection by the temperature detecting unit are necessary. This complicates a structure of the fixing device.

In the technology disclosed in Japanese Patent Application Laid-Open No. 2004-266984, it is necessary to use a capacity with a large capacity that charges power at a high voltage. This undesirably increases cost.

SUMMARY OF THE INVENTION

It is an object of the present invention to at least partially solve the problems in the conventional technology.

According to an aspect of the present invention, an image forming apparatus includes a charge accumulating unit that is chargeable and dischargeable with electric charge and outputs a first output; a step-down unit that steps down a voltage of a commercial power supply and outputs a step-down voltage as a second output; a step-down and charge control unit that controls the step-down unit so that the step-down unit outputs a voltage having certain level as the second output and controls the charge accumulating unit so that the charge accumulating unit accumulates an electric change that corresponds to the level of the second output; a constant-voltage generating unit that generates a constant voltage based on any one of the first output and the second output; and a voltage-supply control unit that supplies the constant voltage to a load that performs an image forming operation.

According to another aspect of the present invention, an image forming apparatus includes a charge accumulating unit that is chargeable and dischargeable with electric charge and outputs a first output; a charging unit that charges the charge accumulating unit with a voltage outputted from a commercial power supply; a constant-voltage generating unit that generates a constant voltage based on an output of the charge accumulating unit; and a voltage-supply control unit that supplies the constant voltage to a load that performs an image forming operation.

According to still another aspect of the present invention, a power supply device that supplies electric power to an external load includes a charge accumulating unit that is chargeable and dischargeable with electric charge and outputs a first output; a step-down unit that steps down a voltage of a commercial power supply and outputs a step-down voltage as a second output; a step-down and charge control unit that controls the step-down unit so that the step-down unit outputs a voltage having certain level as the second output and controls the charge accumulating unit so that the charge accumulating unit accumulates an electric change that corresponds to the level of the second output; a constant-voltage generating unit that generates a constant voltage based on any one of the first output and the second output; a first switching unit that inputs the second output to one of the constant-voltage generating unit and the charge accumulating unit; a second switching unit that inputs one of the first output and the second output to the constant-voltage generating unit, wherein the step-down and charge control unit supplies the constant voltage to the load.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. The present invention is not limited to these embodiments.

An engine power supply unit of an image forming apparatus according to a first embodiment of the present invention steps down a voltage outputted from a commercial power supply and charges a charge accumulating unit. The engine power supply unit changes a voltage outputted from the commercial power supply or a voltage outputted from the charge accumulating unit to a constant voltage using a constant-voltage generating circuit to supply the voltage to a load.

An example of a structure of an engine power supply unit of a printer as an example of an image forming apparatus, to which the present invention is applied, is explained with reference to FIGS. 1 and 2. In this example, the printer is explained as an example of the image forming apparatus. It is possible to apply the present invention to image forming apparatuses such as a copying machine other than the printer, a facsimile apparatus, and a multi function peripheral (MFP) in which a copying function, a printer function, and a facsimile function are combined. It is also possible to apply the present invention to a power supply device that supplies electric power to some load unit.

Figure 1:
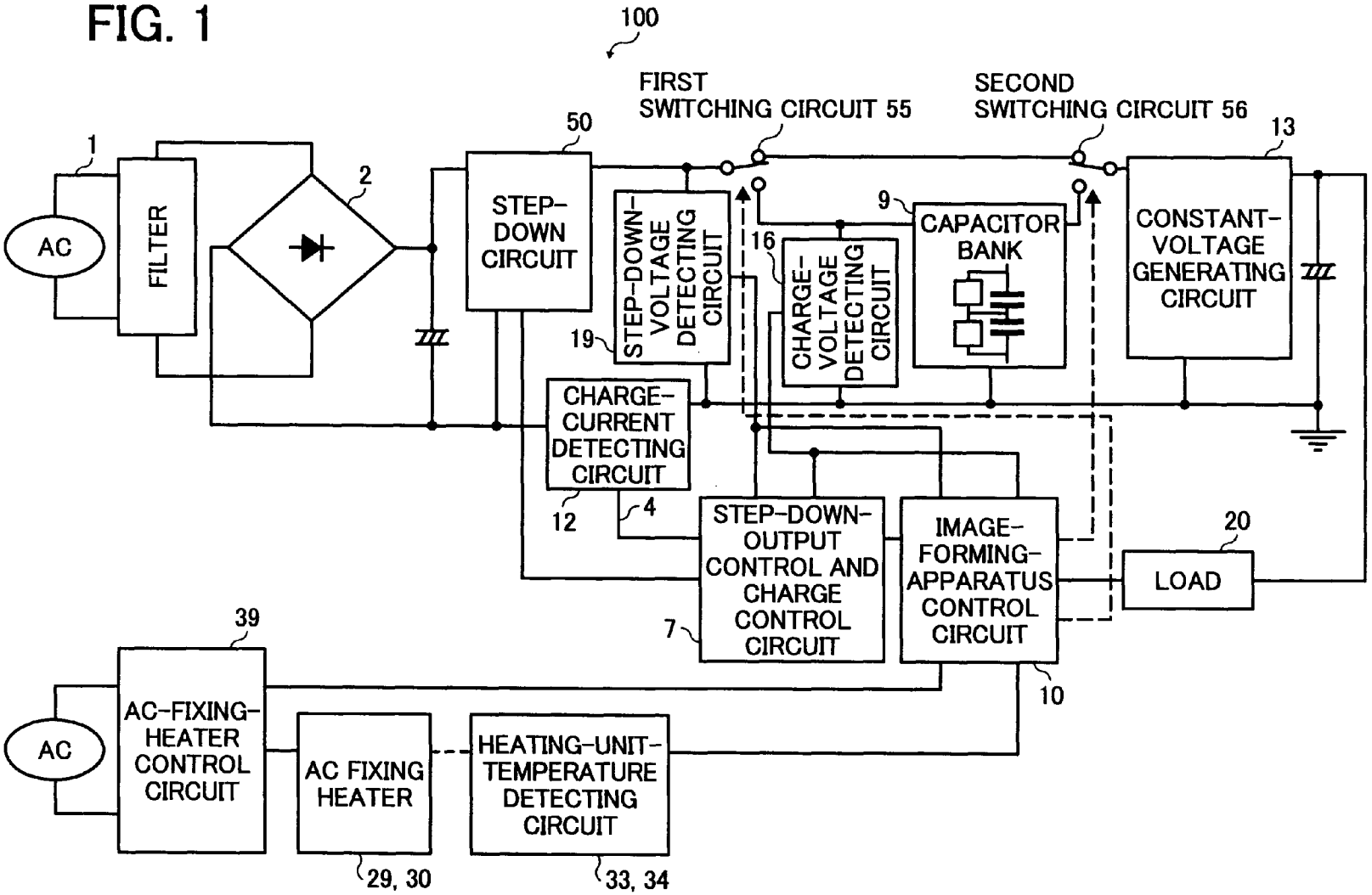
FIG. 1 is a circuit diagram of a circuit configuration of an engine power supply unit of a printer according to a first embodiment of the present invention.

FIG. 1 is a circuit diagram of a circuit configuration of an engine power supply unit of a printer according to the first embodiment. FIG. 2 is a detailed circuit diagram of a detailed circuit configuration of the engine power supply unit of the printer according to the first embodiment.

An engine power supply unit 100 includes a filter 1, a full-wave rectifying circuit 2, a step-down chopper circuit 50, a step-down-voltage detecting circuit 19, a charge accumulating unit (hereinafter, "capacitor bank") 9, a charge-voltage detecting circuit 16, a constant-voltage generating circuit 13, a charge-current detecting circuit 12, an image-forming-apparatus control circuit (hereinafter, "engine control unit") 10, a step-down-output control and charge control circuit 7, a load 20, AC fixing heaters 29 and 30, heating-unit-temperature detecting circuits 33 and 34, an AC-fixing-heater control circuit 39, a first switching circuit 55, and a second switching circuit 56.

Figures 2, 2A, 2B:
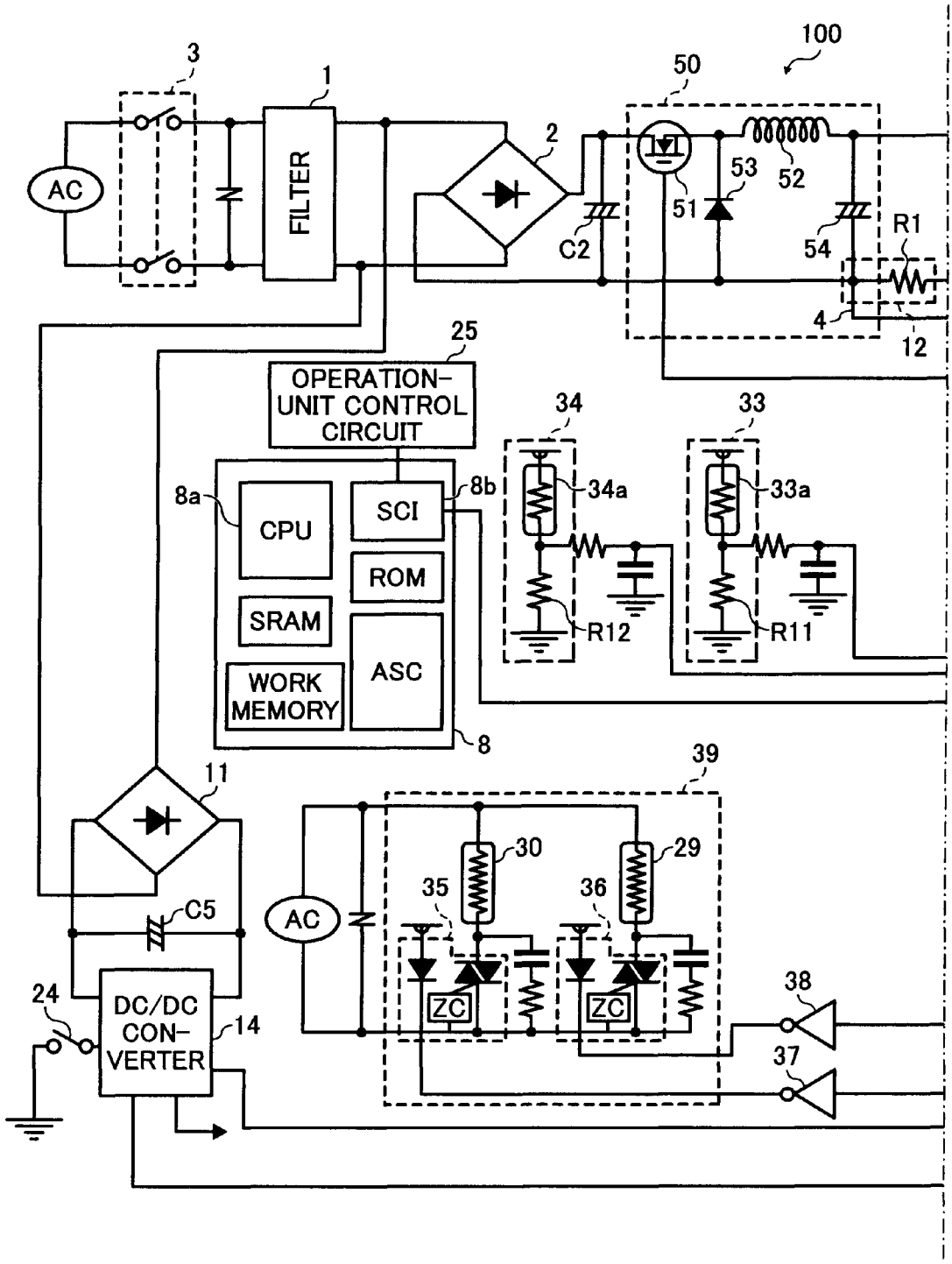
FIG. 2 is a detailed circuit diagram of a detailed circuit configuration of the engine power supply unit of the printer according to the first embodiment.
Figure 2B:
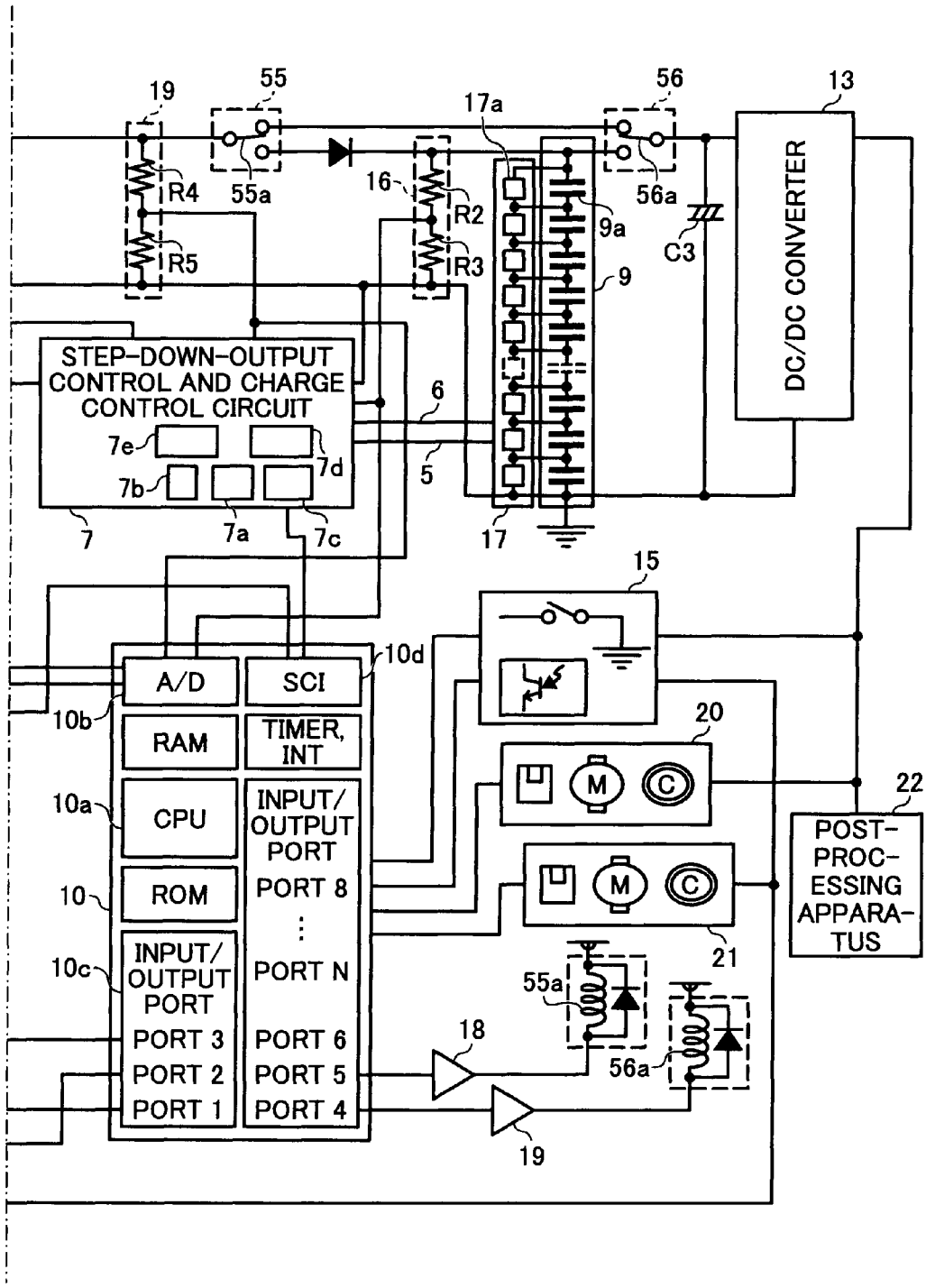

A commercial power supply is inputted to the filter 1 via a main power supply switch 3 (see FIG. 2). An output of the filter 1 is connected to the full-wave rectifying circuit 2 and subjected to full-wave rectification. The output subjected to full-wave rectification is connected to a smoothing capacitor C2. A ripple component and the like of the output are removed by the smoothing capacitor C2. A DC output of the full-wave rectifying circuit 2 is connected to a drain side of a field effect transistor (FET) 51 of a step-down chopper circuit (a step-down circuit) 50.

The step-down chopper circuit 50 steps down an output from the commercial power supply. The step-down chopper circuit 50 includes the FET 51 provided on an input side, a choke coil 52 connected to an output side, that is, a source side of the FET 51, a current feedback diode 53 provided between the output of the FET 51 and the choke coil 52, and a smoothing capacitor 54 provided on the output side of the choke coil 52. The step-down chopper circuit 50 is connected in parallel between terminals of the capacitor bank 9 via the first switching circuit 55.

In the step-down chopper circuit 50, when the FET 51 is turned on by a pulse width modulation signal (PWM signal) outputted from a PWM-signal generating circuit 7*e* of the step-down-output control and charge control circuit 7 described later, an electric current flows to the choke coil 52. A part of input electric power is accumulated in the choke coil 52. Subsequently, when the FET 51 is turned off by the PWM signal, the electric power accumulated in the choke coil 52 in the ON period of the FET 51 is discharged through the current feedback diode 53.

A voltage is stepped down according to repetition of this operation and the voltage stepped down is smoothed by the smoothing capacitor 54. The smoothed voltage is supplied to the capacitor bank 9 via the first switching circuit 55 and respective capacitor cells of the capacitor bank 9 are charged. An output of the capacitor bank 9 is supplied to an input of the constant-voltage generating circuit 13 via the second switching circuit 56 and changed to a constant voltage. The output changed to the constant voltage by the constant-voltage generating circuit 13 is inputted to the load 20 and a post-processing apparatus 22.

An output of the step-down chopper circuit 50 depends on a ratio of an ON period and an OFF period of the FET 51 (a duty ratio D/T) and an input voltage to the step-down chopper circuit 50. When the duty ratio D/T is 100%, an output voltage and an input voltage are equal. When the duty ratio D/T is 50%, an output voltage is 50% of an input voltage. It is possible to control an output of the step-down chopper circuit 50 by controlling a duty ratio (PWM) of the FET 51.

The voltage stepped down by the step-down chopper circuit 50 is detected by the step-down-voltage detecting circuit 19 subjected to voltage division by a resistor R4 and a resistor R5 and fed back to the step-down-output control and charge control circuit 7. The voltage is also inputted to an analog/digital (A/D) converter 10*b* of the engine control unit 10. The voltage stepped down and smoothed by the step-down chopper circuit 50 is monitored by the step-down-output control and charge control circuit 7 and controlled according to a change of an ON duty of the PWM signal.

The capacitor bank 9 accumulates electric power. In the capacitor bank 9, fourteen capacitor cells (electric double layer capacitor cells), each of which has 2.5 volts when fully charged, are connected in series. Therefore, when the fourteen capacitor cells are fully charged, a voltage at 35 volts is accumulated.

The charge-voltage detecting circuit 16 detects a charge voltage at the capacitor bank 9. An inter-terminal voltage at the capacitor bank 9 is detected by the charge-voltage detecting circuit 16 in which a voltage dividing circuit is formed by a resistor R2 and a resistor R3. An output of the capacitor bank 9 is inputted to an A/D converter 7*c* of the step-down-output control and charge control circuit 7 and the A/D converter 10*b* of the engine control unit 10.

The charge-current detecting circuit 12 detects a charge current of the capacitor bank 9. In the detection of the charge current of the capacitor bank 9, an electric current flowing through a resistor R1 connected in series to the capacitor bank 9 is detected as an inter-terminal voltage. An output of the charge-current detecting circuit 12 is inputted to a charge-current detecting circuit 7*d* of the step-down-output control and charge control circuit 7.

An equalizing circuit 17 detects full-charge of the respective capacitor cells, actuates bypass circuits 17*a*, and equalizes charge voltages at the respective capacitor cells. A capacitor cell 9*a* is charged by the step-down-output control and charge control circuit 7. When the capacitor cell 9*a* is charged to the full charge of 2.5 volts, an equalizing circuit 17 bypasses a charge current. Bypass circuits connected to the other capacitor cells in parallel perform the same operation. Charge voltages at the respective capacitor cells are equalized. When the equalizing circuit 17 detects full-charge of any one of the capacitor cells and actuates one of the bypass circuits, the equalizing circuit 17 outputs a single-cell full-charge signal 5 to the step-down-output control and charge control circuit 7. When the equalizing circuit 17 detects full-charge of all the capacitor cells and actuates all the bypass circuits, the equalizing circuit 17 outputs a full-charge signal 6 for all the capacitor cells to the step-down-output control and charge control circuit 7.

The step-down-output control and charge control circuit 7 detects a charge voltage at the capacitor bank 9, detects a charge current, and detects an operation of the bypass circuits. The step-down-output control and charge control circuit 7 applies constant current charge or constant power charge to the capacitor bank 9. The step-down-output control and charge control circuit 7 has a function of generating a PWM signal for applying constant current charge and constant power charge to the capacitor bank 9 and a function of generating a PWM signal for supplying a step-down voltage to the constant-voltage generating circuit 13 via the first switching circuit 55 and the second switching circuit 56. The step-down-output control and charge control circuit 7 includes a CPU 7*a*, a serial controller (SIC) 7*b*, the A/D converter 7*c*, the charge-current detecting circuit 7*d*, the PWM-signal generating circuit 7*e*, a ROM, a RAM, a timer, an interrupt control circuit, and an input/output port.

The step-down-output control and charge control circuit 7 detects an inter-terminal voltage at the capacitor bank 9 according to an output of the charge-voltage detecting circuit 16. When the inter-terminal voltage at the capacitor bank 9 is lower than a value set in advance, the step-down-output control and charge control circuit 7 detects inter-terminal voltages at the resistor R1 connected to the capacitor bank 9 in series one by one. To perform constant current charge set in advance, the step-down-output control and charge control circuit 7 outputs a PWM signal corresponding to the inter-terminal voltage detected to a gate of the FET 51. To calculate the PWM signal for performing the constant current charge set in advance, the step-down-output control and charge control circuit 7 may use a table in which the inter-terminal voltage at the resistor R1 and the ON duty of the PWM signal are associated. The step-down-output control and charge control circuit 7 may calculate the PWM signal according to an arithmetic operation. The step-down-output control and charge control circuit 7 may control the PWM signal with reference to only a charge current to obtain a charge current set in advance. When the capacitor bank 9 is not charged, to prevent a large rush current from flowing to the capacitor bank 9, the step-down-output control and charge control circuit 7 may output the PWM signal to set a step-down voltage low and gradually increase the step-down voltage.

When the inter-terminal voltage at the capacitor bank 9 is equal to or higher than the value set in advance, to perform constant power charge, the step-down-output control and charge control circuit 7 detects charge currents of the capacitor bank 9 and inter-terminal voltages at the capacitor bank 9 one by one. The step-down-output control and charge control circuit 7 detects a charge current of the capacitor bank 9 and an inter-terminal voltage at the capacitor bank 9, calculates a PWM signal for performing constant power charge set in advance from the charge current and the charge voltage detected, and determines the PWM signal.

When the step-down-output control and charge control circuit 7 detects any one of the single-cell full-charge signals 5, the step-down-output control and charge control circuit 7 outputs the PWM signal for performing constant current charge set in advance to the gate of the FET 51 again. When the step-down-output control and charge control circuit 7 detects full-charge signals 6 of all the capacitors, the step-down-output control and charge control circuit 7 outputs a signal for stopping the charge operation to the gate of the FET 51.

Processing by the step-down chopper circuit 50 for supplying electric power to the load 20 and the post-processing apparatus 22 via the constant-voltage generating circuit 13 is explained. When a signal for supplying electric power to the load 20 is outputted from a CPU 10*a* of the engine control unit 10 to the CPU 7*a*, the step-down-output control and charge control circuit 7 outputs a PWM signal set in advance by the PWM-signal generating circuit 7*e* to the gate of the FET 51. The step-down chopper circuit 50 generates a step-down voltage according to the PWM signal outputted and supplies the step-down voltage to the input of the constant-voltage generating circuit 13 via the first switching circuit 55 and the second switching circuit 56. A PWM signal of a fixed duty ratio may be outputted to the step-down chopper circuit 50. The step-down chopper circuit 50 may detect a step-down voltage with the step-down-voltage detecting circuit 19 and feeds back the step-down voltage to the step-down-output control and charge control circuit 7 to generate a constant voltage. A voltage value to be stepped down may be outputted from the CPU 10*a* of the engine control unit 10 to the CPU 7*a* of the step-down-output control and charge control circuit 7 and determined.

Figures 3, 4, 5:
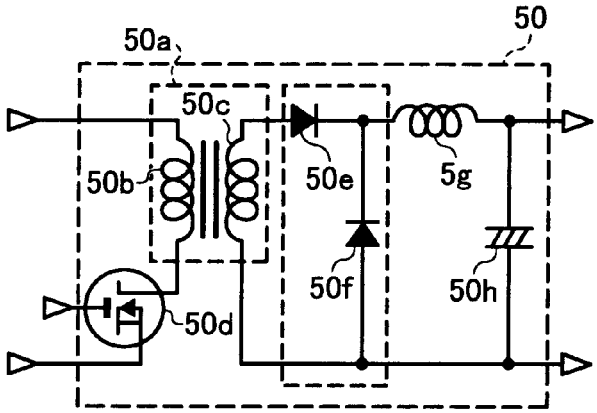
FIG. 3 is a detailed circuit diagram of a circuit configuration of another step-down circuit.
FIG. 4 is a diagram for explaining an example of a data structure of a power use table T1 according to the first embodiment.
FIG. 5 is a diagram for explaining an example of a data structure of a power use table T2 according to the first embodiment.

FIG. 3 is a detailed circuit diagram of a circuit configuration of another step-down circuit. The step-down chopper circuit 50 may generate a step-down voltage with a structure shown in FIG. 3. The step-down chopper circuit 50 switches a primary coil 50*b* of a high-frequency transformer 50*a* using a FET50*d* and rectifies a voltage induced in a secondary coil 50*c* to generate a step-down voltage.

The engine control unit 10 outputs a signal to a first switching circuit and a second switching circuit to switch the circuit and control supply of electric power. The engine control unit 10 constitutes a voltage-supply control unit according to the present invention. The engine control unit 10 includes a serial controller (SIC) 10*d* connected to the CPU 10*a*, an input/output port 10*c*, the A/D converter 10*b*, a ROM, a RAM, a timer, and an interrupt control circuit (INT).

The heating-unit-temperature detecting circuits 33 and 34 that detect a surface temperature (a fixing temperature) of a fixing roller of a fixing device (not shown) are connected to the A/D port 10*b* of the CPU 10*a*. The heating-unit-temperature detecting circuit 33 includes a resistor R11 connected to an AC-heater thermistor 33*a* in series. The heating-unit-temperature detecting circuit 33 detects the temperature in a measurement area corresponding to the AC fixing heater 29. The temperature detecting circuit 34 includes a resistor R12 connected to an AC-heater thermistor 34*a* in series. The temperature detecting circuit 34 detects the temperature in a measurement area corresponding to the AD fixing heater 30.

The AC-fixing-AC heater control circuit 39 that supplies electric power to the AC fixing heaters 29 and 30 according to temperature detection results of the heating-unit-temperature detecting circuits 33 and 34, loads 20 and 21 such as a motor, a solenoid, and a clutch necessary for performing an image forming operation, a sensor necessary for performing an image forming operation, a switch circuit 15, and the like are connected to the input/output port 10*c*. The load 21 is a load of a power system that requires large electric power such as a conveying motor, a development motor, and the like. The load 20 is a load supplied from a separate power supply. The load 20 needs to hold a display LED and rotation of a pulse motor that always need supply of power. It goes without saying that it is unnecessary to supply the load from the separate power supply when it is possible to supply electric power to the load even at the time of charge.

The CPU 10*a* transmits a signal to and receives a signal from the step-down-output control and charge control circuit 7 via the serial controller (SIC) 10*d*. The CPU 10*a* transmits a charge permission signal, a charge current for charging, a patter of a PWM signal, or the like to the step-down-output control and charge control circuit 7 when discharge is not performed, at the time of standby, at the time of an energy saving mode, or the like. The CPU 10*a* detects an inter-terminal voltage at the capacitor bank 9 with the charge-voltage detecting circuit 16 and judges whether power discharge of the capacitor bank 9 is possible. The CPU 10*a* detects a step-down voltage with the step-down-voltage detecting circuit 19 and instructs the step-down-output control and charge control circuit 7 to control the step-down voltage.

When the heating-unit-temperature detecting circuits 33 and 34 detect whether the temperature is equal to or lower than temperature set in advance, the CPU 10*a* outputs a signal for turning on photo-triacs 35*a* and 36*a* to photo-triac drive circuits 35 and 36 from ports 1 and 3. Consequently, electric power is supplied to the AC fixing heaters 29 and 30. When the heating-unit-temperature detecting circuits 33 and 34 detect whether the temperature is equal to or higher than the temperature set in advance, the CPU 10*a* outputs a signal for turning off the photo-triacs 35 and 36 to the photo-triac drive circuits 35 and 36 from the ports 1 and 3. Consequently, the supply of electric power to the AC fixing heaters 29 and 30 is stopped.

The first switching circuit 55 includes a relay 55*a*. The second switching circuit 56 includes a relay 56*a*. The first switching circuit and the second switching circuit according to this embodiment include relays. It goes without saying that an opening and closing circuit including an FET, an insulated Gate Bipolar Transistor (IGBT), or the like may be used. The relays 55*a* and 56*a* are set to be connected to the commercial power supply (the step-down chopper circuit 50) side in a normal close state (a state in which a coil is not conductive). Therefore, when a main power supply is off, discharge from the capacitor bank 9 is stopped.

The CPU 10*a* energizes the relay 55*a* or stops the energization of the relay 55*a* according to a signal outputted from a port 5 and controls switching of the first switching circuit 55. The CPU 10*a* energizes the relay 56*a* or stops the energization of the relay 56*a* according to a signal outputted from a port 6 and controls switching of the second switching circuit 56.

When electric power is unnecessary at the time of standby, the energy saving mode, or the like, to charge the capacitor bank 9, the CPU 10*a* outputs a signal for energizing the relay 55*a* from the port 5 and outputs a signal for stopping the energization of the relay 56*a* from the port 6. When electric power exceeds an AC power rating of the commercial power supply or when flicker occurs because of sudden fluctuation in a load on the image forming apparatus side, to use accumulated electric power in the capacitor bank 9, the CPU 10*a* outputs a signal for stopping the energization of the relay 55*a* from the port 5 and outputs a signal for energizing the relay 56*a* from the port 6.

At the normal time other than charge or discharge, the CPU 10*a* outputs a signal for stopping the energization of the relay 55*a* from the port 5 and outputs a signal for stopping the energization of the relay 56*a* from the port 6. Consequently, the output of the step-down chopper circuit 50 is connected to the input of the constant-voltage generating circuit 13. After the image forming operation is finished, since the image forming apparatus enters the energy saving mode when a fixed time elapses, the CPU 10*a* outputs a signal for stopping a part of power output to a DC/DC converter 14 from the port 2. When an energy saving release switch (SW) 24 (a platen open SW, an original detection SW of an ADF, etc.) returns to a normal operation and the energy saving mode is released.

A power use table T1 defines an image forming operation that cannot be managed by supplied power from the commercial power supply and an accumulated electric power use time necessary for performing processing of the image forming operation. FIG. 4 is a diagram for explaining an example of a data structure of the power use table T1. The power use table T1 stores an image forming operation that requires electric power equal to or larger than normal supplied power and an accumulated electric power use time in association with each other. The image forming operation that requires power equal to or larger than the normal supplied power is, for example, a combination of a sheet size and the number of sheets that makes it impossible to continuously perform an image forming operation because the temperature of the fixing device falls when the image forming operation for a plurality of sheets is performed according to supply of normal electric power from the commercial power supply. The accumulated electric power use time is time during which electric power is supplied from the capacitor bank 9 to perform image formation processing under a condition exceeding the normal supplied power. By referring to the power use table T1, it is possible to supply necessary electric power from the capacitor bank 9 and carry out an image forming operation with short waiting time before the image forming operation that cannot be managed by the normal electric power is performed. Since it is possible to prevent a fixing temperature from falling, it is possible to improve a quality of image formation and prevent flicker.

A power use table T2 defines post processing that requires supply of electric power. FIG. 5 is a diagram for explaining an example of a data structure of the power use table T2. The power use table T2 stores a post-processing type that requires supply of electric power. By referring to the power use table T2, it is possible to judge whether supply of electric power is necessary for post processing to be executed and supply electric power when the post processing is performed.

A control circuit 8 controls the entire image forming apparatus. The control circuit 8 includes a CPU 8*a* that controls the entire image forming apparatus, a serial controller (SIC) 8*d* connected to the CPU 8*a*, a ROM, a RAM, a work memory for image expansion used in a printer, a frame memory that temporarily stores image data of a writing image, an application specific integrated circuit (ASIC) mounted with a function of controlling the periphery of the CPUs, and an interface circuit for the ASIC. An input unit to which a user inputs system setting by operating a panel, a display unit that shows a state of setting details of the system to the user, an operation-unit control circuit that controls the input unit, and the engine control unit 10 are connected to the CPU 8*a* via a serial controller (SIC).

FIGS. 6A to 6D are flowcharts of a procedure of operation mode control processing performed by the engine control unit of the image forming apparatus.

When DC power is supplied according to power-on of the main power supply or release of the energy saving mode, the CPU 10*a* of the engine control unit 10 performs initial setting related to the CPU 10*a* of the engine control unit 10, a peripheral circuit of the CPU 10*a*, and the memories (step S601). The CPU 10*a* judges from a result of detection by the charge-voltage detecting circuit 16 whether a charge voltage is 35 volts, i.e., whether the capacitor cells are in the full-charge state (step S602). When it is judged that the capacitor cells are fully charged ("Yes" at step S602), the CPU 10*a* performs opening-and-closing-circuit control processing P1 (step S603). Consequently, it is possible to stop supply of electric power from the commercial power supply and supply electric power accumulated in the capacitor bank 9 to the constant-voltage generating circuit 13. As a result, excess electric power is supplied to the heating unit of the fixing device (step S604). At the time of the normal operation, electric power is not supplied at 100% duty. Electric power may be supplied only at the time of warm-up of the fixing heater 30 as an auxiliary heater or at the time when a fixing temperature falls. When it is judged that the capacitor cells are not fully charged ("No" at step S602), the processing proceeds to step S604.

The CPU 10*a* judges from a result of detection by the charge-voltage detecting circuit 16 whether a charge voltage is equal to or higher than 28 volts (step S605). When it is judged that the charge voltage is equal to or higher than 28 volts ("Yes" at step S605), the CPU 10*a* judges that it is possible to use accumulated electric power and judges whether a heating unit temperature is equal to or higher than temperature set in advance (e.g., 175° C.) (step S606). When it is judged that the heating unit temperature has not reached the temperature set in advance ("No" at step S606), the CPU 10*a* returns to step S604. The CPU 10*a* continues to supply maximum electric power of the heater rating to the AC fixing heaters 29 and 30.

When it is judged that the heating unit temperature is equal to or higher than the temperature set in advance ("Yes" at step S606) or when it is judged that the charge voltage at the capacitor bank 9 is lower than 28 volts ("No" at step S605), the CPU 10*a* performs opening-and-closing-circuit control processing P2 (step S607). Consequently, electric power is supplied from the commercial power supply (the step-down chopper circuit 50) to the load.

The CPU 10*a* supplies electric power at the normal time set in advance to the AC fixing heaters 29 and 30 of the fixing device (step S608). The CPU 10*a* judges whether the heating unit has a reload temperature (e.g., 180° C.) (step S609). When it is judged that the heating unit does not have the reload temperature ("No" at step S609), the CPU 10*a* returns to step S608. The electric power at the normal time set in advance is continuously supplied to the AC fixing heaters 29 and 30. When it is judged that the heating unit has the reload temperature ("Yes" at step S609), the fixing device comes into a standby state. The electric power at the normal time set in advance is supplied to the fixing heaters and normal temperature control is carried out (step S610).

The CPU 10*a* judges whether the fixing device is in the standby state again (step S611). When it is judged that the fixing device is in the standby state ("Yes" at step S611), the CPU 10*a* judges whether a charge voltage is lower than 35 volts, i.e., whether the capacitor cells are in the full-charge state (step S612). When it is judged that the charge voltage is lower than 35 volts, i.e., the capacitor cells are not in the full-charge state ("Yes" at step S612), the CPU 10*a* performs opening-and-closing-circuit control processing P3 (step S613) and returns to step S610. Consequently, the capacitor bank 9 is charged. When it is judged that the charge voltage is not lower than 35 volts, i.e., the capacitor cells are in the full-charge state ("No" at step S612), the CPU 10*a* performs the opening-and-closing-circuit control processing P2 (step S614) and returns to step S610. Consequently, electric power is supplied from the commercial power supply (the step-down chopper circuit 50) to the load.

When it is judged at step S611 that the fixing device is not in the standby state ("No" at step S611), the CPU 10*a* sets an operation mode or an operation condition for using accumulated electric power with reference to the power use tables T1 and T2 defining use of accumulated electric power for each operation mode and image forming operation process (step S615). For example, the CPU 10*a* acquires, from the power use tables T1 and T2, setting of the number of copies with which the temperature of the heating unit falls according to the number of continuous copies, a timer count of time when the temperature of the heating unit recovers when maximum power is supplied to the fixing heaters, i.e., accumulated electric power of the capacitor bank 9 is used, and post-processing that requires supply of electric power and sets the setting of the number of copies, the timer count, and the post-processing.

The CPU 10*a* judges whether the image forming apparatus is performing a copy operation (step S616). When it is judged that the image forming apparatus is performing a copy operation ("Yes" at step S616), the CPU 10*a* judges whether there is the setting of the number of copies acquired from the power use tables T1 and T2 (step S617). When it is judged that there is the setting of the number of copies ("Yes" at step S617), the CPU 10*a* performs plural copy processing (step S618). Details of the plural copy processing are described later.

The CPU 10*a* performs the opening-and-closing-circuit control processing P2 (step S619). Consequently, electric power is supplied from the commercial power supply (the step-down chopper circuit 50) to the load. The load continuously performs the image forming operation and normal electric power is supplied to the fixing heaters (step S620). The CPU 10*a* judges whether sheets of a number corresponding to one job have been discharged (step S621). When it is judged that the sheets of the number corresponding to one job have not been discharged ("No" at step S621), the CPU 10*a* returns to step S620. The load continues the image forming operation. When it is judged that the sheets of the number corresponding to one job have been discharged ("Yes" at step S621), the CPU 10*a* judges whether supply of electric power is necessary for post-processing (step S622).

When it is judged that supply of electric power is necessary for post-processing ("Yes" at step S622), to increase an output of the DC power supply, the CPU 10*a* performs the opening-and-closing-circuit control processing P1 (step S623). Consequently, power accumulated in the capacitor bank 9 is supplied to the constant-voltage generating circuit 13. A post-processing peripheral apparatus supplied with the electric power carries out a post-processing operation (step S624). The CPU 10*a* returns to step S610. When it is judged that supply of electric power to the post-processing is unnecessary ("No" at step S622), since the copy operation is finished, the CPU 10*a* returns to step S610).

When it is judged at step S616 that the image forming apparatus is not performing the copy operation ("No" at step S616), the CPU 10*a* judges whether the image forming apparatus is in the energy saving mode (step S625). When it is judged that the image forming apparatus is not in the energy saving mode ("No" at step S625), the CPU 10*a* returns to step S610. When it is judged that the image forming apparatus is in the energy saving mode ("Yes" at step S625), the CPU 10*a* judges whether a charge voltage is lower than 35 volts, i.e., whether the capacitor cells are in the full-charge state (step S626). When it is judged that the charge voltage is lower than 35 volts, i.e., the capacitor cells are in the full-charge state ("Yes" at step S626), to charge the capacitor bank 9, the CPU 10*a* performs the opening-and-closing-circuit control processing P3 (step S627) and returns to step S625. Although not shown in this flowchart, when this charge operation is finished, the image forming apparatus control unit also shifts to the energy saving mode. When it is judged that the charge voltage is not lower than 35 volts, i.e., the capacitor cells are in the full-charge state ("No" at step S626), the CPU 10*a* switches the first switching circuit to the commercial power supply side (step S628), switches the second switching circuit to the commercial power supply side (step S629), and returns to step S625.

The CPU 10*a* of the engine control unit 10 performs the opening-and-closing-circuit control processing P2 (step S701). Consequently, electric power is supplied from the commercial power supply (the step-down chopper circuit 50) to the load. The load carries out an image forming operation and normal electric power is supplied to the AC fixing heaters 29 and 30 (step S702). The CPU 10*a* judges whether copying for the number of copies N acquired from the power use tables has been carried out (step S703). When it is judged that copying for the number of copies N has not been carried out ("No" at step S703), the CPU 10*a* returns to step S702. The load repeats the image forming operation. When it is judged that copying for the number of copies N has been carried out ("Yes" at step S703), the CPU 10*a* performs the opening-and-closing-circuit control processing P1 (step S704). Consequently, the supply of electric power from the commercial power supply is stopped, electric power accumulated in the capacitor bank 9 is supplied to the constant-voltage generating circuit 13, and excess electric power is supplied to the heating unit of the fixing device. As a result, it is possible to supply the maximum power of the heater rating to the AC fixing heaters 29 and 30. It is possible to prevent the temperature of the heating unit from falling to be lower than a fixed image guarantee temperature.

The CPU 10*a* continues the state in which the maximum power is supplied to the AC fixing heaters 29 and 30 and continues the image forming operation (step S705). The CPU 10*a* judges whether the timer counter is M (step S706). When it is judged that the timer counter is not M ("No" at step S706), the CPU 10*a* returns to step S705. When it is judged that the timer counter is M ("Yes" at step S706), the CPU 10*a* leaves the processing.

The temperature fall of the heating unit of the fixing device occurs because heat of a fixing pressure roller moves to a sheet when sheet supply is started. Therefore, when this pressure roller is warmed, the temperature fall is solved. The time M until the pressure roller is warmed is acquired from the power use table T2 and set as the timer count. Thus, it is possible to supply the maximum power of the heater rating to the fixing heaters until the time M comes.

Figure 8:
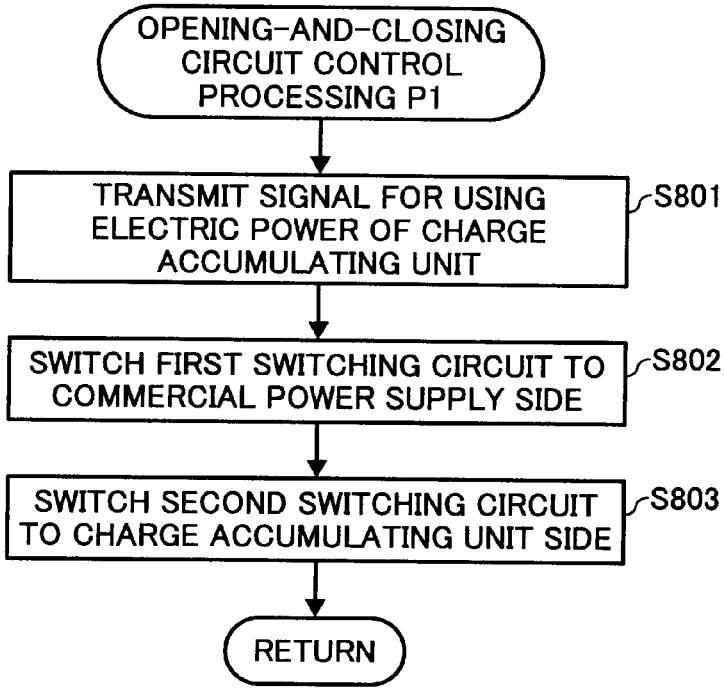
FIG. 8 is a flowchart of a procedure of opening-and-closing-circuit control processing P1 performed by the engine control unit of the image forming apparatus according to the first embodiment.

FIG. 8 is a flowchart of a procedure of the opening-and-closing-circuit control processing P1 performed by the engine control unit of the image forming apparatus. According to this processing, electric power is supplied from the capacitor bank 9. The constant-voltage generating circuit 13 outputs a constant voltage and supplies electric power to the load.

The CPU 10*a* transmits a signal for using electric power of the charge accumulating unit to the CPU 7*a* of the step-down-output control and charge control circuit 7 (step S801). The CPU 10*a* switches the first switching circuit to the commercial power supply side (step S802) and switches the second switching circuit to the charge accumulating unit side (step S803).

In this way, it is possible to supply electric power from the charge accumulating unit. Thus, it is possible to supplement shortage of electric power supplied from the commercial power supply.

Figure 9:
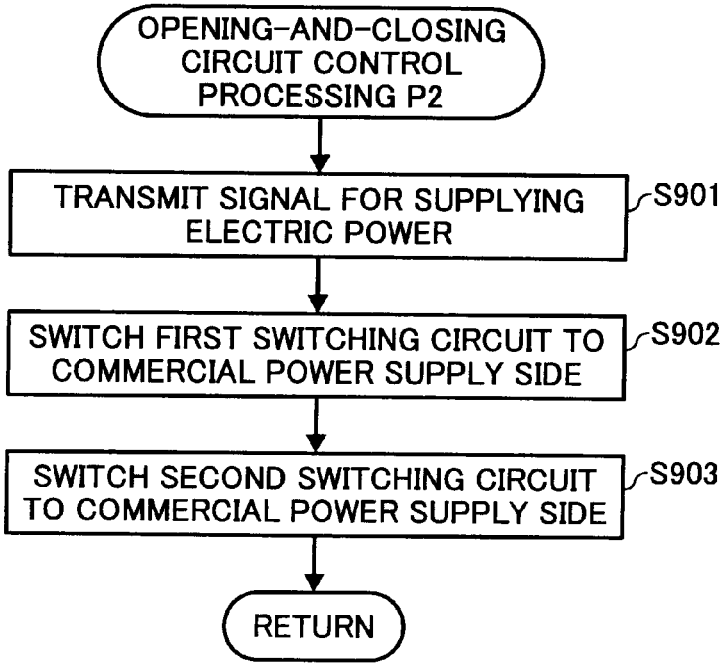
FIG. 9 is a flowchart of a procedure of opening-and-closing-circuit control processing P2 performed by the engine control unit of the image forming apparatus according to the first embodiment.

FIG. 9 is a flowchart of a procedure of the opening-and-closing-circuit control processing P2 performed by the engine control unit of the image forming apparatus. According to this processing, electric power is supplied from the commercial power supply (the step-down chopper circuit 50) to the load.

The CPU 10*a* transmits a signal for supplying electric power to the load to the CPU 7*a* of the step-down-output control and charge control circuit 7 (step S901). The CPU 10*a* switches the first switching circuit to the commercial power supply side (step S902) and switches the second switching circuit to the commercial power supply side (step S903).

In this way, it is possible to interrupt supply of electric power from the charge accumulating unit when electric power is supplied from the commercial power supply. Thus, it is possible to effectively utilize accumulated electric power of the charge accumulating unit.

Figure 10:
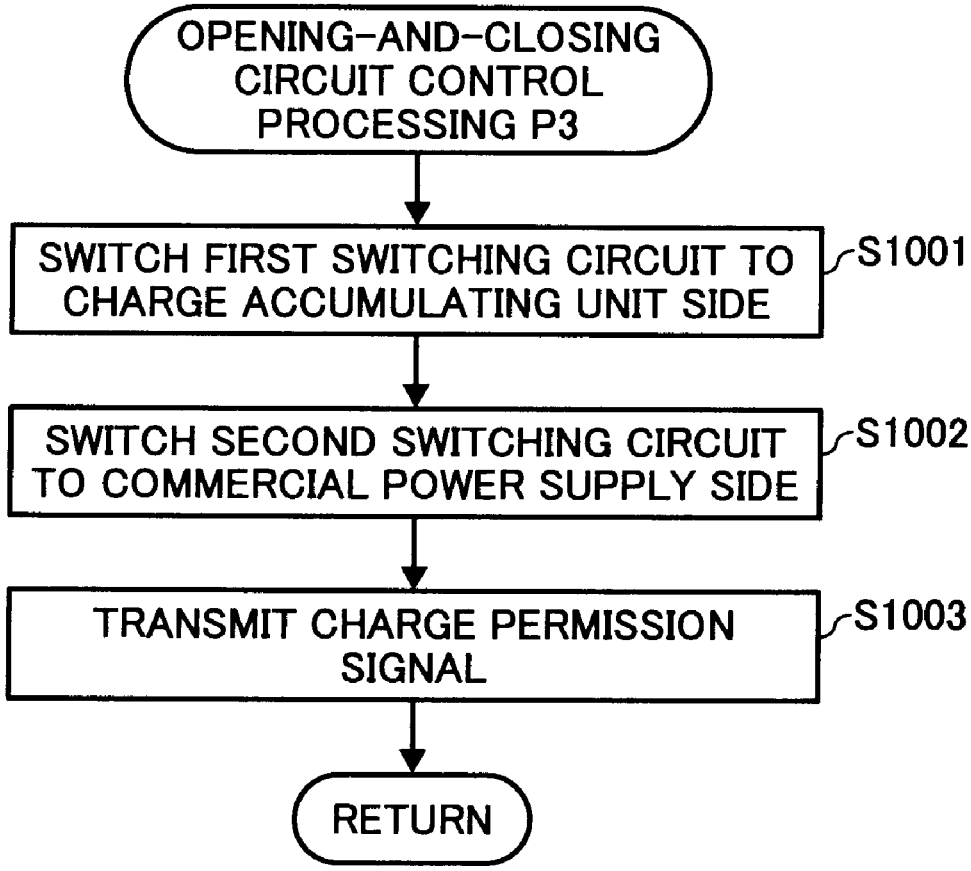
FIG. 10 is a flowchart of a procedure of opening-and-closing-circuit control processing P3 performed by the engine control unit of the image forming apparatus according to the first embodiment.

FIG. 10 is a flowchart of a procedure of the opening-and-closing-circuit control processing P3 performed by the engine control unit of the image forming apparatus. According to this processing, the capacitor bank 9 is charged.

The CPU 10*a* switches the first switching circuit to the charge accumulating unit side (step S1001) and switches the second switching circuit to the commercial power supply side (step S1002). The CPU 10*a* transmits a charge permission signal (step S1003).

In this way, it is possible to charge the charge accumulating unit when electric power is unnecessary for the load. Thus, it is possible to perform leveling of electric power use.

Figure 11A:
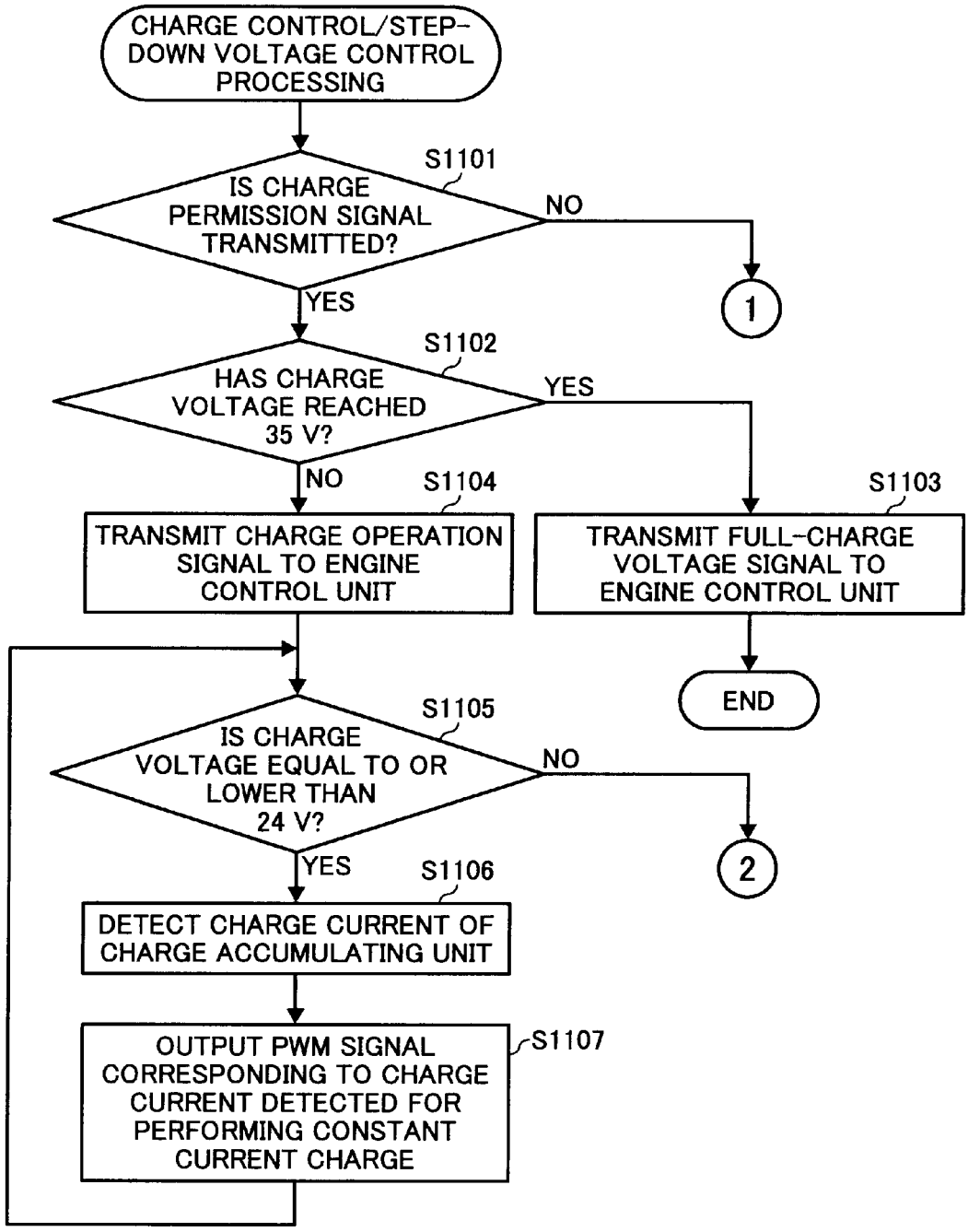
FIG. 11A is a flowchart of a procedure of step-down-voltage control and charge control processing by a step-down-output control and charge control circuit of the image forming apparatus according to the first embodiment.
Figure 11B:
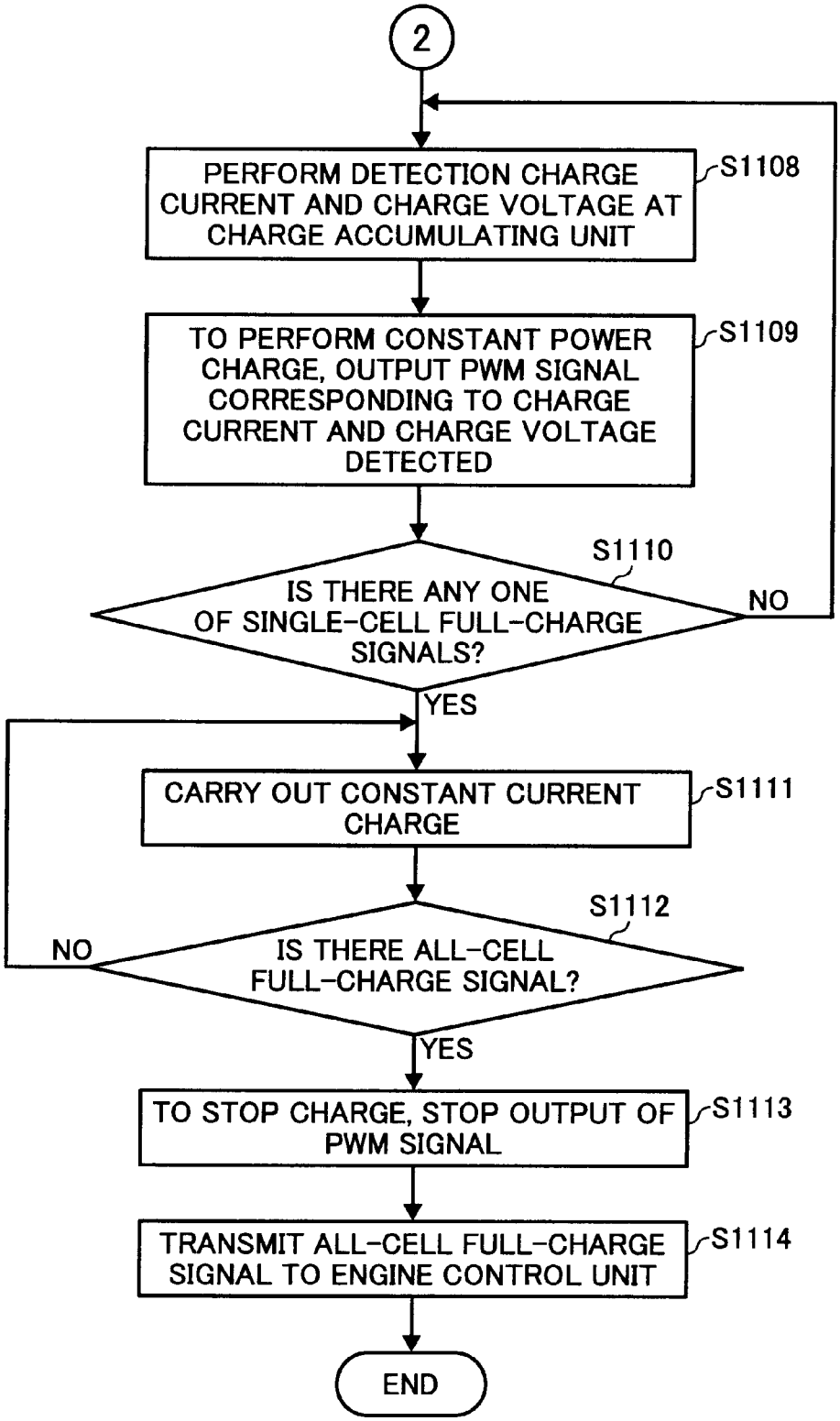
FIG. 11B is a flowchart of the procedure of the step-down-voltage control and charge control processing by the step-down-output control and charge control circuit of the image forming apparatus according to the first embodiment.
Figure 11C:
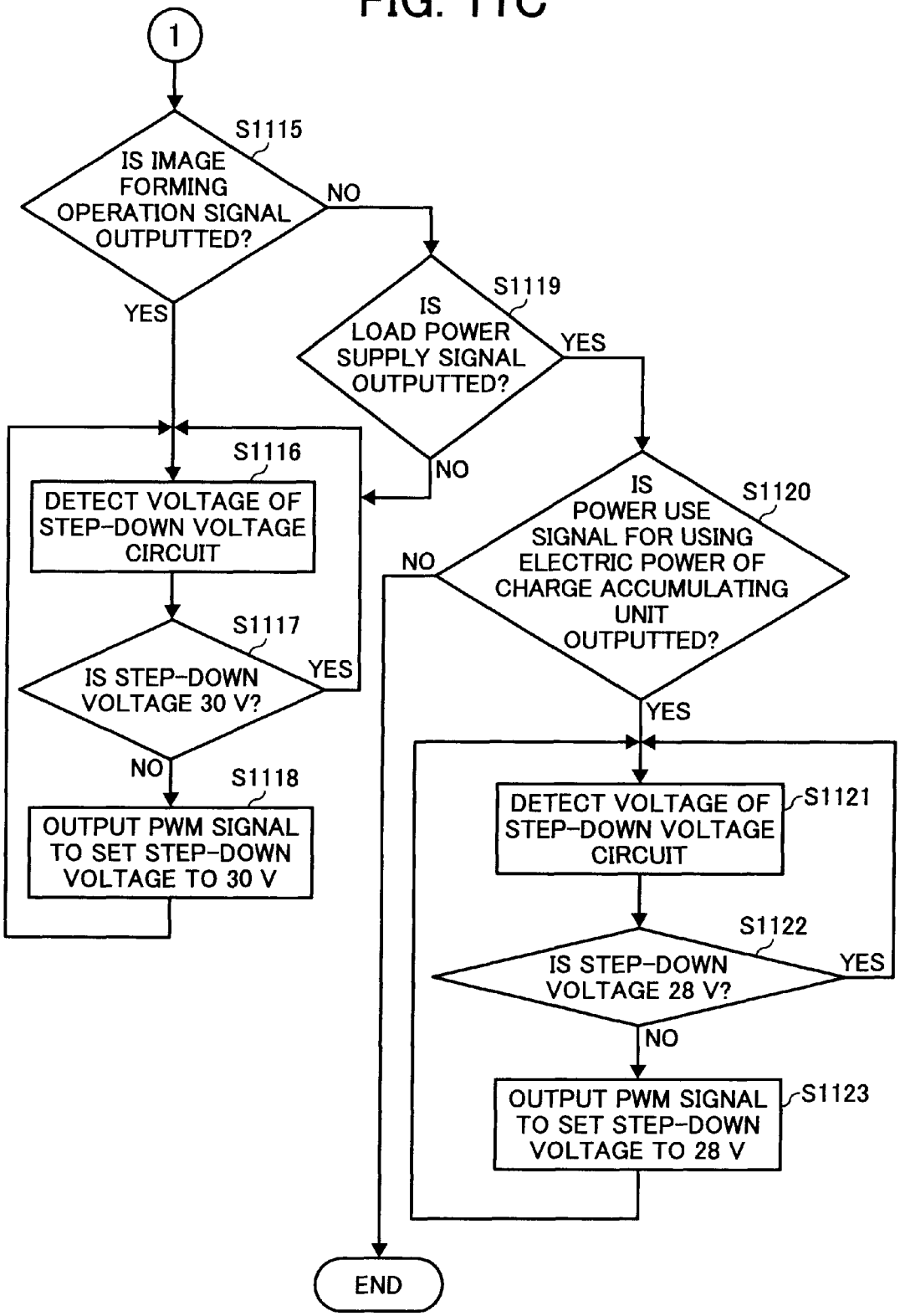
FIG. 11C is a flowchart of the procedure of the step-down-voltage control and charge control processing by the step-down-output control and charge control circuit of the image forming apparatus according to the first embodiment.

FIGS. 11A and 11B are flowcharts of a procedure of step-down-voltage control and charge control processing by the step-down-output control and charge control circuit of the image forming apparatus. According to this processing, the capacitor bank 9 is charged and an output of the commercial power supply is stepped down by the step-down chopper circuit 50.

The CPU 7*a* of the step-down-output control and charge control circuit 7 judges whether a charge permission signal is transmitted from the CPU 10*a* of the engine control unit 10 (step S1101). When it is judged that the charge permission signal is transmitted ("Yes" at step S1101), the CPU 7*a* judges whether a charge voltage has reached 35 volts (step S1102). Specifically, the CPU 7*a* checks a charge voltage from a detection result of the charge-voltage detecting circuit 16 and judges whether the capacitor cells are in the full-charge state. When it is judged that the charge voltage has reached 35 volts ("Yes" at step S1102), since it is unnecessary to charge the charge accumulating unit, the CPU 7*a* transmits a full-charge voltage signal to the CPU 10*a* of the engine control unit 10 (step S1103) and finishes the processing.

When it is judged that the charge voltage has not reached 35 volts ("No" at step S1102), to perform a charge operation, the CPU 7*a* transmits a charge operation signal to the CPU 10*a* of the engine control unit 10 (step S1104). The CPU 7*a* judges whether the charge voltage is equal to or lower than 24 volts (step S1105). When it is judged that the charge voltage is equal to or lower than 24 volts ("Yes" at step S1105), the CPU 7*a* detects a charge current of the charge accumulating unit, i.e., the capacitor bank 9 (step S1106). The CPU 7*a* outputs a PWM signal corresponding to the charge current detected for performing constant current charge to the gate of the FET 51 of the step-down chopper circuit 50 (step S1107). Returning to step S1105, the CPU 7*a* judges whether the charge voltage is equal to or lower than 24 volts. When it is judged that the charge voltage is equal to or lower than 24 volts, the CPU 7*a* repeats the charge operation described above.

When it is judged at step S1105 that the charge voltage is not equal to or lower than 24 volts ("No" at step S1105), the CPU 7*a* performs detection of a charge current and a charge voltage at the charge accumulating unit, i.e., the capacitor bank 9 (step S1108). To perform constant power charge, the CPU 7*a* outputs a PWM signal corresponding to the charge current and the charge voltage detected to the gate of the FET 51 (step S1109). The CPU 7*a* judges whether there is any one of single-cell full-charge signals (step S1110). When it is judged that there is no single-cell full-charge signal ("No" at step S1110), the CPU 7*a* returns to step S1108.

When it is judged that there is any one of the single-cell full-charge signals ("Yes" at step S1110), the CPU 7*a* carries out constant current charge (step S1111). The CPU 7*a* judges whether there is an all-cell full-charge signal (step S1112). When it is judged that there is the all-cell full-charge signal ("Yes" at step S1112), to stop the charge operation, the CPU 7*a* outputs a PWM signal to the gate of the FET 51 (step S1113). The CPU 7*a* transmits the all-cell full-charge signal to the CPU 10*a* (step S1114) and finishes the processing. When it is judged that there is no all-cell full-charge signal ("No" at step S1112), the CPU 7*a* returns to step S1111 and performs constant current charge.

When it is judged at step S1101 that the charge permission signal is not transmitted ("No" at step S1101), the CPU 7*a* judges whether there is an image forming operation signal, i.e., whether the image forming operation signal is outputted from the CPU 10*a* (step S1115). When it is judged that there is the image forming operation signal ("Yes" at step S1115), the CPU 7*a* detects a voltage outputted from the step-down chopper circuit 50 with the step-down-voltage detecting circuit 19 (step S1116). The CPU 7*a* judges whether the voltage outputted from the step-down chopper circuit 50 is 30 volts (step S1117). This step-down voltage is set in advance to be lower than a charge voltage at the capacitor bank 9. In fully charging the respective capacitor cells, a voltage at the capacitor bank 9 is higher than 30 volts of the step-down voltage.

When it is judged that the voltage outputted from the step-down chopper circuit 50 is not 30 volts ("No" at step S1117), the CPU 7*a* outputs a PWM signal corresponding to the step-down voltage detected to set the step-down voltage to 30 volts (step S1118). As this PWM signal, a PWM signal associated with the step-down voltage detected may be set in a table in advance. A PWM signal may be generated by an analog circuit by comparing a comparative-signal generating circuit (a triangular wave) and an analog voltage set in advance (a voltage for outputting 30 volts).

When it is judged that the voltage outputted from the step-down chopper circuit 50 is 30 volts ("Yes" at step S1117), the CPU 7*a* returns to step S1116. The CPU 7*a* repeats such an operation to maintain the step-down voltage at 30 volts with the PWM-signal generating circuit 7*e*.

When it is judged at step S1115 that there is no image forming operation signal ("No" at step S1115), the CPU 7*a* judges whether there is a load power supply signal, i.e., whether the load power supply signal is outputted from the CPU 10*a* (step S1119). When it is judged that there is no load power supply signal ("No" at step S1119), the CPU 7*a* proceeds to step S1116. When it is judged that there is the load power supply signal ("Yes" at step S1119), the CPU 7*a* judges whether there is a power use signal for using electric power of the charge accumulating unit, i.e., whether the power use signal for using electric power of the charge accumulating unit is outputted from the CPU 10*a* (step S1120). When it is judged that there is no power use signal for using electric power of the charge accumulating unit ("No" at step S1120), the CPU 7*a* finishes the processing.

When it is judged that there is the power use signal for using electric power of the charge accumulating unit ("Yes" at step S1120), the CPU 7*a* detects a voltage outputted from the step-down chopper circuit 50 with the step-down-voltage detecting circuit 19 (step S1121). The CPU 7*a* judges whether the voltage outputted from the step-down chopper circuit 50 is 28 volts (step S1122). This step-down voltage is a voltage set such that the capacitor bank 9 starts discharge and the voltage falls to a voltage equal to or lower than 28 volts, the output of the step-down chopper circuit 50 automatically changes to the input of the constant-voltage generating circuit 13.

When it is judged that the voltage outputted from the step-down chopper circuit 50 is not 28 volts ("No" at step S1122), the CPU 7*a* outputs a PWM signal corresponding to the detected step-down voltage from the PWM-signal generating circuit 7*e* to the gate of the FET 51 of the step-down chopper circuit 50 to set the step-down voltage to 28 volts (step S1123). As this PWM signal, a PWM signal associated with the step-down voltage detected may be set in a table in advance. A PWM signal may be generated by an analog circuit by comparing a comparative-signal generating circuit (a triangular wave) and an analog voltage set in advance (a voltage for outputting 28 volts). When it is judged that the voltage outputted from the step-down chopper circuit 50 is 28 volts ("Yes" at step S1122), the CPU 7*a* returns to step S1121. The CPU 7*a* repeats such an operation to maintain the step-down voltage at 28 volts with the PWM-signal generating circuit 7*e*.

In this way, a constant voltage is generated by the constant-voltage generating circuit 13 from an output of the capacitor bank 9 charged by the commercial power supply or an output of the commercial power supply and the constant voltage generated is supplied to the load. Thus, it is possible to realize a plurality of functions, which are realized by a plurality of circuits in the past, with one constant-voltage generating circuit 13. This makes it possible to reduce a warm-up time of the fixing device using the commercial power supply for general offices in Japan without applying special work related to a power supply and simplify a circuit configuration of the power supply device including the charge accumulating unit. Since the circuit configuration of the power supply device including the charge accumulating unit is simplified, it is possible to reduce manufacturing cost for the image forming apparatus. Since a complicated structure is not adopted for the circuit configuration of the power supply device, it is possible to realize improvement of a quality of the apparatus and improvement of easiness of maintenance.

Since a voltage at the commercial power supply is stepped down and the capacitor bank 9 is charged with the voltage stepped down, it is possible to reduce the number of capacitor cells connected in series. It is possible to accumulate an accumulated charge amount (equal to or higher than DC 30 volts) acceptable as a voltage at the fixing device (a halogen heater).

Figure 12:
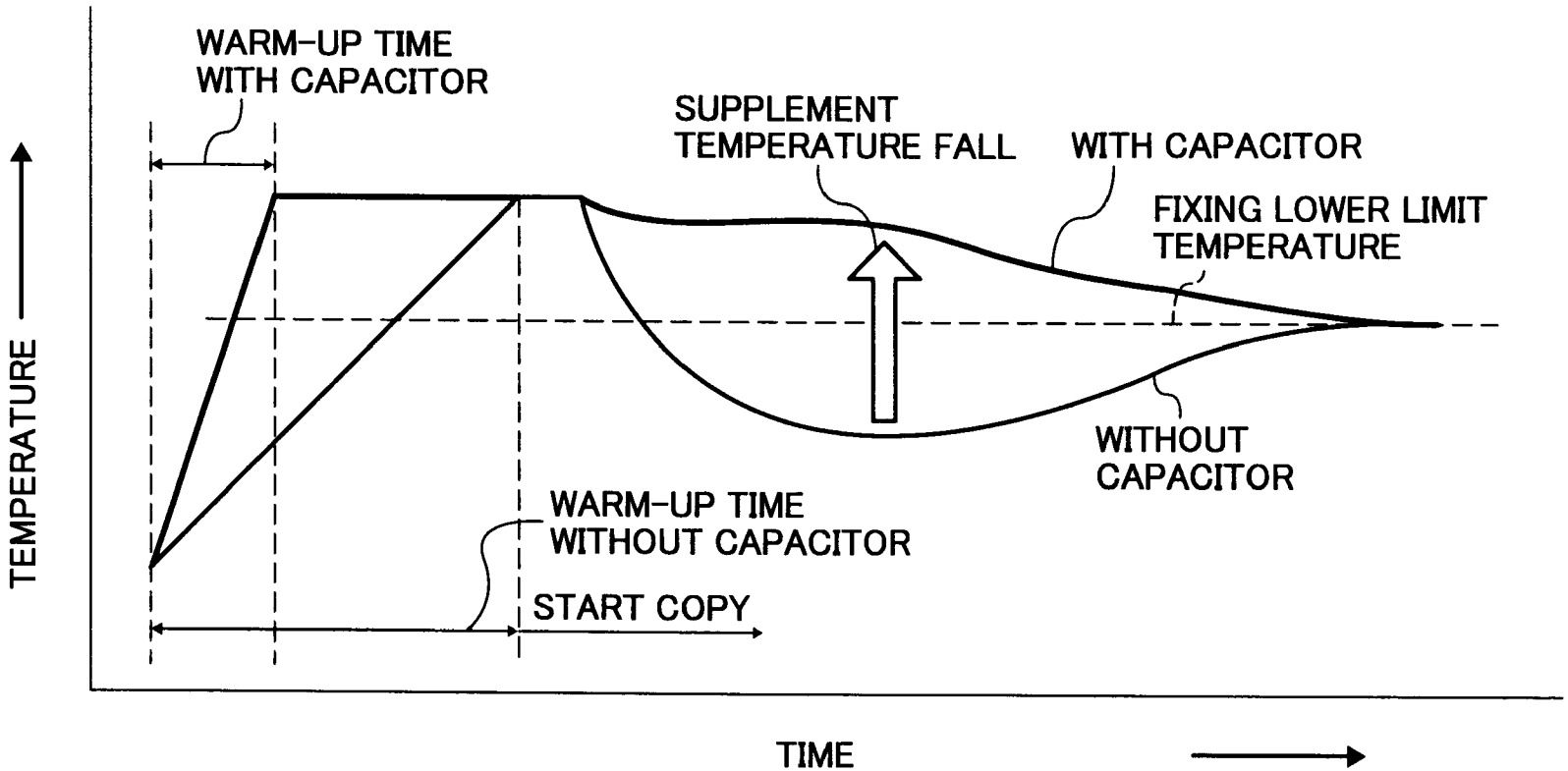
FIG. 12 is a graph for explaining a temperature characteristic of a fixing device at the time of warm-up and copying performed by using a capacitor bank according to the first embodiment.

FIG. 12 is a graph for explaining a temperature characteristic of the fixing device at the time of warm-up and copying performed by using the capacitor bank. In this embodiment, since the structure described above is adopted, a warm-up time until the fixing device at the time of start of the image forming apparatus reaches a predetermined temperature is shorter than a warm-up time at the time when the capacitor cells are not provided. Temperature fall is reduced by performing image formation processing. Since the structure using the capacitor bank charged by the commercial power supply is adopted, it is possible to reduce time during which the image formation processing is impossible by using the commercial power supply used in general offices in Japan.

The present invention is not limited to the embodiment described above. Other embodiments are explained below.

As in the first embodiment, an engine power supply unit of an image forming apparatus according to a second embodiment of the present invention steps down a voltage outputted from the commercial power supply to charge a charge accumulating unit and changes a voltage outputted from the commercial power supply and a voltage outputted from the charge accumulating unit to constant voltages with a constant-voltage generating circuit to supply the voltages to the load. The second embodiment is different from the first embodiment in that a first opening and closing circuit is used instead of the first switching circuit and a second opening and closing circuit and a third opening and closing circuit are used instead of the second switching circuit.

Figure 13:
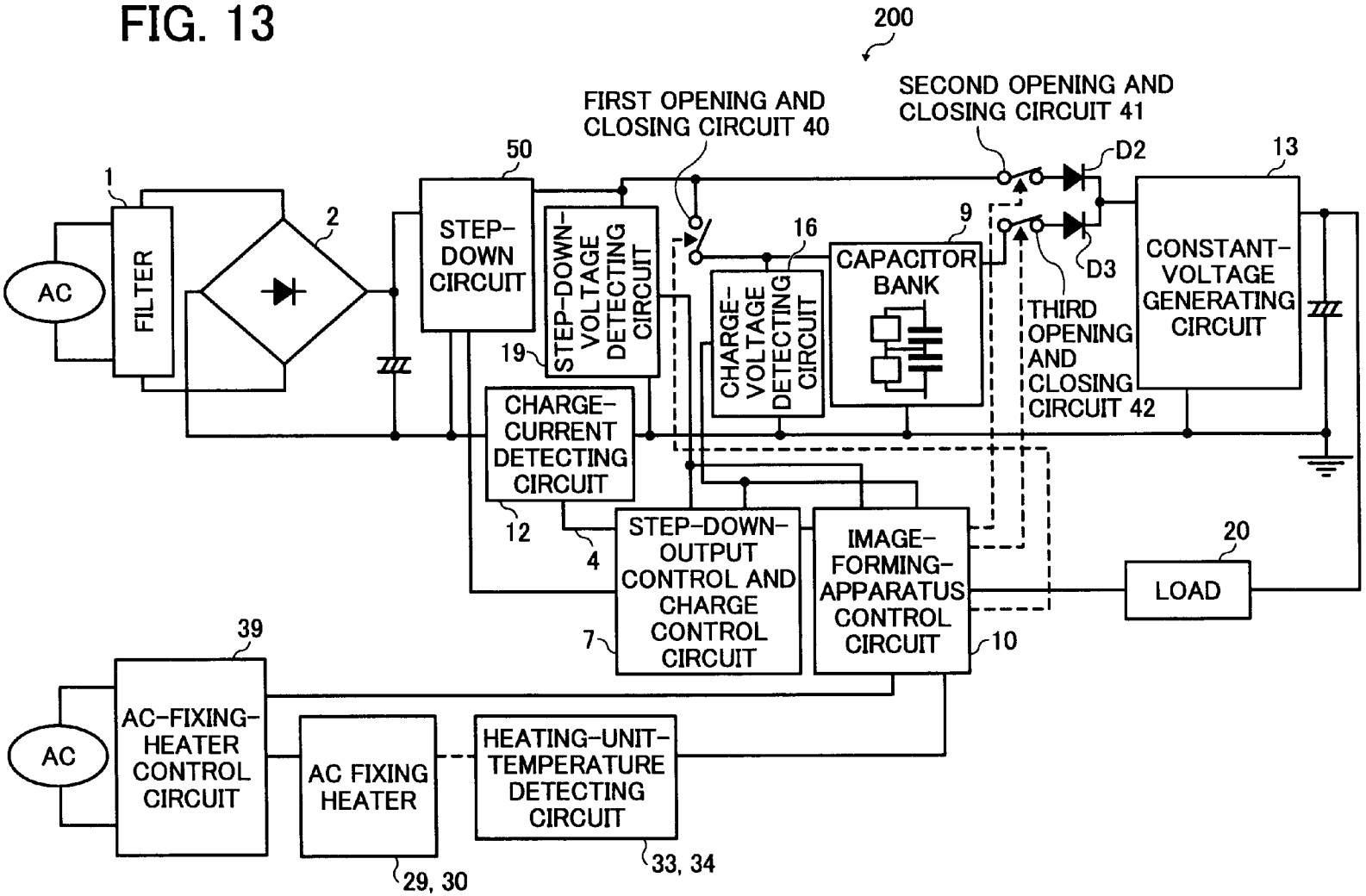
FIG. 13 is a circuit diagram of a circuit configuration of an engine power supply unit of a printer according to a second embodiment of the present invention.
Figures 14, 14A, 14B:
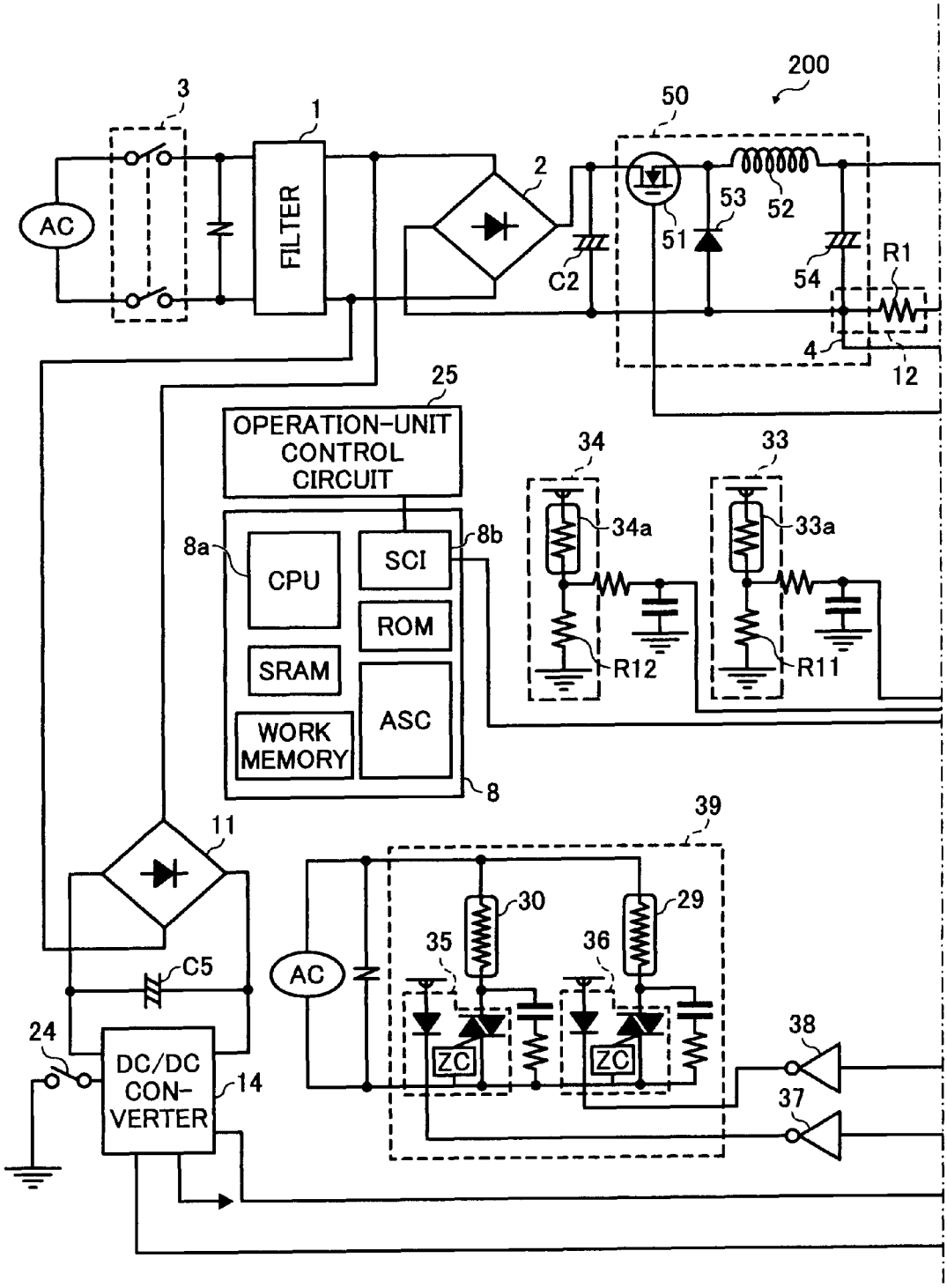
FIG. 14 is a detailed circuit diagram of a detailed circuit configuration of the engine power supply unit of the printer according to the second embodiment.
Figure 14B:
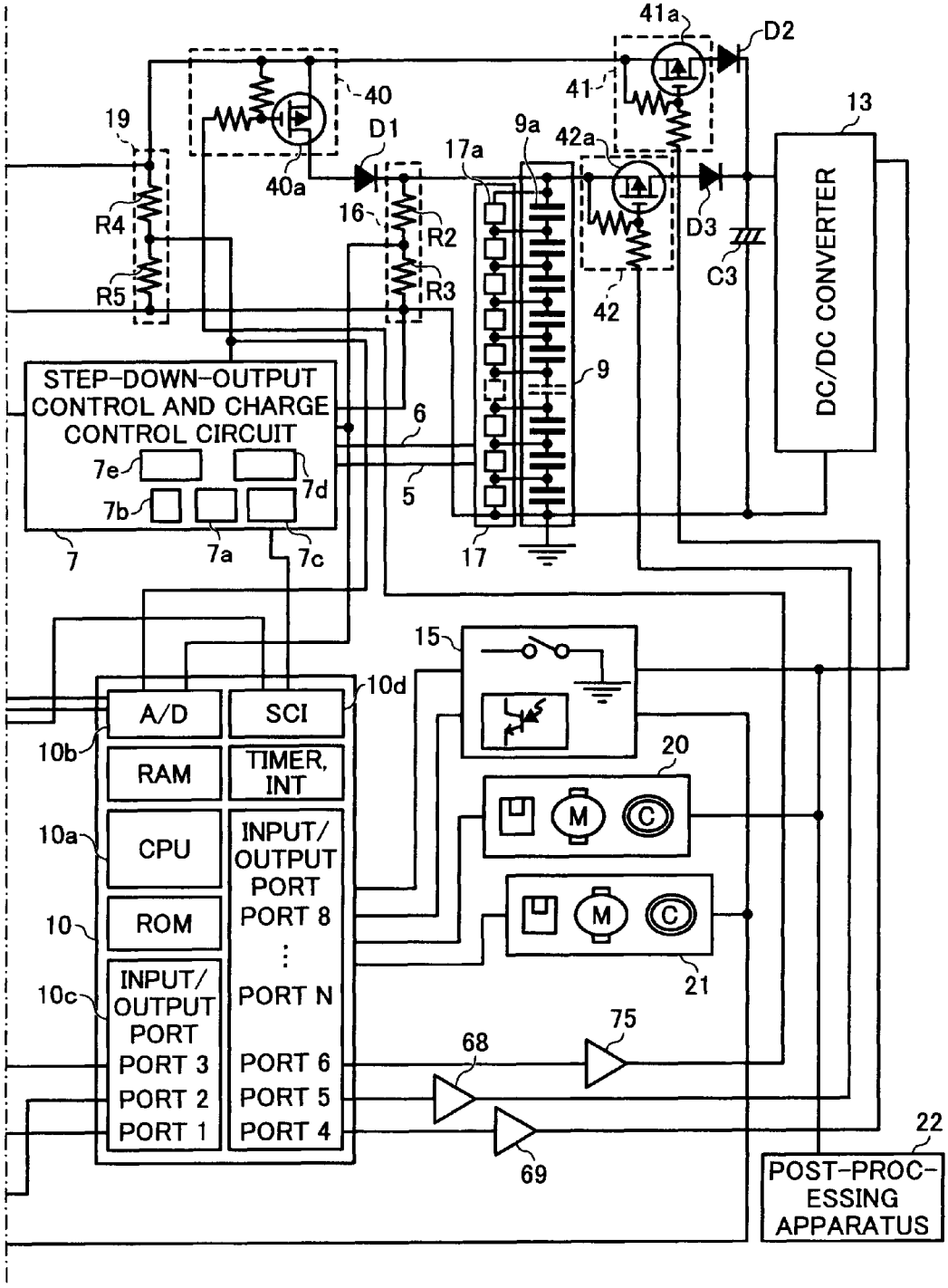

Concerning an example of a structure of an engine power supply unit 200 to which the present invention is applied, differences from the first embodiment are explained. Explanations of components identical with those in the first embodiment are omitted. FIG. 13 is a circuit diagram of a circuit configuration of an engine power supply unit of a printer according to the second embodiment. FIG. 14 is a detailed circuit diagram of a detailed circuit configuration of the engine power supply unit of the printer according to the second embodiment.

The engine power supply unit 200 of the printer according to this embodiment includes the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the engine control unit 10, the step-down-output control and charge control circuit 7, the load 20, the AC fixing heaters 29 and 30, the heating-unit-temperature detecting circuits 33 and 34, the AC-fixing-heater control circuit 39, a first opening and closing circuit 40, a second opening and closing circuit 41, and a third opening and closing circuit 42.

Structures and functions of the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the engine control unit 10, the step-down-output control and charge control circuit 7, the load 20, the AC fixing heaters 29 and 30, the heating-unit-temperature detecting circuits 33 and 34, and the AC-fixing-heater control circuit 39 are the same as those in the first embodiment. Thus, explanations of the structures and the functions are omitted here The first opening and closing circuit 40 opens and closes the connection between the output of the step-down chopper circuit 50 and the capacitor bank 9. The second opening and closing circuit 41 connects the output of the step-down chopper circuit 50 and the input of the constant-voltage generating circuit 13. The third opening and closing circuit 42 opens and closes the connection between the input of the constant-voltage generating circuit 13 and the capacitor bank 9. It is possible to supply a voltage to the constant-voltage generating circuit 13 even at the time of charge by closing the second opening and closing circuit 41. In charging the charge accumulating unit when it is unnecessary to supply electric power to the load, for example, at the time of the energy saving mode, it is possible to reduce electric power if the second opening and closing circuit 41 is opened. The first to the third opening and closing circuits according to this embodiment include FETS. It goes without saying that opening and closing circuit including IGBTs or the like may be used.

When a relay is used for the second opening and closing circuit 41 and the third opening and closing circuit 42, it is possible to continuously supply electric power to the constant-voltage generating circuit 13 if a signal for opening the third opening and closing circuit 42 is outputted in a fixed time after a signal for turning on the second opening and closing circuit 41 is outputted. When the second opening and closing circuit 41 is turned off, it is possible to continuously supply electric power to the constant-voltage generating circuit 13 if a signal for opening the second opening and closing circuit 41 is outputted in a fixed time after a signal for turning on the third opening and closing circuit 42 is outputted.

Opening and closing of the first opening and closing circuit 40 is controlled by outputting a signal for turning on and off a FET 40*a* from the port 6 of the engine control unit 10 to a gate of the FET 40*a*. Opening and closing of the second opening and closing circuit 41 is controlled by outputting a signal for turning on and off a FET 41*a* from the port 4 of the engine control unit 10 to a gate of the FET 41*a*. Opening and closing of the third opening and closing circuit 42 is controlled by outputting a signal for turning on and off a FET 42*a* from the port 5 of the engine control unit 10 to a gate of the FET 42*a*. The first opening and closing circuit 40 and the third opening and closing circuit 42 are set to be opened in a normal close state. Therefore, when the main power supply is off, discharge from the capacitor bank 9 is stopped.

Operation mode control processing according to this embodiment is the same as the processing of the flowcharts shown in FIGS. 6A to 6D explained in the first embodiment. Thus, only differences are explained below.

In this embodiment, instead of steps S628 and S629, processing for outputting an opening signal to the first opening and closing circuit, outputting an opening signal to the second opening and closing circuit, and outputting an opening signal to the third opening and closing circuit is performed.

Figure 15:
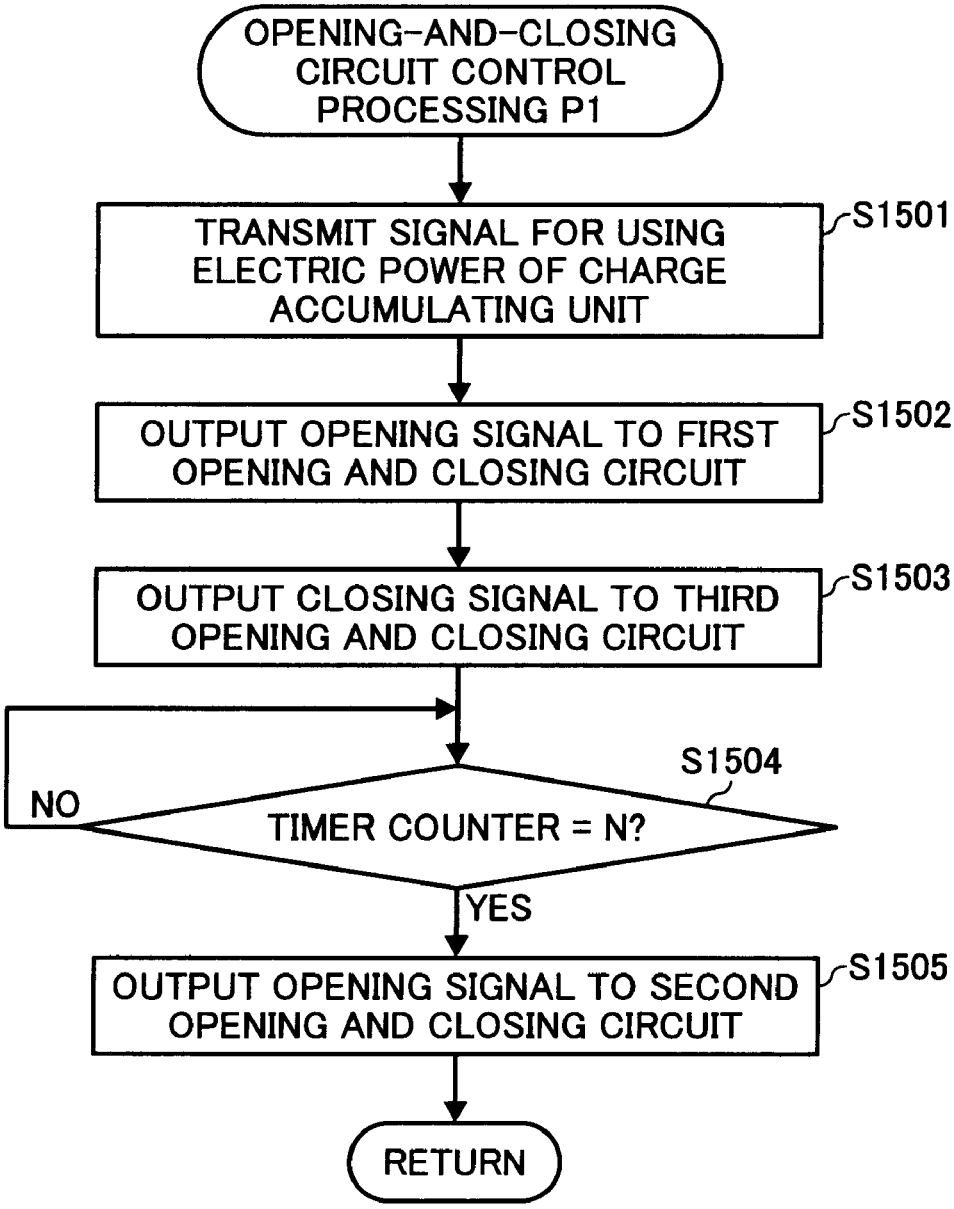
FIG. 15 is a flowchart of a procedure of opening-and-closing-circuit control processing P1 performed by an engine control unit of an image forming apparatus according to the second embodiment.

The opening-and-closing-circuit control processing P1 in the flowcharts shown in FIGS. 6A to 6D is replaced with opening-and-closing-circuit control processing P1 shown in FIG. 15. The opening-and-closing-circuit control processing P2 is replaced with opening-and-closing-circuit control processing P2 shown in FIG. 16. The opening-and-closing-circuit control processing P3 is replaced with opening-and-closing-circuit control processing P3 shown in FIG. 17.

FIG. 15 is a flowchart of a procedure of the opening-and-closing-circuit control processing P1 performed by the engine control unit of the image forming apparatus. According to this processing, the constant-voltage generating circuit 13 generates a constant voltage using accumulated electric power of the capacitor bank 9 and supplies electric power to the load.

The CPU 10*a* transmits a signal for using electric power of the charge accumulating unit to the CPU 7*a* of the step-down-output control and charge control circuit 7 (step S1501). The CPU 10*a* outputs a closing signal to the first opening and closing circuit from the port 6 (step S1502) and outputs a closing signal to the third opening and closing circuit from the port 5 (step S1503). When a relay is used for the second and the third opening and closing circuits, the CPU 10*a* counts time N with the timer counter (step S1504). The CPU 10*a* outputs an opening signal to the second opening and closing circuit from the port 4 (step S1505).

Figure 16:
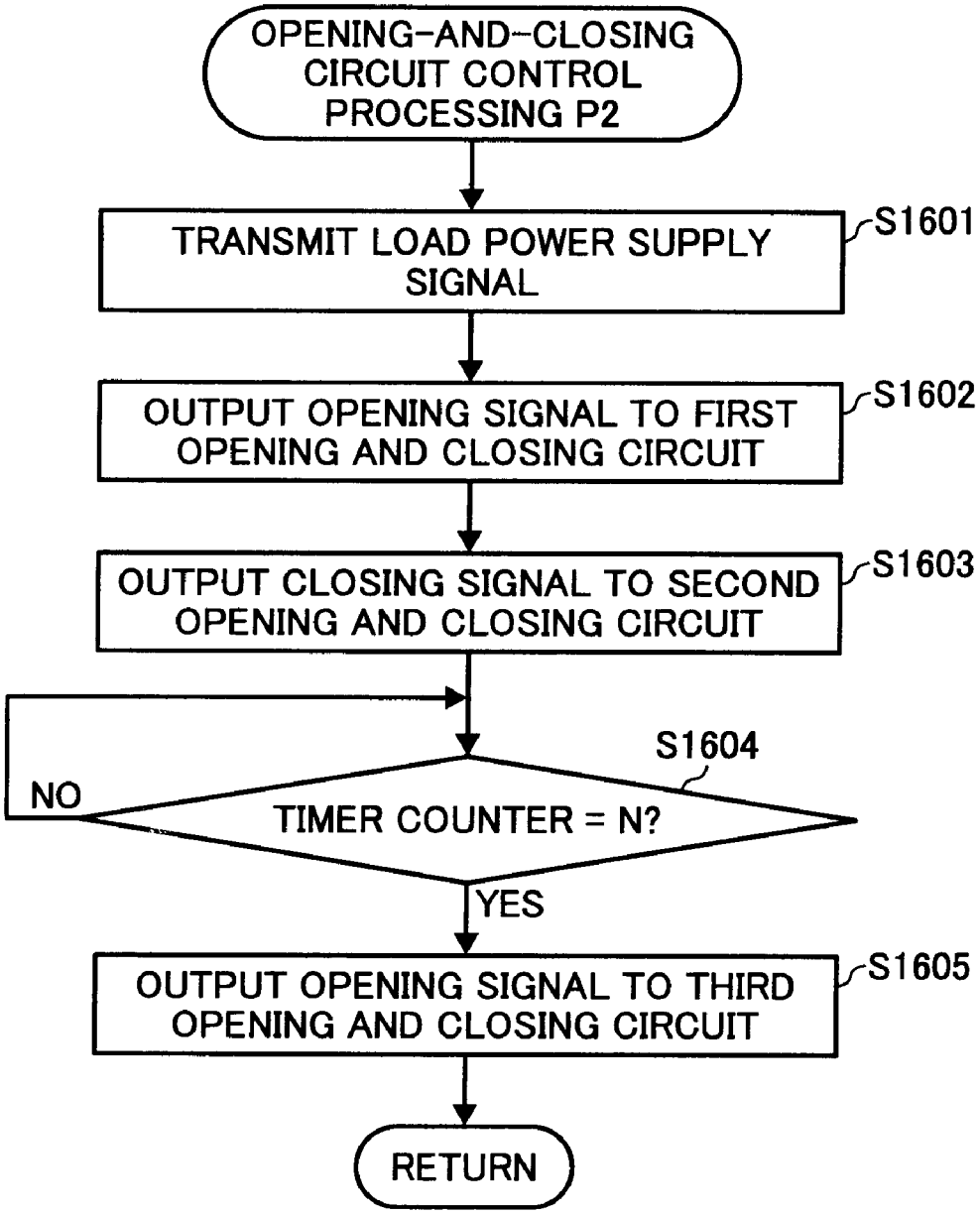
FIG. 16 is a flowchart of a procedure of opening-and-closing-circuit control processing P2 performed by the engine control unit of the image forming apparatus according to the second embodiment.

FIG. 16 is a flowchart of a procedure of the opening-and-closing-circuit control processing P2 performed by the engine control unit of the image forming apparatus. According to this processing, the constant-voltage generating circuit 13 generates a constant voltage using a voltage outputted from the commercial power supply and supplies electric power to the load.

The CPU 10*a* transmits a load power supply signal to the CPU 7*a* of the step-down-output control and charge control circuit 7 (step S1601). The CPU 10*a* outputs an opening signal to the first opening and closing circuit from the port 6 (step S1602) and outputs a closing signal to the second opening and closing circuit from the port 4 (step S1603). When a relay is used for the second and the third opening and closing circuits, the CPU 10*a* counts time N with the timer counter (step S1604). The CPU 10*a* outputs an opening signal to the third opening and closing circuit from the port 5 (step S1605).

Figure 17:
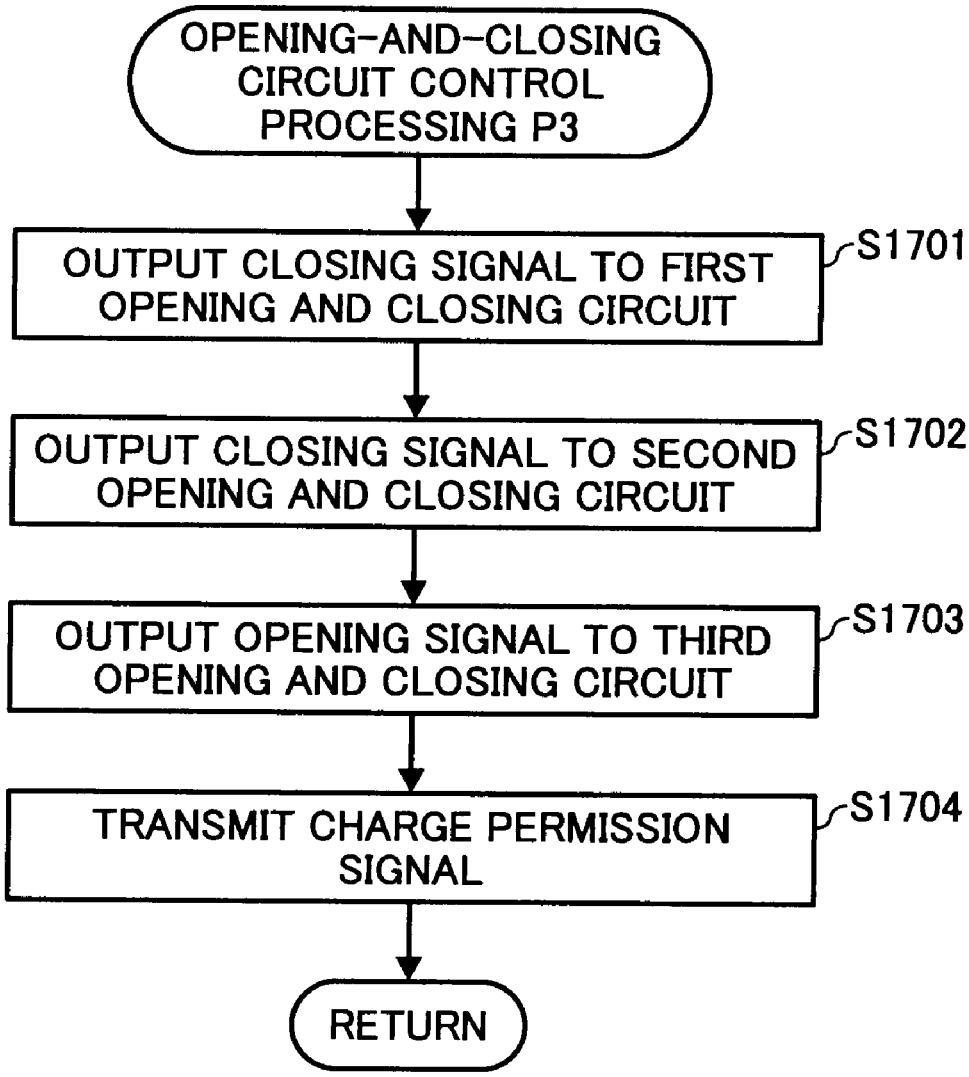
FIG. 17 is a flowchart of a procedure of opening-and-closing-circuit control processing P3 performed by the engine control unit of the image forming apparatus according to the second embodiment.

FIG. 17 is a flowchart of a procedure of the opening-and-closing-circuit control processing P3 performed by the engine control unit of the image forming apparatus. According to this processing, a voltage outputted from the commercial power supply is stepped down and the charge accumulating unit is charged by the step-down voltage.

The CPU 10*a* outputs a closing signal to the first opening and closing circuit from the port 6 (step S1701) and outputs a closing signal to the second opening and closing circuit from the port 4 (step S1702). The CPU 10*a* outputs an opening signal to the third opening and closing circuit from the port 5 (step S1703). The CPU 10*a* transmits a charge permission signal to the CPU 7*a* of the step-down-output control and charge control circuit 7 (step S1704).

As described above, in this embodiment, in addition to the effects of the first embodiment, it is possible to supply electric power to the load even at the time of charge by closing the second opening and closing circuit. When it is unnecessary to supply electric power to the load, for example, at the time of the energy saving mode, it is possible reduce electric power by opening the second opening and closing circuit.

In this embodiment, when the second opening and closing circuit 41 and the third opening and closing circuit 42 are closed, in discharging a voltage at the capacitor bank 9 (supplying the voltage to the constant-voltage generating circuit 13 via the third opening and closing circuit 42), the step-down-output control and charge control circuit 7 outputs a PWM signal for stepping down the voltage to an input voltage, which allows the constant-voltage generating circuit 13 to generate a constant voltage, to the gate of the FET 51 of the step-down chopper circuit 50. Consequently, the capacitor bank 9 starts discharge and the voltage is supplied from the capacitor bank 9 to the constant-voltage generating circuit 13. When the voltage supplied from the capacitor bank 9 is stepped down to the input voltage, which allows the constant-voltage generating circuit 13 to generate a constant voltage, the voltage supplied to the constant-voltage generating circuit 13 is switched to the voltage outputted from the step-down chopper circuit 50.

As in the first embodiment, an engine power supply unit of an image forming apparatus according to a third embodiment of the present invention steps down a voltage outputted from the commercial power supply to charge a charge accumulating unit and changes a voltage outputted from the commercial power supply and a voltage outputted from the charge accumulating unit to constant voltages with a constant-voltage generating circuit to supply the voltages to the load. The third embodiment is different from the first embodiment in that a first opening and closing circuit is used instead of the first switching circuit and a second opening and closing circuit is used instead of the second switching circuit.

Figure 18:
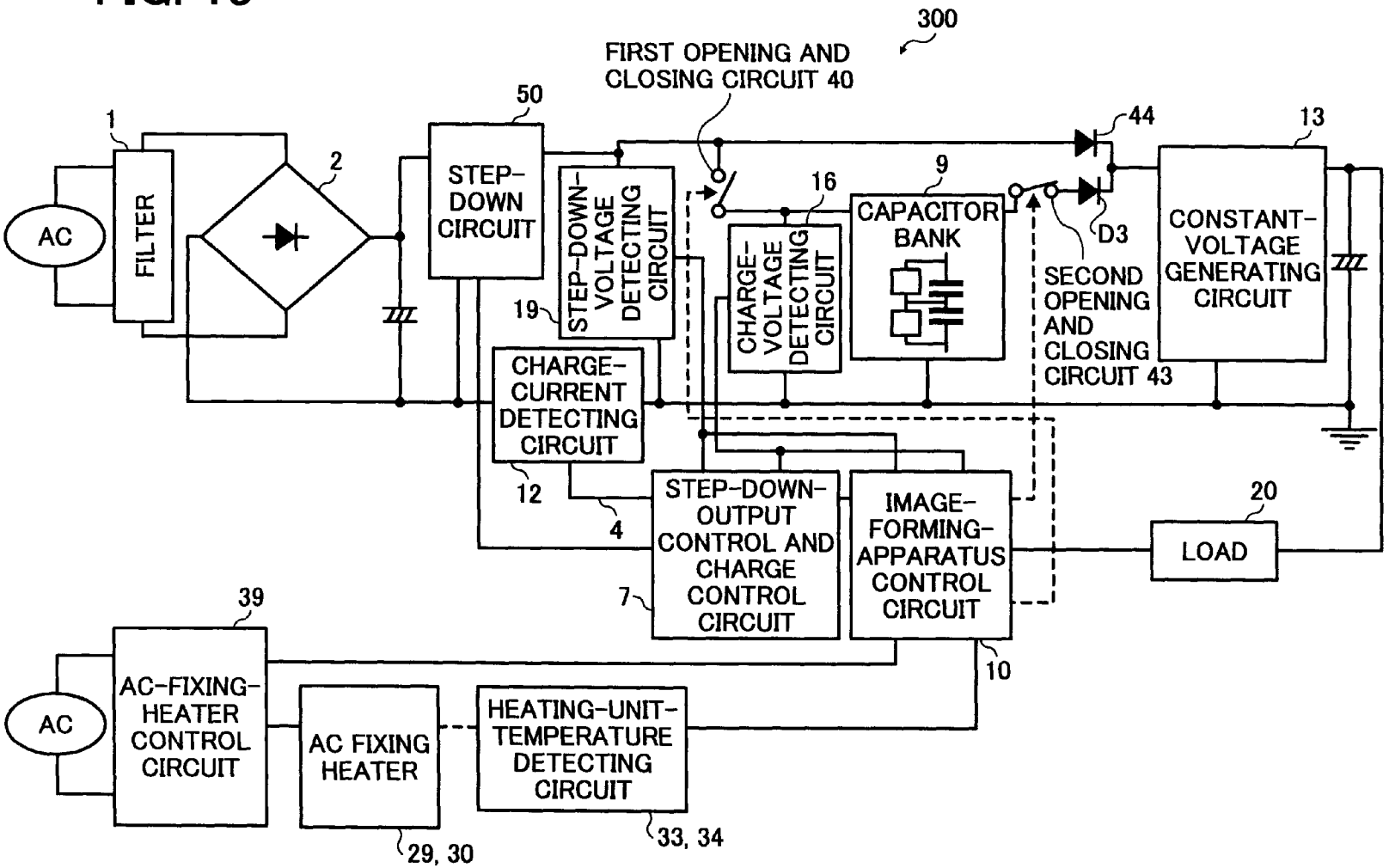
FIG. 18 is a circuit diagram of a circuit configuration of an engine power supply unit of a printer according to a third embodiment of the present invention.
Figures 19, 19A, 19B:
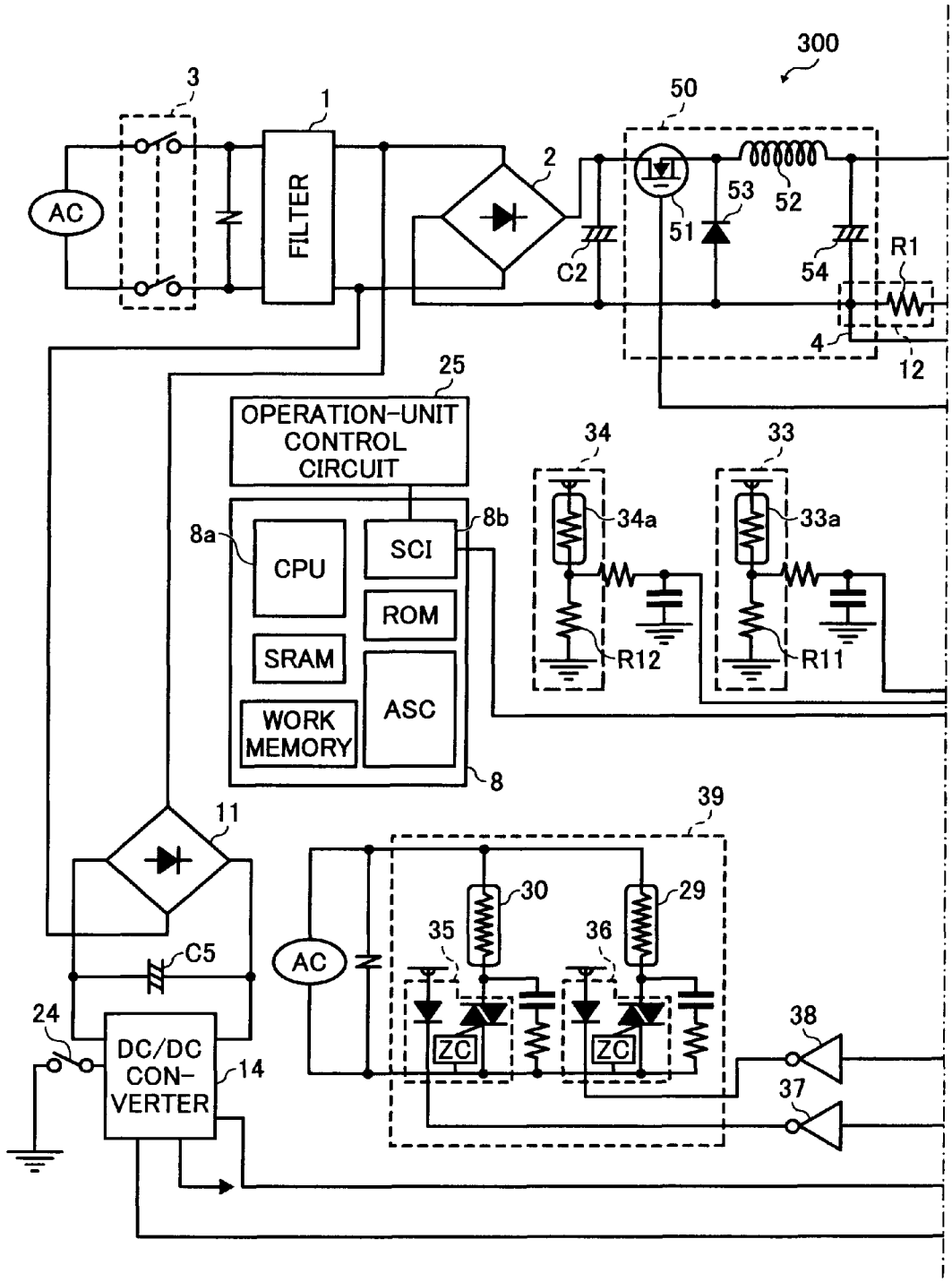
FIG. 19 is a detailed circuit diagram of a detailed circuit configuration of the engine power supply unit of the printer according to the third embodiment.
Figure 19B:
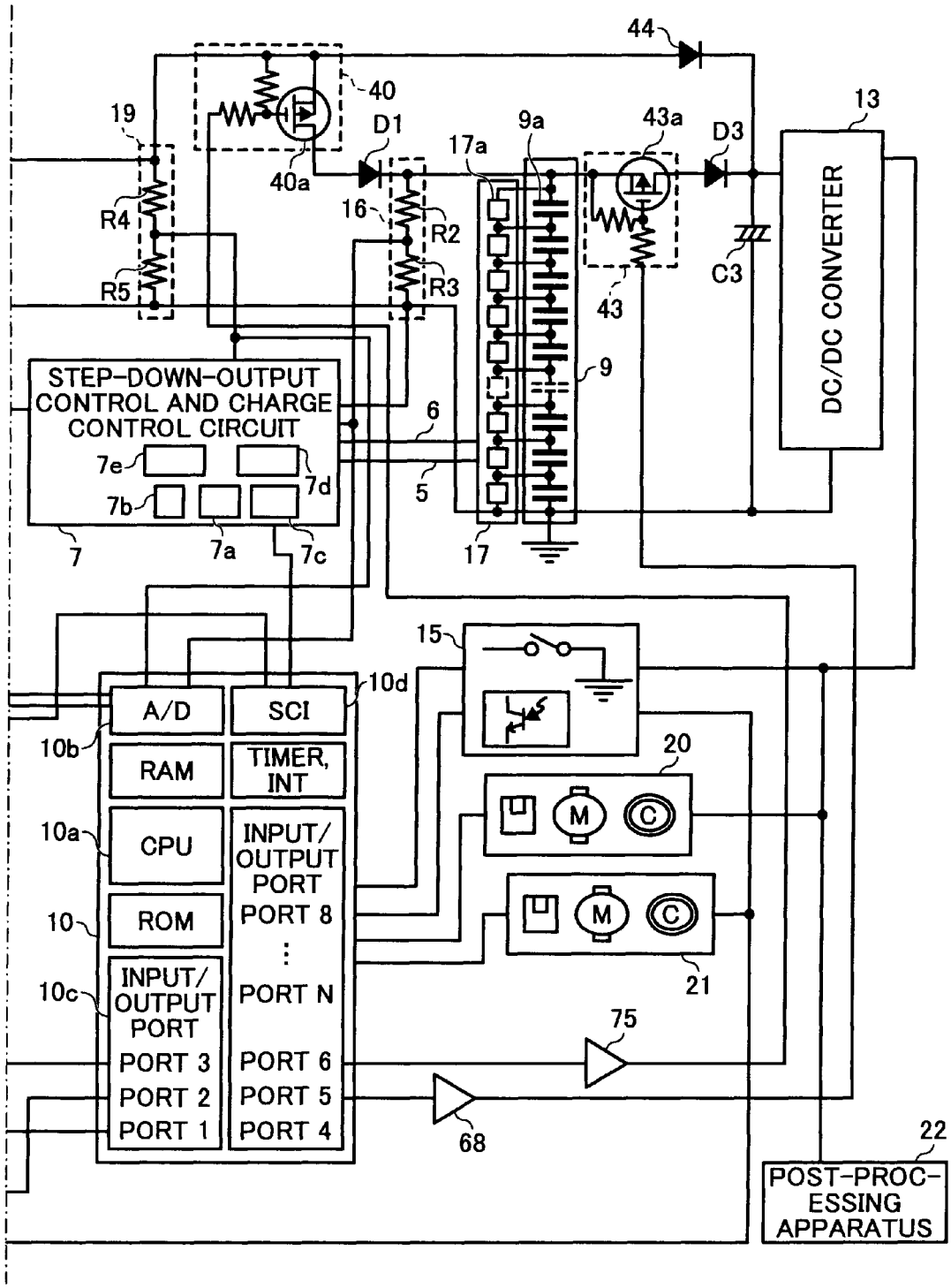

Concerning an example of a structure of an engine power supply unit 300 to which the present invention is applied, differences from the first embodiment are explained. Explanations of components identical with those in the first embodiment are omitted. FIG. 18 is a circuit diagram of a circuit configuration of an engine power supply unit of a printer according to the third embodiment. FIG. 19 is a detailed circuit diagram of a detailed circuit configuration of the engine power supply unit of the printer according to the third embodiment.

The engine power supply unit 300 of the printer according to this embodiment includes the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the engine control unit 10, the step-down-output control and charge control circuit 7, the load 20, the AC fixing heaters 29 and 30, the heating-unit-temperature detecting circuits 33 and 34, the AC-fixing-heater control circuit 39, the first opening and closing circuit 40, and a second opening and closing circuit 43.

Structures and functions of the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the engine control unit 10, the step-down-output control and charge control circuit 7, the load 20, the AC fixing heaters 29 and 30, the heating-unit-temperature detecting circuits 33 and 34, and the AC-fixing-heater control circuit 39 are the same as those in the first embodiment. Thus, explanations of the structures and the functions are omitted here The first opening and closing circuit 40 opens and closes the connection between the output of the step-down chopper circuit 50 and the capacitor bank 9. The second opening and closing circuit 43 connects the input of the constant-voltage generating circuit 13 and the capacitor bank 9. As a characteristic of the circuits according to this embodiment, a voltage is always supplied to the constant-voltage generating circuit 13 via a diode. When electric power is discharged from the capacitor bank 9, a voltage is not supplied from the capacitor bank 9 to the constant-voltage generating circuit 13 if a voltage at the step-down chopper circuit 50 is set lower than a voltage at the capacitor bank 9. The first and the second opening and closing circuits according to this embodiment include FETs. It goes without saying that opening and closing circuit including relays, IGBTs, or the like may be used.

Opening and closing of the first opening and closing circuit 40 is controlled by outputting a signal for turning on and off the FET 40*a* from the port 6 of the engine control unit 10 to the gate of the FET 40*a* of the first opening and closing circuit 40. Opening and closing of the second opening and closing circuit 43 is controlled by outputting a signal for turning on and off a FET 43*a* from the port 5 of the engine control unit 10 to the gate of the FET 43*a*. The first opening and closing circuit 40 and the second opening and closing circuit 43 are set to be opened in the normal close state. Therefore, when the main power supply is off, discharge from the capacitor bank 9 is stopped.

Figure 6A:
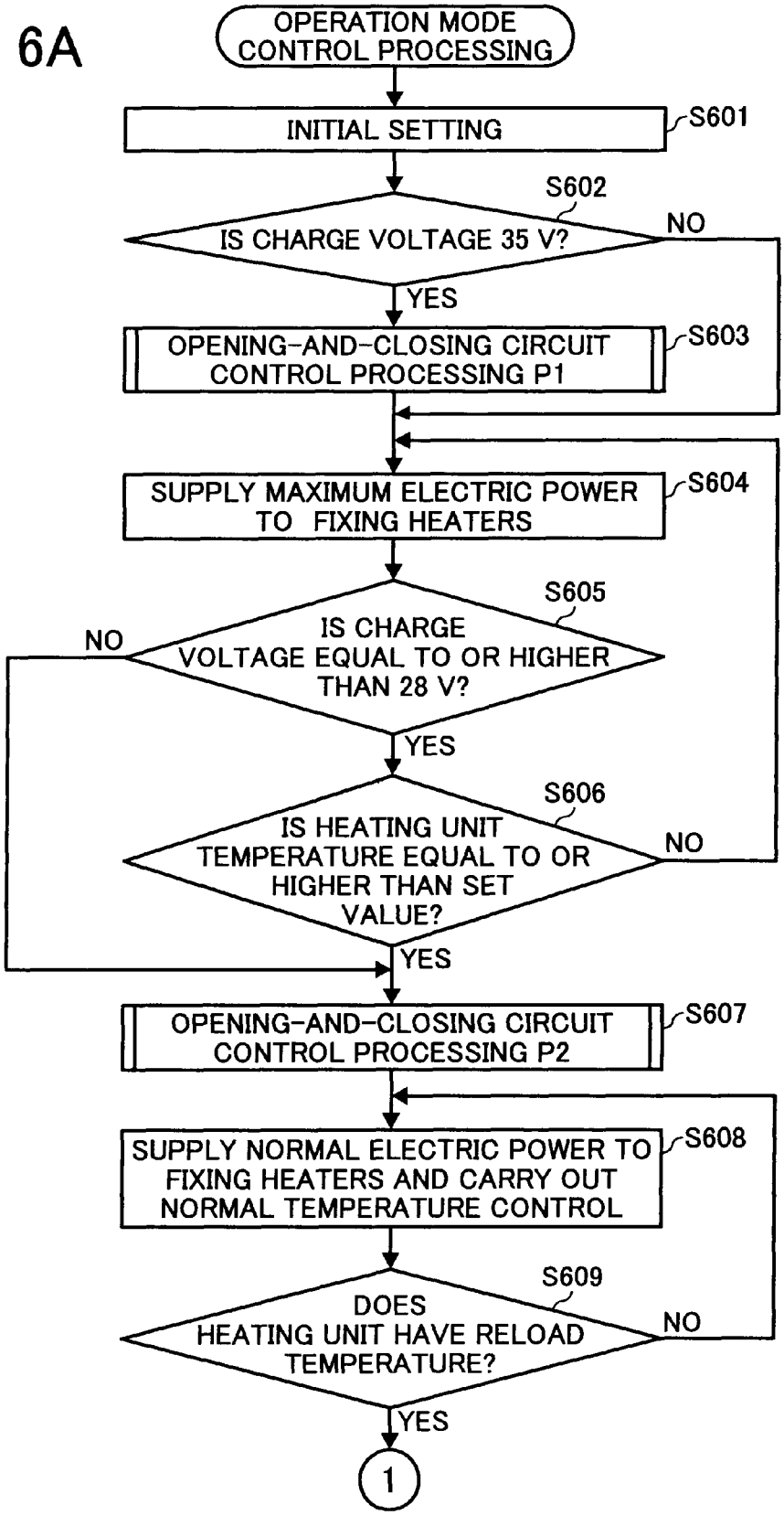
FIG. 6A is a flowchart of a procedure of operation mode control processing performed by an engine control unit of an image forming apparatus according to the first embodiment.
Figure 6B:
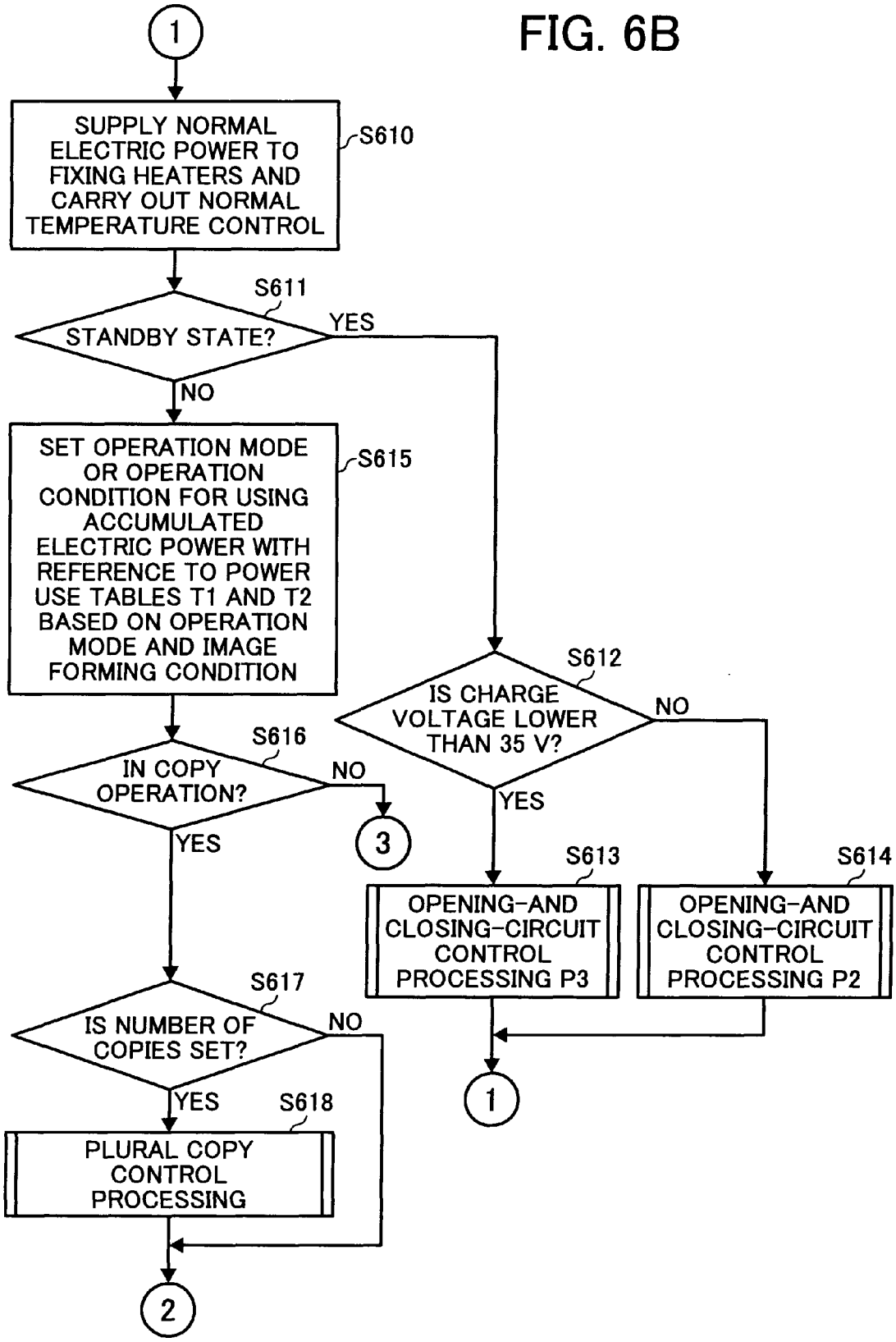
FIG. 6B is a flowchart of the procedure of the operation mode control processing performed by the engine control unit of the image forming apparatus according to the first embodiment.
Figure 6C:
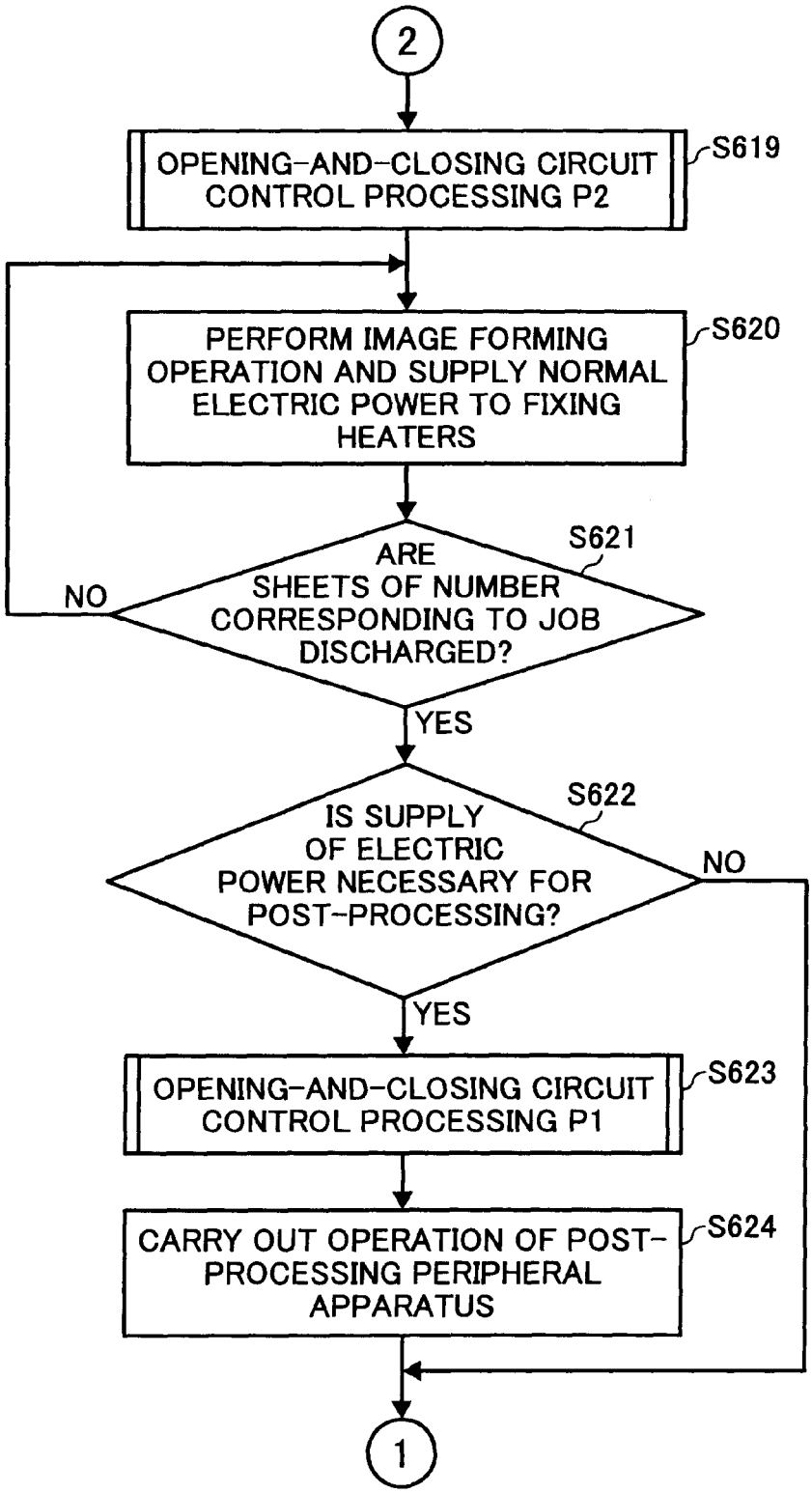
FIG. 6C is a flowchart of the procedure of the operation mode control processing performed by the engine control unit of the image forming apparatus according to the first embodiment.
Figure 20A:
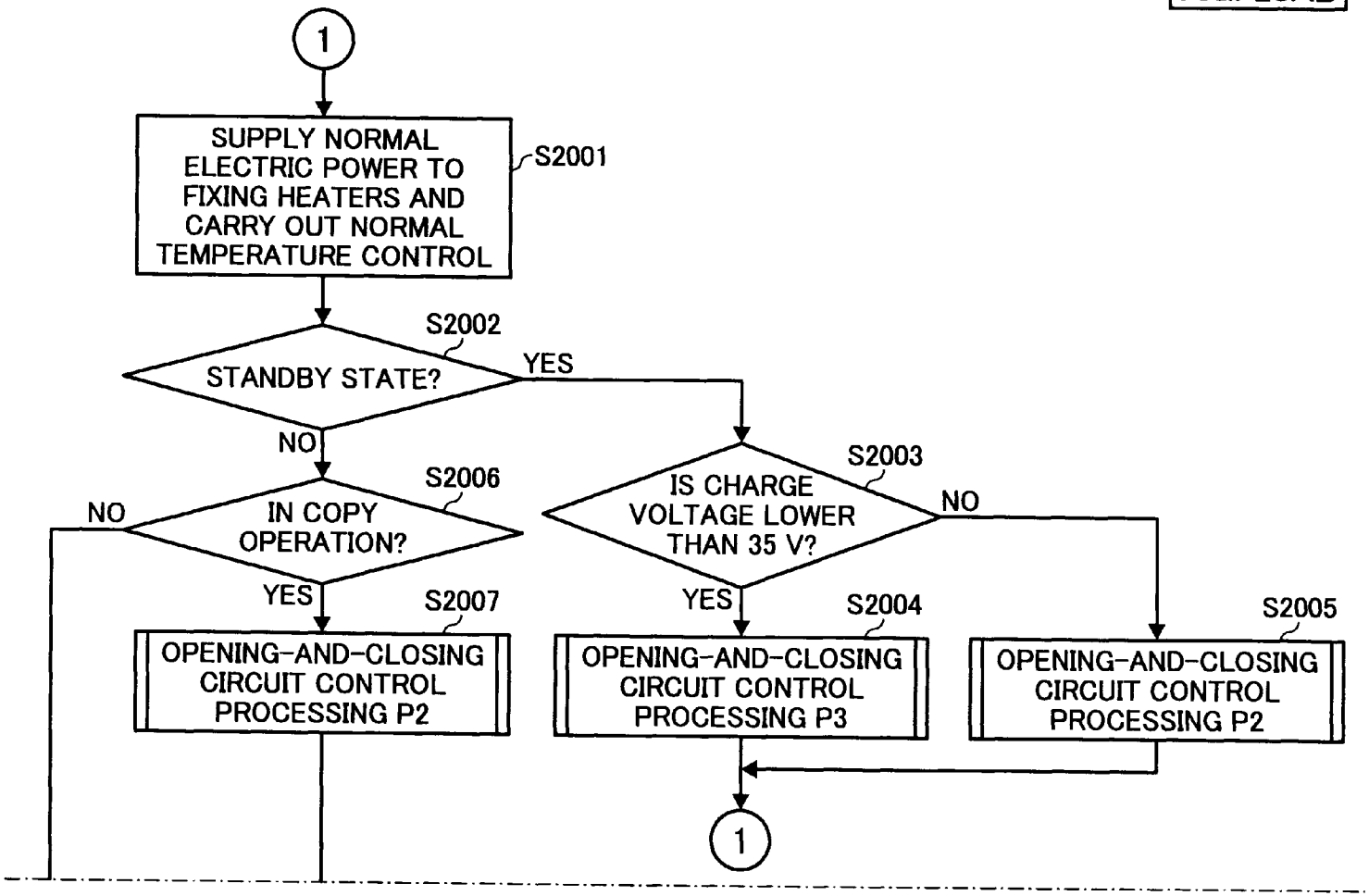
FIG. 20A is a flowchart of a procedure of operation mode control processing performed by an engine control unit of an image forming apparatus according to the third embodiment.
Figure 20A:
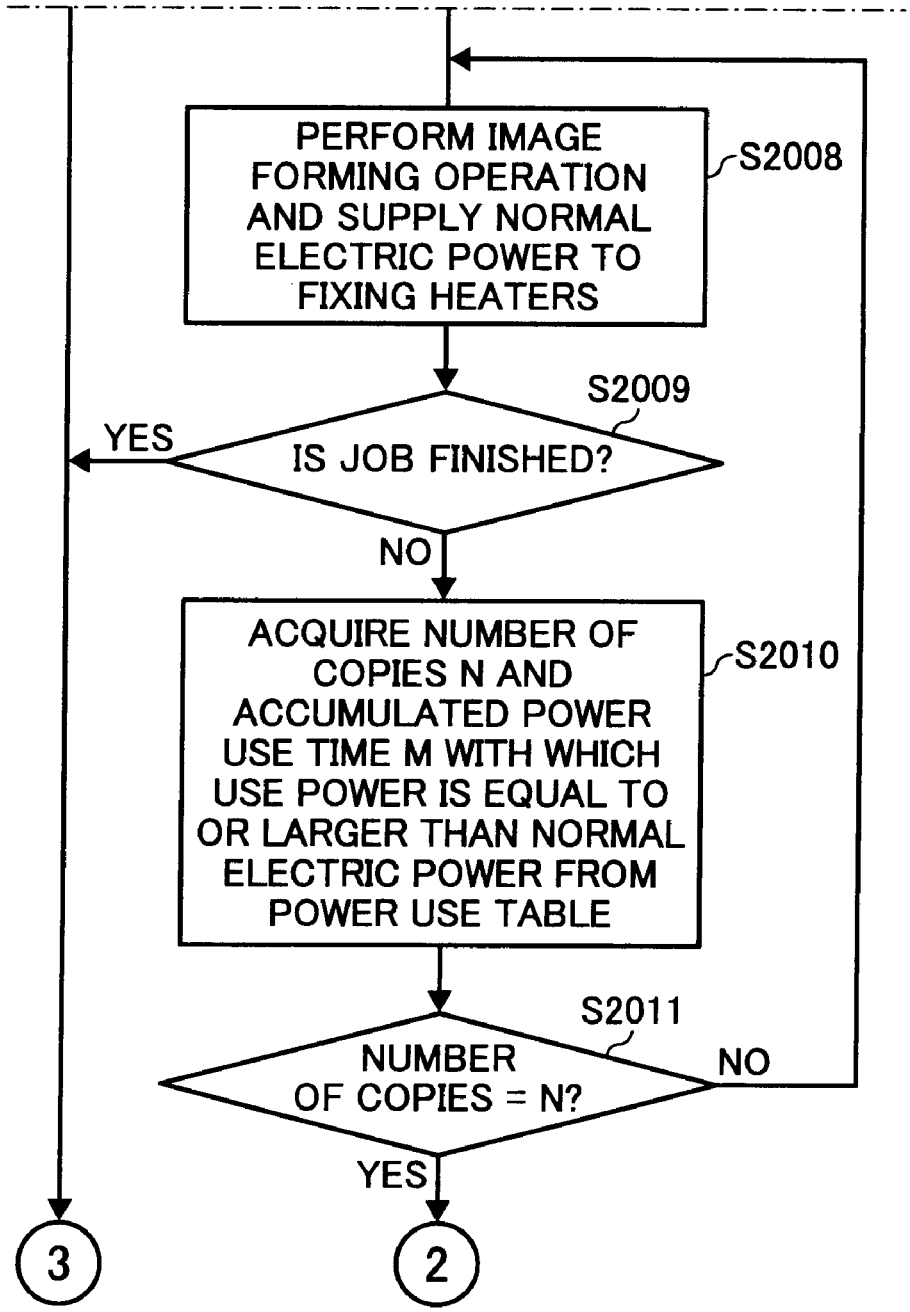
Figure 20B:
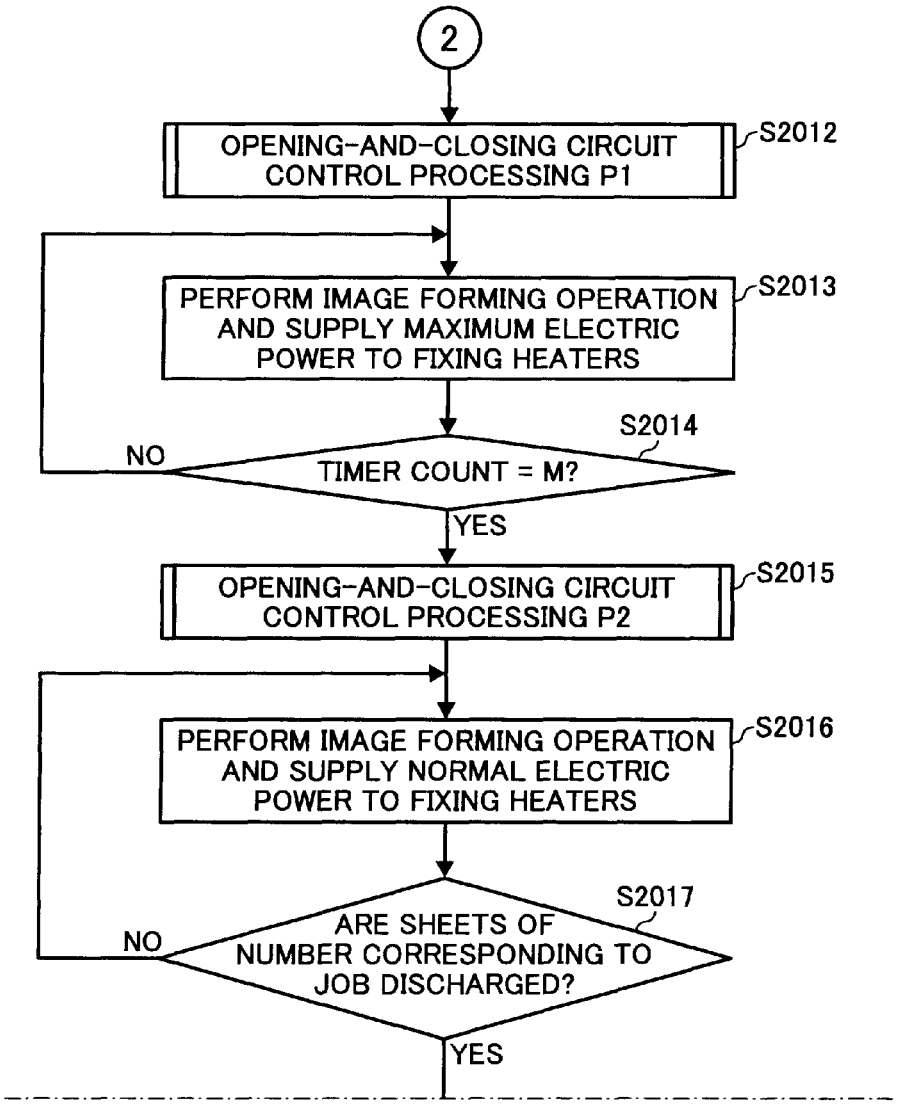
FIG. 20B is a flowchart of the procedure of the operation mode control processing performed by the engine control unit of the image forming apparatus according to the third embodiment.
Figure 20B:
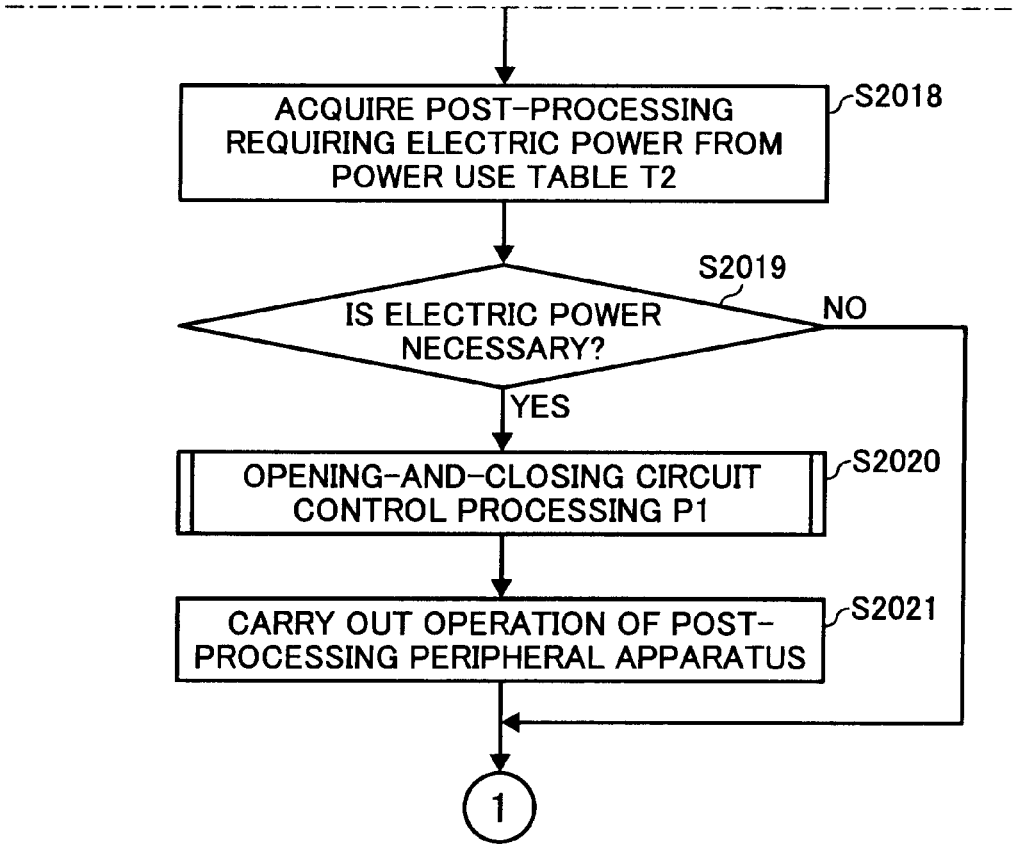

FIGS. 20A and 20B are flowcharts of a procedure of operation mode control processing performed by the engine control unit of the image forming apparatus. The operation mode control processing is partially the same as the processing of the flowcharts shown in FIGS. 6A to 6D explained in the first embodiment. Thus, only differences are explained below. Since processing before step S2001 is the same as that at steps S601 to S609 in FIG. 6A, the explanation with reference to FIG. 6A is referred to. An explanation of the processing is omitted here.

When the CPU 10*a* of the engine control unit 10 judges at step S609 in FIG. 6A that the heating unit has the reload temperature, the fixing device comes into the standby state, electric power at the normal time set in advance is supplied to the fixing heaters, and normal temperature control is carried out (step S2001).

The CPU 10*a* judges whether the fixing device is in the standby state again (step S2002). When it is judged that the fixing device is in the standby state ("Yes" at step S2002), the CPU 10*a* judges whether a charge voltage is lower than 35 volts, i.e., whether the capacitor cells are in the full-charge state (step S2003). When it is judged that the charge voltage is lower than 35 volts, i.e., the capacitor cells are not in the full-charge state ("Yes" at step S2003), the CPU 10*a* performs the opening-and-closing-circuit control processing P3 (step S2004). Consequently, the capacitor bank 9 is charged. Thereafter, the CPU 10*a* returns to step S2001. When it is judged that the charge voltage is not lower than 35 volts, i.e., the capacitor cells are in the full-charge state ("No" at step S2003), the CPU 10*a* performs the opening-and-closing-circuit control processing P2 (step S2005). Consequently, electric power inputted from the commercial power supply is supplied to the load via the constant-voltage generating circuit 13. Thereafter, the CPU 10*a* returns to step S2001.

When it is judged at step S2002 that the fixing device is not in the standby state ("No" at step S2002), the CPU 10*a* judges whether the image forming apparatus is performing a copy operation (step S2006). When it is judged that the image forming apparatus is performing the copy operation ("Yes" at step S2006), the CPU 10*a* performs the opening-and-closing-circuit control processing P2 (step S2007). Consequently, electric power inputted from the commercial power supply is supplied to the load via the constant-voltage generating circuit 13. The load performs an image forming operation and normal electric power is supplied to the AC fixing heaters 29 and 30 (step S2008).

The CPU 10*a* judges whether a job has been finished (step S2009). When it is judged that the job has been finished ("Yes" at step S2009), the CPU 10*a* carries out processing of the energy saving mode described later. When it is judged that the job has not been finished ("No" at step S2009), the CPU 10*a* acquires, from the power use table T1, the number of copies N and an accumulated electric power use time M corresponding to a present sheet size with which use power is equal to or larger than normal electric power (step S2010).

The CPU 10*a* judges whether a present number of copies is N (step S2011). When it is judged that the present number of copies is not N ("No" at step S2011), the CPU 10*a* returns to step S2008 and the image forming operation is continued. When it is judged that the present number of copies is N ("Yes" at step S2011), to prevent the temperature of the heating unit from falling to be lower than a fixed image guarantee temperature, the CPU 10*a* performs the opening-and-closing-circuit control processing P1 (step S2012). Consequently, the supply of electric power from the commercial power supply is stopped. Moreover, electric power accumulated in the capacitor bank 9 is supplied to the constant-voltage generating circuit 13. It is possible to supply excess electric power to the heating unit of the fixing device. As a result, it is possible to supply maximum electric power of the heater rating to the AC fixing heaters 29 and 30.

The CPU 10*a* continues the state in which the maximum electric power is supplied to the AC fixing heaters 29 and 30 and continues the copy operation (step S2013). The temperature fall in the heating unit of the fixing device occurs because heat of a fixing pressure roller moves to a sheet when sheet supply is started. Therefore, when this pressure roller is warmed, the temperature fall is solved. The CPU 10*a* counts the accumulated electric power use time M, which is time until the pressure roller is warmed, with the timer (step S2014). When it is judged that a timer count is not M ("No" at step S2014), the CPU 10*a* returns to step S2013. The maximum electric power of the heater rating is supplied to the fixing heaters until the accumulated electric power use time M elapses.

When it is judged that the timer count is M ("Yes" at step S2014), the CPU 10*a* performs the opening-and-closing-circuit control processing P2 (step S2015). Consequently, the electric power inputted from the commercial power supply is supplied to the load. The load continuously performs the image forming operation and the CPU 10*a* supplies normal electric power to the fixing heaters (step S2016). The CPU 10*a* judges whether sheets of a number that should be discharged in one job have been discharged (step S2017). When it is judged that the sheets of the number that should be discharged in one job have not been discharged ("No" at step S2017), the CPU 10*a* returns to step S2016 and continues the image forming operation. When it is judged that the sheets of the number that should be discharged in one job have been discharged ("Yes" at step S2017), the CPU 10*a* acquires, from the power use table T2, post-processing that requires supply of electric power (step S2018).

The CPU 10*a* judges whether supply of electric power is necessary for the post-processing to be carried out (step S2019). When it is judged that supply of electric power is necessary for the post-processing ("Yes" at step S2019), the CPU 10*a* performs the opening-and-closing-circuit control processing P1 (step S2020). Consequently, electric power accumulated in the capacitor bank 9 is supplied to the constant-voltage generating circuit 13. It is possible to increase an output of a DC power supply. For example, supply of electric power is performed when a binding operation of staple processing is performed as the post-processing. A post-processing peripheral apparatus supplied with the electric power carries out a post-processing operation (step S2021). Thereafter, the CPU 10*a* returns to step S2001. When it is judged that supply of electric power is not necessary for the post-processing ("No" at step S2019), since the copy operation has been finished, the CPU 10*a* returns to step S2001.

Figure 6D:
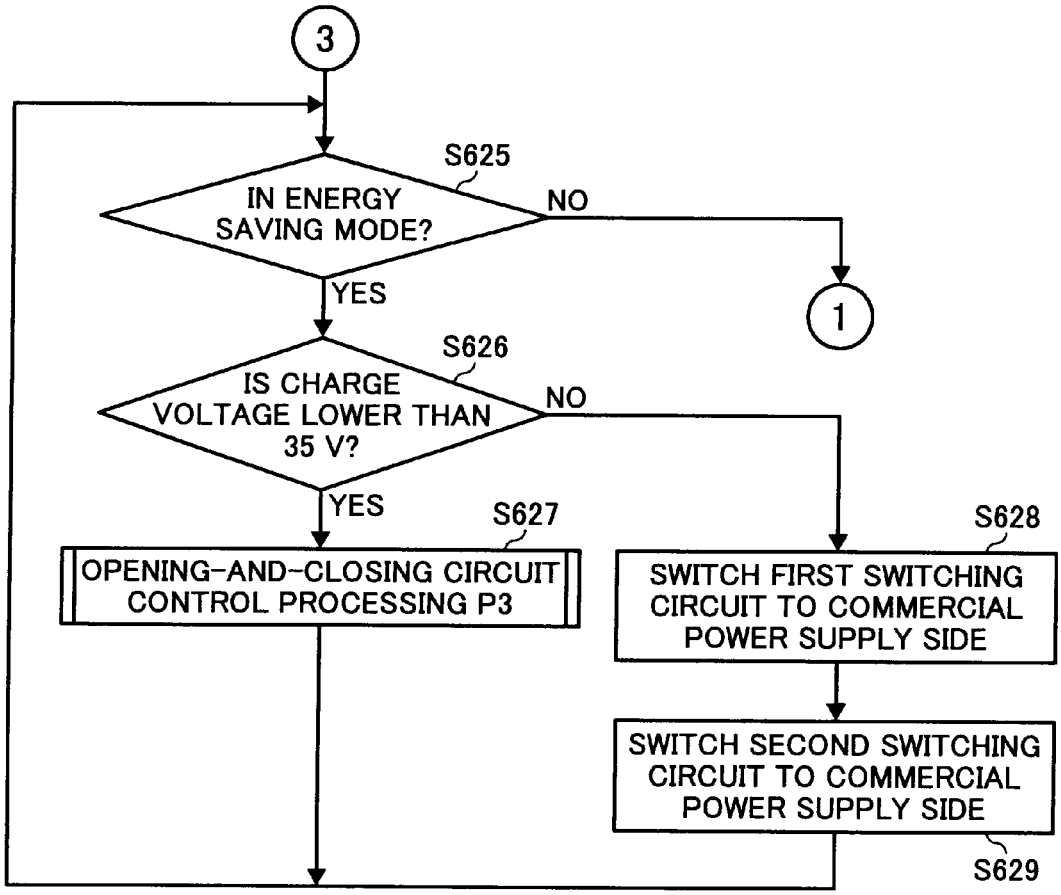
FIG. 6D is a flowchart of the procedure of the operation mode control processing performed by the engine control unit of the image forming apparatus according to the first embodiment.

When it is judged at step S2006 that the image forming apparatus is not performing the copy operation ("No" at step S2006) or when it is judged at step S2009 that the job has not been finished ("No" at step S2009), a procedure of the processing is substantially the same as that of steps S625 to S628 of the flowcharts in FIG. 6D. Thus, the explanation with reference to FIG. 6D is referred to. An explanation of the procedure is omitted here and only differences are explained below.

In this embodiment, processing for transmitting a step-down output stop signal is performed instead of steps S628 and S629.

Figure 21:
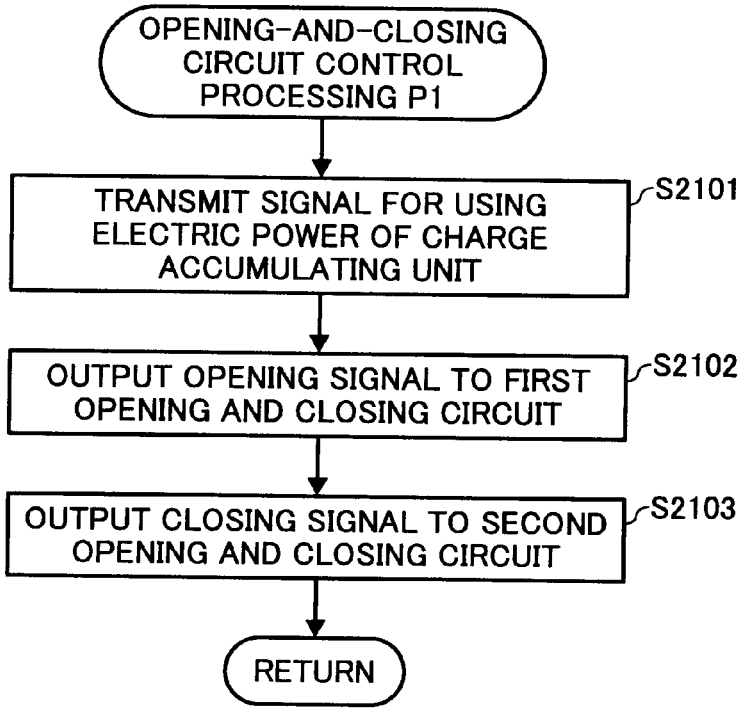
FIG. 21 is a flowchart of a procedure of opening-and-closing-circuit control processing P1 performed by the engine control unit of the image forming apparatus according to the third embodiment.

The opening-and-closing-circuit control processing P1 in the flowcharts shown in FIGS. 6A to 6D is replaced with opening-and-closing-circuit control processing P1 shown in FIG. 21. The opening-and-closing-circuit control processing P2 is replaced with opening-and-closing-circuit control processing P2 shown in FIG. 22. The opening-and-closing-circuit control processing P3 is replaced with opening-and-closing-circuit control processing P3 shown in FIG. 23.

FIG. 21 is a flowchart of a procedure of the opening-and-closing-circuit control processing P1 performed by the engine control unit of the image forming apparatus. According to this processing, the constant-voltage generating circuit 13 generates a constant voltage using accumulated electric power of the capacitor bank 9 and supplies electric power to the load.

The CPU 10*a* transmits a signal for using electric power of the charge accumulating unit to the CPU 7*a* of the step-down-output control and charge control circuit 7 (step S2101). The CPU 10*a* outputs an opening signal to the first opening and closing circuit from the port 6 (step S2102) and outputs a closing signal to the second opening and closing circuit from the port 5 (step S2103).

Figure 22:
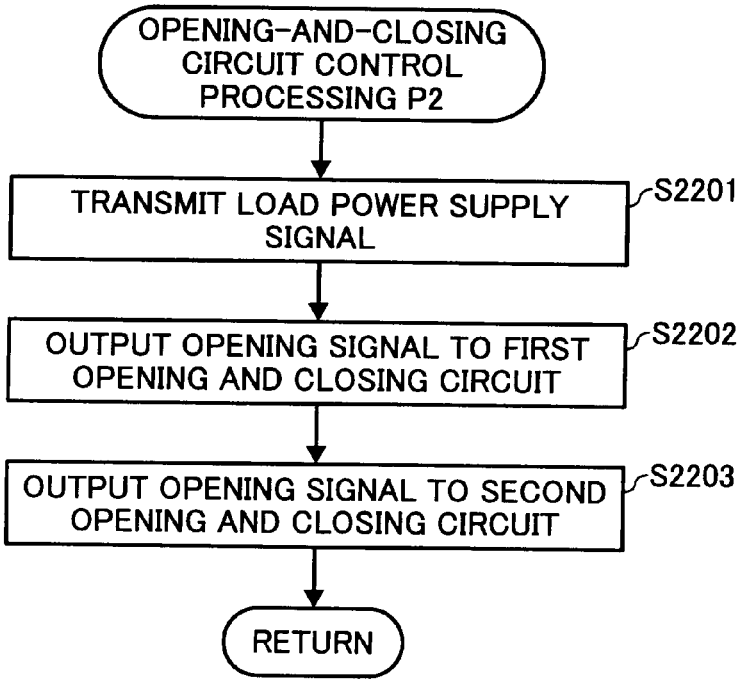
FIG. 22 is a flowchart of a procedure of opening-and-closing-circuit control processing P2 performed by the engine control unit of the image forming apparatus according to the third embodiment.

FIG. 22 is a flowchart of a procedure of the opening-and-closing-circuit control processing P2 performed by the engine control unit of the image forming apparatus. According to this processing, the constant-voltage generating circuit 13 generates a constant voltage using a voltage outputted from the commercial power supply and supplies electric power to the load.

The CPU 10*a* transmits a load power supply signal to the CPU 7*a* of the step-down-output control and charge control circuit 7 (step S2201). The CPU 10*a* outputs an opening signal to the first opening and closing circuit from the port 6 (step S2202). The CPU 10*a* outputs an opening signal to the second opening and closing circuit from the port 5 (step S2203).

Figure 23:
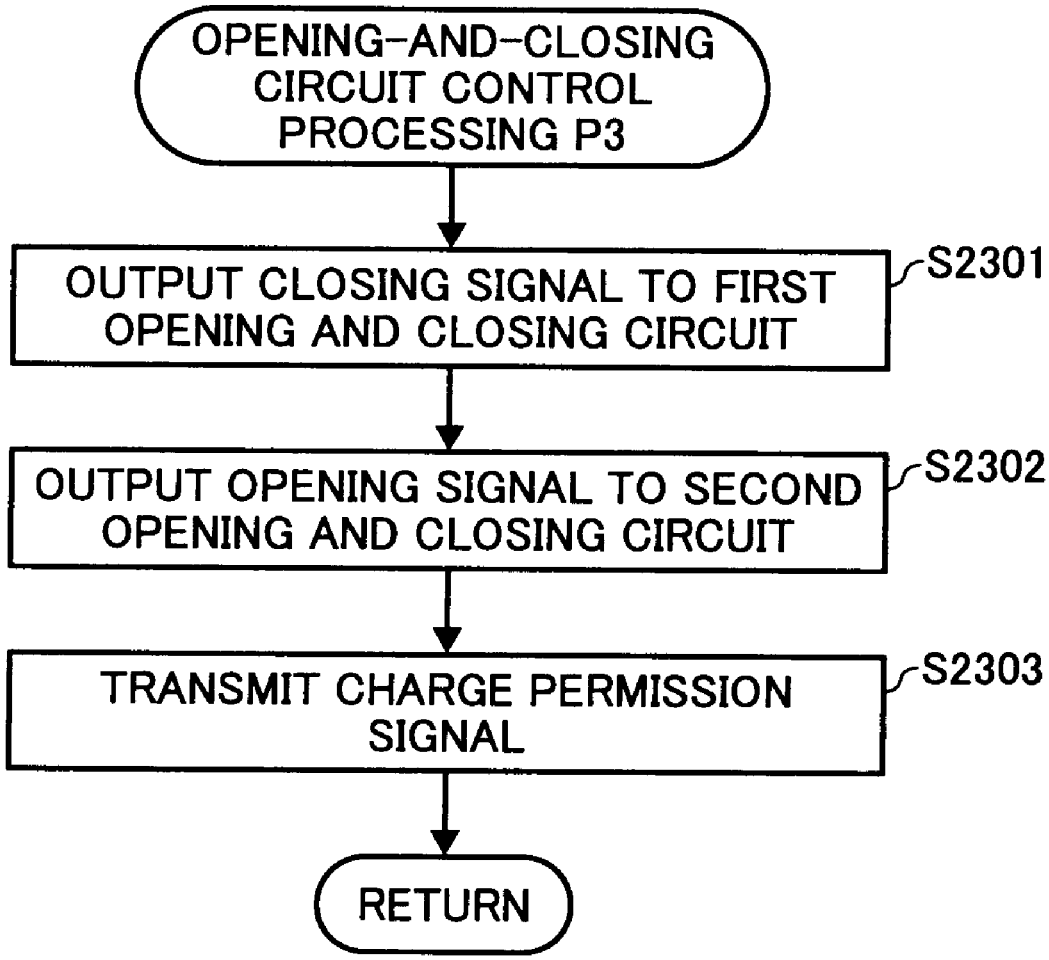
FIG. 23 is a flowchart of a procedure of opening-and-closing-circuit control processing P3 performed by the engine control unit of the image forming apparatus according to the third embodiment.

FIG. 23 is a flowchart of a procedure of the opening-and-closing-circuit control processing P3 performed by the engine control unit of the image forming apparatus. According to this processing, a voltage outputted from the commercial power supply is stepped down and the charge accumulating unit is charged with the step-down voltage.

The CPU 10*a* outputs a closing signal to the first opening and closing circuit from the port 6 (step S2301) and outputs an opening signal to the second opening and closing circuit from the port 5 (step S2302). The CPU 10*a* transmits a charge permission signal to the CPU 7*a* of the step-down-output control and charge control circuit 7 (step S2303).

As described above, in this embodiment, it is possible to simplify the opening and closing circuits and electric power is always supplied to the load. Since an output of the step-down chopper circuit 50 is reduced at the time of discharge, it is possible to automatically switch the input of the constant-voltage generating circuit 13 to the step-down chopper circuit 50 side when a voltage at the capacitor bank 9 falls because of discharge. In other words, when a voltage at the capacitor bank 9 is discharged (supplied to the constant-voltage generating circuit 13 via the second opening and closing circuit 43), the step-down-output control and charge control circuit 7 according to this embodiment outputs a PWM signal for lowering a voltage to an input voltage, which allows the constant-voltage generating circuit 13 to generate a rated voltage, to the gate of the FET 51 of the step-down chopper circuit 50. Consequently, when the capacitor bank 9 starts discharge and a voltage falls to the input voltage, which allows the constant-voltage generating circuit 13 to generate a rated voltage, the input of the constant-voltage generating circuit 13 automatically switches to the step-down chopper circuit 50 side.

An engine power supply unit of an image forming apparatus according to a fourth embodiment of the present invention charges a charge accumulating unit with a voltage outputted from the commercial power supply using a charging circuit and changes a voltage outputted from the commercial power supply and a voltage outputted from the charge accumulating unit to constant voltages with a constant-voltage generating circuit to supply the voltages to load. The fourth embodiment is different from the first embodiment in that a step-down circuit is not provided and the charge accumulating unit is charged by the charging circuit.

Figure 24:
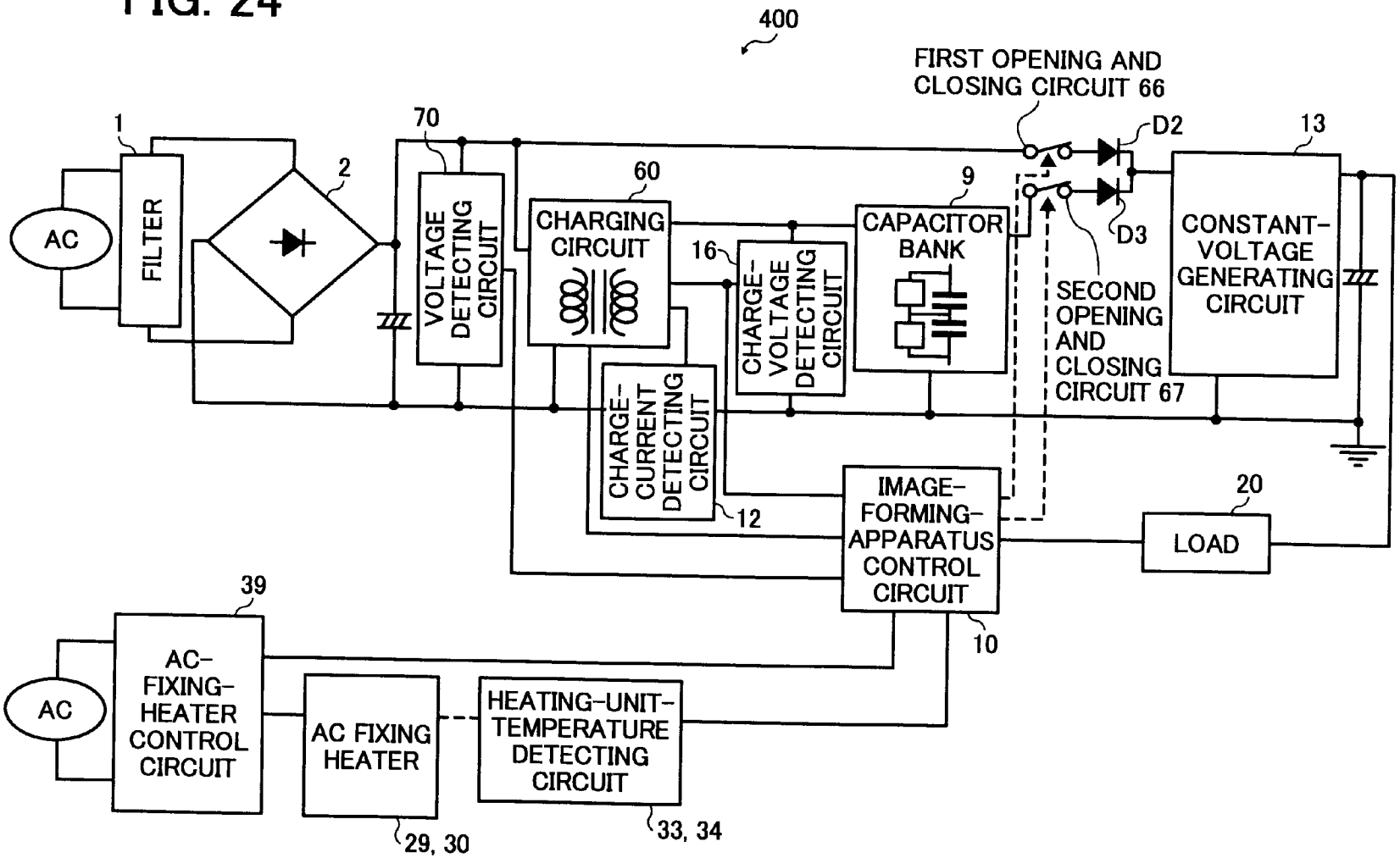
FIG. 24 is a circuit diagram of a circuit configuration of an engine power supply unit of a printer according to a fourth embodiment of the present invention.
Figures 25, 25A, 25B:
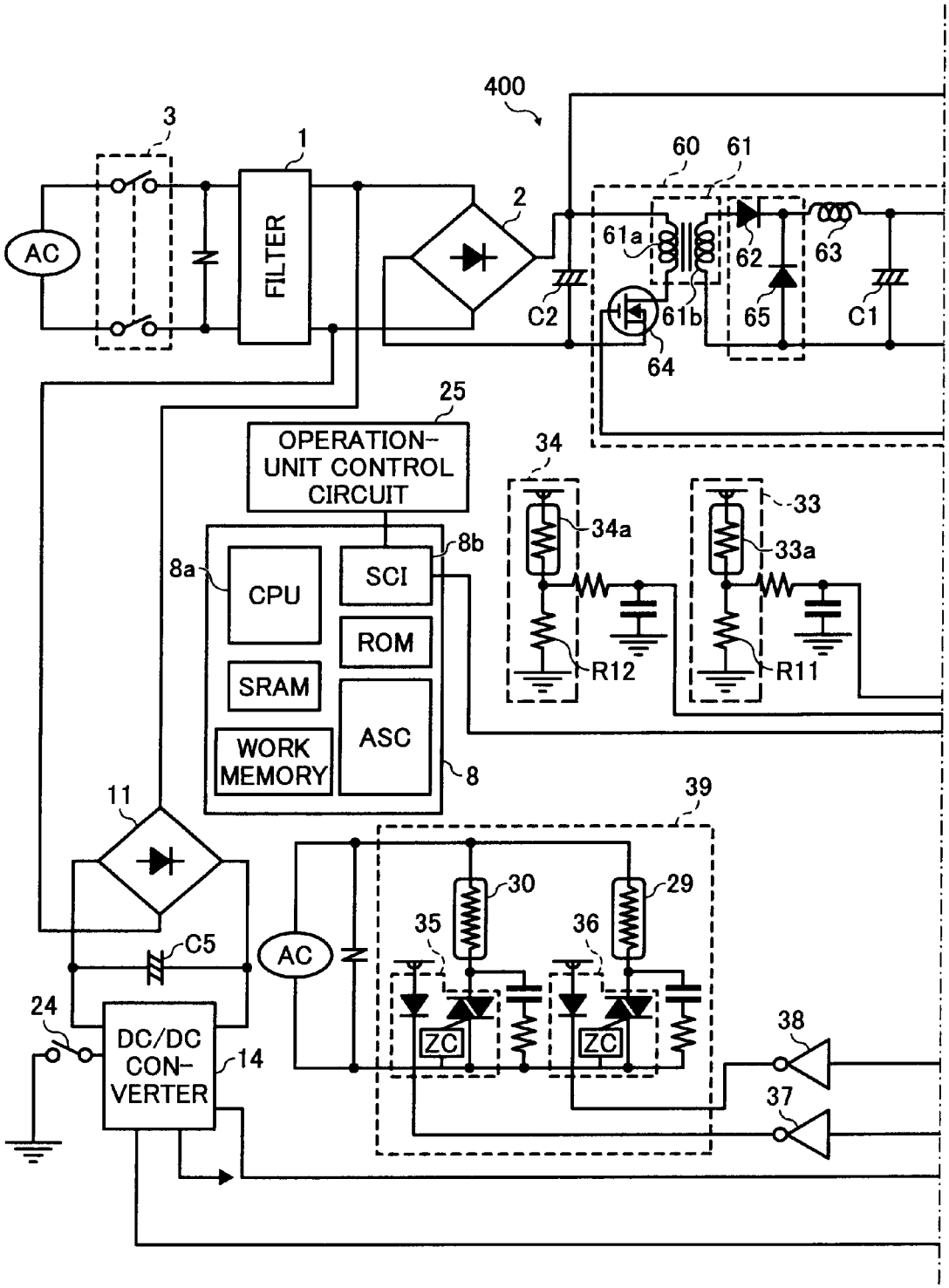
FIG. 25 is a detailed circuit diagram of a detailed circuit configuration of the engine power supply unit of the printer according to the fourth embodiment.
Figure 25B:
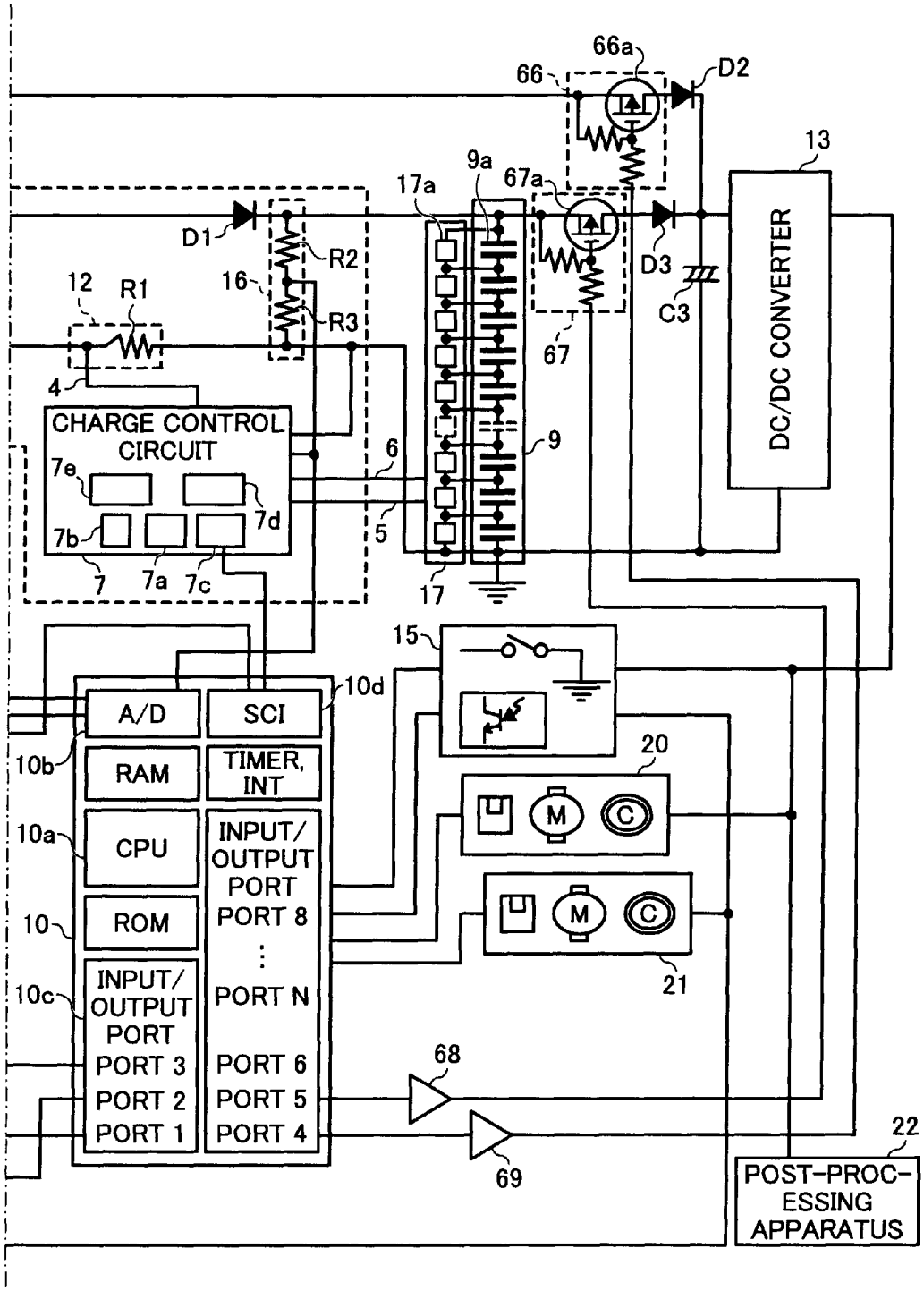

Concerning an example of a structure of an engine power supply unit 400 to which the present invention is applied, differences from the first embodiment are explained. Explanations of components identical with those in the first embodiment are omitted. FIG. 24 is a circuit diagram of a circuit configuration of an engine power supply unit of a printer according to the fourth embodiment. FIG. 25 is a detailed circuit diagram of a detailed circuit configuration of the engine power supply unit of the printer according to the fourth embodiment.

The engine power supply unit 400 of the printer according to this embodiment includes the filter 1, the full-wave rectifying circuit 2, a voltage detecting circuit 70, a charging circuit 60, the capacitor bank 9, the charge-voltage detecting circuit 16, the constant-voltage generating circuit 13, the charge-current detecting circuit 12, the engine control unit 10, the step-down-output control and charge control circuit 7, the load 20, the AC fixing heaters 29 and 30, the heating-unit-temperature detecting circuits 33 and 34, the AC-fixing-heater control circuit 39, a first opening and closing circuit 66, and a second opening and closing circuit 67.

Structures and functions of the filter 1, the full-wave rectifying circuit 2, the capacitor bank 9, the charge-voltage detecting circuit 16, the constant-voltage generating circuit 13, the charge-current detecting circuit 12, the engine control unit 10, the step-down-output control and charge control circuit 7, the load 20, the AC fixing heaters 29 and 30, the heating-unit-temperature detecting circuits 33 and 34, and the AC-fixing-heater control circuit 39 are the same as those in the first embodiment. Thus, explanations of the structures and the functions are omitted here The charging circuit 60 charges the capacitor bank 9. The charging circuit 60 includes, as shown in FIG. 25, the charge-voltage detecting circuit 16 and the step-down-output control and charge control circuit 7.

The charge circuit 60 is connected to input a DC voltage outputted from the full-wave rectifying circuit 2 to a primary coil 61*a* of a high-frequency transformer 61 arranged in parallel with the smoothing capacitor C2. A FET 64 as switching means is connected to the primary coil 61*a* in series. In a switching circuit including the FET 64, when the FET 64 is switched (on and off) by a PWM signal outputted from the PWM-signal generating circuit 7*e* of the step-down-output control and charge control circuit 7, a switching current flows to the primary coil 61*a*.

A switching voltage is induced in a secondary coil 61*b* of the transformer 61 by the switching current on the primary side. If a conduction period of this switching frequency is changed, it is possible to control an output voltage. Diodes 62 and 65 are connected to the secondary coil 61*b* of the transformer 61 as a rectifying circuit. The switching voltage is rectified by the rectifying circuit, smoothed by a choke coil 63 and the capacitor C1, and converted into a DC output. This DC output is supplied to the capacitor bank 9 via a diode D1. The smoothed DC voltage is supplied to the constant-voltage generating circuit 13 (a DC/DC converter) via the first opening and closing circuit 66 (a FET 66*a*). This charge voltage is monitored by the step-down-output control and charge control circuit 7 and controlled by changing an ON duty of a PWM signal with the PWM-signal generating circuit 7*e*.

The charge control circuit 7 detects a charge voltage at the capacitor bank 9, a charge current, and an operation of a bypass circuit and applies constant current charge or constant power charge to the capacitor bank 9. The charge control circuit 7 generates a PWM signal for applying constant current charge and constant power charge to the capacitor bank 9. The charge control circuit 7 includes the CPU 7*a*, the SIC 7*b*, the A/D converter 7*c*, the charge-current detecting circuit 7*d*, the PWM-signal generating circuit 7*e*, a ROM, a RAM, a timer, an interrupt control circuit, and an input/output port.

The charge control circuit 7 detects an inter-terminal voltage at the capacitor bank 9 according to an output of the charge-voltage detecting circuit 16. When the inter-terminal voltage at the capacitor bank 9 is lower than a value set in advance, the step-down-output control and charge control circuit 7 detects inter-terminal voltages at the resistor R1 connected to the capacitor bank 9 in series one by one. To perform constant current charge, the step-down-output control and charge control circuit 7 outputs a PWM signal set in advance in association with the inter-terminal voltage to a gate of the FET 64. The PWM signal for performing constant current charge may be obtained using a table created in advance based on a relation between the inter-terminal voltage at the resistor R1 and the ON duty of the PWM signal. Alternatively, the PWM signal may be calculated by an arithmetic operation.

The charge control circuit 7 may control the PWM signal with reference to only a charge current to obtain a charge current set in advance. When the capacitor bank 9 is not charged, to prevent a large rush current from flowing to the capacitor bank 9, the step-down-output control and charge control circuit 7 may output the PWM signal to set the charge voltage low and gradually increase the charge voltage. When the inter-terminal voltage at the capacitor bank 9 is equal to or higher than the value set in advance, to perform constant power charge, the step-down-output control and charge control circuit 7 detects charge currents of the capacitor bank 9 and inter-terminal voltages at the capacitor bank 9 one by one. The charge control circuit 7 outputs a PWM signal for performing constant power charge set in advance based on the charge currents and the charge voltages detected to the gate of the FET 64. The PWM signal is determined by detecting a charge current of the capacitor bank 9 and an inter-terminal voltage at the capacitor bank 9 and calculating a PWM signal for performing constant power charge set in advance based on the charge current and the charge voltage detected.

When the step-down-output control and charge control circuit 7 detects any one of the single-cell full-charge signals 5, the step-down-output control and charge control circuit 7 outputs the PWM signal for performing constant current charge set in advance to the gate of the FET 64 again. When the step-down-output control and charge control circuit 7 detects full-charge signals 6 of all the capacitor cells, the step-down-output control and charge control circuit 7 outputs a signal for stopping the charge operation to the gate of the FET 64.

In the capacitor bank 9 according to this embodiment, thirty-six capacitor cells (electric double layer capacitor cells, each of which has 2.5 volts when fully charged, are connected in series. Therefore, when the sixteen capacitor cells are fully charged, a voltage at 90 volts is accumulated. The accumulated electric power of the capacitor bank 9 is supplied to the constant-voltage generating circuit 13 via the second opening and closing circuit 67.

The first opening and closing circuit 66 and the second opening and closing circuit 67 include FETs. The CPU 10*a* performs ON/OFF control for the FET 66*a* according to a signal from the port 4. The first opening and closing circuit 66 (the FET 66*a*) is closed when a signal for turning on the FET 66*a* is outputted and is opened when a signal for turning off the FET 66*a* is outputted. ON/OFF and close or open of the second opening and closing circuit 67 (a FET 67*a*) are controlled according to a signal outputted from the port 5 of the CPU 10*a*.

When electric power is unnecessary, for example, at the time of standby or at the time of the energy saving mode, to charge the capacitor bank 9, the CPU 10*a* outputs a signal for turning off the FET 67*a* from the port 5 and outputs a signal for turning off the FET 66*a* or a signal for turning on the FET 66*a* from the port 4. When the FET 66*a* is turned ON, electric power is also supplied to the load side.

When electric power exceeds an AC power rating of the commercial power supply or when flicker occurs because of sudden fluctuation in a load on the image forming apparatus side, to use accumulated electric power in the capacitor bank 9, the CPU 10*a* outputs a signal for turning on the FET 67*a* from the port 5 and outputs a signal for turning OFF the FET 66*a* from the port 4.

To stop discharge at the normal time other than charge or discharge, the CPU 10*a* outputs a signal for turning off the FET 67*a* from the port 5 and outputs a signal for turning on the FET 66*a* from the port 4. Consequently, the commercial power supply is connected to the input of the constant-voltage generating circuit 13.

After the image forming operation is finished, since the image forming apparatus enters the energy saving mode when a fixed time elapses, the CPU 10*a* outputs a signal for stopping a part of power output to the DC/DC converter 14 from the port 2. When the energy saving release SW 24 (a platen open SW, an original detection SW of an ADF, etc.) is turned on, the energy saving mode is released and the DC/DC converter 14 returns to the normal operation. The CPU 10*a* also has a function of detecting fall of the commercial power supply by detecting a DC voltage at the commercial power supply, supplying accumulated electric power from the capacitor bank 9 by opening the first opening and closing circuit 66 and closing the second opening and closing circuit 67, and supplementing AC power with the electric power.

FIGS. 26A to 26D are flowcharts of a procedure of operation mode control processing performed by the engine control unit of the image forming apparatus.

When DC power is supplied according to power-on of the main power supply or release of the energy saving mode, the CPU 10*a* of the engine control unit 10 performs initial setting related to peripheral circuits of the engine control unit 10 and memories (step S2601). The CPU 10*a* judges, from a detection result of the charge-voltage detecting circuit 16, whether a charge voltage is 90 volts, i.e., whether the capacitor cells are in the full-charge state (step S2602). When it is judged that the capacitor cells are fully charged ("Yes" at step S2602), the CPU 10*a* performs the opening-and-closing-circuit control processing P1 (step S2603). Consequently, it is possible to stop supply of electric power from the commercial power supply and supply electric power accumulated in the capacitor bank 9 to the constant-voltage generating circuit 13. As a result, excess electric power is supplied to the heating unit of the fixing device (step S2604). When it is judged that the capacitor cells are not fully charged ("No" at step S2602), the CPU 10*a* proceeds to step S2604.

The CPU 10*a* judges from a result of detection by the charge-voltage detecting circuit 16 whether the charge voltage is equal to or higher than 60 volts (step S2605). When it is judged that the charge voltage is equal to or higher than 60 volts ("Yes" at step S2605), the CPU 10*a* judges that it is possible to use accumulated electric power and judges whether a heating unit temperature is equal to or higher than temperature set in advance (e.g., 175° C.) (step S2606). When it is judged that the heating unit temperature has not reached the temperature set in advance ("No" at step S2606), the CPU 10*a* returns to step S2604 and continues to supply the maximum electric power of the heater rating to the AC fixing heaters 29 and 30.

When it is judged that the heating unit temperature is equal to or higher than the temperature set in advance ("Yes" at step S2606) or when it is judged that the charge voltage at the capacitor bank 9 is lower than 60 volts ("No" at step S2605), the CPU 10*a* performs the opening-and-closing-circuit control processing P2 (step S2607). Consequently, electric power is supplied from the commercial power supply to the load.

The CPU 10*a* supplies electric power at the normal time set in advance to the AC fixing heaters 29 and 30 of the fixing device (step S2608). The CPU 10*a* judges whether the heating unit has a reload temperature (e.g., 180° C.) (step S2609). When it is judged that the heating unit does not have the reload temperature ("No" at step S2609), the CPU 10*a* returns to step S2608. The supply of electric power at the normal time set in advance to the AC fixing heaters 29 and 30 is continued. When it is judged that the heating unit has the reload temperature ("Yes" at step S2609), the fixing device comes into the standby state and the supply of electric power at the normal time set in advance is continued (step S2601).

The CPU 10*a* judges whether the fixing device is in the standby state again (step S2611). When it is judged that the fixing device is in the standby state ("Yes" at step S2611), the CPU 10*a* judges whether a charge voltage is lower than 90 volts, i.e., whether the capacitor cells are in the full-charge state (step S2612). When it is judged that the charge voltage is lower than 90 volts, i.e., the capacitor cells are not in the full-charge state ("Yes" at step S2612), the CPU 10*a* performs the opening-and-closing-circuit control processing P3 (step S2613). Consequently, the capacitor bank 9 is charged. Thereafter, the CPU 10*a* returns to step S2610. When it is judged that the charge voltage is not lower than 90 volts, i.e., the capacitor cells are fully charged ("No" at step S2612), the CPU 10*a* performs the opening-and-closing-circuit control processing P2 (step S2614). Consequently, electric power inputted from the commercial power supply is supplied to the load via the constant-voltage generating circuit 13. Thereafter, the CPU 1*a* returns to step S2610.

When it is judged at step S2611 that the fixing device is not in the standby state ("No" at step S2611), the CPU 10*a* judges whether the image forming apparatus is performing a copy operation (step S2615). When it is judged that the image forming apparatus is performing the copy operation ("Yes" at step S2615), the CPU 10*a* performs the opening-and-closing-circuit control processing P2 (step S2616). Consequently, electric power inputted from the commercial power supply is supplied to the load via the constant-voltage generating circuit 13. The load performs an image forming operation and normal electric power is supplied to the AC fixing heaters 29 and 30 (step S2617).

The CPU 10*a* judges whether a job has been finished (step S2618). When it is judged that the job has been finished ("Yes" at step S2618), the CPU 10*a* carries out processing of the energy saving mode described later. When it is judged that the job has not been finished ("No" at step S2618), the CPU 10*a* acquires, from the power use table T1, the number of copies N and an accumulated electric power use time M corresponding to a present sheet size with which use power is equal to or larger than normal electric power (step S2619).

The CPU 10*a* judges whether a present number of copies is N (step S2620). When it is judged that the present number of copies is not N ("No" at step S2620), the CPU 10*a* returns to step S2617 and the image forming operation is continued. When it is judged that the present number of copies is N ("Yes" at step S2620), to prevent the temperature of the heating unit from falling to be lower than a fixed image guarantee temperature, the CPU 10*a* performs the opening-and-closing-circuit control processing P1 (step S2621). Consequently, the supply of electric power from the commercial power supply is stopped. Moreover, electric power accumulated in the capacitor bank 9 is supplied to the constant-voltage generating circuit 13. It is possible to supply excess electric power to the heating unit of the fixing device. As a result, it is possible to supply maximum electric power of the heater rating to the AC fixing heaters 29 and 30.

The CPU 10*a* continues the state in which the maximum electric power is supplied to the AC fixing heaters 29 and 30 and continues the copy operation (step S2622). The temperature fall in the heating unit of the fixing device occurs because heat of a fixing pressure roller moves to a sheet when sheet supply is started. Therefore, when this pressure roller is warmed, the temperature fall is solved. The CPU 10*a* counts the accumulated electric power use time M, which is time until the pressure roller is warmed, with the timer (step S2623). When it is judged that a timer count is not M ("No" at step S2623), the CPU 10*a* returns to step S2622. The maximum electric power of the heater rating is supplied to the fixing heaters until the accumulated electric power use time M elapses.

When it is judged that the timer count is M ("Yes" at step S2623), the CPU 10*a* performs the opening-and-closing-circuit control processing P2 (step S2624). Consequently, the electric power inputted from the commercial power supply is supplied to the load. The load continuously performs the image forming operation and the CPU 10*a* supplies normal electric power to the fixing heaters (step S2625). The CPU 10*a* judges whether sheets of a number that should be discharged in one job have been discharged (step S2626). When it is judged that the sheets of the number that should be discharged in one job have not been discharged ("No" at step S2626), the CPU 10*a* returns to step S2625 and continues the image forming operation. When it is judged that the sheets of the number that should be discharged in one job have been discharged ("Yes" at step S2626), the CPU 10*a* acquires, from the power use table T2, post-processing that requires supply of electric power (step S2627).

The CPU 10*a* judges whether supply of electric power is necessary for the post-processing to be carried out (step S2628). When it is judged that supply of electric power is necessary for the post-processing ("Yes" at step S2628), the CPU 10*a* performs the opening-and-closing-circuit control processing P1 (step S2629). Consequently, electric power accumulated in the capacitor bank 9 is supplied to the constant-voltage generating circuit 13. It is possible to increase an output of a DC power supply. For example, electric power is supplied when a binding operation of staple processing is performed as the post-processing. A post-processing peripheral apparatus supplied with the electric power carries out a post-processing operation (step S2630). Thereafter, the CPU 10*a* returns to step S2610. When it is judged that supply of electric power is not necessary for the post-processing ("No" at step S2628), since the copy operation has been finished, the CPU 10*a* returns to step S2610.

When it is judged at step S2615 that the image forming apparatus is not performing the copy operation ("No" at step S2615) or when it is judged at step S2618 that the job has been finished ("Yes" at step S2618), the CPU 10*a* judges whether the image forming apparatus is in the energy saving mode (step S2631). When it is judge that the image forming apparatus is not in the energy saving mode ("No" at step S2631), the CPU 10*a* returns to step S2610. When it is judged that the image forming apparatus is in the energy saving mode ("Yes" at step S2631), the CPU 10*a* judges whether a charge voltage is lower than 35 volts, i.e., whether the capacitor cells are in the full-charge state (step S2632). When it is judged that the charge voltage is lower than 35 volts, i.e., the capacitor cells are not in the full-charge state ("Yes" at step S2632), to charge the capacitor bank 9, the CPU 10*a* performs the opening-and-closing-circuit control processing P3 (step S2633) and returns to step S2631. Although not shown in this flowchart, when this charge operation is finished, the image forming apparatus control unit also shifts to the energy saving mode. When it is judged that the charge voltage is not lower than 35 volts, i.e., the capacitor cells are in the full-charge state ("No" at step S2634), the CPU 10*a* returns to step S2631.

Figure 27:
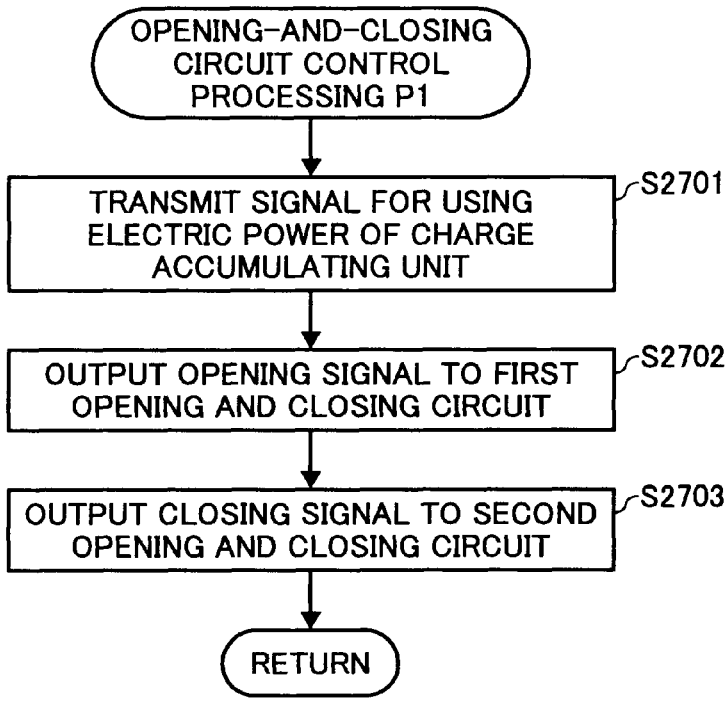
FIG. 27 is a flowchart of a procedure of opening-and-closing-circuit control processing P1 performed by the engine control unit of the image forming apparatus according to the fourth embodiment.

FIG. 27 is a flowchart of a procedure of the opening-and-closing-circuit control processing P1 performed by the engine control unit of the image forming apparatus. According to this processing, the constant-voltage generating circuit 13 performs constant voltage output control using the accumulated electric power of the capacitor bank 9.

The CPU 10*a* transmits a signal for using electric power of the charge accumulating unit (step S2701). The CPU 10*a* outputs a signal for opening the first opening and closing circuit (step S2702) and outputs a signal for closing the second opening and closing circuit (step S2703).

Figure 28:
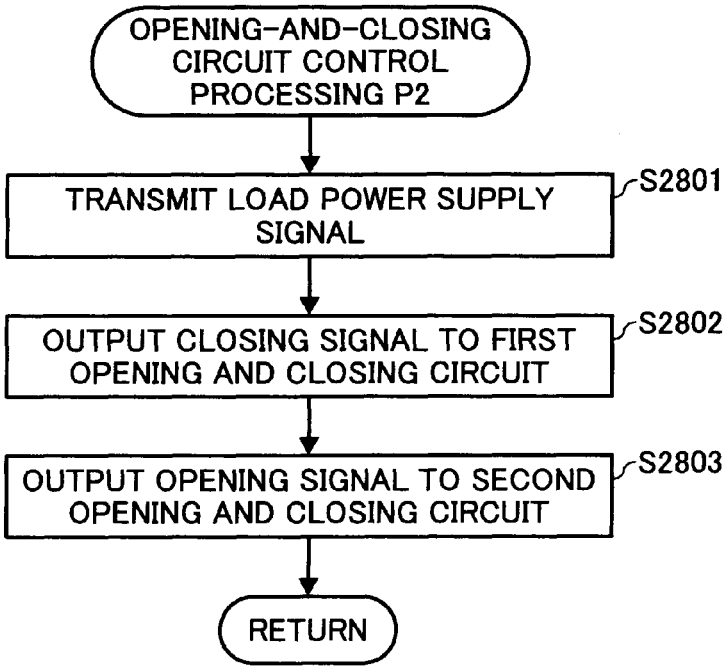
FIG. 28 is a flowchart of a procedure of opening-and-closing-circuit control processing P2 performed by the engine control unit of the image forming apparatus according to the fourth embodiment.

FIG. 28 is a flowchart of a procedure of the opening-and-closing-circuit control processing P2 performed by the engine control unit of the image forming apparatus. According to this processing, electric power is supplied to the load from the commercial power supply.

The CPU 10*a* transmits a signal for supplying electric power to the load (step S2801). The CPU 10*a* outputs a signal for closing the first opening and closing circuit (step S2802) and outputs a signal for opening the second opening and closing circuit (step S2803).

Figure 29:
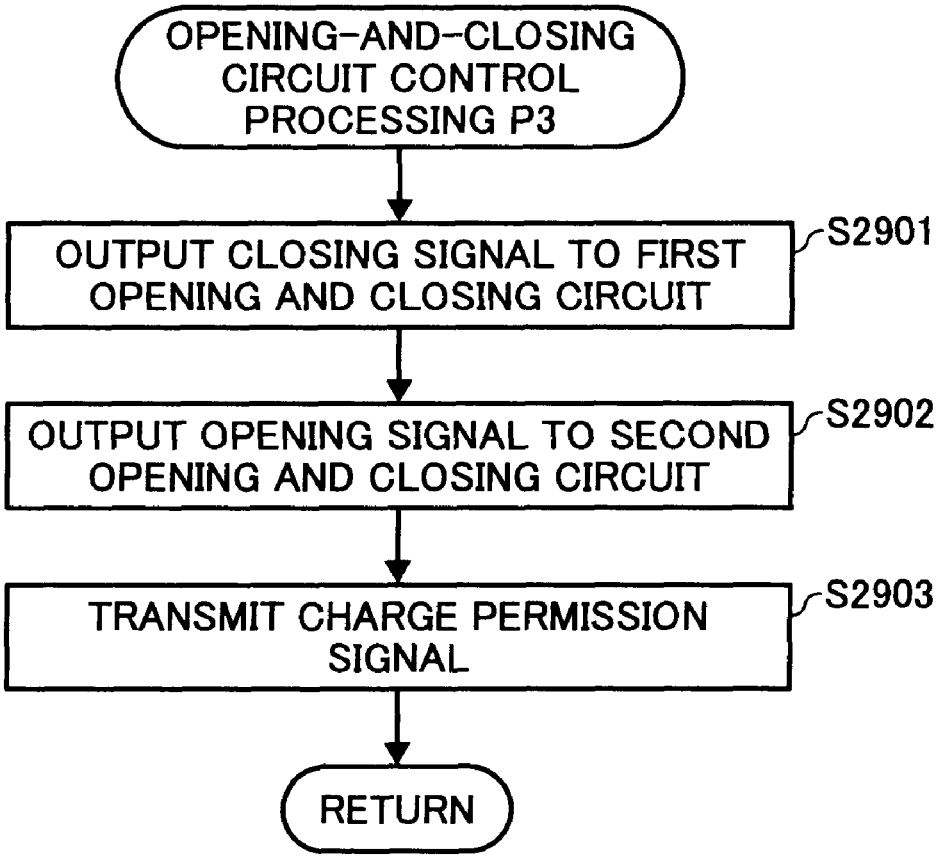
FIG. 29 is a flowchart of a procedure of opening-and-closing-circuit control processing P3 performed by the engine control unit of the image forming apparatus according to the fourth embodiment.

FIG. 29 is a flowchart of a procedure of the opening-and-closing-circuit control processing P3 performed by the engine control unit of the image forming apparatus. According to this processing, the capacitor bank 9 is charged.

The CPU 10*a* outputs a signal for closing the first opening and closing circuit (step S2901) and outputs a signal for opening the second opening and closing circuit (step S2902). The CPU 10*a* transmits a charge permission signal (step S2903).

Figure 30A:
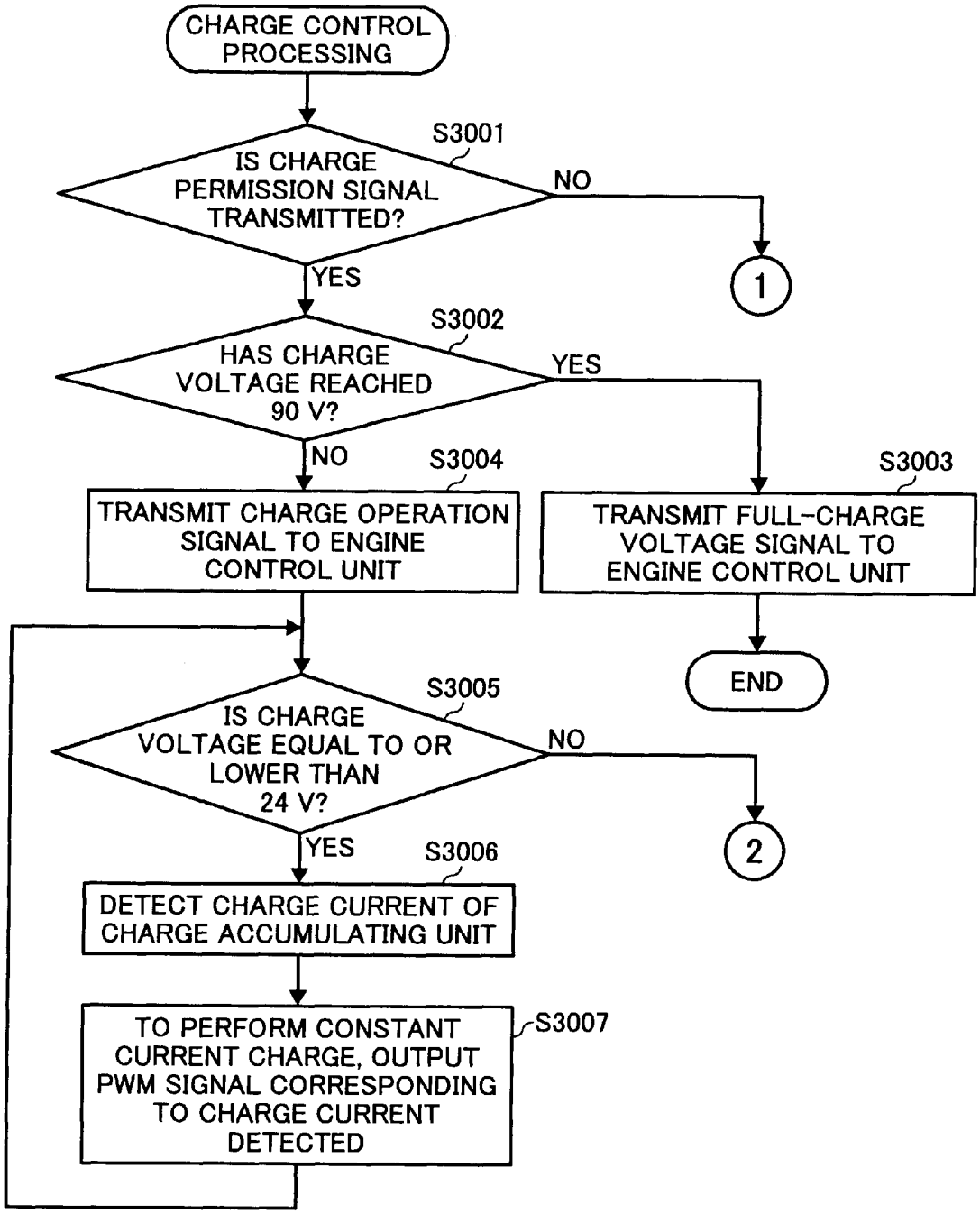
FIG. 30A is a flowchart of a procedure of charge processing performed by a charge control circuit of the image forming apparatus according to the fourth embodiment.
Figure 30B:
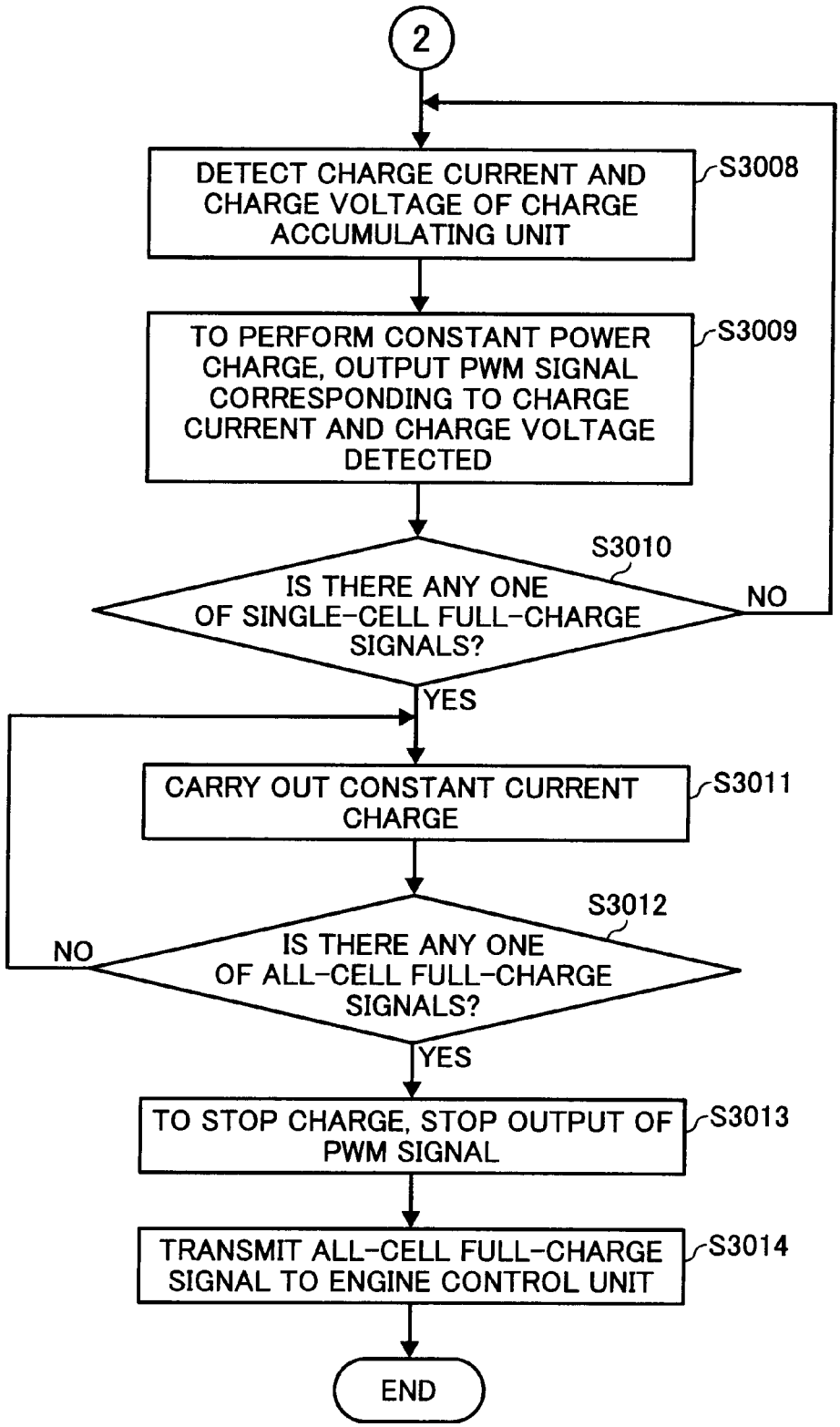
FIG. 30B is a flowchart of the procedure of the charge processing performed by the step-down-output control and charge control circuit of the image forming apparatus according to the fourth embodiment.

FIGS. 30A and 30B are flowcharts of a procedure of charge processing performed by the step-down-output control and charge control circuit of the image forming apparatus. According to this processing, the capacitor bank 9 is charged.

The charge control circuit 7 judges whether a charge permission signal is transmitted from the CPU 10*a* of the engine control unit 10 (step S3001). When it is judged that the charge permission signal is not transmitted ("No" at step S3001), the processing is finished. When it is judged that the charge permission signal is transmitted ("Yes" at step S3001), the step-down-output control and charge control circuit 7 judges whether a charge voltage has reached 90 volts (step S3002). Specifically, the step-down-output control and charge control circuit 7 checks the charge voltage from a result of detection by the charge-voltage detecting circuit 16 and judges whether the capacitor cells are in the full-charge state. When it is judged that the charge voltage has reached 90 volts ("Yes" at step S3002), since it is unnecessary to charge the charge accumulating unit, the step-down-output control and charge control circuit 7 transmits a full-charge voltage signal to the CPU 10*a* of the engine control unit 10 (step S3003) and finishes the processing.

When it is judged that the charge voltage has not reached 90 volts ("No" at step S3002), to perform a charge operation, the step-down-output control and charge control circuit 7 transmits a charge operation signal to the CPU 10*a* of the engine control unit 10 (step S3004). The charge control circuit 7 judges whether the charge voltage is equal to or lower than 24 volts (step S3005). When it is judged that the charge voltage is equal to or lower than 24 volts ("Yes" at step S3005), the step-down-output control and charge control circuit 7 detects a charge current of the charge accumulating unit, i.e., the capacitor bank 9 (step S3006). To perform constant current charge, the step-down-output control and charge control circuit 7 outputs a PWM signal corresponding to the charge current to the gate of the FET 64 (step S3007). Returning to step S3005, the step-down-output control and charge control circuit 7 judges whether the charge voltage is equal to or lower than 24 volts. When it is judged that the charge voltage is equal to or lower than 24 volts, the step-down-output control and charge control circuit 7 repeats the charge operation.

When it is judged at step S3005 that the charge voltage is not equal to or lower than 24 volts ("No" at step S3005), the step-down-output control and charge control circuit 7 detects a charge current and a charge voltage at the charge accumulating unit, i.e., the capacitor bank 9 (step S3008). To perform constant power charge, the step-down-output control and charge control circuit 7 outputs a PWM signal corresponding to the charge current and the charge voltage detected to the gate of the FET 64 (step S3009). The charge control circuit 7 judges whether there is any one of the single-cell full-charge signals (step S3010). When it is judged that there is no single-cell full-charge signal ("No" at step S3010), the CPU 10*a* returns to step S3008.

When it is judged that there is any one of the single-cell full-charge signal ("Yes" at step S3010), the step-down-output control and charge control circuit 7 carries out constant current charge (step S3011). The charge control circuit 7 judges whether there is an all-cell full-charge signal (step S3012). When it is judged that there is the all-cell full-charge signal ("Yes" at step S3012), to stop the charge operation, the step-down-output control and charge control circuit 7 outputs a PWM signal to the gate of the FET 64 (step S3013). The charge control circuit 7 transmits the all-cell full-charge signal to the CPU 10*a* (step S3014) and finishes the processing. When it is judged that there is no all-cell full-charge signal ("No" at step S3012), the CPU 10*a* returns to step S3011 and performs constant current charge.

In the circuit configuration according to this embodiment, it is possible to supply electric power to the load at the time of charge. It is also possible to isolate a power supply to the load when it is desired to reduce electric power as at the time of the energy saving mode. It is possible to reduce the number of capacitor cells in use connected in series by expanding a control input voltage range of a constant voltage power supply.

An engine power supply unit of an image forming apparatus according to a fifth embodiment of the present invention charges a charge accumulating unit with a voltage outputted from the commercial power supply using a charging circuit and changes a voltage outputted from the commercial power supply and a voltage outputted from the charge accumulating unit to constant voltages with a constant-voltage generating circuit to supply the voltages to load. The fifth embodiment is different from the fourth embodiment in that an opening and closing circuit is provided between a step-down circuit and a capacitor bank.

Figure 31:
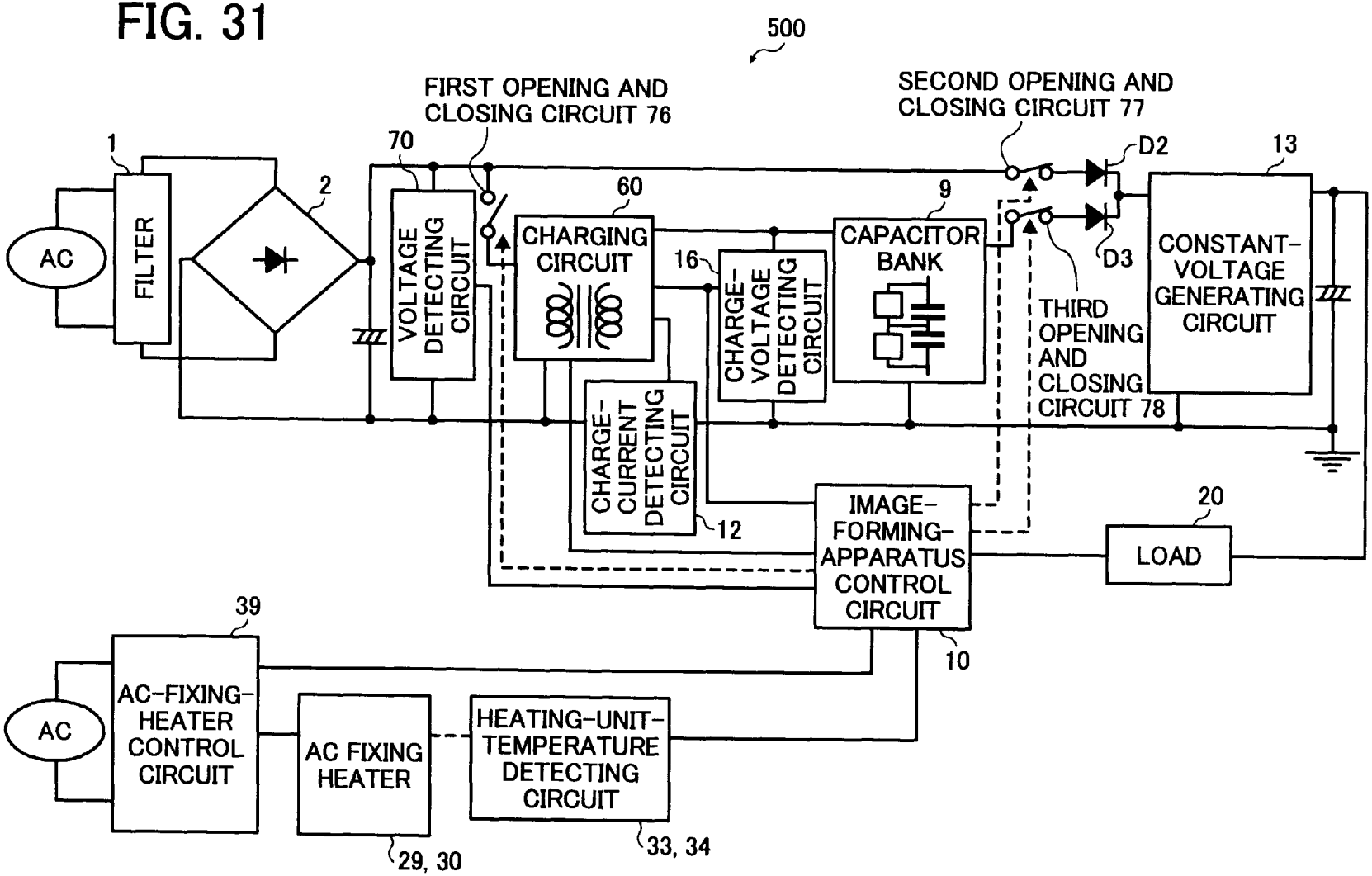
FIG. 31 is a circuit diagram of a circuit configuration of an engine power supply unit of a printer according to a fifth embodiment of the present invention.
Figure 32A:
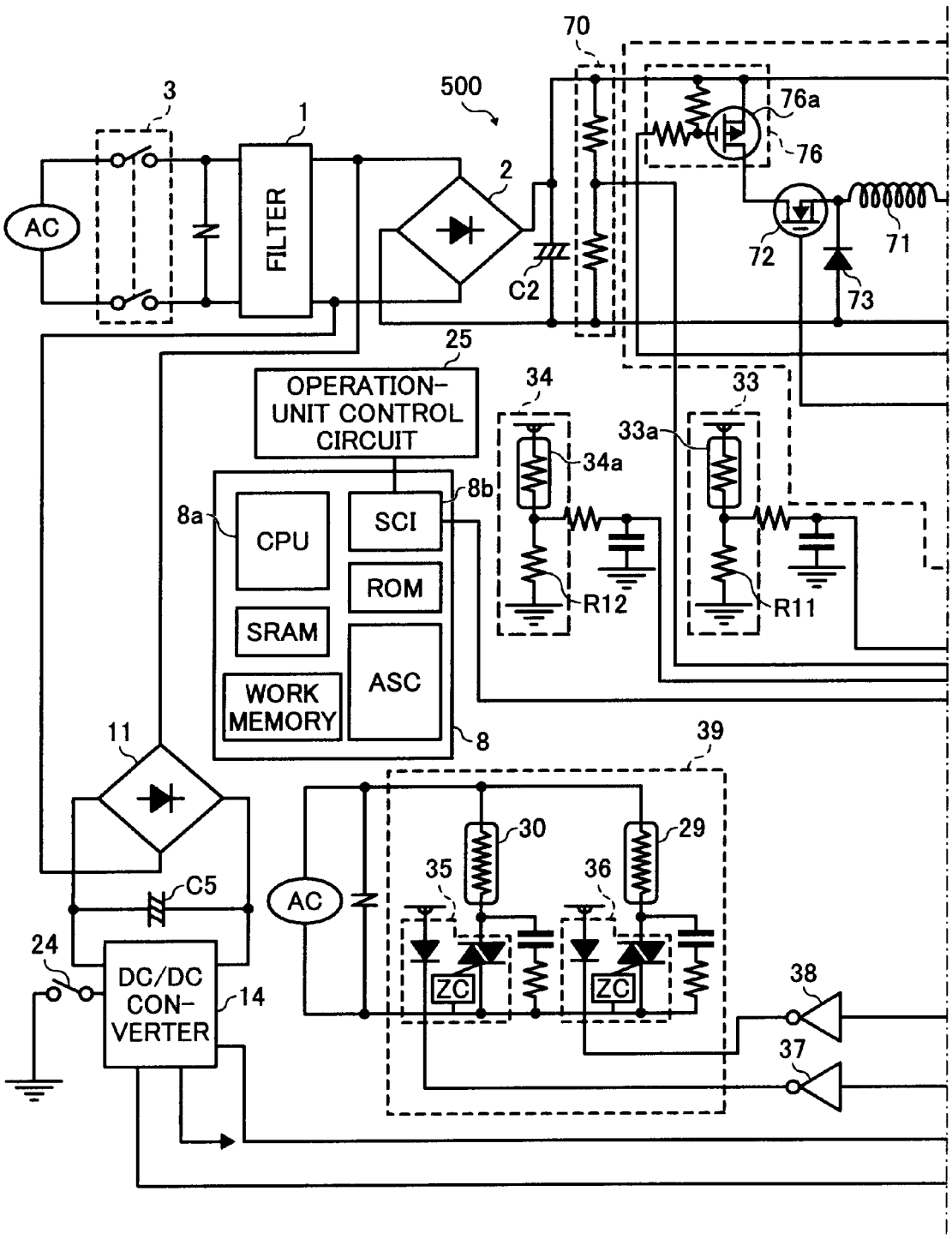
FIG. 32 is a detailed circuit diagram of a detailed circuit configuration of the engine power supply unit of the printer according to the fifth embodiment.
Figure 32B:
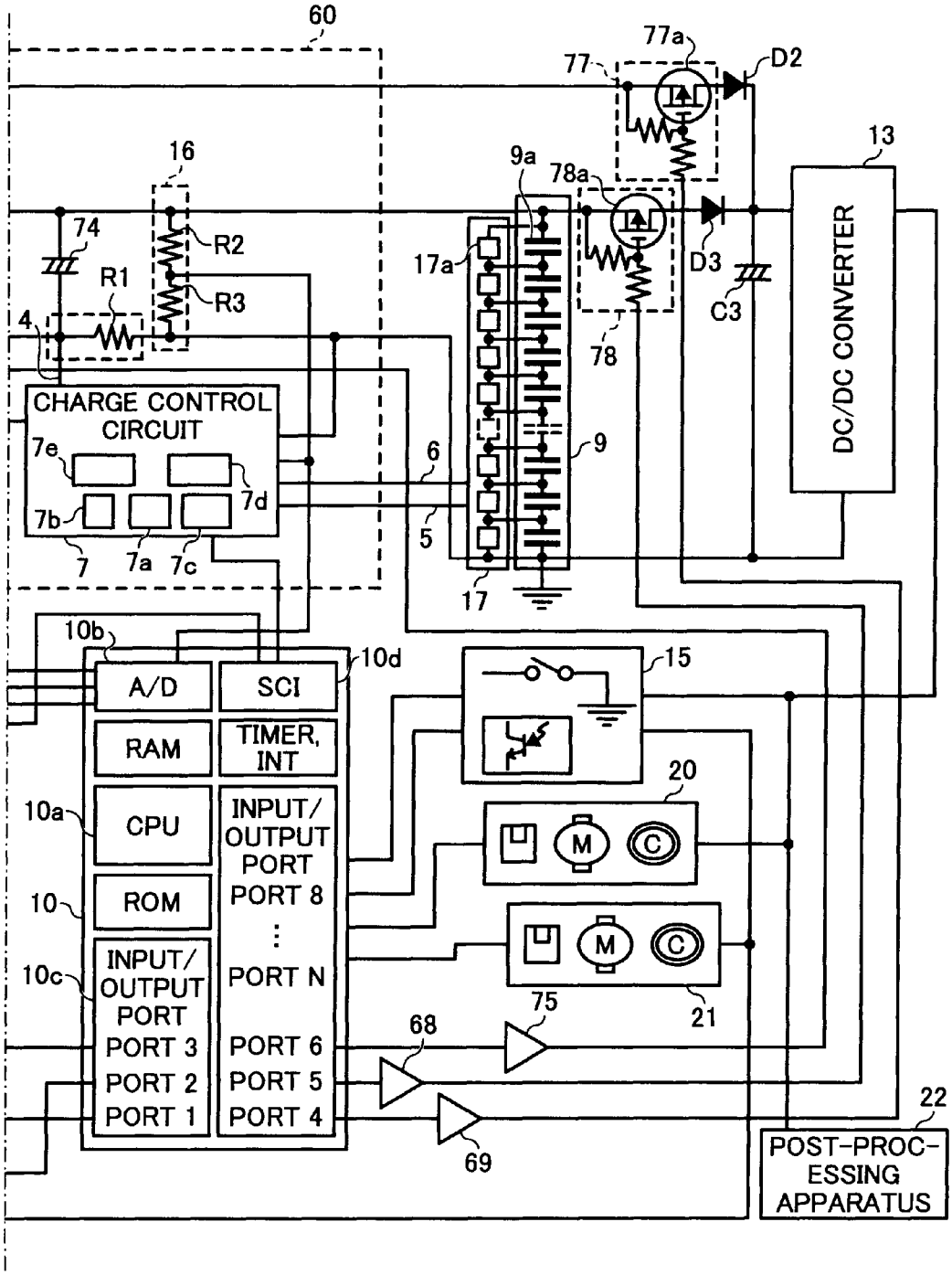

Concerning an example of a structure of an engine power supply unit 500 to which the present invention is applied, differences from the fourth embodiment are explained. Explanations of components identical with those in the fourth embodiment are omitted. FIG. 31 is a circuit diagram of a circuit configuration of an engine power supply unit of a printer according to the fifth embodiment. FIG. 32 is a detailed circuit diagram of a detailed circuit configuration of the engine power supply unit of the printer according to the fifth embodiment.

The engine power supply unit 500 of the printer according to this embodiment includes the filter 1, the full-wave rectifying circuit 2, the voltage detecting circuit 70, a charging circuit 60, the capacitor bank 9, the charge-voltage detecting circuit 16, the constant-voltage generating circuit 13, the charge-current detecting circuit 12, the engine control unit 10, the load 20, the AC fixing heaters 29 and 30, the heating-unit-temperature detecting circuits 33 and 34, the AC-fixing-heater control circuit 39, a first opening and closing circuit 76, a second opening and closing circuit 77, and a third opening and closing circuit 78.

Structures and functions of the filter 1, the full-wave rectifying circuit 2, the capacitor bank 9, the charge-voltage detecting circuit 16, the constant-voltage generating circuit 13, the charge-current detecting circuit 12, the engine control unit 10, the load 20, the AC fixing heaters 29 and 30, the heating-unit-temperature detecting circuits 33 and 34, and the AC-fixing-heater control circuit 39 are the same as those in the first and the fourth embodiments. Thus, explanations of the structures and the functions are omitted. The fifth embodiment is different from the fourth embodiment in that the first opening and closing circuit 76, the second opening and closing circuit 77, and the third opening and closing circuit 78 are provided instead of the first opening and closing circuit 66 and the second opening and closing circuit 67.

The first opening and closing circuit 76 opens and closes the connection between the commercial power supply and the charging circuit 60. The second opening and closing circuit 77 connects the commercial power supply and constant-voltage power supply unit. The third opening and closing circuit 78 opens and closes the connection between the capacitor bank 9 and the constant-voltage generating circuit 13. The constant-voltage generating circuit 13 uses an output of the second opening and closing circuit or the third opening and closing circuit as an input and generates a constant voltage.

When the capacitor bank 9 is charged, the CPU 10*a* closes the first opening and closing circuit 76 (turns on a FET 76*a*), closes the second opening and closing circuit 77 (turns off a FET 77*a*) or closes the second opening and closing circuit 77 (turns on the FET 77*a*), and opens the third opening and closing circuit 78 (turns off a FET 78*a*). By closing the second opening and closing circuit 77 in this way, it is possible to supply a voltage to the constant-voltage generating circuit 13 even at the time of charge. In charging the charge accumulating unit when it is unnecessary to supply electric power to the load, for example, at the time of the energy saving mode, it is possible to reduce electric power by opening the second opening and closing circuit 77.

When electric power of the capacitor bank 9 is used, the CPU 10*a* opens the first opening and closing circuit 76 (turns off the FET 76*a*), opens the second opening and closing circuit 77 (turns off the FET 77*a*), and closes the third opening and closing circuit 78 (turns on the FET 78*a*).

When electric power is supplied from the commercial power supply to the constant-voltage generating circuit 13, the CPU 10*a* opens the first opening and closing circuit 76 (turns off the FET 76*a*), closes the second opening and closing circuit 77 (turns on the FET 77*a*), and opens the third opening and closing circuit 78 (turns off the FET 78*a*). When the third opening and closing circuit 78 is opened, electric power is continuously supplied to the constant-voltage generating circuit 13 if the second opening and closing circuit 77 is closed and then the third opening and closing circuit 78 is opened. When the second opening and closing circuit 77 is opened, electric power is continuously supplied to the constant-voltage generating circuit 13 if the third opening and closing circuit 78 is closed and then the second opening and closing circuit 77 is opened.

Figure 33A:
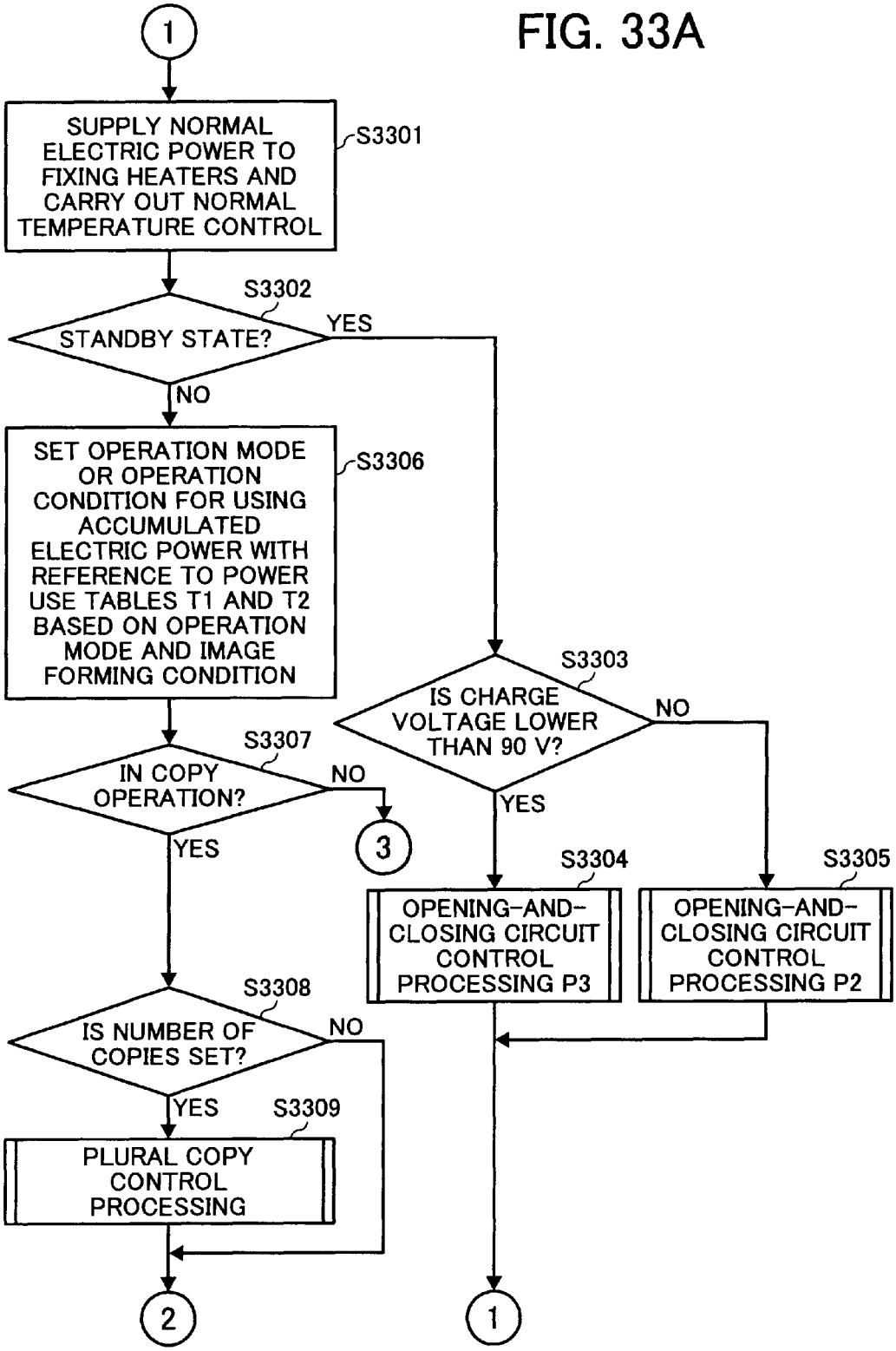
FIG. 33A is a flowchart of a procedure of operation mode control processing performed by an engine control unit of an image forming apparatus according to the fifth embodiment.
Figure 33B:
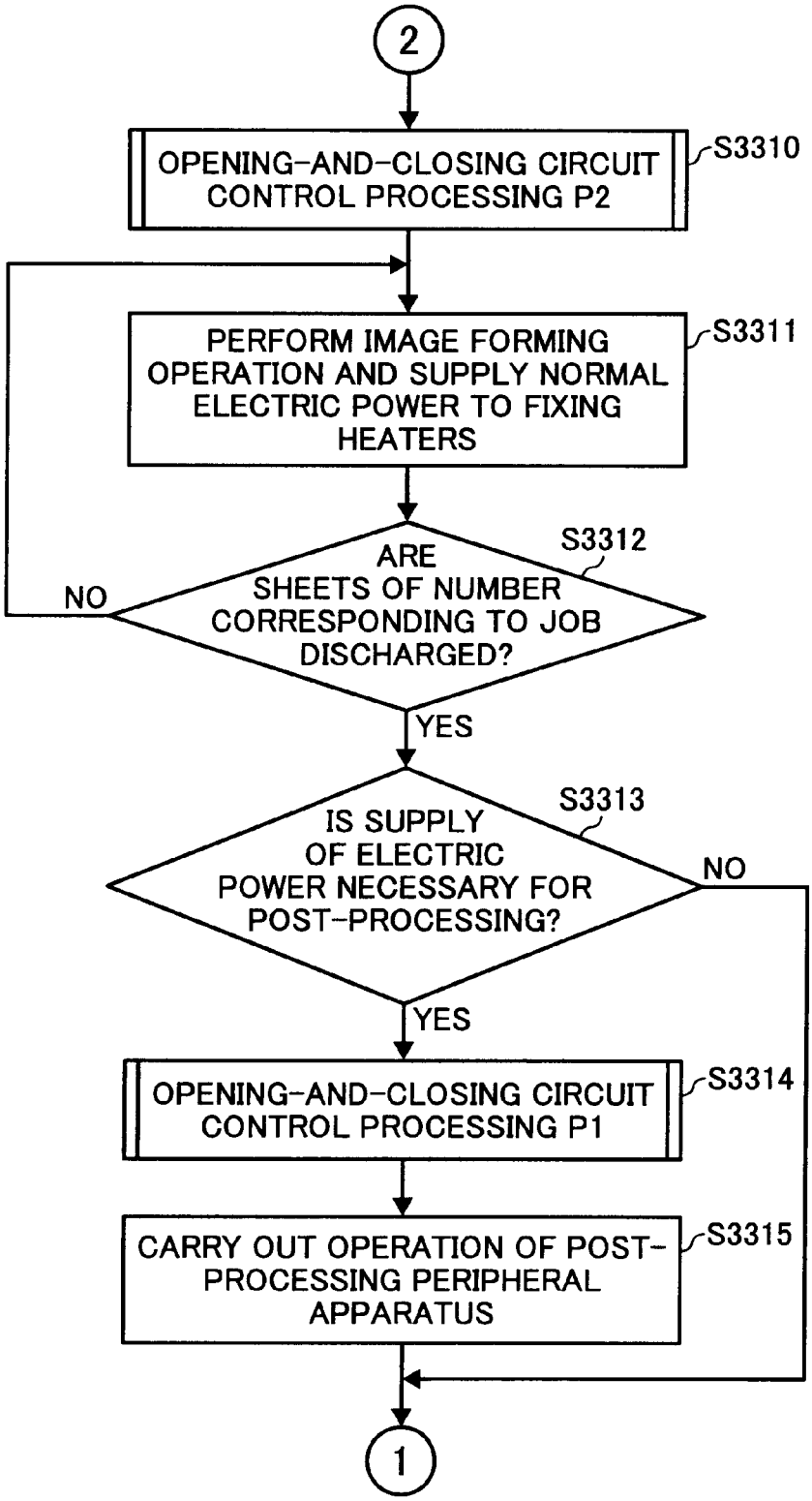
FIG. 33B is a flowchart of the procedure of the operation mode control processing performed by the engine control unit of the image forming apparatus according to the fifth embodiment.

FIGS. 33A and 33B are flowcharts of a procedure of operation mode control processing performed by the engine control unit of the image forming apparatus.

Figure 26A:
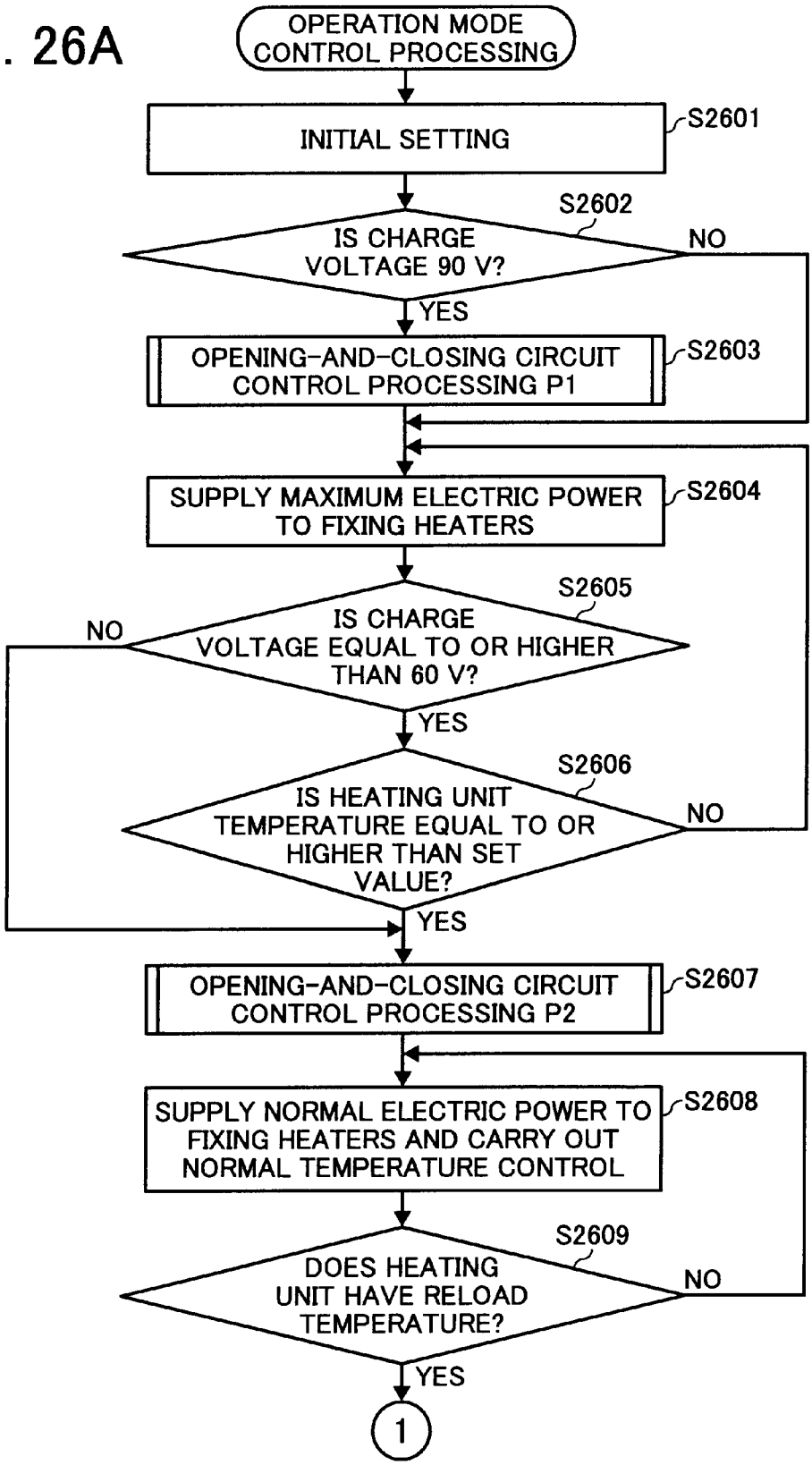
FIG. 26A is a flowchart of a procedure of operation mode control processing performed by an engine control unit of an image forming apparatus according to the fourth embodiment.
Figure 26B:
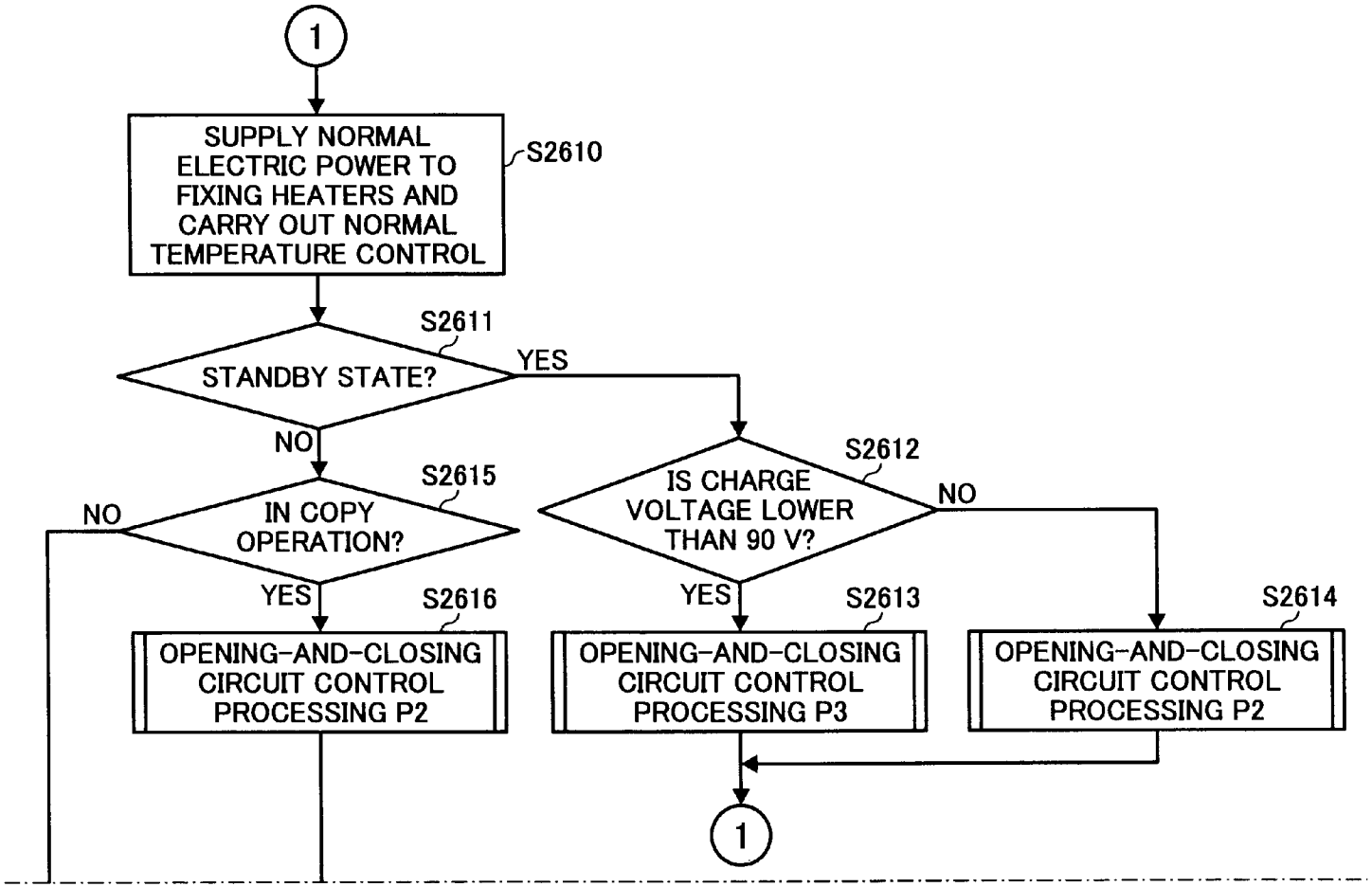
FIG. 26B is a flowchart of the procedure of the operation mode control processing performed by the engine control unit of the image forming apparatus according to the fourth embodiment.
Figure 26B:
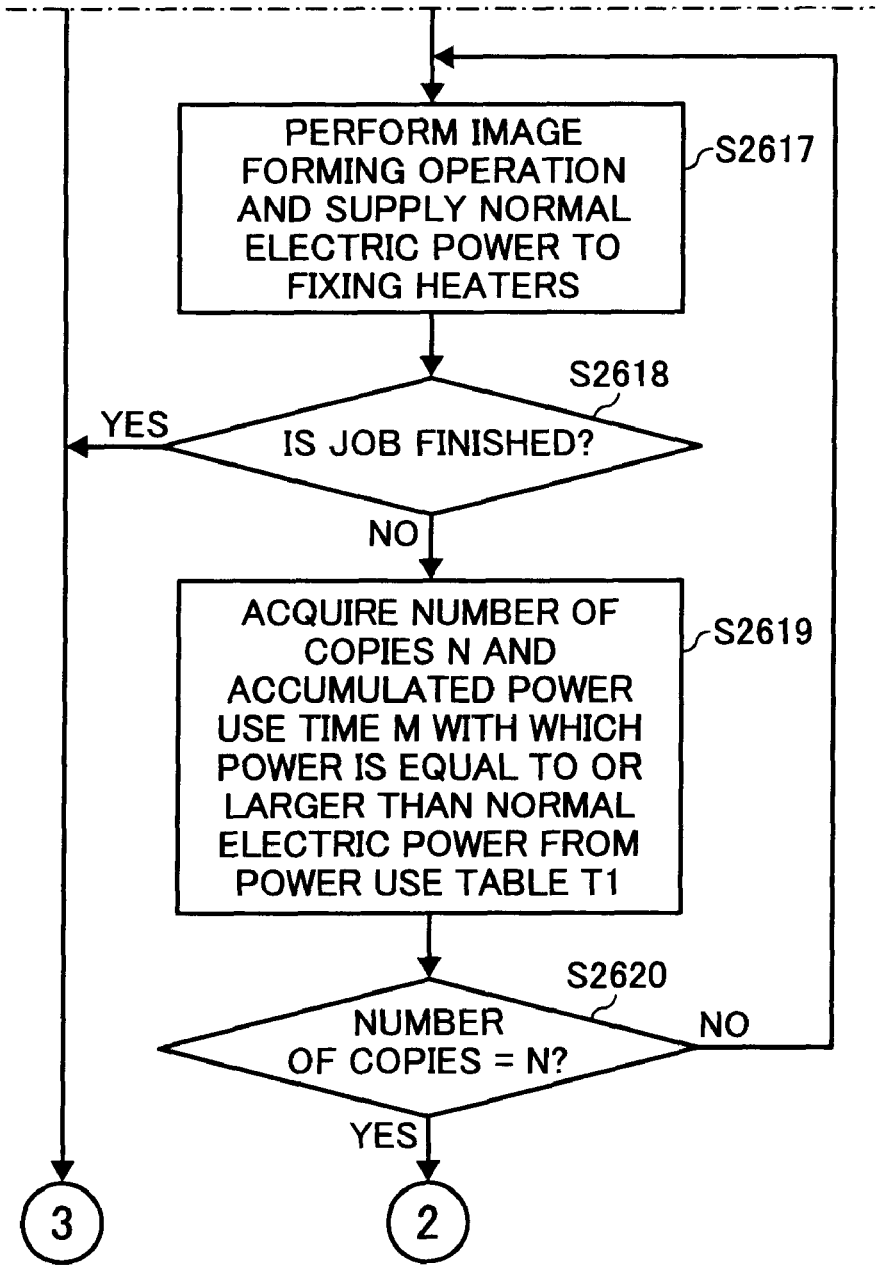
Figure 26C:
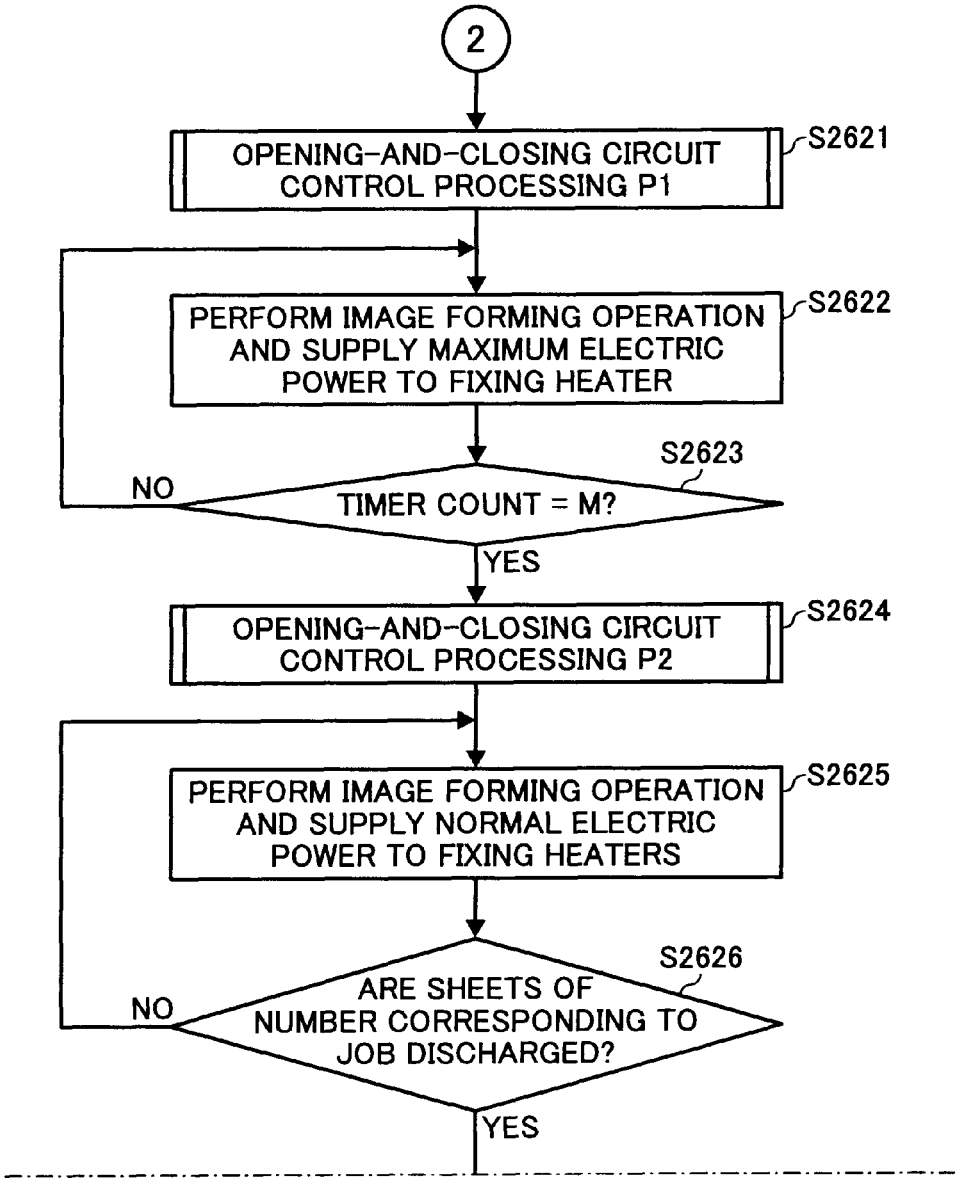
FIG. 26C is a flowchart of the procedure of the operation mode control processing performed by the engine control unit of the image forming apparatus according to the fourth embodiment.
Figure 26C:
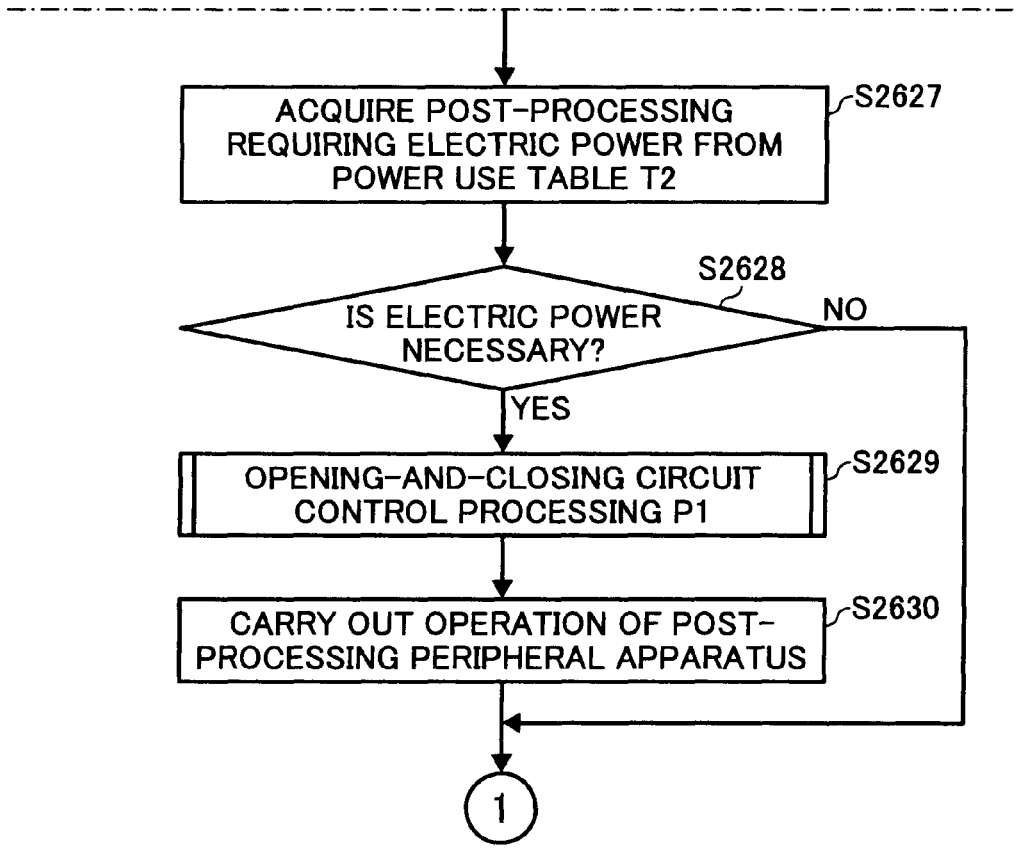

The procedure of the operation mode control processing according to this embodiment is the same as a part of the flowcharts shown in FIGS. 26A to 26D. Thus, only differences are explained. Since processing before step S3301 is the same as the processing at steps S2601 to S2609 in FIG. 26A, the explanation with reference to FIG. 26A is referred to. An explanation of the processing is omitted here.

When the CPU 10*a* of the engine control unit 10 judges at step S2609 in FIG. 26A that the heating unit has the reload temperature, the fixing device comes into the standby state. Electric power at the normal time set in advance is supplied to the fixing heaters and normal temperature control is carried out (step S3301).

The CPU 10*a* judges whether the fixing device is in the standby state again (step S3302). When it is judged that the fixing device is in the standby state ("Yes" at step S3302), the CPU 10*a* judges whether a charge voltage is lower than 90 volts, i.e., the capacitor cells are in the full-charge state (step S3303). When it is judged that the charge voltage is lower than 90 volts, i.e., the capacitor cells are not in the full-charge state ("Yes" at step S3303), the CPU 10*a* performs the opening-and-closing-circuit control processing P3 (step S3304) and returns to step S3301. Consequently, the capacitor bank 9 is charged. When it is judged that the charge voltage is not lower than 90 volts, i.e., the capacitor cells are in the full-charge state ("No" at step S3303), the CPU 10*a* performs the opening-and-closing-circuit control processing P2 (step S3305) and returns to step S3301. Consequently, electric power is supplied to the load from the commercial power supply.

When it is judged at step S3302 that the fixing device is not in the standby state ("No" at step S3302), the CPU 10*a* sets an operation mode or an operation condition for using accumulated electric power with reference to the power use tables T1 and T2 defining use of accumulated electric power for each operation mode and image forming operation process (step S3306). For example, the CPU 10*a* acquires, from the power use tables T1 and T2, setting of the number of copies with which the temperature of the heating unit falls according to the number of continuous copies, a timer count of time when the temperature of the heating unit recovers when maximum power is supplied to the fixing heaters, i.e., accumulated electric power of the capacitor bank 9 is used, and post-processing that requires supply of electric power and sets the setting of the number of copies, the timer count, and the post-processing.

Figure 7:
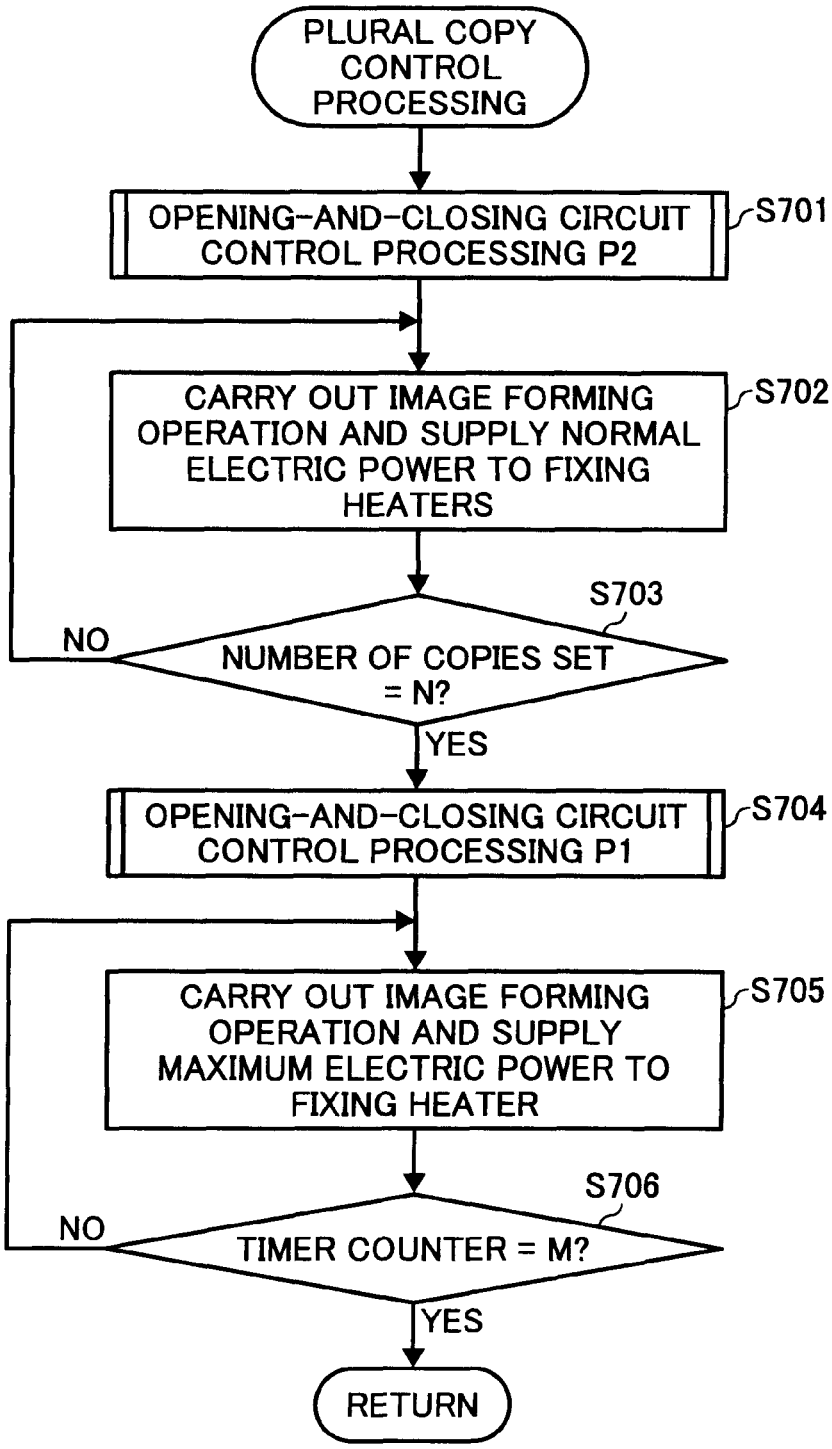
FIG. 7 is a flowchart of a procedure of plural-copy control processing performed by an engine control unit of a printer according to the first embodiment.

The CPU 10*a* judges whether the image forming apparatus is performing a copy operation (step S3307). When it is judged that the image forming apparatus is performing a copy operation ("Yes" at step S3307), the CPU 10*a* judges whether there is the setting of the number of copies acquired from the power use tables T1 and T2 (step S3308). When it is judged that there is the setting of the number of copies ("Yes" at step S3308), to supply electric power to the load from the commercial power supply, the CPU 10*a* performs plural copy processing (step S3309). Since the plural copy processing is the same as that of the flowchart in FIG. 7 in the first embodiment, FIG. 7 and the explanation with reference to FIG. 7 are referred to. An explanation of the plural copy processing is omitted here.

The CPU 10*a* performs the opening-and-closing-circuit control processing P2 (step S3310). The load continuously performs the image forming operation and normal electric power is supplied to the fixing heaters (step S3311). The CPU 10*a* judges whether sheets of a number corresponding to one job have been discharged (step S3312). When it is judged that the sheets of the number corresponding to one job have not been discharged ("No" at step S3312), the CPU 10*a* returns to step S3311. The load continues the image forming operation. When it is judged that the sheets of the number corresponding to one job have been discharged ("Yes" at step S3312), the CPU 10*a* judges whether supply of electric power is necessary for post-processing (step S3313).

When it is judged that supply of electric power is necessary for post-processing ("Yes" at step S3313), to increase an output of the DC power supply, the CPU 10*a* performs the opening-and-closing-circuit control processing P1 (step S3314). Consequently, power accumulated in the capacitor bank 9 is supplied to the constant-voltage generating circuit 13. A post-processing peripheral apparatus supplied with the electric power carries out a post-processing operation (step S3315). The CPU 10*a* returns to step S3301. When it is judged that supply of electric power to the post-processing is unnecessary ("No" at step S3313), since the copy operation is finished, the CPU 10*a* returns to step S3301.

Figure 26D:
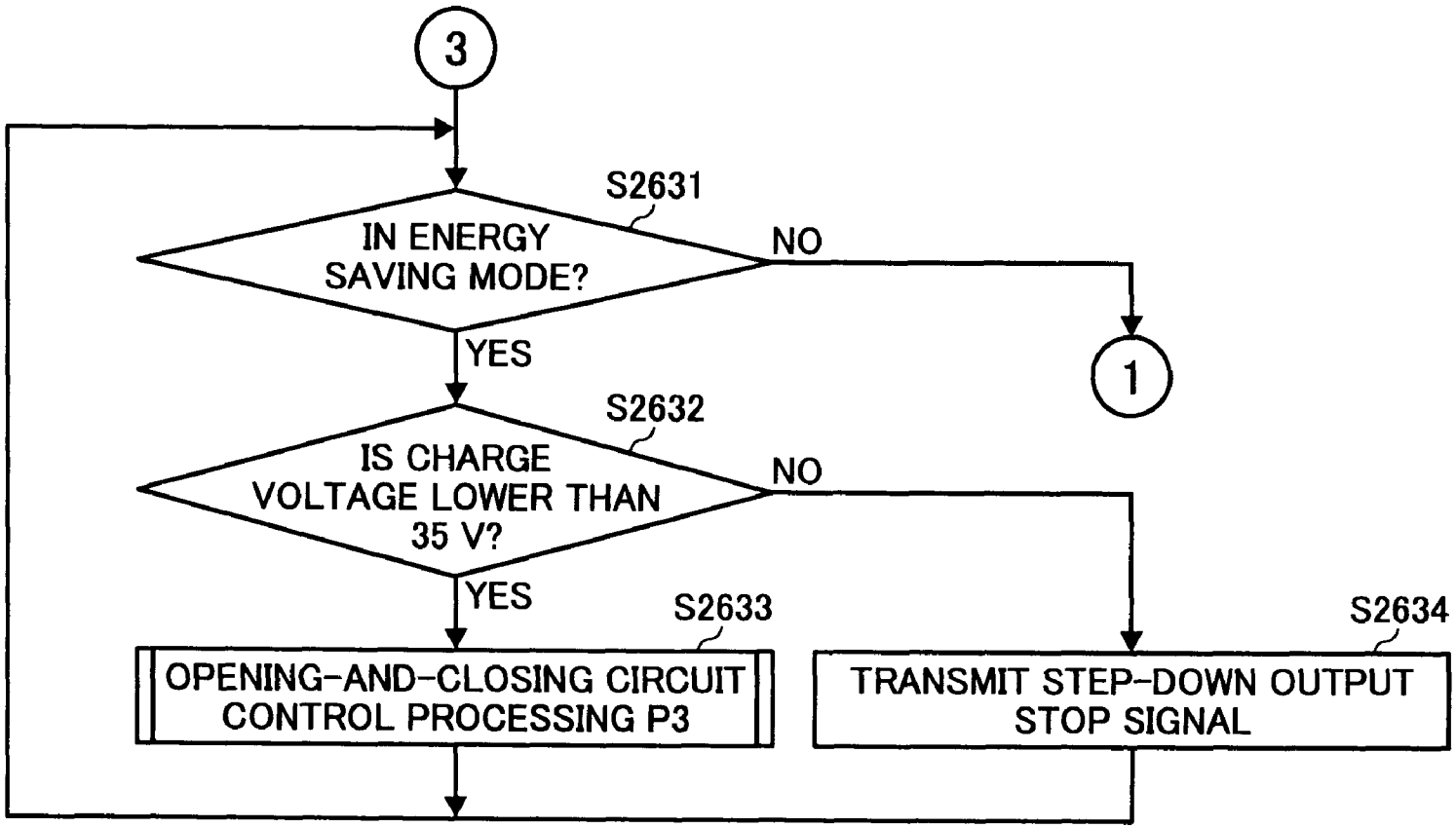
FIG. 26D is a flowchart of the procedure of the operation mode control processing performed by the engine control unit of the image forming apparatus according to the fourth embodiment.

When it is judged at step S3307 that the image forming apparatus is not performing the copy operation ("No" at step S3307), since a procedure of the processing is the same as that at steps S2631 to S2534 of the flowchart in FIG. 26D, the explanation with reference to FIG. 26D is referred to. An explanation of the processing is omitted here.

Figure 34:
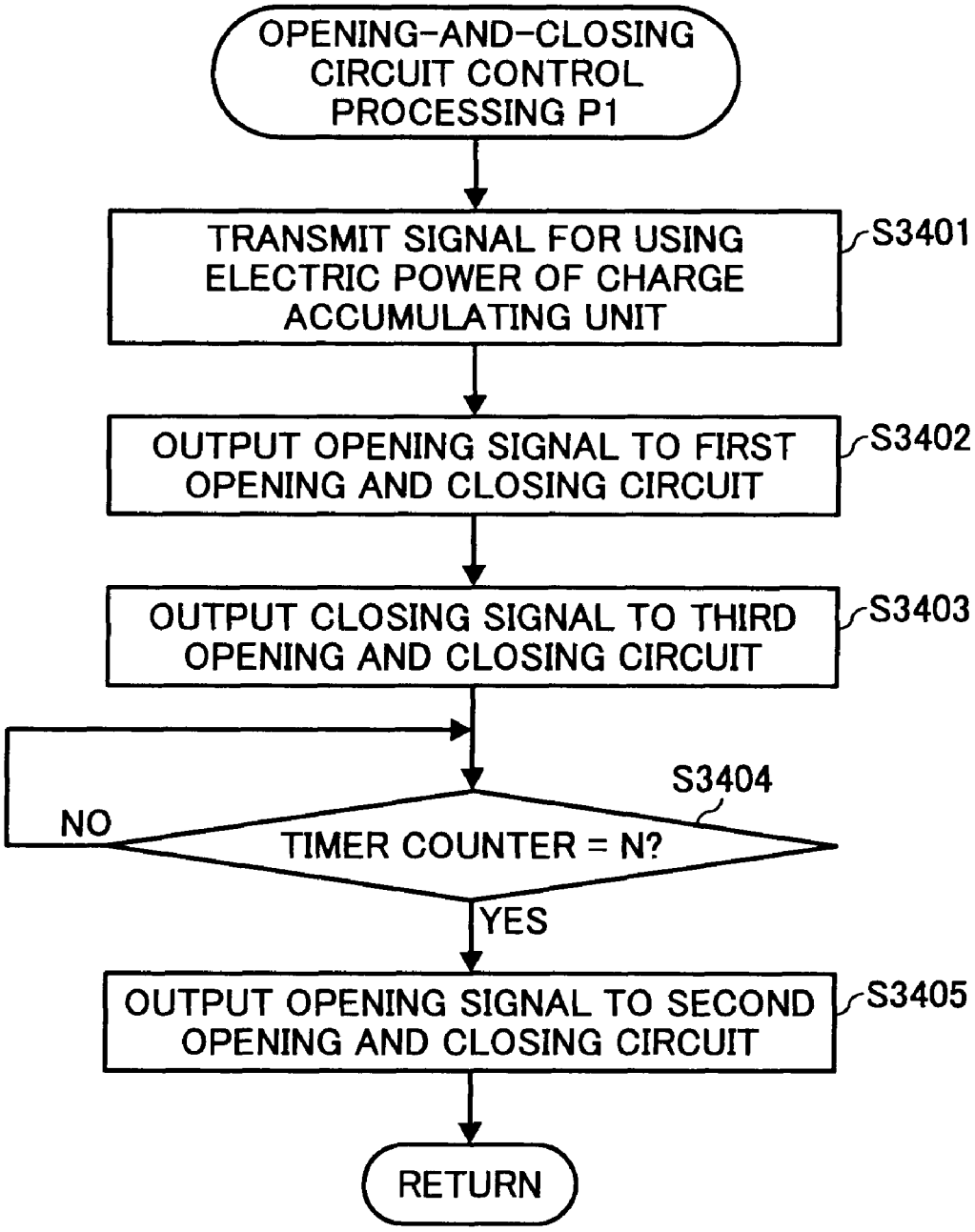
FIG. 34 is a flowchart of a procedure of opening-and-closing-circuit control processing P1 performed by the engine control unit of the image forming apparatus according to the fifth embodiment.

FIG. 34 is a flowchart of a procedure of the opening-and-closing-circuit control processing P1 performed by the engine control unit of the image forming apparatus. According to this processing, the constant-voltage generating circuit 13 performs constant voltage output control using accumulated electric power of the capacitor bank 9.

The CPU 10*a* transmits a signal for using electric power of the charge accumulating unit (step S3401). The CPU 10*a* outputs a signal for opening the first opening and closing circuit (step S3402). The CPU 10*a* outputs a signal for closing the third opening and closing circuit (step S3403). When a relay is used for the second and the third opening and closing circuits, the CPU 10*a* counts time N with the timer counter (step S3404). The CPU 10*a* outputs a signal for opening the second opening and closing circuit (step S3405).

Figure 35:
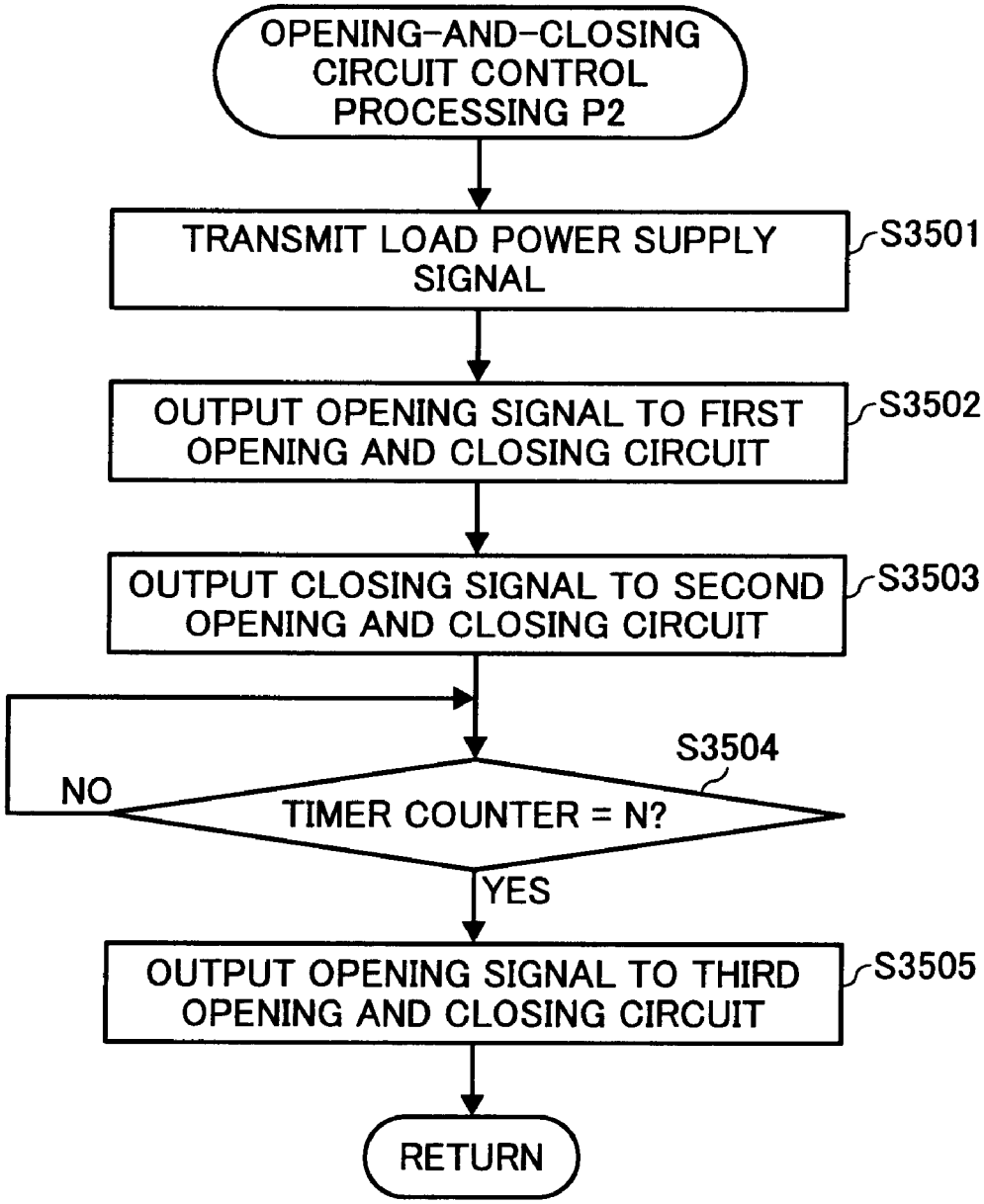
FIG. 35 is a flowchart of a procedure of opening-and-closing-circuit control processing P2 performed by the engine control unit of the image forming apparatus according to the fifth embodiment.

FIG. 35 is a flowchart of a procedure of the opening-and-closing-circuit control processing P2 performed by the engine control unit of the image forming apparatus. According to this processing, electric power is supplied to the load from the commercial power supply.

The CPU 10*a* transmits a load power supply signal (step S3501). The CPU 10*a* outputs a signal for opening the first opening and closing circuit (step S3502) and outputs a signal for closing the second opening and closing circuit (step S3503). When a relay is used for the second and the third opening and closing circuits, the CPU 10*a* counts the time N with the timer counter (step S3504). The CPU 10*a* outputs a signal for opening the third opening and closing circuit (step S3505).

Figure 36:
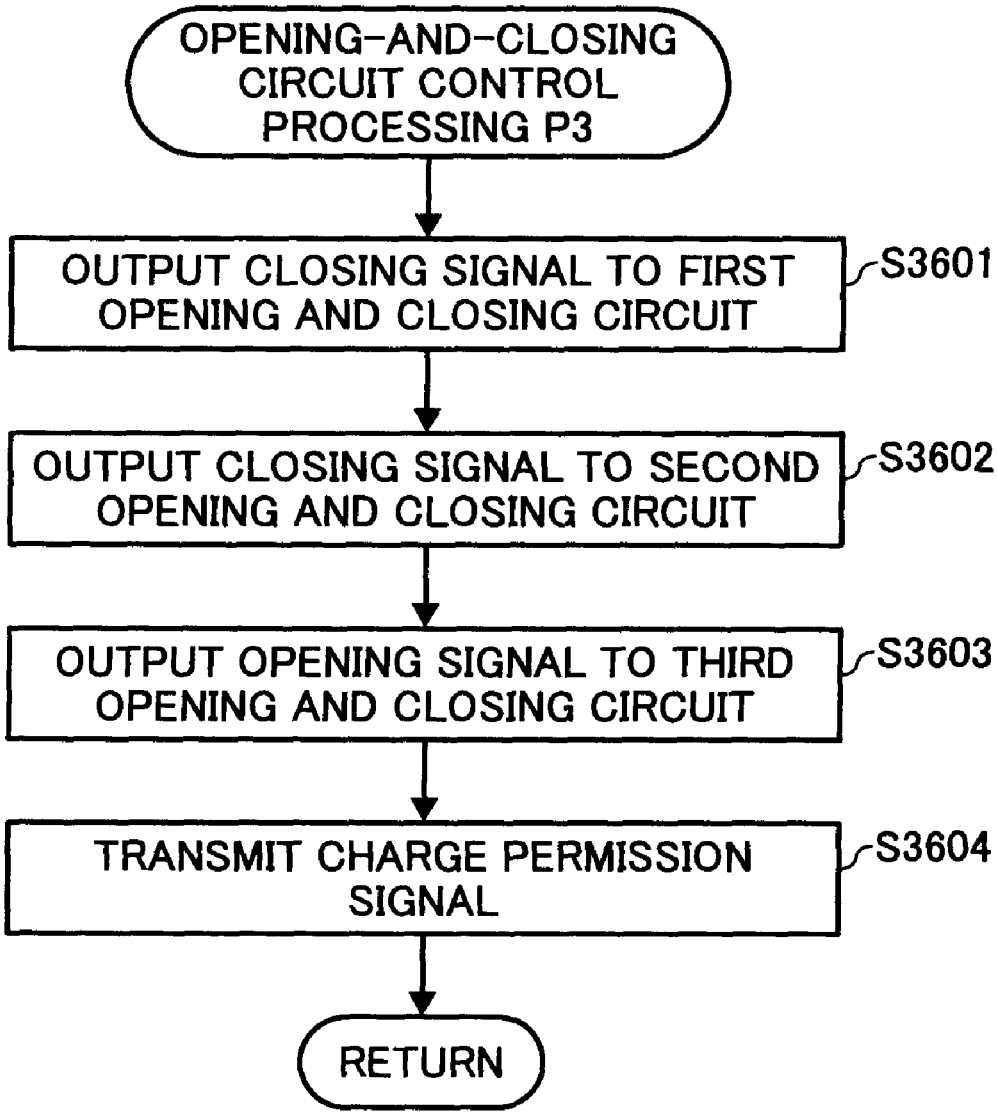
FIG. 36 is a flowchart of a procedure of opening-and-closing-circuit control processing P3 performed by the engine control unit of the image forming apparatus according to the fifth embodiment.

FIG. 36 is a flowchart of a procedure of the opening-and-closing-circuit control processing P3 performed by the engine control unit of the image forming apparatus. According to this processing, the capacitor bank 9 is charged.

The CPU 10*a* outputs a signal for closing the first opening and closing circuit (step S3601) and outputs a signal for closing the second opening and closing circuit (step S3602). The CPU 10*a* outputs a signal for opening the third opening and closing circuit (step S3603) and transmits a charge permission signal (step S3604).

As described above, in addition to the effects of the fourth embodiments, in the circuit configuration according to this embodiment, when electric power is supplied to the load, it is possible to interrupt connection to the charge circuit by opening the first opening and closing circuit. In the case of a light load at the time of standby or the like, it is possible to supple electric power to the load even at the time of charge by closing the first opening and closing circuit and the second opening and closing circuit. When it is unnecessary to supply electric power to the load at the time of the energy saving mode or the like, it is possible to reduce electric power by opening the second opening and closing circuit.

The present invention has been explained using the first to the fifth embodiments. However, it is possible to apply various alterations or modifications to the embodiments. It is possible to freely combine the components and the functions explained in the first to the fifth embodiments.

The respective circuits described in the embodiments may be formed as a program stored in a storage medium. A control program executed in the printer according to the embodiments is stored in a ROM or the like in advance and provided.

The control program executed in the printer according to the embodiments may be recorded in a computer-readable recording medium such as a compact disk-read only memory (CD-ROM), a flexible disk (FD), a compact disk-recordable (CD-R), or a digital versatile disk (DVD) in an installable format or an executable format and provided.

The control program executed in the printer according to the embodiments may be stored on a computer connected to a network such as the Internet, downloaded through the network, and provided. The control program executed in the printer according to the embodiments may be provided or distributed through the network such as the Internet.

The control program executed in the printer according to the embodiments is formed as a module including the respective units (the engine control unit, etc.) described above. As actual hardware, when a CPU (a processor) reads out the control program from the ROM and executes the control program, the respective units are loaded on a main storage device and the engine control unit and the like are generated on the main storage device.

The power use tables T1 and T2 may be stored in a ROM in advance and may be constituted by any kind of storage medium generally used such as a hard disk (HD), an optical disk, or a memory card.

Figure 37:
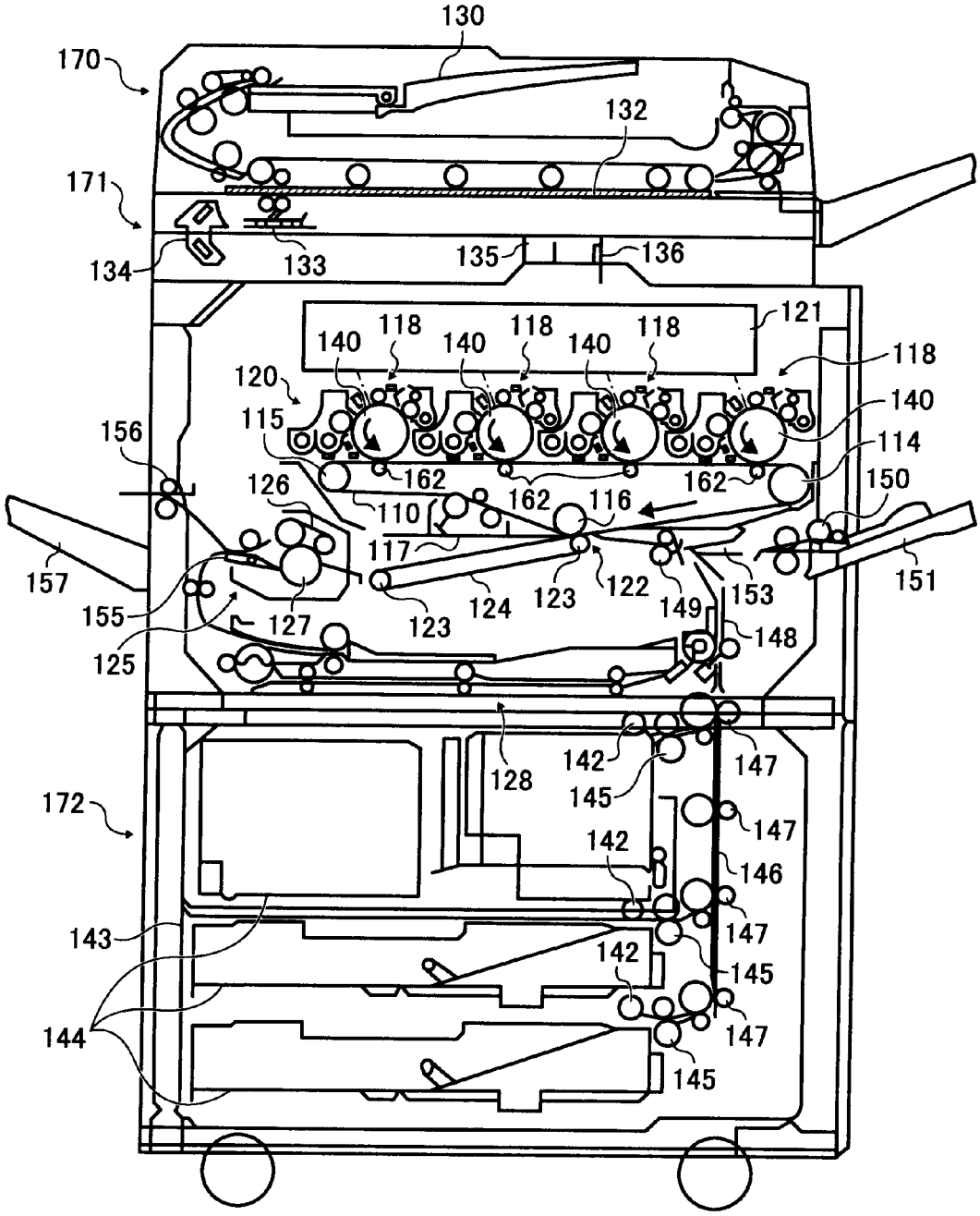
FIG. 37 is a diagram for explaining an example of a schematic structure of a printer according to the fifth embodiment.

FIG. 37 is a diagram for explaining an example of a schematic structure of the printer according to the embodiments. In FIG. 37, mechanical units of the image forming apparatus according to the first to the fifth embodiments are schematically shown. The printer as the image forming apparatus includes an intermediate transfer unit in the center thereof. The intermediate transfer unit includes an intermediate transfer belt 110 as an endless belt. The intermediate transfer belt 110 is, for example, a plural-layer belt in which an elastic layer is provided on a base layer formed of a less stretchable material such as canvas on fluoride fluorine resin with small stretch or a rubber material with large stretch. The elastic layer is obtained by forming a coat layer with high smoothness by coating, for example, fluorine resin on the surface of, for example, fluorine rubber or acrylonitrile-butadiene copolymer rubber.

The intermediate transfer belt 110 is wound around first to third support rollers 114 to 116 and driven to rotate clockwise. An intermediate-transfer-member cleaning unit 117 that removes a residual toner remaining on the intermediate transfer belt 110 after image transfer is provided on the left of a second support roller 115.

Over the intermediate transfer belt 110 between the first support roller 114 and the second support roller 115, there is an image forming device 120 including photosensitive member units 140, charger units 118, developing units, and cleaning units of colors black (K), yellow (Y), magenta (M), and cyan (C) along a moving direction of the intermediate transfer belt 110. The image forming device 120 includes an IC tag and is detachably mounted on a printer body. Above the image forming device 120, there is a writing unit 121 that irradiates a laser beam for image formation on respective photosensitive drums of the photosensitive units of the respective colors.

Below the intermediate transfer belt 110, there is a secondary transfer unit 122. In the secondary transfer unit 122, a secondary transfer belt 124 as an endless belt is laid over between two rollers 123. The secondary transfer unit 122 is arranged to push up the intermediate transfer belt 110 to press the intermediate transfer belt 110 against the third support roller 116. The secondary transfer belt 124 transfers an image on the intermediate transfer belt 110 onto a sheet. Beside the secondary transfer unit 122, there is a fixing unit 125 that fixes the transferred image on the sheet. A sheet having a toner image transferred thereon is fed to the fixing unit 125. The fixing unit 125 is obtained by pressing a heating and pressing roller 127 against a fixing belt 126 as an endless belt. Below the secondary transfer unit 122 and the fixing unit 125, there is a sheet reversing unit 128 that reverses a sheet just having an image formed on the front surface thereof to record an image on the rear surface thereof and feeds the sheet.

When a start switch of an operation unit (not shown) is pressed, an original on an original feeding stand 130 of an automatic document feeder (ADF) 170 is conveyed onto a contact glass 132. When there is no original on the ADF, to read an original manually placed on the contact glass 132, a scanner of an image reading unit 171 is driven and a first carriage 123 and a second carriage 134 are driven to perform reading and scanning. Light is emitted on the contact glass from a light source on the first carriage 133. Reflected light from an original surface is reflected on a first mirror on the first carriage 133, directed to the second carriage 134, reflected on a mirror on the second carriage 134, and focused on a charge coupled device (CCD) 136 as a reading sensor through a focusing lens 135. Recording data of the respective colors K, Y, M, and C are generated based on an image signal obtained by the reading sensor 136.

When the start switch is pressed, rotational drive of the intermediate transfer belt 110 is started and preparation for image formation of the respective units of the image forming device 120 is started. An image formation sequence for image formation of the respective colors is started. Exposure laser beams modulated based on the recording data of the respective colors are projected on the photosensitive drums for the respective colors. Toner images of the respective colors are superimposed and transferred onto the intermediate transfer belt 110 as one image. A sheet is fed to the secondary transfer unit 122 at such timing that, when the leading end of the toner image enters the secondary transfer unit 122, the leading end thereof simultaneously enters the secondary transfer unit 122. Consequently, the toner image on the intermediate transfer belt 110 is transferred onto the sheet. The sheet having the toner image transferred thereon is fed to the fixing unit 125. The toner image is fixed on the sheet in the fixing unit 125.

One of sheet feeding rollers 142 of a sheet feeding table 172 is selectively driven to rotate to deliver sheets from one of sheet feeding trays 144 provided in multiple stages in a sheet feeding unit 143. One of the sheets is separated by a separating roller 145, sent into a conveyance roller unit 146, conveyed by a conveying roller 147 and guided to a conveying roller unit 148 in the printer 100, and brought into contact with registration rollers 149 of the conveying roller unit 148 and stopped. Then, the sheet is delivered to the secondary transfer unit 122 at the timing described above. It is also possible to place sheets on a manual feed tray 151 and feed the sheet. When a user places the sheets on the manual feed tray 151, the printer 100 drives to rotate the sheet feeding roller 150 to separate one of the sheets on the manual feed tray 151 and draw the sheet into a manual-feed sheet feeding path 153 and brings the sheet into contact with the registration rollers 149 to stop the sheet.

The sheet subjected to fixing processing in the fixing unit 125 and discharged is guided to a discharge roller 156 by a switching pawl 155 and stacked on a sheet discharge tray 157. Alternatively, the sheet is guided to a sheet reversing unit 128 by the switching pawl 155, reversed in the sheet reversing unit 128, and guided to a transfer position again. After an image is recorded on the rear surface thereof, the sheet is discharged onto the sheet discharge tray 157 by the discharge roller 156. On the other hand, a residual toner remaining on the intermediate transfer belt 110 after the image transfer is removed by the intermediate-transfer-member cleaning unit 117. In this way, the printer prepares for the next image formation.

The registration rollers 149 are generally grounded for use. However, it is also possible to apply a bias voltage to the registration rollers 149 to remove paper powder of sheets. For example, the bias voltage is applied using a conductive rubber roller. The conductive rubber roller has a diameter of 18 millimeters. The surface of the conductive rubber roller is made of conductive NBR rubber with thickness of 1 millimeter. An electric resistance is about 109 Ωcm in a volume resistance of a rubber material. The paper surface after passing between the registration rollers 149 is charged slightly on a negative side. Thus, in the transfer from the intermediate transfer belt 110 to the sheet, a transfer condition may be changed from a transfer condition of the transfer performed without applying a voltage to the registration roller 149. A voltage at about −800 volts is applied to a side to which a toner is transferred (the front side) of the intermediate transfer belt 110. A voltage at about +200 volts is applied to the rear side by a transfer roller 162.

Figure 38:
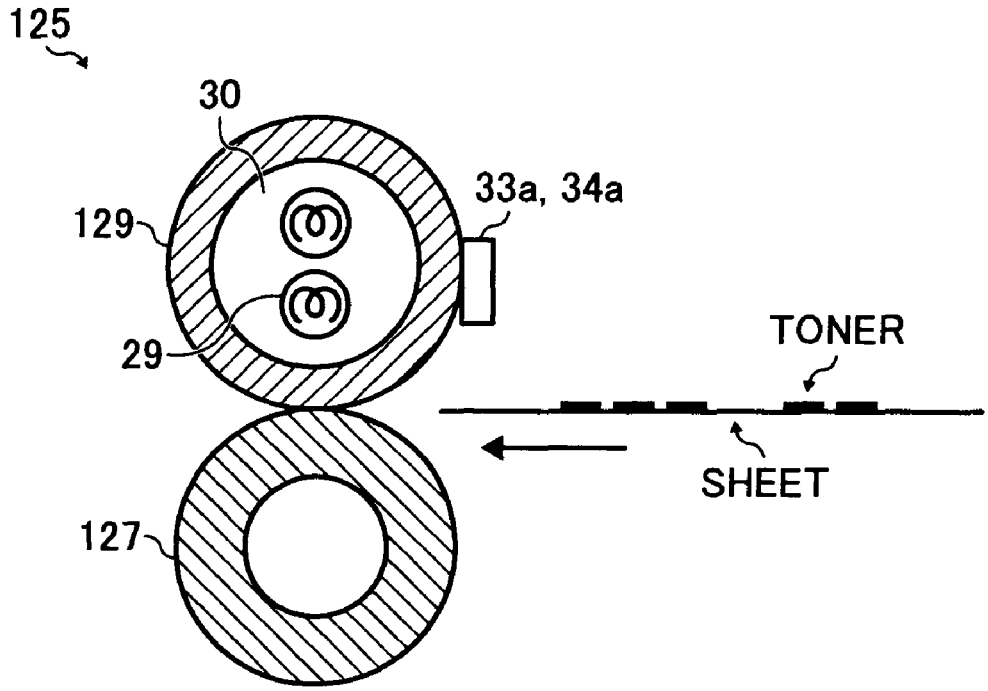
FIG. 38 is a longitudinal sectional side view of a schematic structure of a fixing device according to the fifth embodiment.

FIG. 38 is a longitudinal sectional side view of a schematic structure of the fixing device. As shown in FIG. 38, the fixing unit 125 includes a fixing roller 129 as a fixing member, a pressure roller 127 as a pressure member, and a pressing unit (not shown) that presses the pressure roller 127 against the fixing roller 129 with a fixed pressing force. The fixing roller 129 and the pressure roller 127 are driven to rotate by a driving mechanism (not shown).

The fixing device also includes a main heater 29, an auxiliary heater 30, and thermistors 33*a* and 34*a* for detecting surface temperature of the fixing roller 129. The fixing heaters 29 and 30 are arranged inside the fixing roller 129 and heat the fixing roller 129 from the inside thereof to supply heat to the fixing roller 129. The thermistors 33*a* and 34*a* are set in contact with the surface of the fixing roller 129 and detect surface temperature (fixing temperature) of the fixing roller 129. The thermistor 33*a* is arranged in a measurement area corresponding to the AC fixing heaters 29. The thermistor 34*a* is arranged in a measurement area corresponding to the auxiliary fixing heater 30.

The AC fixing heaters 29 is turned on and heats the fixing roller 129 when the temperature of the fixing roller 129 has not reached a target temperature. The auxiliary fixing heater 30 also has a function of a supporting heater that supports warm-up of the fixing device using electric power of the charge accumulating unit, for example, at the time of warm-up from the time of power-on of the main power supply or at the time of an off mode for energy saving until it is possible to perform copying, i.e., at the time of warm-up of the fixing device. Therefore, the auxiliary fixing heater 30 is normally used at electric power slightly lower than rated electric power of heaters and used at the rated electric power when the temperature falls at the time of warm-up of the fixing device or at the time of continuous copying.

In such the fixing unit 125, when a sheet bearing a toner image passes a nip section of the fixing roller 129 and the pressure roller 127, the sheet is heated and pressed by the fixing roller 129 and the pressure roller 127. Consequently, the toner image is fixed on the sheet.

Figure 39:
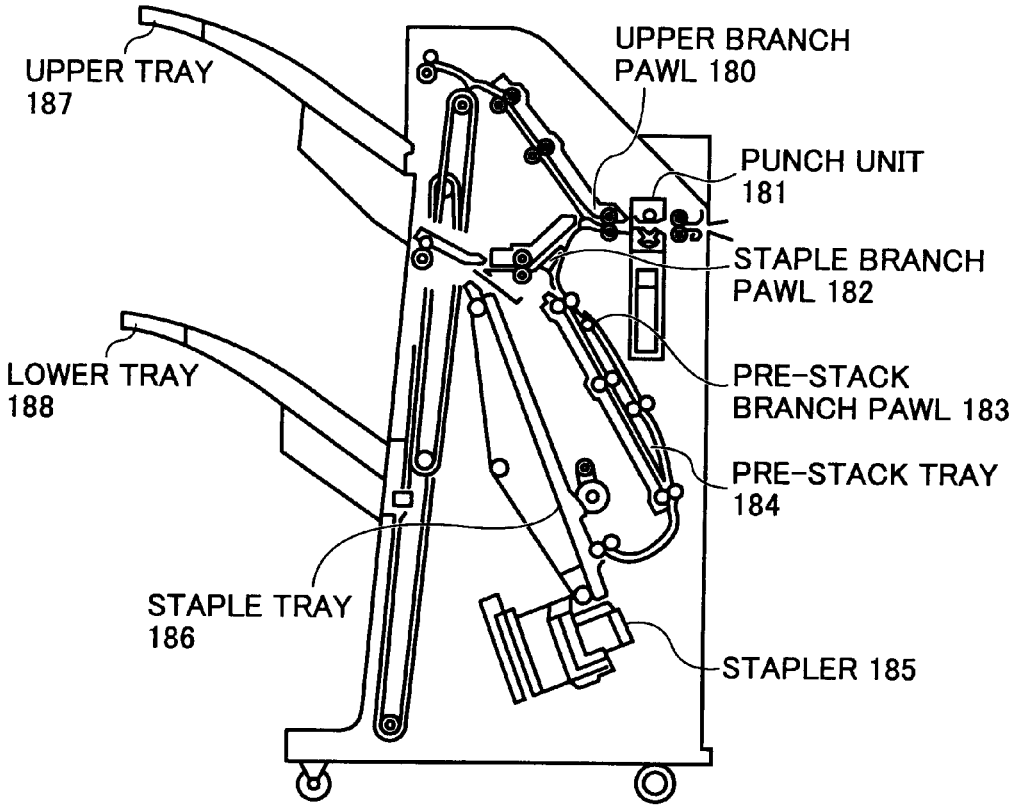
FIG. 39 is a schematic diagram of a post-processing apparatus according to the fifth embodiment.

FIG. 39 is a schematic diagram of a post-processing apparatus. A branch section performs branch of sheets to a shift mode M1 (upper sheet discharge), a shift mode M2 (lower sheet discharge), a pre-stack mode, and a staple mode (lower sheet discharge) using an upper branch pawl 180, a staple branch pawl 182, and a pre-stack branch pawl 183.

In the case of the staple mode for a plurality of documents, to reduce a standby time at the time of a staple operation, a first print of a second document is put on standby in a pre-stack tray 184 and, when a second print comes, sent to a staple tray 186 together with the second print.

An upper tray 187 and a lower tray 188 perform a side-shift operation for the trays at the time of a sort mode and lifting and lowering operations according to the number of prints to be discharged. In performing staple, sheets are gathered on the staple tray 186, aligned by a roller and a jogger fence, and stapled by a stapler 185. A punch unit 181 is driven by a punch motor and opens two punch holes in sheets.

Figure 40:
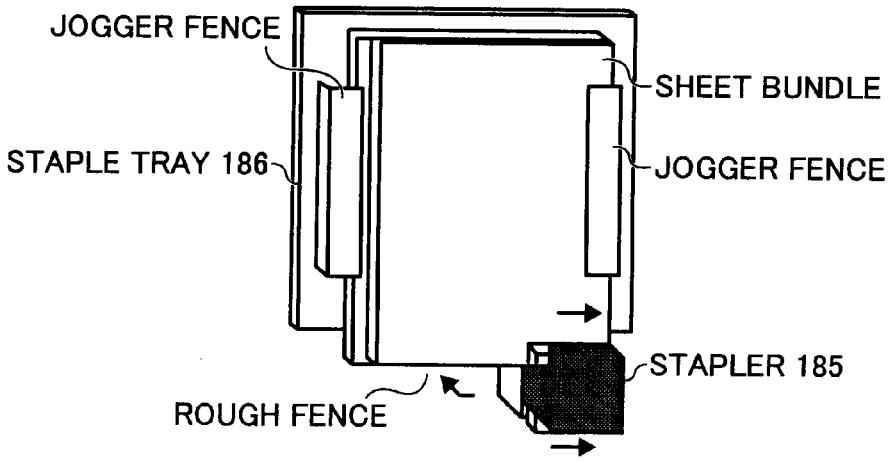
FIG. 40 is a schematic diagram of a stapler section according to the fifth embodiment.

FIG. 40 is a schematic diagram of a stapler section. The staple tray 186 stacks sheets. The sheet stacked or a sheet bundle is subjected to stapling processing by the stapler 185.

A power supply device according to a sixth embodiment of the present invention steps down a voltage outputted from the commercial power supply to charge a charge accumulating unit and changes a voltage outputted from the commercial power supply or a voltage outputted from the charge accumulating unit to constant voltages with a constant-voltage generating circuit to supply the voltages to load. The power supply device according to this embodiment is equivalent to the power supply unit in the engine power supply unit according to the first embodiment.

It is possible to mount the power supply device, to which the present invention is applied, on image forming apparatuses such as a copying machine other than the printer, a facsimile apparatus, and a multi function peripheral (MFP) in which a copying function, a printer function, and a facsimile function are combined.

Figure 41:
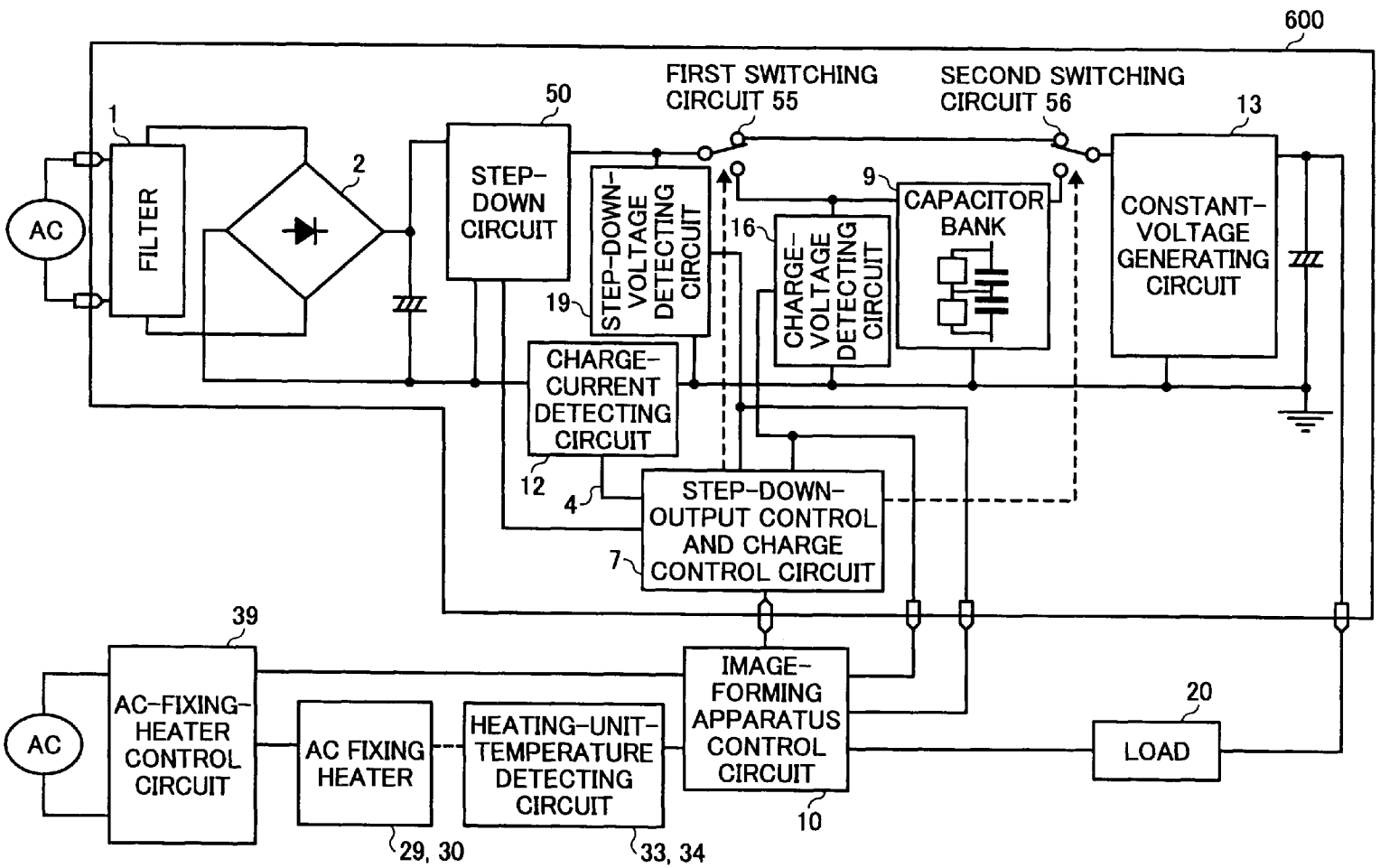
FIG. 41 is a circuit diagram of a circuit configuration of a power supply device according to a sixth embodiment of the present invention.
Figures 42, 42A, 42B:
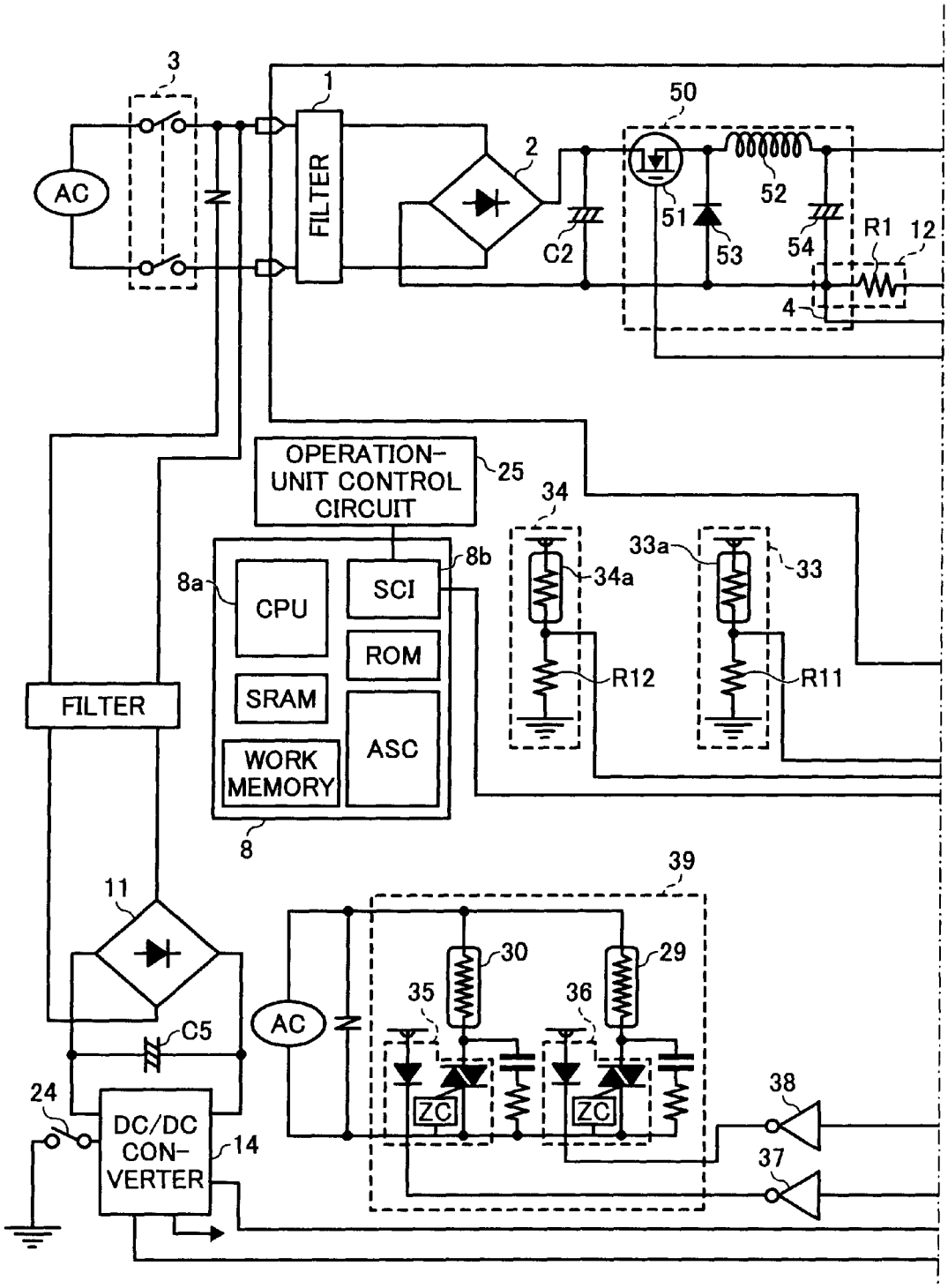
FIG. 42 is a detailed circuit diagram of a detailed circuit configuration of the power supply device according to the sixth embodiment.
Figure 42B:
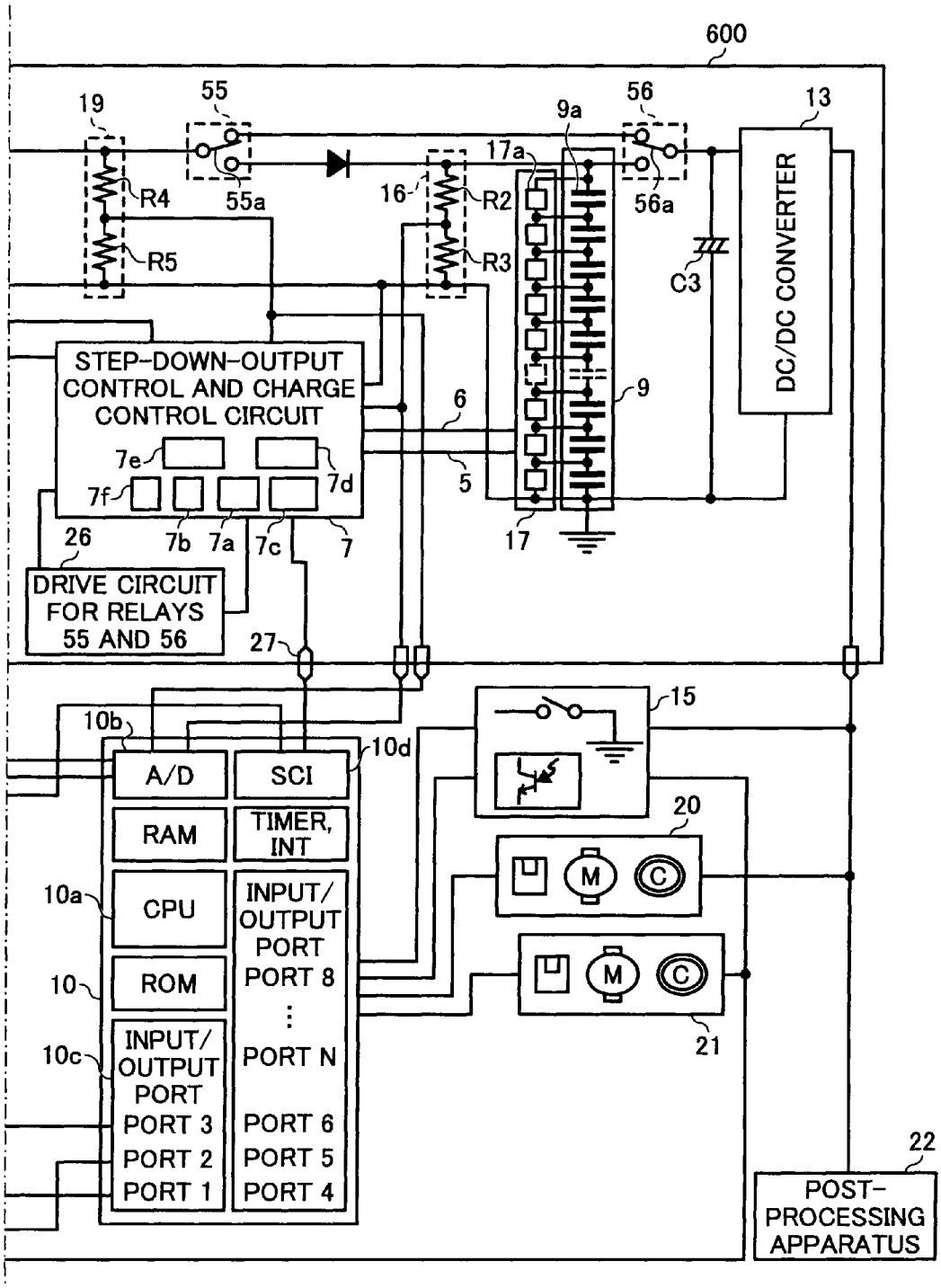

FIG. 41 is a circuit diagram of a circuit configuration of the power supply device according to the sixth embodiment. FIG. 42 is a detailed circuit diagram of a detailed circuit configuration of the power supply device according to the sixth embodiment. In the figures, it is assumed that the power supply device shown in FIGS. 41 and 42 are mounted on an engine unit of a printer.

A power supply device 600 according to this embodiment includes the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the step-down-output control and charge control circuit 7, the first switching circuit 55, and the second switching circuit 56. An engine unit of a printer mounted with the power supply device 600 includes the engine control unit 10, the load 20, the AC fixing heaters 29 and 30, the heating-unit-temperature detecting circuits 33 and 34, and the AC-fixing-heater control circuit 39.

Structures and functions of the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the step-down-output control and charge control circuit 7, the first switching circuit 55, and the second switching circuit 56 are substantially the same as those in the first embodiment. Thus, the above explanations are referred to and only differences are explained. The engine control unit 10, the load 20, the AC fixing heaters 29 and 30, the heating-unit-temperature detecting circuits 33 and 34, and the AC-fixing-heater control circuit 39 are the same as those in the first embodiment. Thus, only differences are explained below.

The step-down-output control and charge control circuit 7 detects a charge voltage at the capacitor bank 9, a charge current, and an operation of a bypass circuit and applies constant current charge or constant power charge to the capacitor bank 9. The step-down-output control and charge control circuit 7 has a function of generating a PWM signal for applying constant current charge and constant power charge to the capacitor bank 9 and a function of supplying a step-down voltage to the constant-voltage generating circuit 13 via the first switching circuit and the second switching circuit 56. The step-down-output control and charge control circuit 7 includes the CPU 7*a*, the SIC 7*b*, the A/D converter 7*c*, the charge-current detecting circuit 7*d*, the PWM-signal generating circuit 7*e*, a ROM, a RAM, a timer, an interrupt control circuit, and an input/output port 7*f*. Since an operation of the step-down-output control and charge control circuit 7 is the same as that in the first embodiment, the above explanations are referred to and an explanation of the operation is omitted here.

In the step-down-output control and charge control circuit 7, when a load power supply signal is outputted from the CPU 10*a* of the engine control unit 10 to the CPU 7*a*, a PWM signal set in advance is outputted from the PWM signal generating circuit 7*e* to the gate of the FET 51. In the step-down chopper circuit 50, a step-down voltage is generated by the PWM signal and a voltage is supplied as an input to the constant-voltage generating circuit 13 via the first switching circuit 55 and the second switching circuit 56. A PWM signal of a fixed duty ratio may be outputted to the step-down chopper circuit 50. A step-down voltage may be detected by the step-down-voltage detecting circuit 19 and fed back to the step-down-output control and charge control circuit 7 to generate a fixed voltage. A voltage value to be stepped down may be outputted from the CPU 10*a* of the engine control unit 10 to the CPU 7*a* of the step-down-output control and charge control circuit 7 and determined. The step-down chopper circuit 50 may switch the primary coil 50*b* of the high-frequency transformer 50*a* shown in FIG. 3 with the FET 50*d*, rectify a voltage induced in the secondary coil 50*c*, and generate a step-down voltage. The step-down chopper circuit 50 may generate a step-down voltage with the step-down chopper circuit described above.

The first switching circuit 55 includes the relay 55*a*. The second switching circuit 56 includes the relay 56*a*. It goes without saying that an opening and closing circuit including an FET, an IGBT, or the like instead of the relay may be used. The relays 55*a* and 56*a* are set to be connected to the commercial power supply (the step-down chopper circuit 50) side in a normal close state (a state in which a coil is not conductive). Therefore, when a main power supply is off, discharge from the capacitor bank 9 is stopped.

Timing for switching the first switching circuit 55 and the second switching circuit 56 is outputted from the CPU 10*a* of the engine control unit 10 via a communication interface between the SIC 7*b* connected to the CPU 7*a* of the step-down-output control and charge control circuit 7 and a serial controller (SIC) connected to the CPU 10*a* of the engine control unit 10. When the switching timing is outputted from the CPU 10*a*, the CPU 7*a* of the step-down-output control and charge control circuit 7 outputs a signal for switching the relay 55 or the relay 56 to a drive circuit 26 for the relays 55*a* and 56*a* from the input/output port 7*f*.

When electric power is unnecessary at the time of standby, the energy saving mode, or the like, to charge the capacitor bank 9, the CPU 10*a* transmits a signal for energizing the relay 55*a* to the step-down-output control and charge control circuit 7 via the serial controller (SIC) 10*d*. The CPU 10*a* transmits a signal for stopping the energization of the relay 56*a* to the step-down-output control and charge control circuit 7 via the serial controller (SIC) 10*d*.

When electric power exceeds an AC power rating of the commercial power supply or when flicker occurs because of sudden fluctuation in a load on the image forming apparatus side, to use accumulated electric power in the capacitor bank 9, the CPU 10*a* outputs a signal for stopping the energization of the relay 55*a* to the step-down-output control and charge control circuit 7 and outputs a signal for energizing the relay 56*a* to the step-down-output control and charge control circuit 7.

At the normal time other than charge or discharge, the CPU 10*a* outputs a signal for stopping the energization of the relay 55*a* to the step-down-output control and charge control circuit 7. The CPU 10*a* outputs a signal for stopping the energization of the relay 56*a* to the step-down-output control and charge control circuit 7. Consequently, the output of the step-down chopper circuit 50 is connected to the input of the constant-voltage generating circuit 13.

After the image forming operation is finished, since the image forming apparatus enters the energy saving mode when a fixed time elapses, the CPU 10*a* outputs a signal for stopping a part of power output to the DC/DC converter 14 from the port 2. When an energy saving release switch (SW) 24 (a platen open SW, an original detection SW of an ADF, etc.) returns to a normal operation and the energy saving mode is released.

Figure 43:
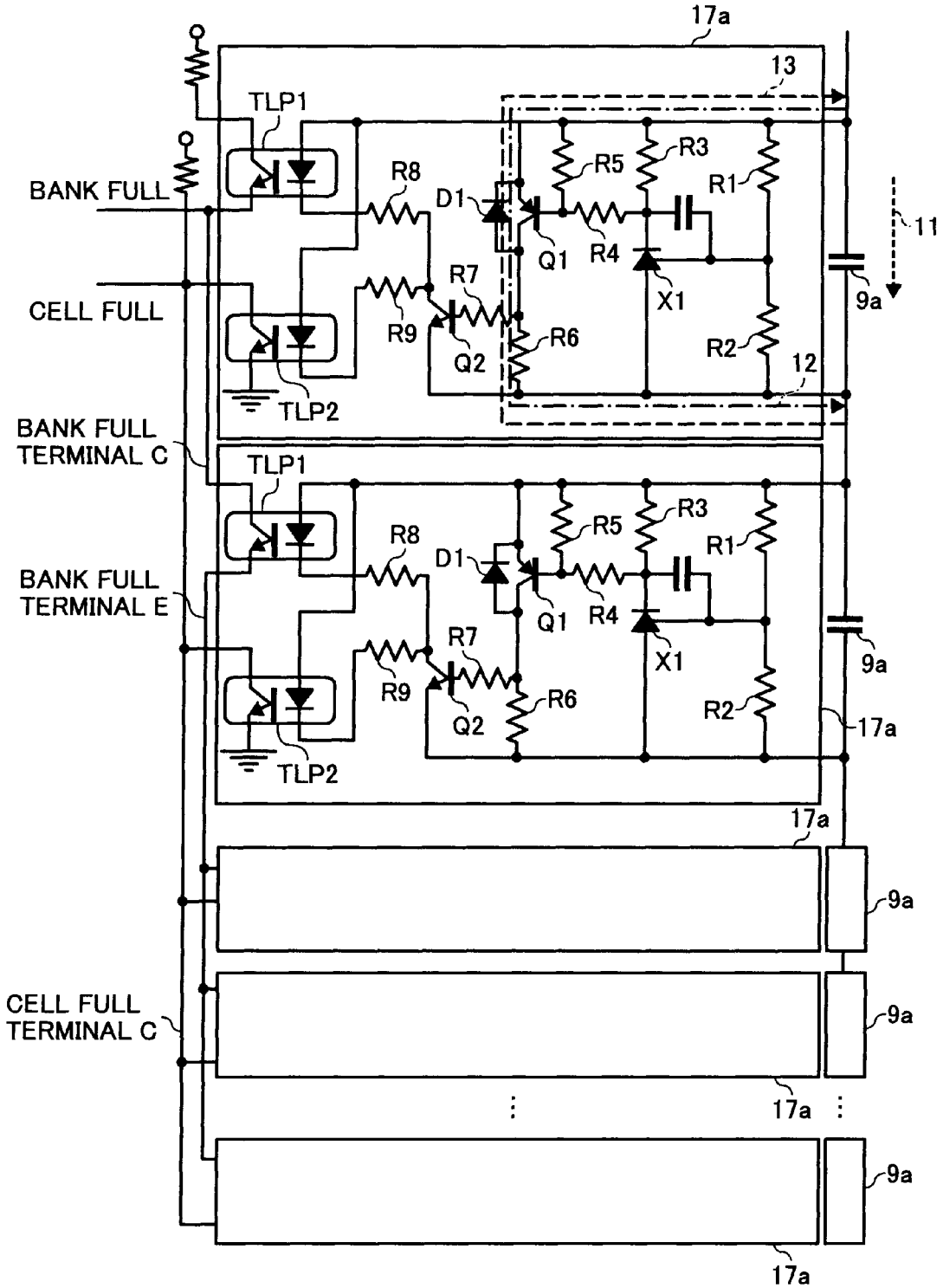
FIG. 43 is a detailed circuit diagram of a detailed circuit configuration of a capacitor cell and a bypass circuit according to the sixth embodiment.

FIG. 43 is a detailed circuit diagram of capacitor cells and an equalizing circuit. In the circuit diagram shown in FIG. 43, bypass circuits 17*a* are connected in parallel to the capacitor cells 9*a*. Fourteen bypass circuit 17*a* are connected in series to each of eighteen capacitor cells 9*a*. The capacitor bank 9 is an electric double layer capacitor connected in series to store electric power.

The bypass circuit 17*a* is connected in parallel between terminals of the capacitor cell 9*a*. The bypass circuit 17*a* includes a shunt regulator X1, resistors R1 to R5, a transistor Q1, and a diode D1. Detection of a terminal voltage at the capacitor cell 9*a* is performed by a voltage dividing circuit including resisters R1 and R2 and the shunt regulator X1. When a divided voltage at the voltage dividing circuit including the resistors R1 and R2 is inputted to a control terminal of the shunt regulator X1 and the terminal voltage at the capacitor cell 9*a* is charged to a predetermined voltage, the shunt regulator X1 is turned on.

When the shunt regulator X1 is turned on, a base current flows to the transistor Q1 through the resistor R3 and the transistor Q1 is turned on. When the transistor Q1 is turned on, a charge current of the capacitor cell 9*a* is bypassed in a current direction 12 by an electric current determined by the resistor R5. When the transistor Q1 is turned on, the transistor Q2 is turned on. An electric current flows to light-emitting diodes of photo-couplers TLP1 and TLP2 through resistors R7 and R8.

Since a Bank Full terminal is connected in series to the other bypass circuit 17*a*, all the capacitor cells 9*a* are charged to a predetermined voltage. When all the bypass circuit 17*a* operate, an all-cell full-charge signal is outputted. According to this signal, the PWM signal generating circuit 7*e* of the step-down-output control and charge control circuit 7 shown in FIG. 42 stops the charge.

Cell Full terminals of the bypass circuit 17*a* are connected in parallel. When the capacitor cell 9*a* connected to any one of the bypass circuit 17*a* is charged to the predetermined voltage and the bypass circuit 17*a* operates, a cell full-charge signal is outputted. The cell full-charge signal is inputted to the step-down-output control and charge control circuit 7 shown in FIGS. 41 and 42. The step-down-output control and charge control circuit 7 performs a predetermined constant current charge operation according to the cell full-charge signal. The other bypass circuits 17*a* have the same functions and structures as the bypass circuit 17*a* described above, explanations of the other bypass circuits 17*a* are omitted here.

Figure 44A:
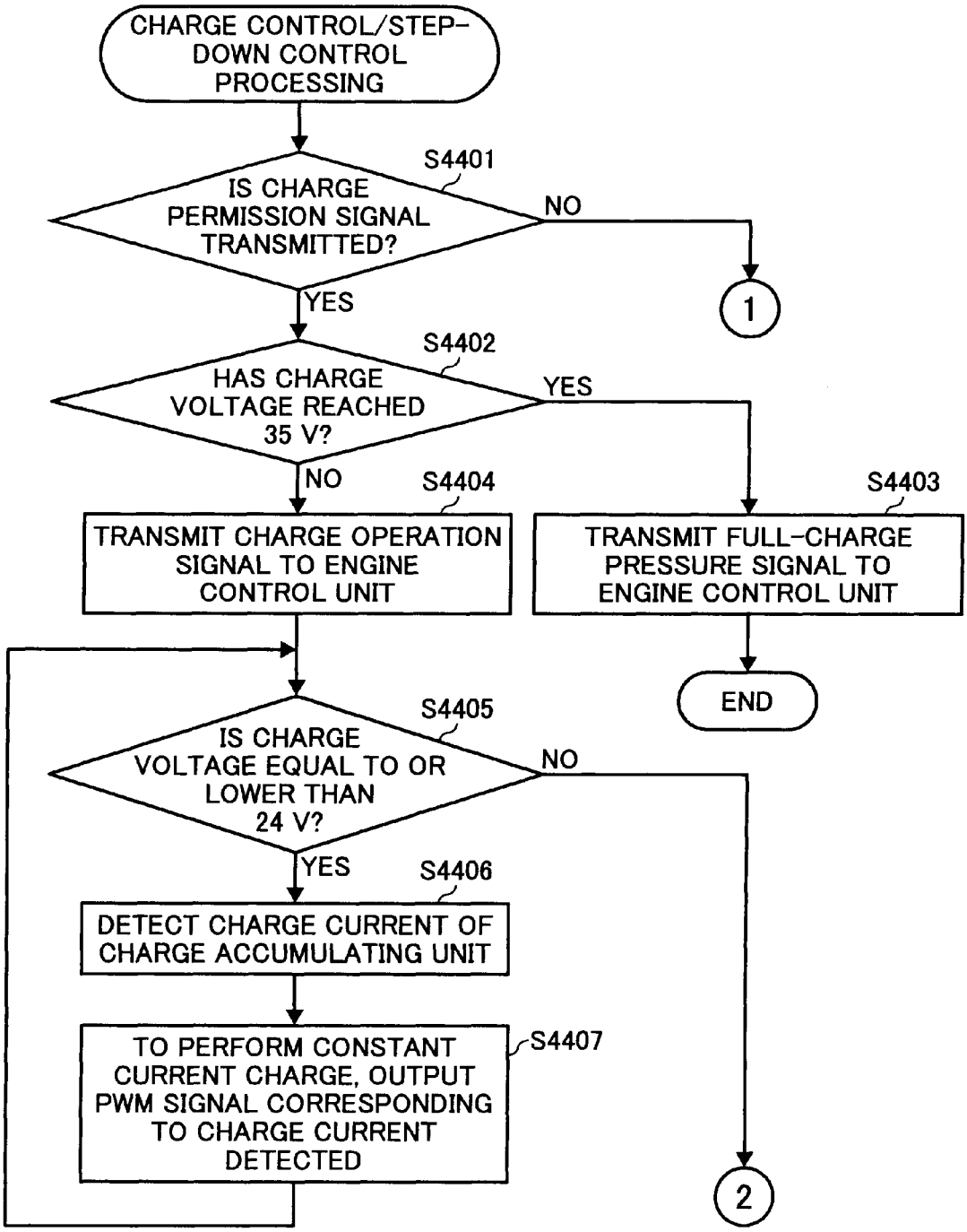
FIG. 44A is a flowchart of a procedure of step-down-voltage control and charge control processing performed by a step-down-output control and charge control circuit of the power supply device according to the sixth embodiment.
Figure 44B:
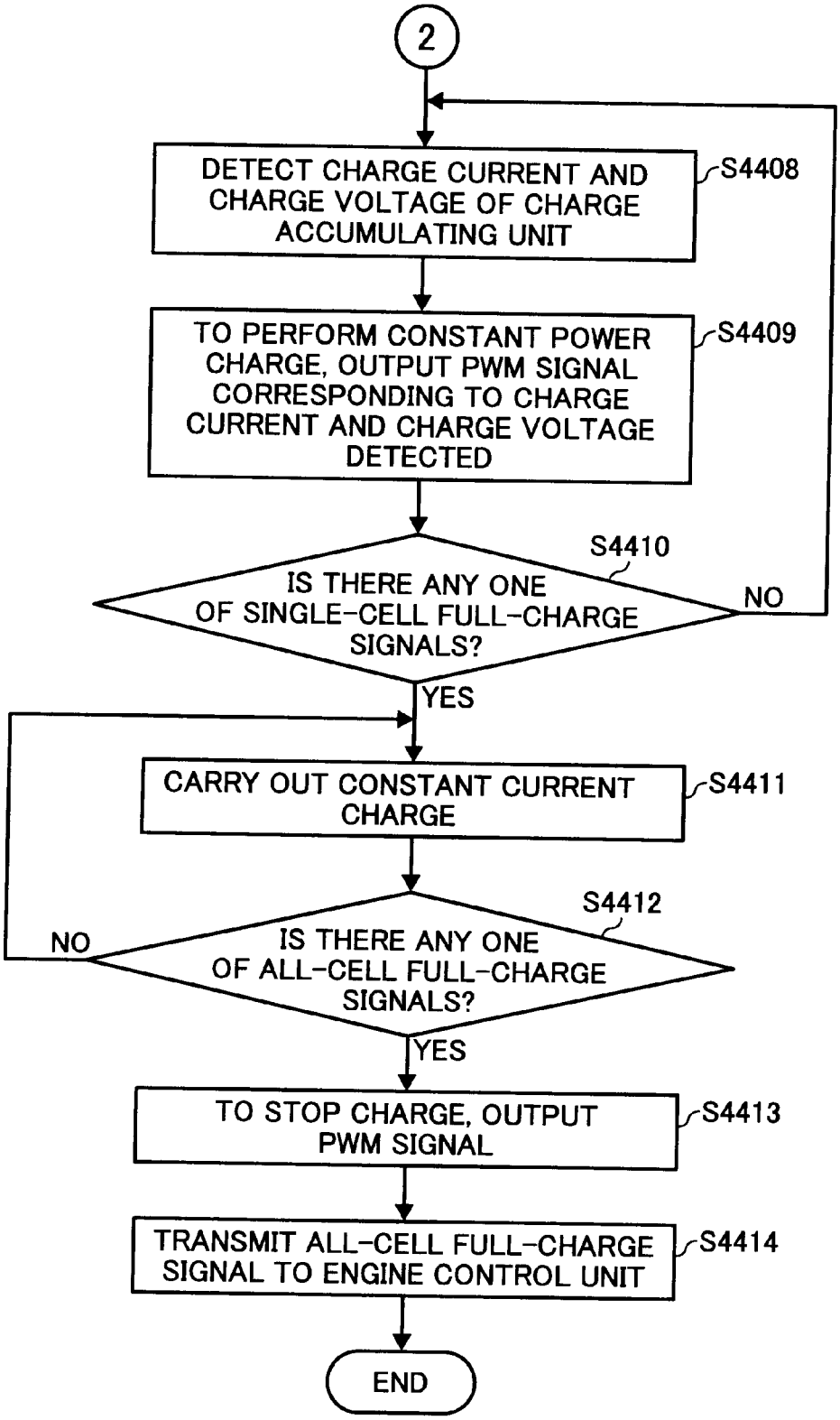
FIG. 44B is a flowchart of the procedure of the step-down-voltage control and charge control processing performed by the step-down-output control and charge control circuit of the power supply device according to the sixth embodiment.
Figure 44C:
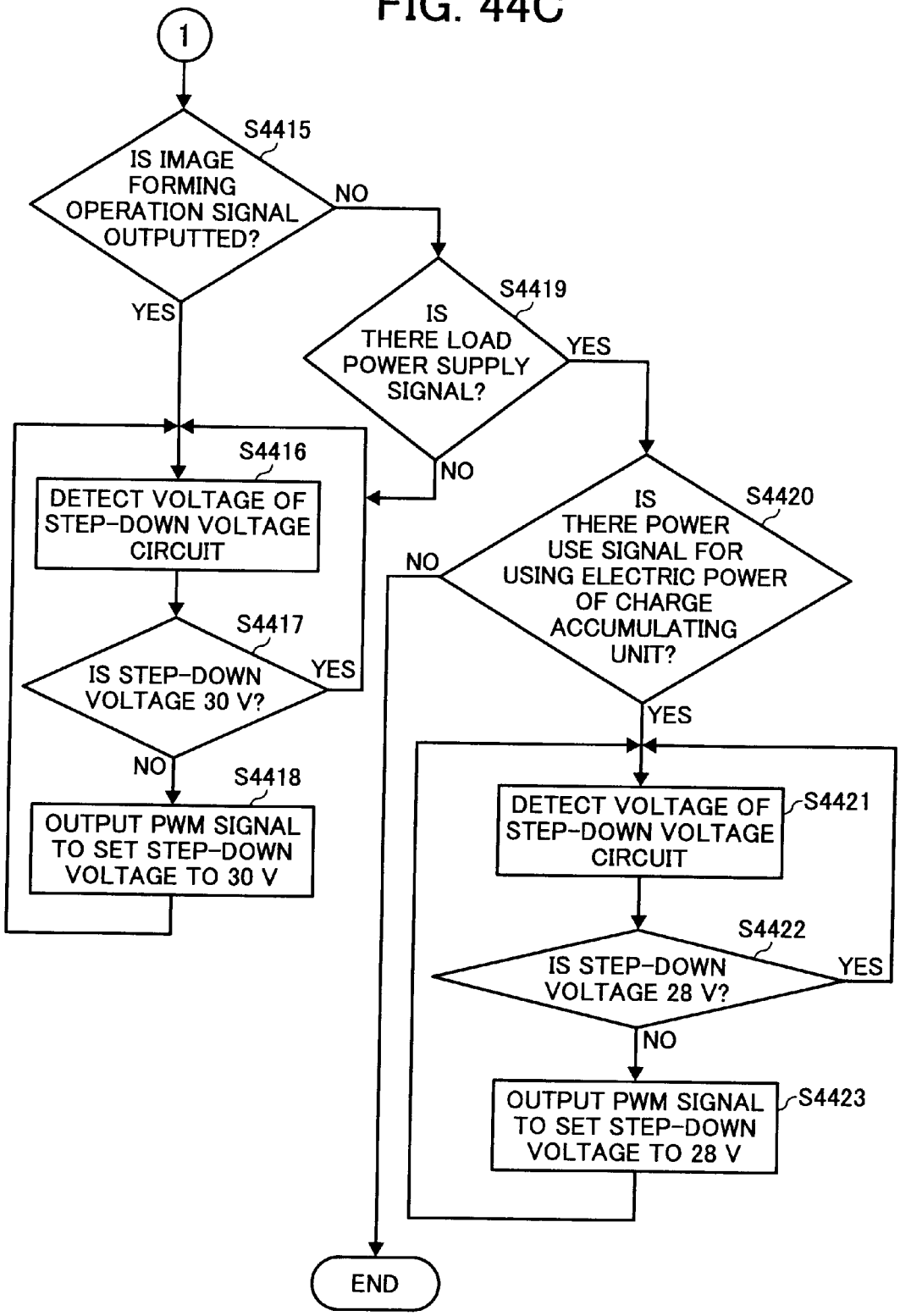
FIG. 44C is a flowchart of the procedure of the step-down-voltage control and charge control processing performed by the step-down-output control and charge control circuit of the power supply device according to the sixth embodiment.

FIGS. 44A to 44C are flowcharts of a procedure of step-down output control performed by the power supply device and step-down-voltage control and charge control processing performed by the step-down-output control and charge control circuit. According to this processing, the capacitor bank 9 is charged. An output of the commercial power supply is stepped down by the step-down chopper circuit 50.

The CPU 7*a* of the step-down-output control and charge control circuit 7 judges whether a charge permission signal is transmitted from the CPU 10*a* of the engine control unit 10 (step S4401). When it is judged that the charge permission signal is transmitted ("Yes" at step S4401), the CPU 7*a* judges whether a charge voltage has reached 35 volts (step S4402). Specifically, the CPU 7*a* checks the charge voltage from a result of detection by the charge-voltage detecting circuit 16 and judges whether the capacitor cells are in the full-charge state. When it is judged that the charge voltage has reached 35 volts ("Yes" at step S4402), since it is necessary to charge the capacitor bank 9, the CPU 7*a* transmits a full-charge voltage signal to the CPU 10*a* of the engine control unit 10 (step S4403) and finishes the processing.

When it is judged that the charge voltage has not reached 35 volts ("No" at step S4402), to perform a charge operation, the CPU 7*a* transmits a charge operation signal to the CPU 10*a* of the engine control unit 10 (step S4404). The CPU 7*a* judges whether the charge voltage is equal to or lower than 24 volts (step S4405). When it is judged that the charge voltage is equal to or lower than 24 volts ("Yes" at step S4405), the CPU 7*a* detects a charge current of the charge accumulating unit, i.e., the capacitor bank 9 (step S4406). To perform constant current charge, the CPU 7*a* outputs a PWM signal corresponding to the charge current detected from the PWM-signal generating circuit 7*e* to the gate of the FET 51 of the step-down chopper circuit 50 (step S4407). Returning to step S4405, the CPU 7*a* judges whether the charge voltage is equal to or lower than 24 volts. When it is judged that the charge voltage is equal to or lower than 24 volts, the CPU 7*a* repeats the charge operation described above.

When it is judged at step S4405 that the charge voltage is not equal to or lower than 24 volts ("No" at step S4405), the CPU 7*a* detects a charge current and a charge voltage at the charge accumulating unit, i.e., the capacitor bank 9 (step S4408). To perform constant power charge, the CPU 7*a* outputs a PWM signal corresponding to the charge current and the charge voltage detected from the PWM-signal generating circuit 7*e* to the gate of the FET 51 (step S4409). The CPU 7*a* judges whether there is any one of single-cell full-charge signals (step S4410). When it is judged that there is no single-cell full-charge signal ("No" at step S4410), the CPU 7*a* returns to step s4408.

When there is any one of the single-cell full-charge signals ("Yes" at step s4410), the CPU 7*a* carries out constant current charge (step S4411). The CPU 7*a* judges whether there is an all-cell full-charge signal (step S4412). When it is judged that the all-cell full-charge signal ("Yes" at step S4412), to stop the charge operation, the CPU 7*a* outputs a PWM signal to the gate of the FET 51 (step S4413). The CPU 7*a* transmits the all-cell full-charge signal to the CPU 10*a* (step S4414) and finishes the processing. When it is judged that there is no all-cell full-charge signal ("No" at step S4412), the CPU 7*a* returns to step S4411 and performs constant current charge.

When it is judged at step S4401 that the charge permission signal is not transmitted ("No" at step 4401), the CPU 7*a* judges whether there is an image forming operation signal, i.e., the image forming operation signal is outputted from the CPU 10*a* (step S4415). When it is judged that there is the image forming operation signal ("Yes" at step s4415), the CPU 7*a* detects a voltage outputted from the step-down chopper circuit 50 with the step-down-voltage detecting circuit 19 (step S4416). The CPU 7*a* judges whether the voltage outputted from the step-down chopper circuit 50 is 30 volts (step S4417). This step-down voltage is set in advance to be lower than a charge voltage at the capacitor bank 9. When the respective capacitor cells are fully charged, a voltage at the capacitor bank 9 is higher than 30 volts.

When it is judged that the voltage outputted from the step-down chopper circuit 50 is not 30 volts ("No" at step S4417), the CPU 7*a* outputs a PWM signal corresponding to the step-down voltage detected from the PWM-signal generating circuit 7*e* to set the step-down voltage to 30 volts (step S4418). As this PWM signal, a PWM signal associated with the step-down voltage detected may be set in a table in advance. A PWM signal may be generated by an analog circuit by comparing a comparative-signal generating circuit (a triangular wave) and an analog voltage set in advance (a voltage for outputting 30 volts).

When it is judged that the voltage outputted from the step-down chopper circuit 50 is 30 volts ("Yes" at step S4417), the CPU 7*a* returns to step S4416. The CPU 7*a* repeats such an operation to maintain the step-down voltage at 30 volts with the PWM-signal generating circuit 7*e*.

When it is judged at step S4415 that there is no image forming operation signal ("No" at step S4415), the CPU 7*a* judges whether there is a load power supply signal, i.e., whether the load power supply signal is outputted from the CPU 10*a* (step S4419). When it is judged that there is no load power supply signal ("No" at step S4419), the CPU 7*a* proceeds to step S4416. When it is judged that there is the load power supply signal ("Yes" at step S4419), the CPU 7*a* judges whether there is a power use signal for using electric power of the charge accumulating unit, i.e., whether the power use signal for using electric power of the charge accumulating unit is outputted from the CPU 10*a* (step S4420). When it is judged that there is no power use signal for using electric power of the charge accumulating unit ("No" at step S4420), the CPU 7*a* finishes the processing.

When it is judged that there is the power use signal for using electric power of the charge accumulating unit ("Yes" at step S4420), the CPU 7*a* detects a voltage outputted from the step-down chopper circuit 50 with the step-down-voltage detecting circuit 19 (step S4421). The CPU 7*a* judges whether the voltage outputted from the step-down chopper circuit 50 is 28 volts (step S4422). This step-down voltage is a voltage set such that the capacitor bank 9 starts discharge and the voltage falls to a voltage equal to or lower than 28 volts, the output of the step-down chopper circuit 50 automatically changes to the input of the constant-voltage generating circuit 13.

When it is judged that the voltage outputted from the step-down chopper circuit 50 is not 28 volts ("No" at step S4422), the CPU 7*a* outputs a PWM signal corresponding to the detected step-down voltage from the PWM-signal generating circuit 7*e* to the gate of the FET 51 of the step-down chopper circuit 50 to set the step-down voltage to 28 volts (step S4423). As this PWM signal, a PWM signal associated with the step-down voltage detected may be set in a table in advance. A PWM signal may be generated by an analog circuit by comparing a comparative-signal generating circuit (a triangular wave) and an analog voltage set in advance (a voltage for outputting 28 volts). When it is judged that the voltage outputted from the step-down chopper circuit 50 is 28 volts ("Yes" at step S4422), the CPU 7*a* returns to step S4421. The CPU 7*a* repeats such an operation to maintain the step-down voltage at 28 volts with the PWM-signal generating circuit 7*e*.

FIGS. 45A to 45D are flowcharts of a procedure of operation mode control processing performed by the engine control unit of the image forming apparatus.

When DC power is supplied according to power-on of the main power supply or release of the energy saving mode, the CPU 10*a* of the engine control unit 10 performs initial setting related to the CPU 10*a* of the engine control unit 10, the peripheral circuit of the CPU 10*a*, and the memories (step S4501). The CPU 10*a* judges whether a fixing temperature is equal to or lower than the fixed temperature with the heating-unit-temperature detecting circuits 33 and 34 (step S4502). The set temperature is set to temperature at which time until the fixing device reaches a reload temperature (e.g., 180° C.) according to power-on of the main power supply or release of the energy saving mode is time set in advance. As the set temperature is higher, the reload time is shorter.

When it is judged that the fixing temperature is equal to or lower than the set temperature ("Yes" at step S4502), the CPU 10*a* judges from a result of detection by the charge-voltage detecting circuit 16 whether a charge voltage is equal to or higher than 30 volts (step S4503). When it is judged that the charge voltage is equal to or higher than 30 volts ("Yes" at step S4503), the CPU 10*a* performs the opening-and-closing-circuit control processing P1 (step S4504). Consequently, it is possible to stop supply of electric power from the commercial power supply and supply electric power accumulated in the capacitor bank 9 to the constant-voltage generating circuit 13. As a result, excess electric power is supplied to the heating unit of the fixing device and maximum electric power is supplied to the fixing heaters (step S4505). At the time of the normal operation, electric power is not supplied at 10% duty. Electric power may be supplied only at the time of warm-up of the fixing heater 30 as an auxiliary heater or at the time when a fixing temperature falls.

The CPU 10*a* judges from a result of detection by the charge-voltage detecting circuit 16 whether a charge voltage is equal to or higher than 28 volts (step S4506). When it is judged that the charge voltage is equal to or higher than 28 volts ("Yes" at step S4506), the CPU 10*a* judges that it is possible to use accumulated electric power and judges whether a heating unit temperature is equal to or higher than temperature set in advance (e.g., 175° C.) (step S4507). When it is judged that the heating unit temperature has not reached the temperature set in advance ("No" at step S4507), the CPU 10*a* returns to step S4505 and continues to supply maximum electric power of the heater rating of the AC fixing heaters 29 and 30.

When it is judged that the heating unit temperature is equal to or higher than the temperature set in advance ("Yes" at step S4507), when it is judged at step S4502 that the fixing temperature is not equal to or lower than the set temperature ("No" at step S4502), when it is judged at step S4503 that the charge temperature is not equal to or higher than 30 volts ("No" at step S4503), or when it is judged at step S4506 that the charge voltage at the capacitor bank 9 is not equal to or higher than 28 volts ("No" at step S4506), the CPU 10*a* performs the opening-and-closing-circuit control processing P2 (step S4508). Consequently, electric power is supplied from the commercial power supply (the step-down chopper circuit 50) to the load.

The CPU 10*a* supplies electric power at the normal time set in advance to the AC fixing heaters 29 and 30 of the fixing device (step S4509). The CPU 10*a* judges whether the heating unit has a reload temperature (e.g., 180° C.) (step S4510). When it is judged that the heating unit does not have the reload temperature ("No" at step S4510), the CPU 10*a* returns to step S45009 and the supply of electric power at the normal time set in advance to the AC fixing heaters 29 and 30 is continued. When it is judged that the heating unit has the reload temperature ("Yes" at step S4510), the fixing device comes into the standby state, the electric power at the normal time set in advance is supplied to the fixing heaters, and normal temperature control is carried out (step S4511).

The CPU 10*a* judges whether the fixing device is in the standby state again (step S4512). When it is judged that the fixing device is in the standby state ("Yes" at step S4512), the CPU 10*a* judges whether a charge voltage is lower than 35 volts (step S4513). When it is judged that the charge voltage is lower than 35 volts ("Yes" at step S4513), the CPU 10*a* performs the opening-and-closing-circuit control processing P3 (step S4514) and returns to step S4511. Consequently, the capacitor bank 9 is charged. When it is judged that the charge voltage is not lower than 35 volts ("No" at step S4513), the CPU 10*a* performs the opening-and-closing-circuit control processing P2 (step S4515) and returns to step S4511. Consequently, electric power is supplied from the commercial power supply (the step-down chopper circuit 50) to the load.

When it is judged at step S4512 that the fixing device is not in the standby state ("No" at step S4512), the CPU 10*a* sets an operation mode or an operation condition for using accumulated electric power with reference to the power use tables T1 and T2 defining use of accumulated electric power for each operation mode and image forming operation process (step S4516). For example, the CPU 10*a* acquires, from the power use tables T1 and T2, setting of the number of copies with which the temperature of the heating unit falls according to the number of continuous copies, a timer count of time when the temperature of the heating unit recovers when maximum power is supplied to the fixing heaters, i.e., accumulated electric power of the capacitor bank 9 is used, and post-processing that requires supply of electric power and sets the setting of the number of copies, the timer count, and the post-processing.

The CPU 10*a* judges whether the image forming apparatus is performing a copy operation (step S4517). When it is judged that the image forming apparatus is performing a copy operation ("Yes" at step S4517), the CPU 10*a* judges whether there is the setting of the number of copies acquired from the power use tables T1 and T2 (step S4518). When it is judged that there is the setting of the number of copies ("Yes" at step S4518), the CPU 10*a* performs plural copy processing (step S4519). Details of the plural copy processing are described later.

The CPU 10*a* performs the opening-and-closing-circuit control processing P2 (step S4520). Consequently, electric power is supplied from the commercial power supply (the step-down chopper circuit 50) to the load. The load continuously performs the image forming operation and normal electric power is supplied to the fixing heaters (step S4521). The CPU 10*a* judges whether sheets of a number corresponding to one job have been discharged (step S4522). When it is judged that the sheets of the number corresponding to one job have not been discharged ("No" at step S4522), the CPU 10*a* returns to step S4521. The load continues the image forming operation. When it is judged that the sheets of the number corresponding to one job have been discharged ("Yes" at step S4522), the CPU 10*a* judges whether supply of electric power is necessary for post-processing (step S4523).

When it is judged that supply of electric power is necessary for post-processing ("Yes" at step S4523), to increase an output of the DC power supply, the CPU 10*a* performs the opening-and-closing-circuit control processing P1 (step S4524). Consequently, power accumulated in the capacitor bank 9 is supplied to the constant-voltage generating circuit 13. A post-processing peripheral apparatus supplied with the electric power carries out a post-processing operation (step S4525). The CPU 10*a* returns to step S4511. When it is judged that supply of electric power to the post-processing is unnecessary ("No" at step S4523), since the copy operation is finished, the CPU 10*a* returns to step S4511).

When it is judged at step S4517 that the image forming apparatus is not performing the copy operation ("No" at step S4517), the CPU 10*a* judges whether the image forming apparatus is in the energy saving mode (step S4526). When it is judged that the image forming apparatus is not in the energy saving mode ("No" at step S4526), the CPU 10*a* returns to step S4511. When it is judged that the image forming apparatus is in the energy saving mode ("Yes" at step S4526), the CPU 10*a* judges whether a charge voltage is lower than 35 volts (step S4527). When it is judged that the charge voltage is lower than 35 volts ("Yes" at step S4527), to charge the capacitor bank 9, the CPU 10*a* performs the opening-and-closing-circuit control processing P3 (step S4528) and returns to step S4526. Although not shown in this flowchart, when this charge operation is finished, the image forming apparatus control unit also shifts to the energy saving mode. When it is judged that the charge voltage is not lower than 35 volts ("No" at step S4527), the CPU 10*a* switches the first switching circuit to the commercial power supply side (step S4529), switches the second switching circuit to the commercial power supply side (step S4530), and returns to step S4526.

Figure 46:
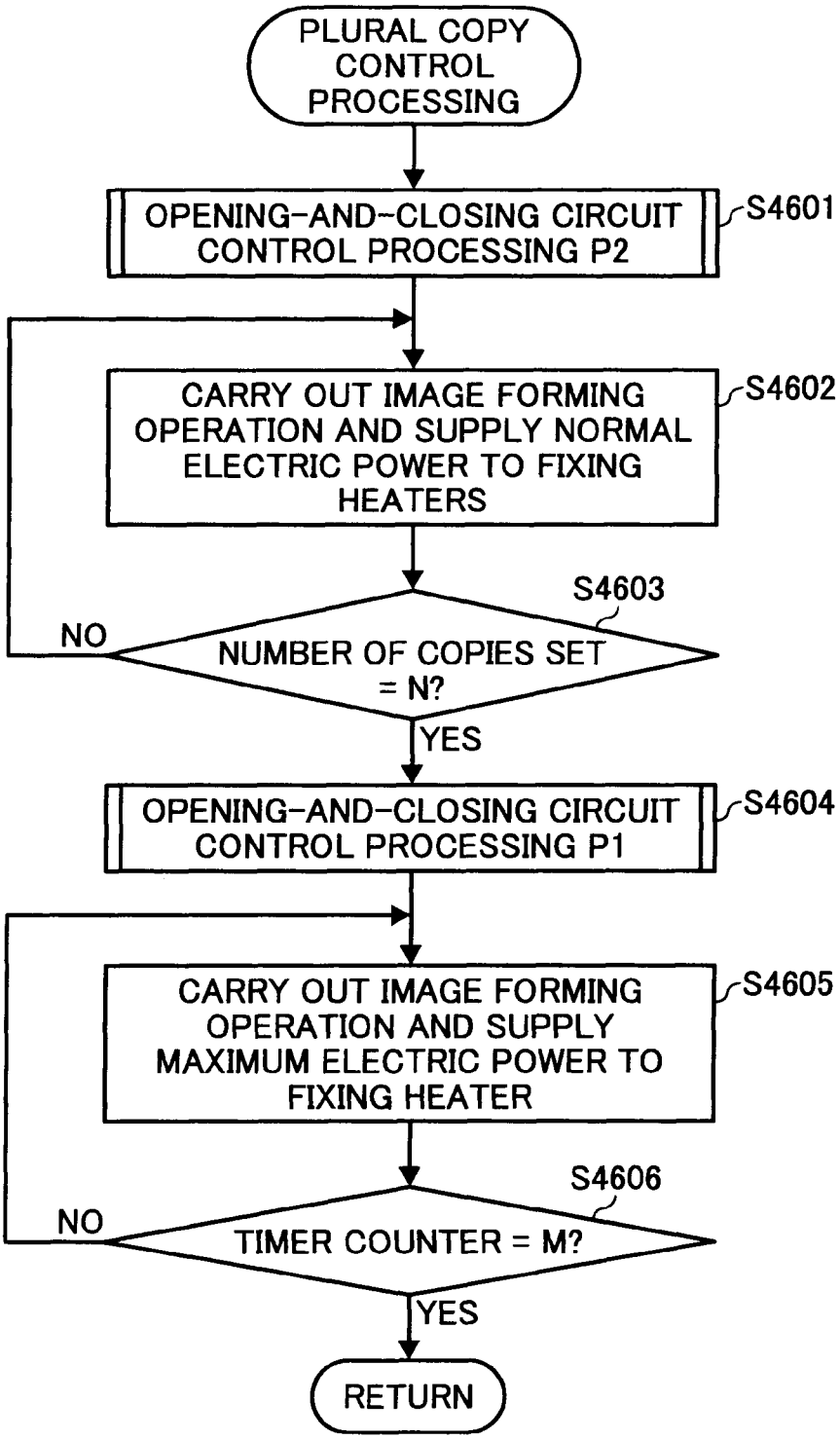
FIG. 46 is a flowchart of a procedure of plural-copy control processing performed by an engine control unit of a printer according to the sixth embodiment.

FIG. 46 is a flowchart of a procedure of plural-copy control processing performed by the engine control unit of the printer.

First, the CPU 10*a* of the engine control unit 10 performs the opening-and-closing-circuit control processing P2 (step S4601). Consequently, electric power is supplied from the commercial power supply (the step-down chopper circuit 50) to the load. The load carry out an image forming operation and normal electric power is supplied to the AC fixing heaters 29 and 30 (step S4602). The CPU 10*a* judges whether copying for the number of copies N acquired from the power use tables has been carried out (step S4603). When it is judged that copying for the number of copies N has not been carried out ("No" at step S4603), the CPU 10*a* returns to step S4602. The load repeats the image forming operation. When it is judged that copying for the number of copies N has been carried out ("Yes" at step S4603), the CPU 10*a* performs the opening-and-closing-circuit control processing P1 (step S4604). Consequently, the supply of electric power from the commercial power supply is stopped and electric power accumulated in the capacitor bank 9 is supplied to the constant-voltage generating circuit 13. As a result, excess electric power is supplied to the heating unit of the fixing device. Thus, it is possible to supply the maximum power of the heater rating to the AC fixing heaters 29 and 30. It is possible to prevent the temperature of the heating unit from falling to be lower than a fixed image guarantee temperature.

The CPU 10*a* continues the state in which the maximum power is supplied to the AC fixing heaters 29 and 30 and continues the image forming operation (step S4605). The CPU 10*a* judges whether the timer counter is M (step S4606). When it is judged that the timer counter is not M ("No" at step S4606), the CPU 10*a* returns to step S4605. When it is judged that the timer counter is M ("Yes" at step S4606), the CPU 10*a* leaves the processing.

The temperature fall of the heating unit of the fixing device occurs because heat of a fixing pressure roller moves to a sheet when sheet supply is started. Therefore, when this pressure roller is warmed, the temperature fall is solved. The time M until the pressure roller is warmed is acquired from the power use table T2 and set as the timer count. Thus, it is possible to supply the maximum power of the heater rating to the fixing heaters until the time M comes.

Figure 47:
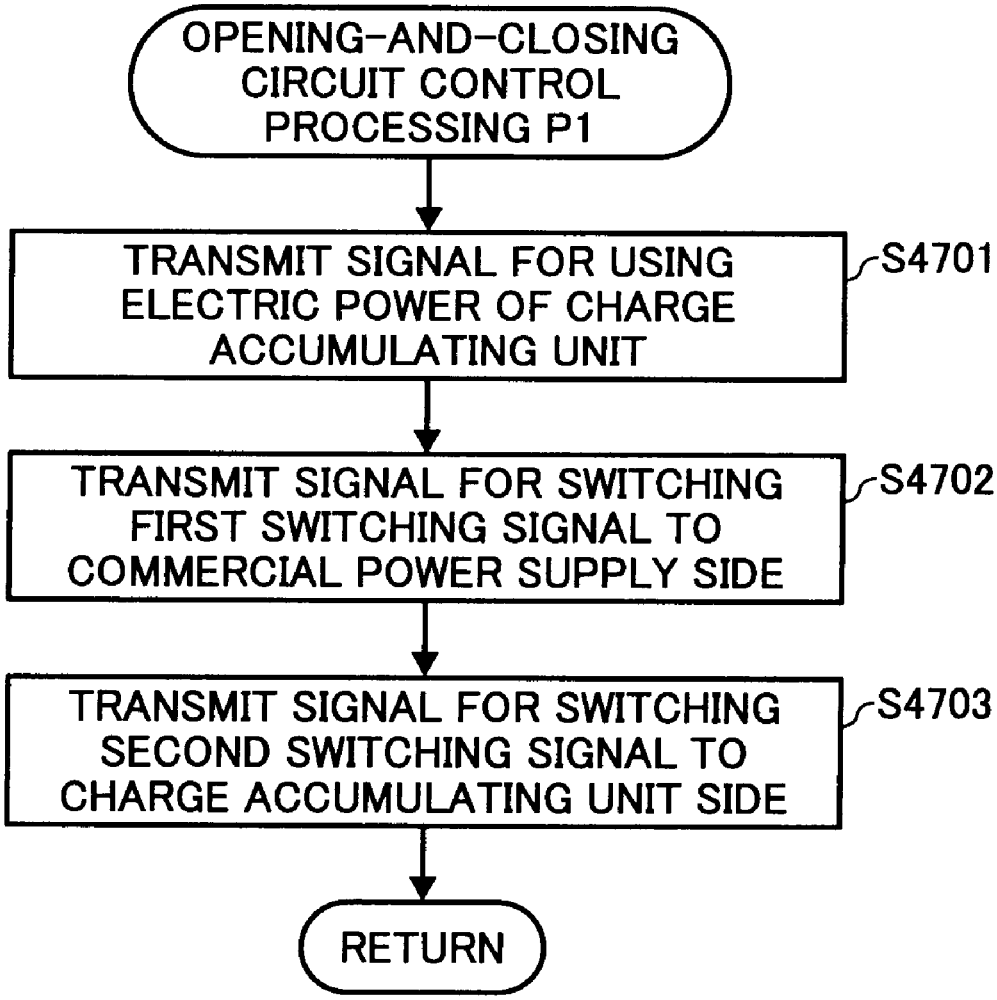
FIG. 47 is a flowchart of a procedure of opening-and-closing-circuit control processing P1 performed by the engine control unit of the image forming apparatus according to the sixth embodiment.

FIG. 47 is a flowchart of a procedure of the opening-and-closing-circuit control processing P1 performed by the engine control unit of the image forming apparatus. According to this processing, electric power is supplied from the capacitor bank 9. The constant-voltage generating circuit 13 outputs a constant voltage and supplies electric power to the load.

The CPU 10*a* transmits a signal for using electric power of the charge accumulating unit to the CPU 7*a* of the step-down-output control and charge control circuit 7 (step S4701). The CPU 1*a* transmits a signal for switching the first switching circuit to the commercial power supply side to the CPU 7*a* of the step-down-output control and charge control circuit 7 (step S4702) and transmits a signal for switching the second switching circuit to the charge accumulating unit side to the CPU 7*a* of the step-down-output control and charge control circuit 7 (step S4703).

Figure 48:
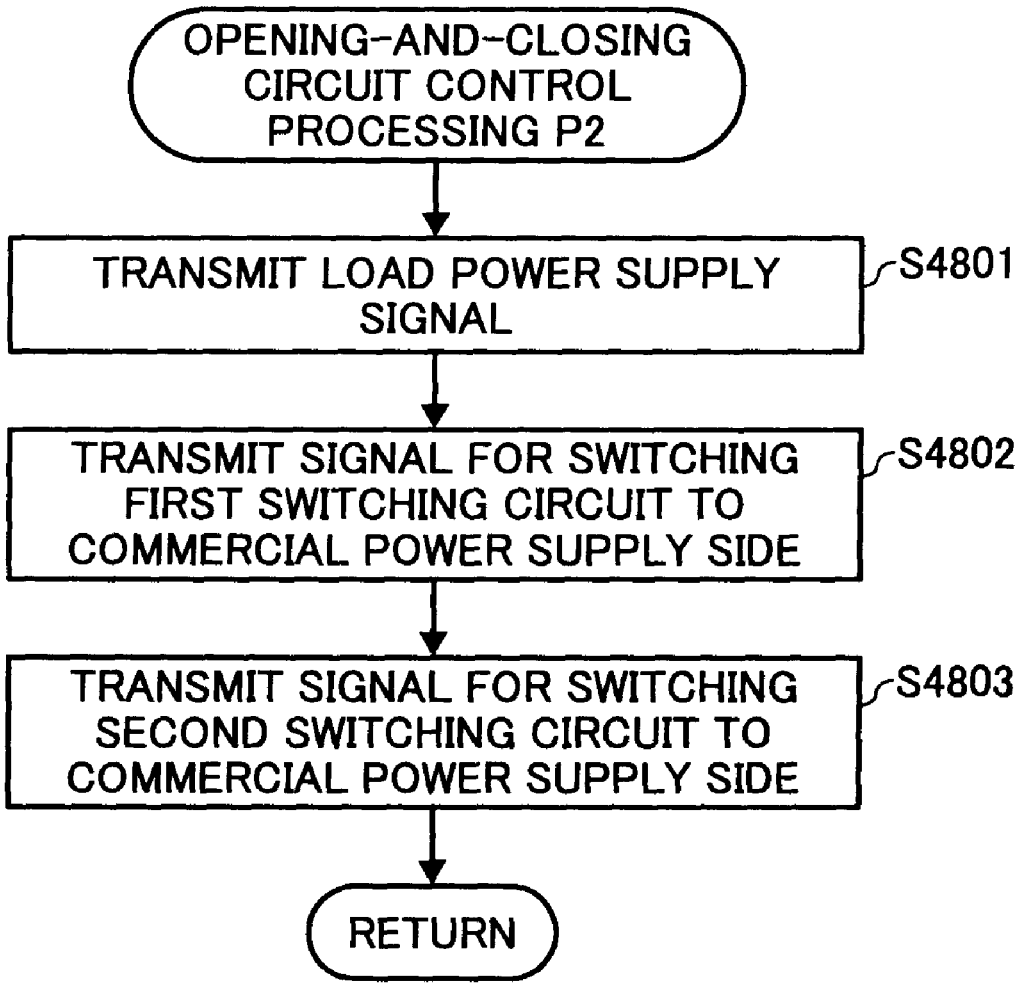
FIG. 48 is a flowchart of a procedure of opening-and-closing-circuit control processing P2 performed by the engine control unit of the image forming apparatus according to the sixth embodiment.

FIG. 48 is a flowchart of a procedure of the opening-and-closing-circuit control processing P2 performed by the engine control unit of the image forming apparatus. According to this processing, electric power is supplied from the commercial power supply (the step-down chopper circuit 50) to the load.

The CPU 10*a* transmits a signal for supplying electric power to the load to the CPU 7*a* of the step-down-output control and charge control circuit 7 (step S4801). The CPU 10*a* transmits a signal for switching the first switching circuit to the commercial power supply side to the CPU 7*a* of the step-down-output control and charge control circuit 7 (step S4802) and transmits a signal for switching the second switching circuit to the charge accumulating unit side to the CPU 7*a* of the step-down-output control and charge control circuit 7 (step S4803).

Figure 49:
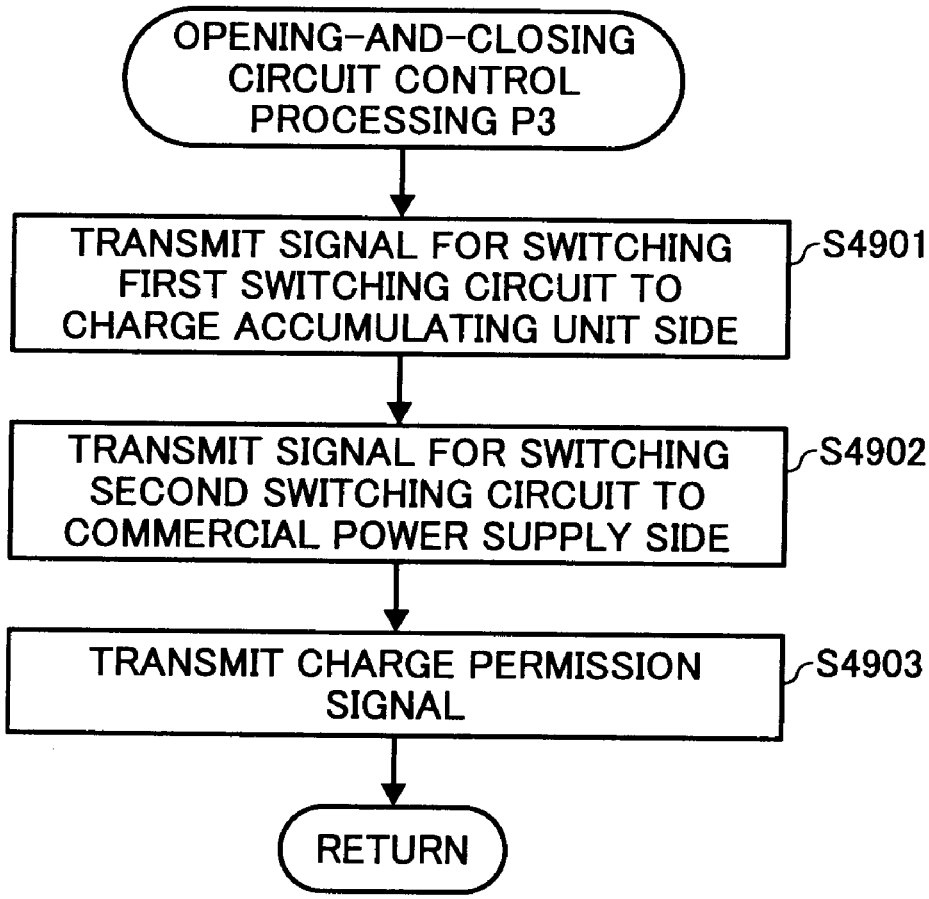
FIG. 49 is a flowchart of a procedure of opening-and-closing-circuit control processing P3 performed by the engine control unit of the image forming apparatus according to the sixth embodiment.

FIG. 49 is a flowchart of a procedure of the opening-and-closing-circuit control processing P3 performed by the engine control unit of the image forming apparatus. According to this processing, the capacitor bank 9 is charged.

The CPU 10*a* transmits a signal for switching the first switching circuit to the charge accumulating unit side to the CPU 7*a* of the step-down-output control and charge control circuit 7 (step S4901) and transmits a signal for switching the second switching circuit to the commercial power supply side to the CPU 7*a* of the step-down-output control and charge control circuit 7 (step S4902). The CPU 10*a* transmits a charge permission signal to the CPU 7*a* of the step-down-output control and charge control circuit 7 (step S4903).

In this way, in the power supply device 600 according to this embodiment, constant voltage is generated by the constant-voltage generating circuit 13 from an output of the capacitor bank 9 charged by the commercial power supply or an output of the commercial power supply and the constant voltage generated is supplied to the load. Thus, it is possible to realize a plurality of functions, which are realized by a plurality of circuits in the past, with one constant-voltage generating circuit 13 and simplify a circuit configuration of the engine power supply unit of the printer. This makes it possible to reduce a warm-up time of the fixing device using the commercial power supply for general offices in Japan without applying special work related to a power supply and simplify a circuit configuration of the power supply device including the charge accumulating unit. Since the circuit configuration of the power supply device including the charge accumulating unit is simplified, it is possible to reduce manufacturing cost for the image forming apparatus. Since a complicated structure is not adopted for the circuit configuration of the power supply device, it is possible to realize improvement of a quality of the apparatus and improvement of easiness of maintenance.

Since a voltage at the commercial power supply is stepped down and the capacitor bank 9 is charged with the voltage stepped down, it is possible to reduce the number of capacitor cells connected in series. It is possible to accumulate an accumulated charge amount (equal to or higher than DC 30 volts) acceptable as a voltage at the fixing device (a halogen heater).

By using a normal-close relay for the switching circuit, in a state in which the main power supply is off, it is possible to supply an output of the step-down chopper circuit 50 to the constant-voltage generating circuit 13. Thus, a circuit configuration for supplying an output of the commercial power supply (the step-down chopper circuit 50) or an output of the capacitor bank 9 is simplified.

Figure 50:
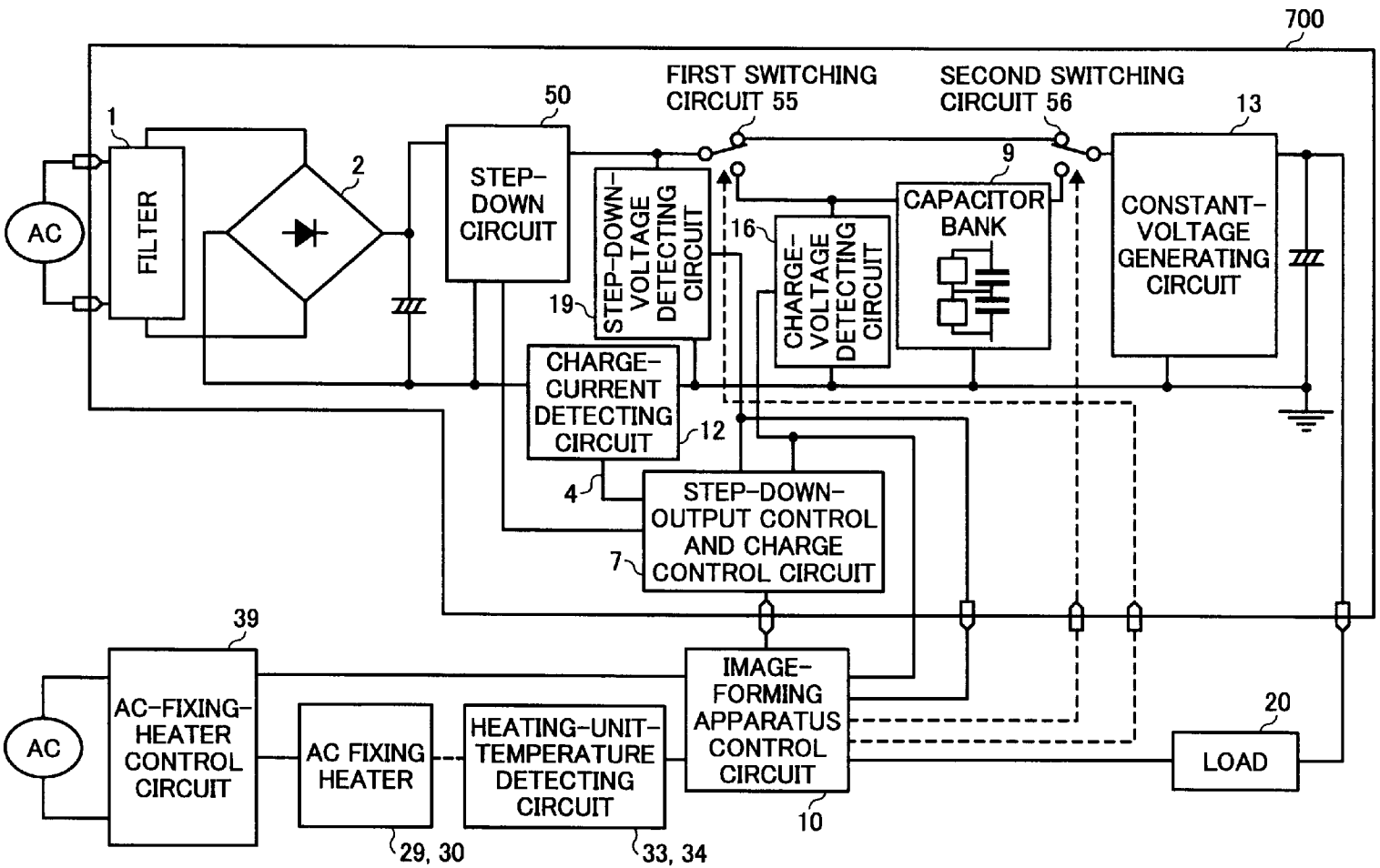
FIG. 50 is a circuit diagram of a circuit configuration of a power supply device according to another embodiment.

FIG. 50 is a circuit diagram of a circuit configuration of a power supply device according to another embodiment. In a power supply device 700 shown in FIG. 50, drive circuit for the relays 55*a* and 56*a* of the power supply device 600 according to the sixth embodiment is provided in an image forming apparatus and an interface for directly controlling the first and the second switching circuits 55 and 56 on the image forming apparatus side is provided.

As in the sixth embodiment, a power supply device according to a seventh embodiment of the present invention steps down a voltage outputted from the commercial power supply to charge a charge accumulating unit and changes a voltage outputted from the commercial power supply and a voltage outputted from the charge accumulating unit to constant voltages with a constant-voltage generating circuit to supply the voltages to load. The seventh embodiment is different from the sixth embodiment in that a first opening and closing circuit is used instead of the first switching circuit and a second opening and closing circuit and a third opening and closing circuit are used instead of the second switching circuit.

Figure 51:
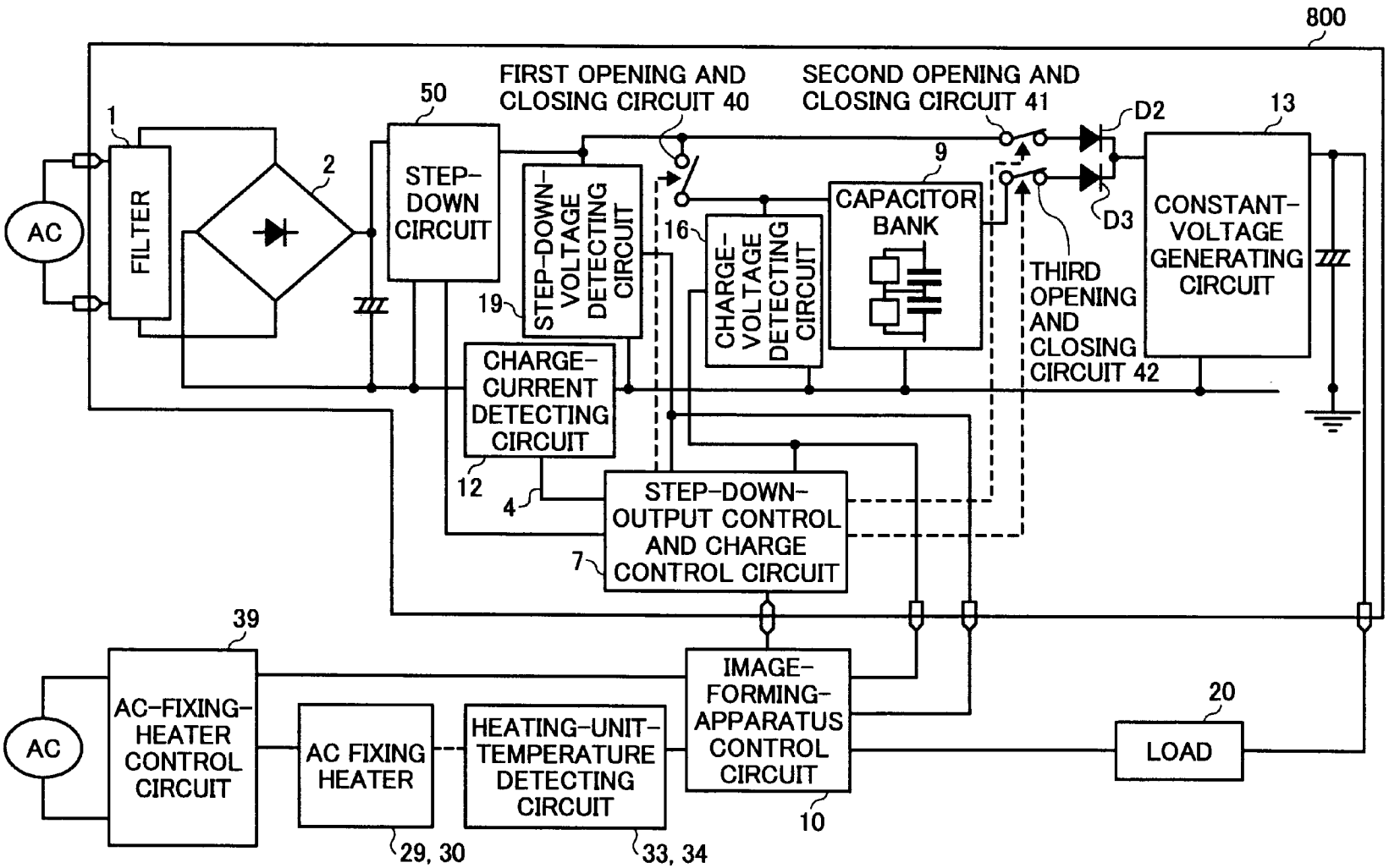
FIG. 51 is a circuit diagram of a circuit configuration of a power supply device according to a seventh embodiment of the present invention.
Figure 52A:
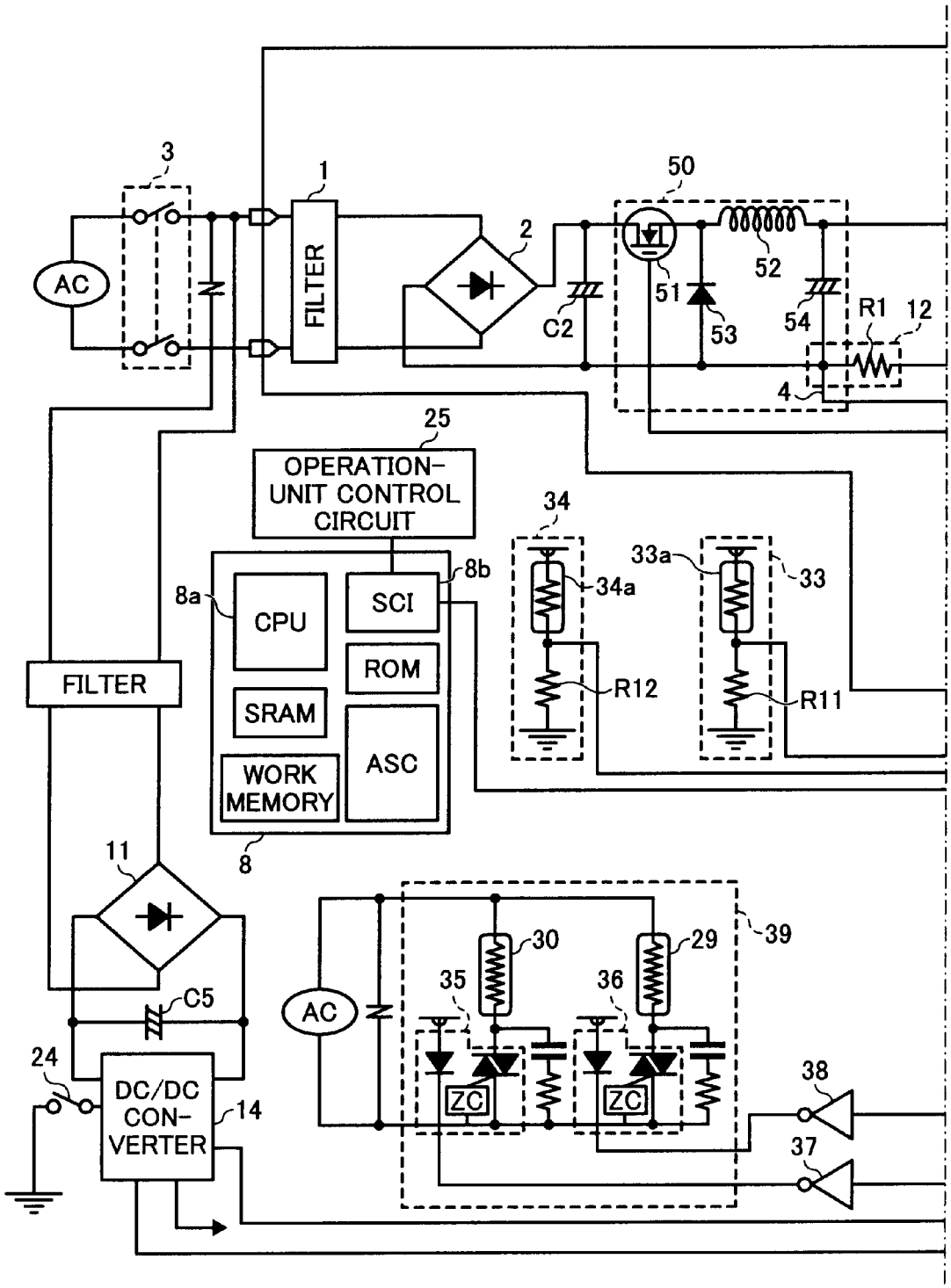
FIG. 52 is a detailed circuit diagram of a detailed circuit configuration of the power supply device according to the seventh embodiment.
Figure 52B:
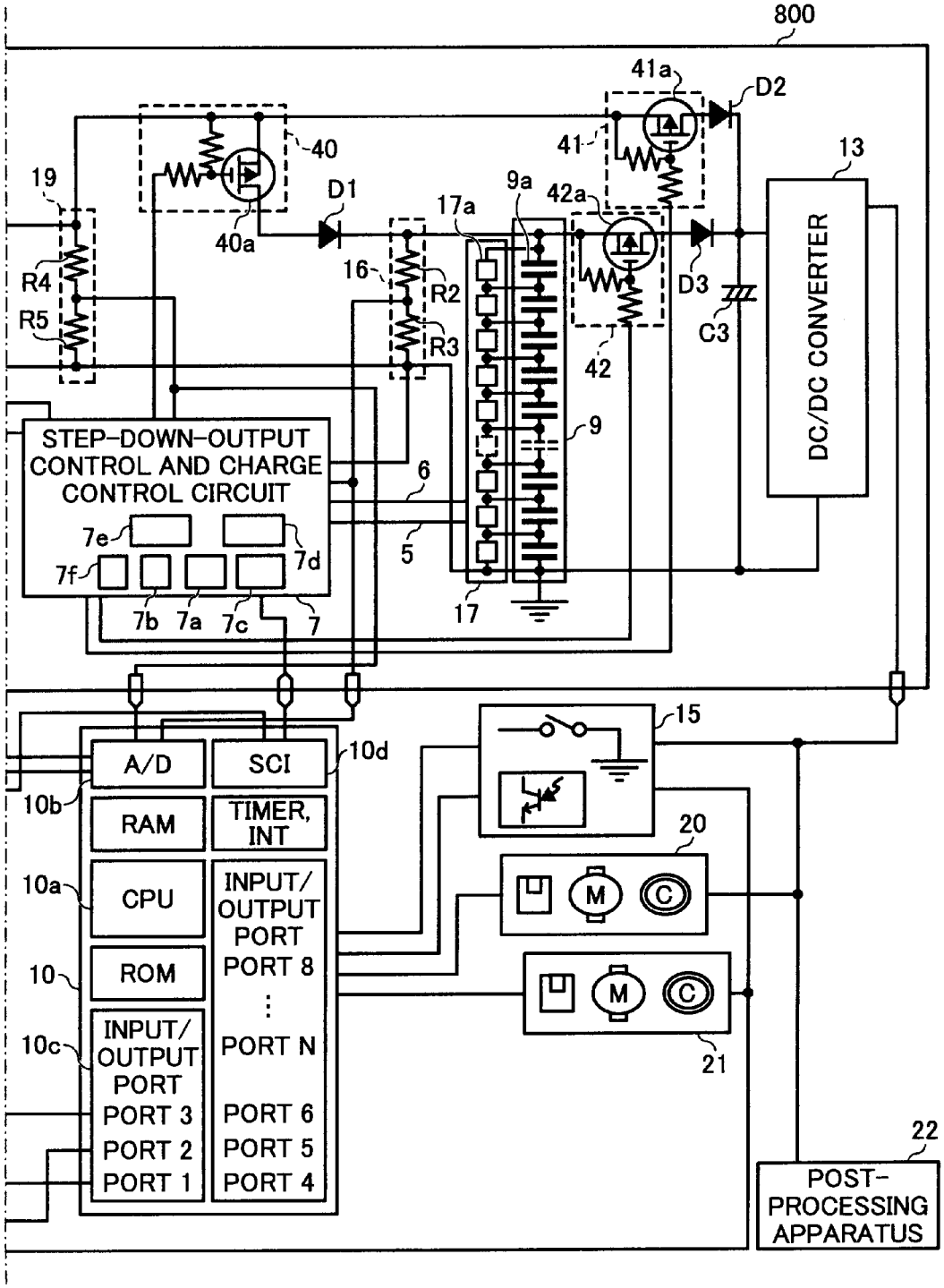

FIG. 51 is a circuit diagram of a circuit configuration of the power supply device according to the seventh embodiment. FIG. 52 is a detailed circuit diagram of a detailed circuit configuration of the power supply device according to the seventh embodiment. The power supply device shown in FIGS. 51 and 52 is mounted on an engine unit of a printer.

A power supply device 800 according to this embodiment includes the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the step-down-output control and charge control circuit 7, the first opening and closing circuit 40, the second opening and closing circuit 41, and the third opening and closing circuit 42. An engine unit of a printer mounted with the power supply device 800 includes the engine control unit 10, the load 20, the AC fixing heaters 29 and 30, the heating-unit-temperature detecting circuits 33 and 34, and the AC-fixing-heater control circuit 39.

Structures and functions of the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the step-down-output control and charge control circuit 7, the first opening and closing circuit 40, the second opening and closing circuit 41, and the third opening and closing circuit 42 are substantially the same as those in the sixth embodiment. Thus, the above explanations are referred to and only differences are explained. The engine control unit 10, the load 20, the AC fixing heaters 29 and 30, the heating-unit-temperature detecting circuits 33 and 34, and the AC-fixing-heater control circuit 39 are the same as those in the sixth embodiment. Thus, only differences are explained below.

When a voltage at the capacitor bank 9 is discharged, i.e., when the voltage is supplied to the constant-voltage generating circuit 13 via the third opening and closing circuit 42, the step-down-output control and charge control circuit 7 outputs a PWM signal for lowering the voltage to an input voltage, which allows the constant-voltage generating circuit 13 to generate a constant voltage, to the gate of the FET 51. Consequently, the capacitor bank 9 starts discharge. When the voltage inputted to the constant-voltage generating circuit 13 falls to the voltage, which allows the constant-voltage generating circuit 13 to generate a constant voltage, the input of the constant-voltage generating circuit 13 is automatically switched to the step-down chopper circuit 50 side.

The first opening and closing circuit 40 opens and closes the connection between the output of the step-down chopper circuit 50 and the capacitor bank 9. The second opening and closing circuit 41 connects the output of the step-down chopper circuit 50 and the input of the constant-voltage generating circuit 13. The third opening and closing circuit 42 opens and closes the connection between the input of the constant-voltage generating circuit 13 and the capacitor bank 9. It is possible to supply a voltage to the constant-voltage generating circuit 13 even at the time of charge by closing the second opening and closing circuit 41. In charging the charge accumulating unit when it is unnecessary to supply electric power to the load, for example, at the time of the energy saving mode, it is possible to reduce electric power if the second opening and closing circuit 41 is opened.

When a relay is used for the second opening and closing circuit 41 and the third opening and closing circuit 42, it is possible to continuously supply electric power to the constant-voltage generating circuit 13 if a signal for opening the third opening and closing circuit 42 is outputted in a fixed time after a signal for turning on the second opening and closing circuit 41 is outputted. When the second opening and closing circuit 41 is turned off, a signal for opening the second opening and closing circuit 41 only has to be outputted in a fixed time after a signal for turning on the third opening and closing circuit 42 is outputted.

The serial controller (SIC) 10*d* of the engine control unit 10 controls opening and closing of the first opening and closing circuit 40 by outputting a signal for turning on and off the gate of the FET 40*a* of the first opening and closing circuit 40 to the step-down-output control and charge control circuit 7. The serial controller (SIC) 10*d* of the engine control unit 10 controls opening and closing of the second opening and closing circuit 41 by outputting a signal for turning on and off the gate of the FET 41*a* to the step-down-output control and charge control circuit 7. The serial controller (SIC) 10*d* of the engine control unit 10 controls opening and closing of the third opening and closing circuit 42 by outputting a signal for turning on and off the gate of the FET 42 to the step-down-output control and charge control circuit 7. The opening and closing operations of the opening and closing circuits are described later.

Charge control processing and operation mode control processing by the power supply device 800 constituted as described above are substantially the same as those in the sixth embodiment. Thus, FIGS. 44A to 46 and the explanations of the figure are referred to. Only differences from the sixth embodiment are explained.

Figure 53:
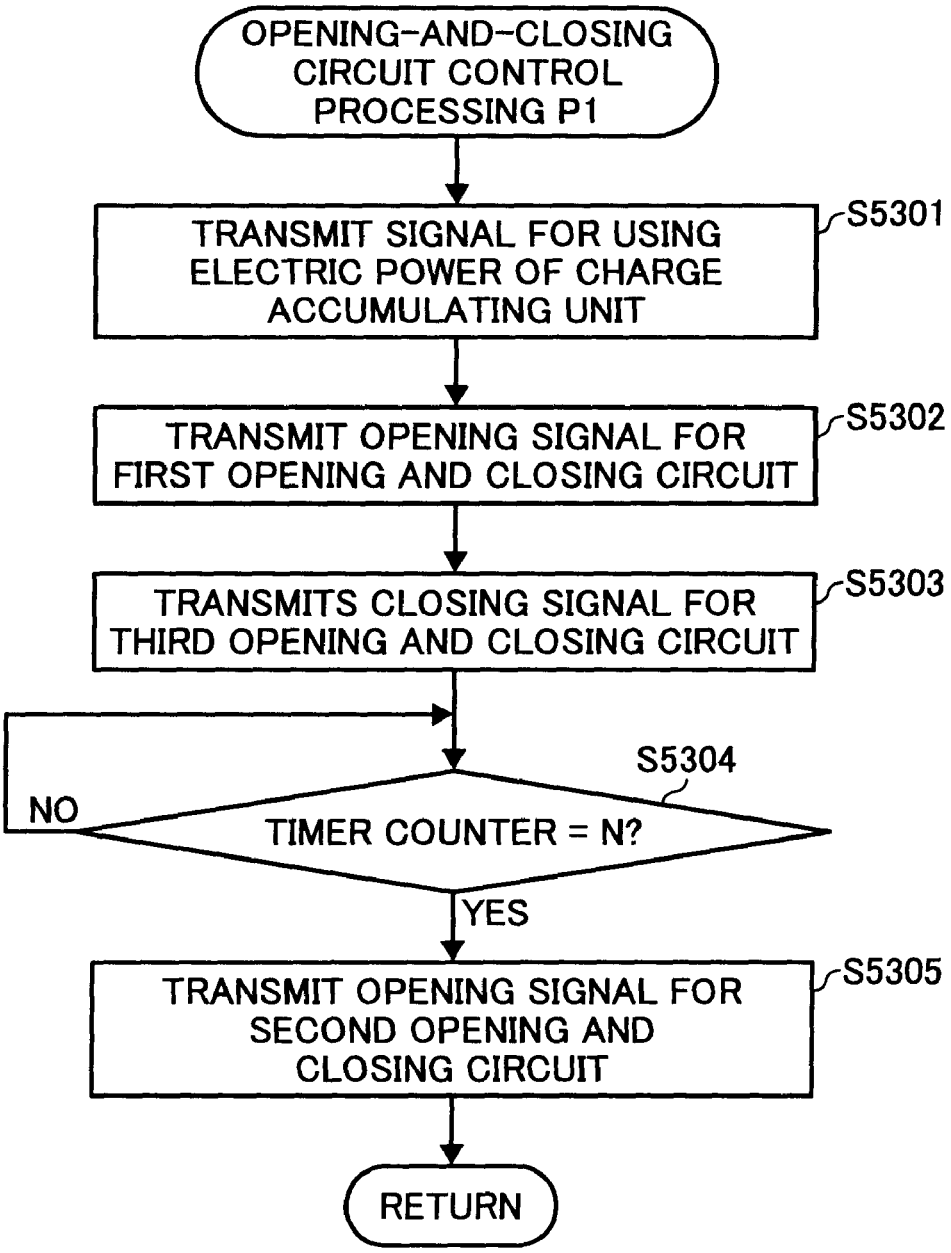
FIG. 53 is a flowchart of a procedure of opening-and-closing-circuit control processing P1 performed by an engine control unit of an image forming apparatus according to the seventh embodiment.

The opening-and-closing-circuit control processing P1 in the flowcharts shown in FIGS. 45A to 45D is replaced with opening-and-closing-circuit control processing P1 shown in FIG. 53. The opening-and-closing-circuit control processing P2 in the flowcharts shown in FIGS. 45A to 45D is replaced with opening-and-closing-circuit control processing P2 shown in FIG. 54. The opening-and-closing-circuit control processing P3 in the flowcharts shown in FIGS. 45A to 45D is replaced with opening-and-closing-circuit control processing P3 shown in FIG. 55.

FIG. 53 is a flowchart of a procedure of the opening-and-closing-circuit control processing P1 performed by the engine control unit of the image forming apparatus. According to this processing, the constant-voltage generating circuit 13 generates a constant voltage using accumulated electric power of the capacitor bank 9 and supplies electric power to the load.

The CPU 10*a* transmits a signal for using electric power of the charge accumulating unit to the CPU 7*a* of the step-down-output control and charge control circuit 7 (step S5301). The CPU 10*a* transmits an opening signal for the first opening and closing circuit to the CPU 7*a* of the step-down-output control and charge control circuit 7 (step S5302) and transmits a closing signal for the third opening and closing circuit to the CPU 7*a* of the step-down-output control and charge control circuit 7 (step S5303). When a relay is used for the second and the third opening and closing circuits, the CPU 10*a* counts time N with the timer counter (step S5304). The CPU 10*a* transmits an opening signal for the second opening and closing circuit to the CPU 7*a* of the step-down-output control and charge control circuit 7 (step S5305).

Figure 54:
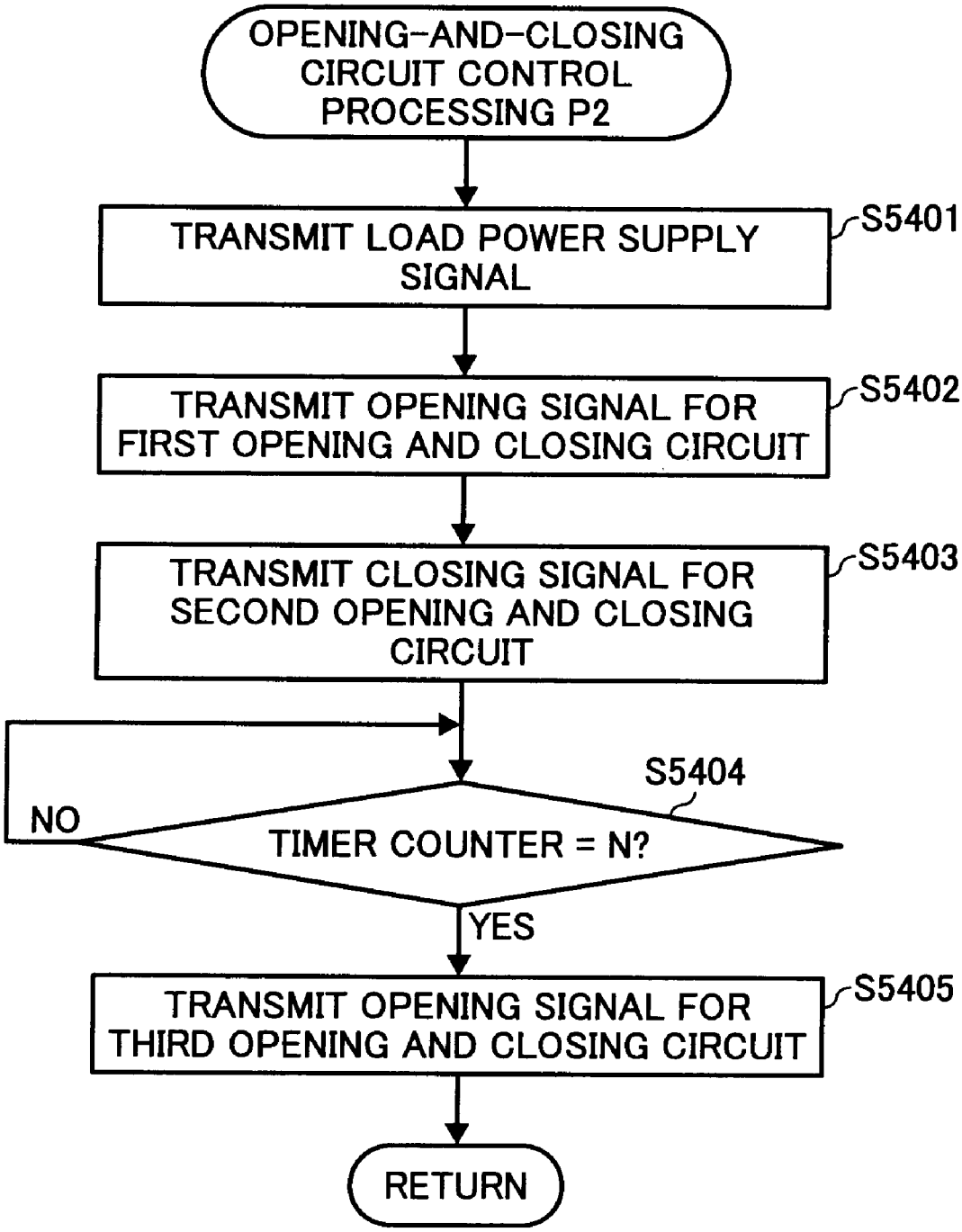
FIG. 54 is a flowchart of a procedure of opening-and-closing-circuit control processing P2 performed by the engine control unit of the image forming apparatus according to the seventh embodiment.

FIG. 54 is a flowchart of a procedure of the opening-and-closing-circuit control processing P2 performed by the engine control unit of the image forming apparatus. According to this processing, the constant-voltage generating circuit 13 generates a constant voltage using a voltage outputted from the commercial power supply and supplies electric power to the load.

The CPU 10*a* transmits a load power supply signal to the CPU 7*a* of the step-down-output control and charge control circuit 7 (step S5401). The CPU 10*a* transmits an opening signal for the first opening and closing circuit to the CPU 7*a* of the step-down-output control and charge control circuit 7 (step S5402) and outputs a closing signal for the second opening and closing circuit to the CPU 7*a* of the step-down-output control and charge control circuit 7 (step S5403). When a relay is used for the second and the third opening and closing circuits, the CPU 10*a* counts time N with the timer counter (step S5404). The CPU 10*a* outputs an opening signal for the third opening and closing circuit to the CPU 7*a* of the step-down-output control and charge control circuit 7 (step S5405).

Figure 55:
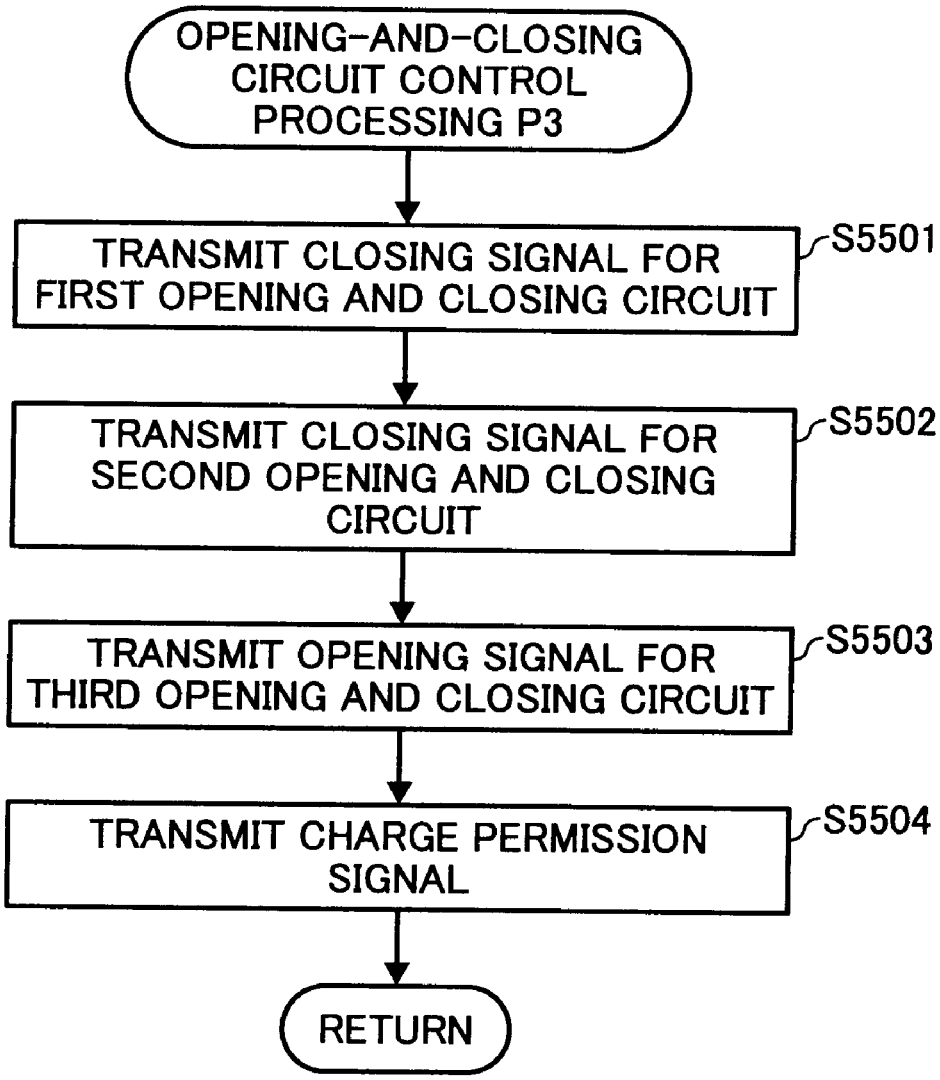
FIG. 55 is a flowchart of a procedure of opening-and-closing-circuit control processing P3 performed by the engine control unit of the image forming apparatus according to the seventh embodiment.

FIG. 55 is a flowchart of a procedure of the opening-and-closing-circuit control processing P3 performed by the engine control unit of the image forming apparatus. According to this processing, a voltage outputted from the commercial power supply is stepped down and the charge accumulating unit is charged by the step-down voltage.

The CPU 10*a* outputs a closing signal for the first opening and closing circuit to the CPU 7*a* of the step-down-output control and charge control circuit 7 (step S5501) and outputs a closing signal for the second opening and closing circuit to the CPU 7*a* of the step-down-output control and charge control circuit 7 (step S5502). The CPU 10*a* outputs an opening signal for the third opening and closing circuit to the CPU 7*a* of the step-down-output control and charge control circuit 7 (step S5503). The CPU 10*a* transmits a charge permission signal to the CPU 7*a* of the step-down-output control and charge control circuit 7 (step S5504).

As described above, in the power supply device 800 according to the seventh embodiment, in addition to the effects described above, it is possible to supply electric power to the load even at the time of charge by closing the second opening and closing circuit. Thus, even at the time of charge, it is possible to connect load in which fluctuation to some degree of a power supply voltage does not cause a problem. When it is unnecessary to supply electric power to the load, for example, at the time of the energy saving mode, it is possible reduce electric power by opening the second opening and closing circuit. It is possible to prevent interruption of electric power supplied to the load by opening the third opening and closing circuit after closing the second opening and closing circuit or opening the second opening and closing circuit after closing the second opening and closing circuit.

As in the sixth embodiment, a power supply device according to an eighth embodiment of the present invention steps down a voltage outputted from the commercial power supply to charge a charge accumulating unit and changes a voltage outputted from the commercial power supply and a voltage outputted from the charge accumulating unit to constant voltages with a constant-voltage generating circuit to supply the voltages to load. The eighth embodiment is different from the sixth embodiment in that a first opening and closing circuit is used instead of the first switching circuit and a second opening and closing circuit is used instead of the second switching circuit.

Figure 56:
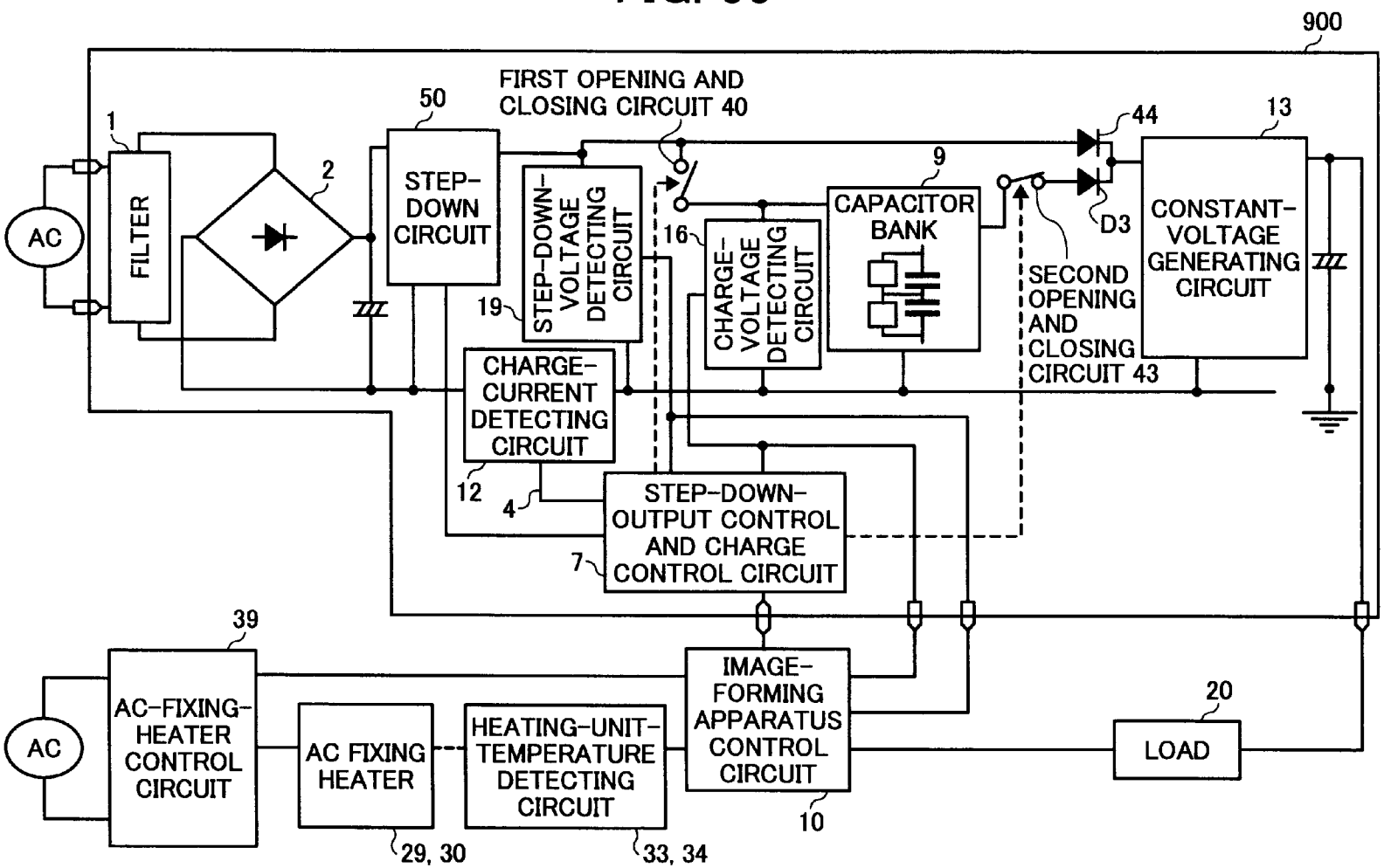
FIG. 56 is a circuit diagram of a circuit configuration of a power supply device according to an eighth embodiment of the present invention.
Figures 57, 57A, 57B:
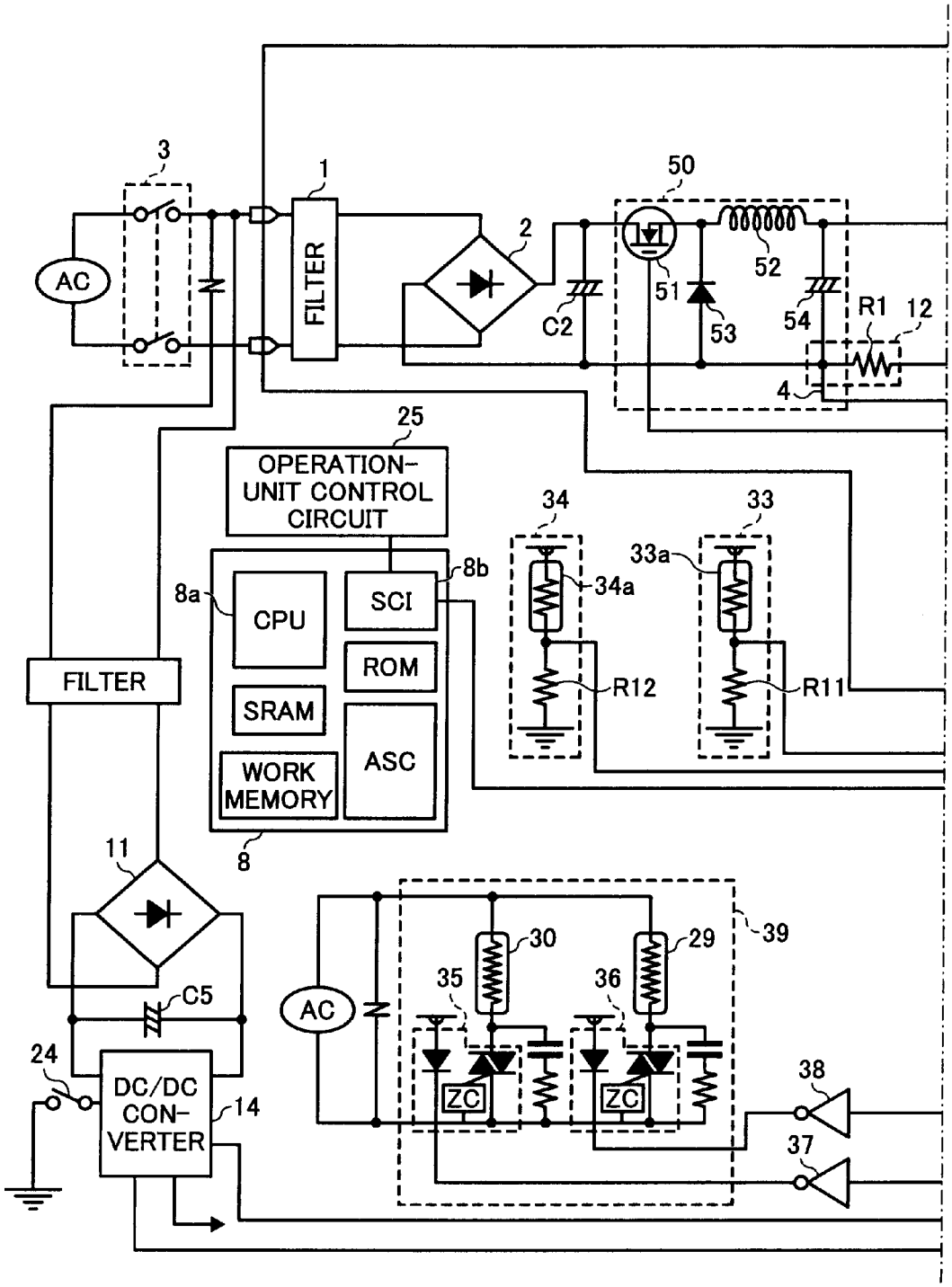
FIG. 57 is a detailed circuit diagram of a detailed circuit configuration of the power supply device according to the eighth embodiment.
Figure 57B:
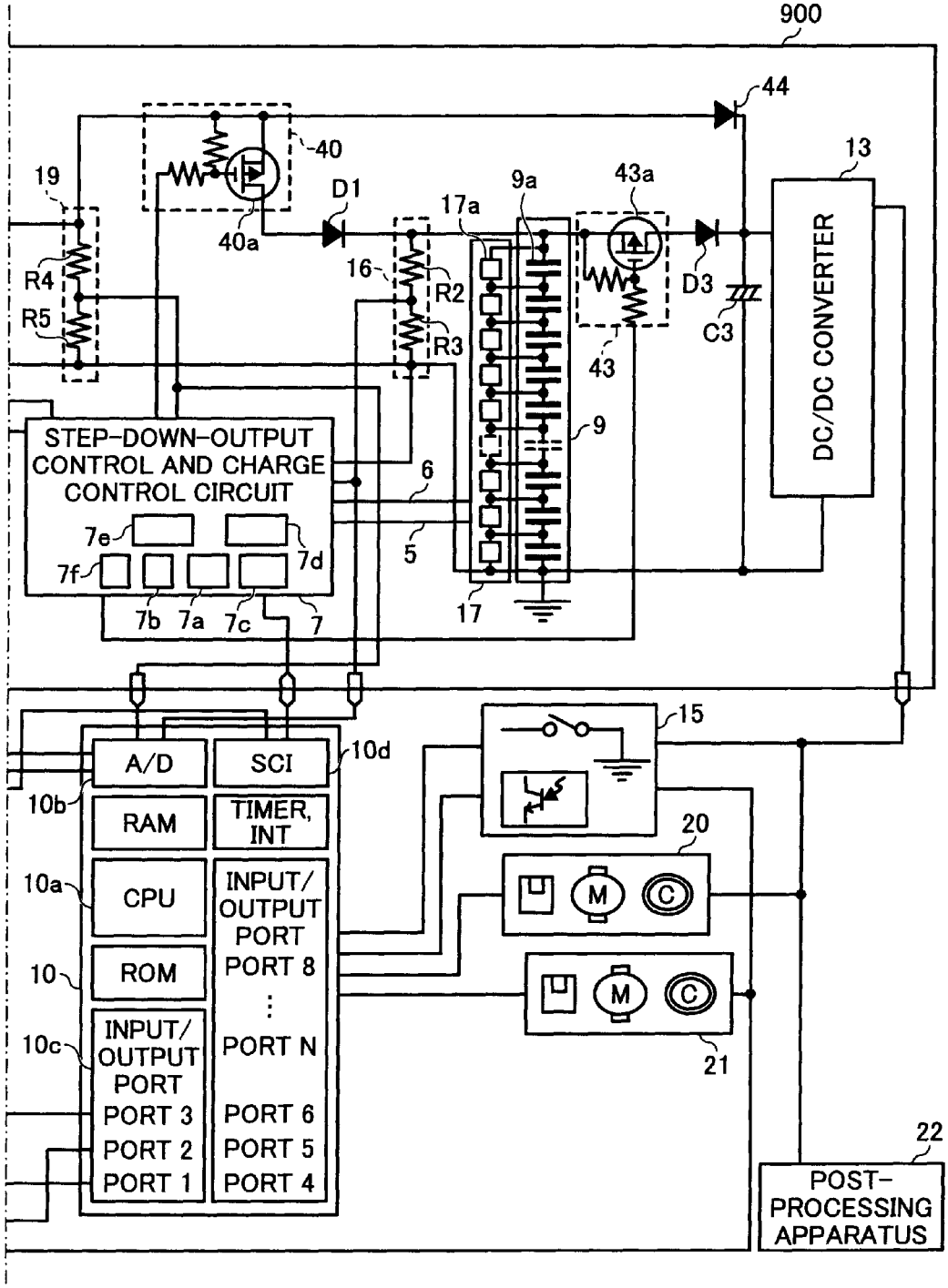

FIG. 56 is a circuit diagram of a circuit configuration of the power supply device according to the eighth embodiment. FIG. 57 is a detailed circuit diagram of a detailed circuit configuration of the power supply device according to the eighth embodiment. The power supply device shown in FIGS. 56 and 57 is mounted on an engine unit of a printer.

A power supply device 900 according to this embodiment includes the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the step-down-output control and charge control circuit 7, the first opening and closing circuit 40 and the second opening and closing circuit 43. An engine unit of a printer mounted with the power supply device 900 includes the engine control unit 10, the load 20, the AC fixing heaters 29 and 30, the heating-unit-temperature detecting circuits 33 and 34, and the AC-fixing-heater control circuit 39.

Structures and functions of the filter 1, the full-wave rectifying circuit 2, the step-down chopper circuit 50, the step-down-voltage detecting circuit 19, the capacitor bank 9, the charge-voltage detecting circuit 16, the constant-voltage generating circuit 13, the charge-current detecting circuit 12, the step-down-output control and charge control circuit 7, the first opening and closing circuit 40, and the second opening and closing circuit 43 are substantially the same as those in the sixth embodiment. Thus, the above explanations are referred to and only differences are explained. The engine control unit 10, the load 20, the AC fixing heaters 29 and 30, the heating-unit-temperature detecting circuits 33 and 34, and the AC-fixing-heater control circuit 39 are the same as those in the sixth embodiment. Thus, only differences are explained below.

As in the embodiments described above, the first opening and closing circuit 40 opens and closes the connection between the output of the step-down chopper circuit 50 and the capacitor bank 9. The second opening and closing circuit 41 connects the output of the step-down chopper circuit 50 to the input of the constant-voltage generating circuit 13 via the diode 44 and opens and closes the connection between the input of the constant-voltage generating circuit 13 and the capacitor bank 9. These circuits always supplies voltages to the constant-voltage generating circuit 13 via the diode. Thus, when electric power is discharged from the capacitor bank 9, if a voltage at the step-down chopper circuit 50 is set lower than a voltage at the capacitor bank 9, a voltage is not supplied from the capacitor bank 9 to the constant-voltage generating circuit 13.

The serial controller (SIC) 10*d* of the engine control unit 10 controls opening and closing of the first opening and closing circuit 40 by outputting a signal for turning on and off the gate of the FET 40*a* of the first opening and closing circuit 40 to the step-down-output control and charge control circuit 7. The serial controller (SIC) 10*d* of the engine control unit 10 controls opening and closing of the second opening and closing circuit 43 by outputting a signal for turning on and off the gate of the FET 43*a* to the step-down-output control and charge control circuit 7. Opening and closing operations of the opening and closing circuits are described later.

Figure 58A:
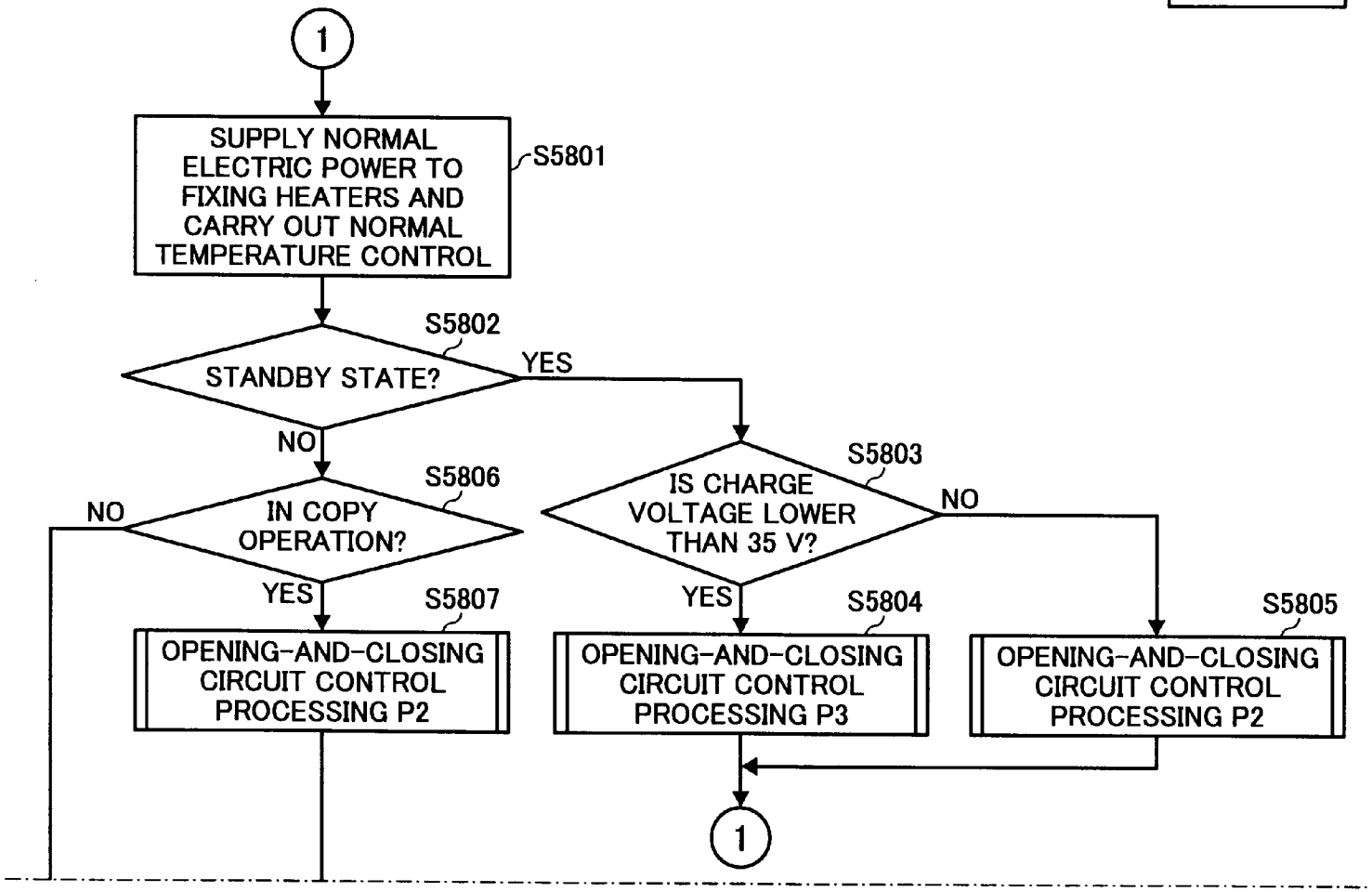
FIG. 58A is a flowchart of a procedure of operation mode control processing performed by an engine control unit of an image forming apparatus according to the eighth embodiment.
Figure 58A:
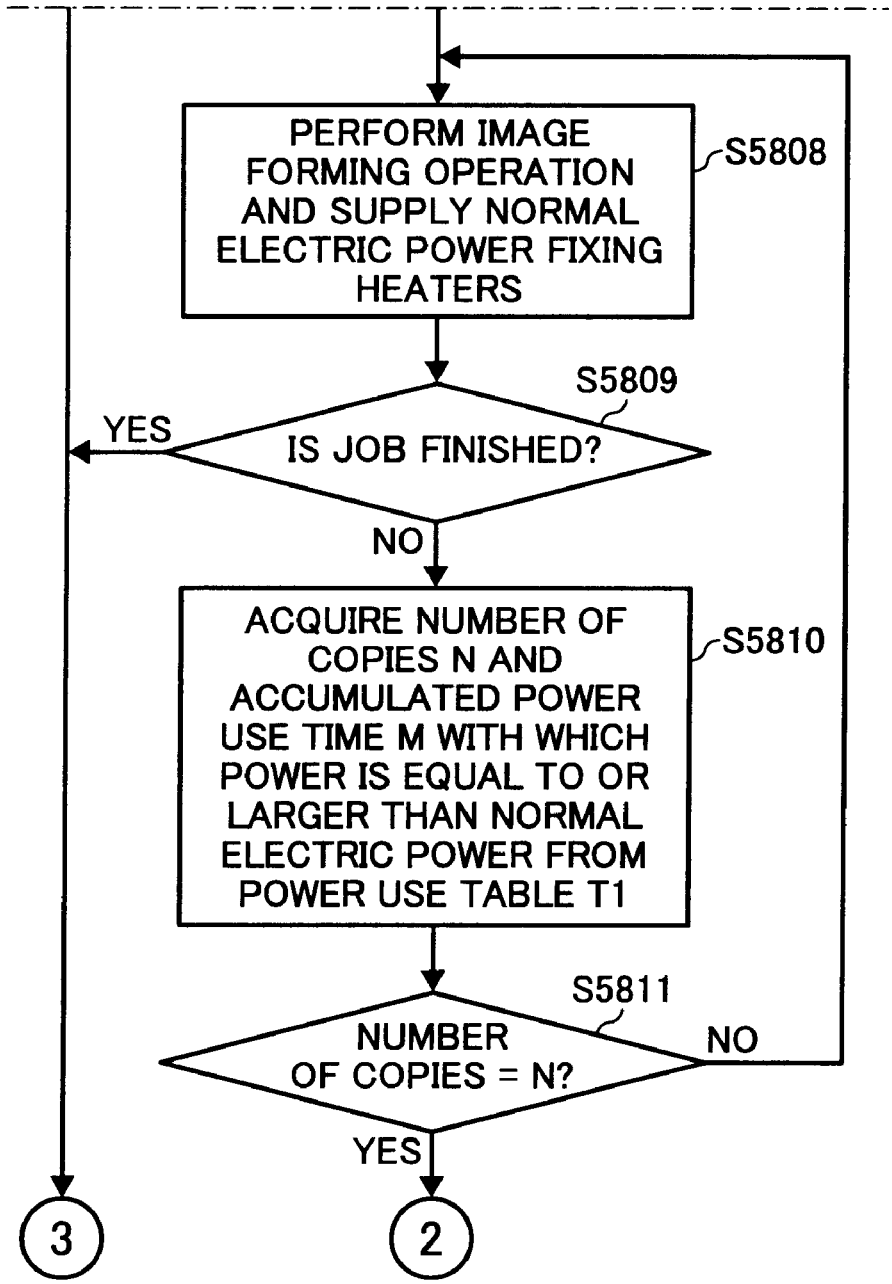
Figure 58B:
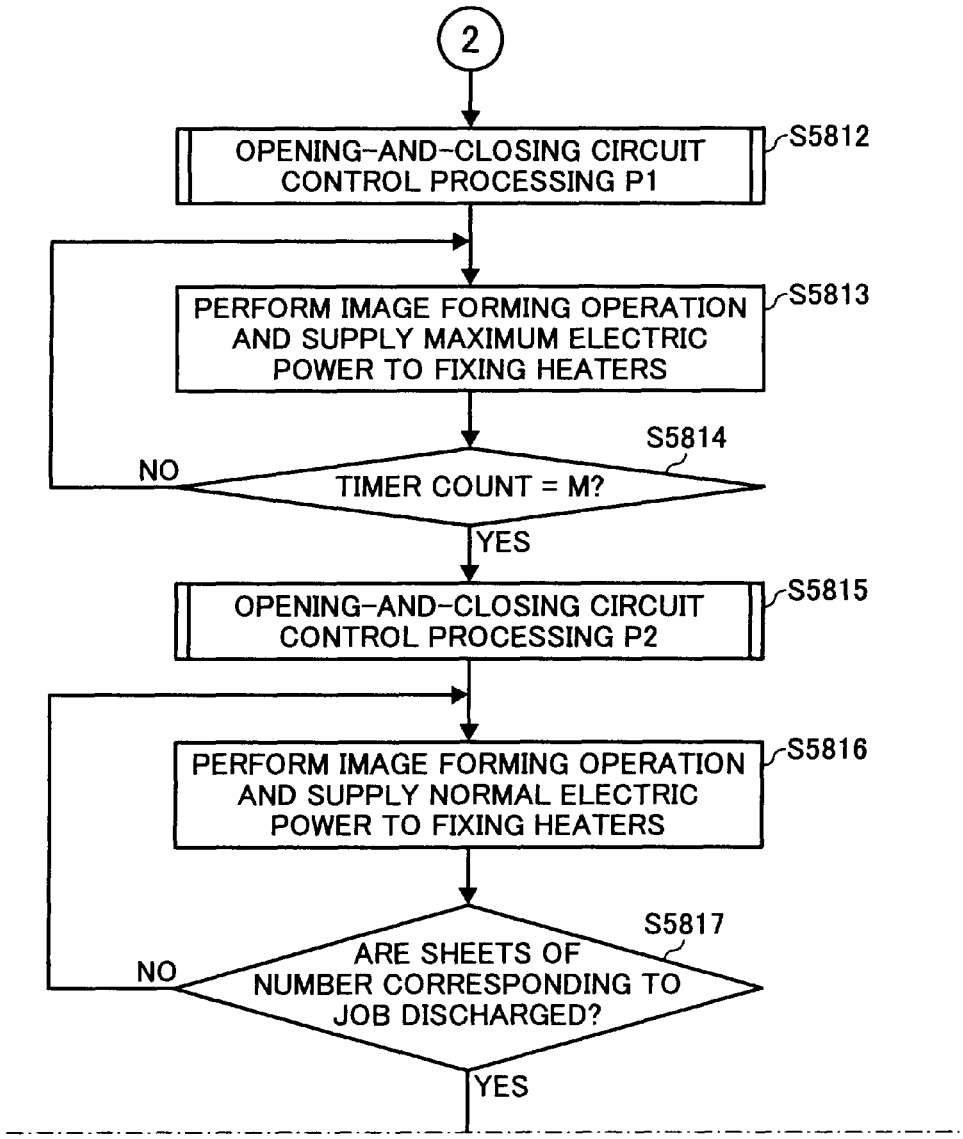
FIG. 58B is a flowchart of the procedure of the operation mode control processing performed by the engine control unit of the image forming apparatus according to the eighth embodiment.
Figure 58B:
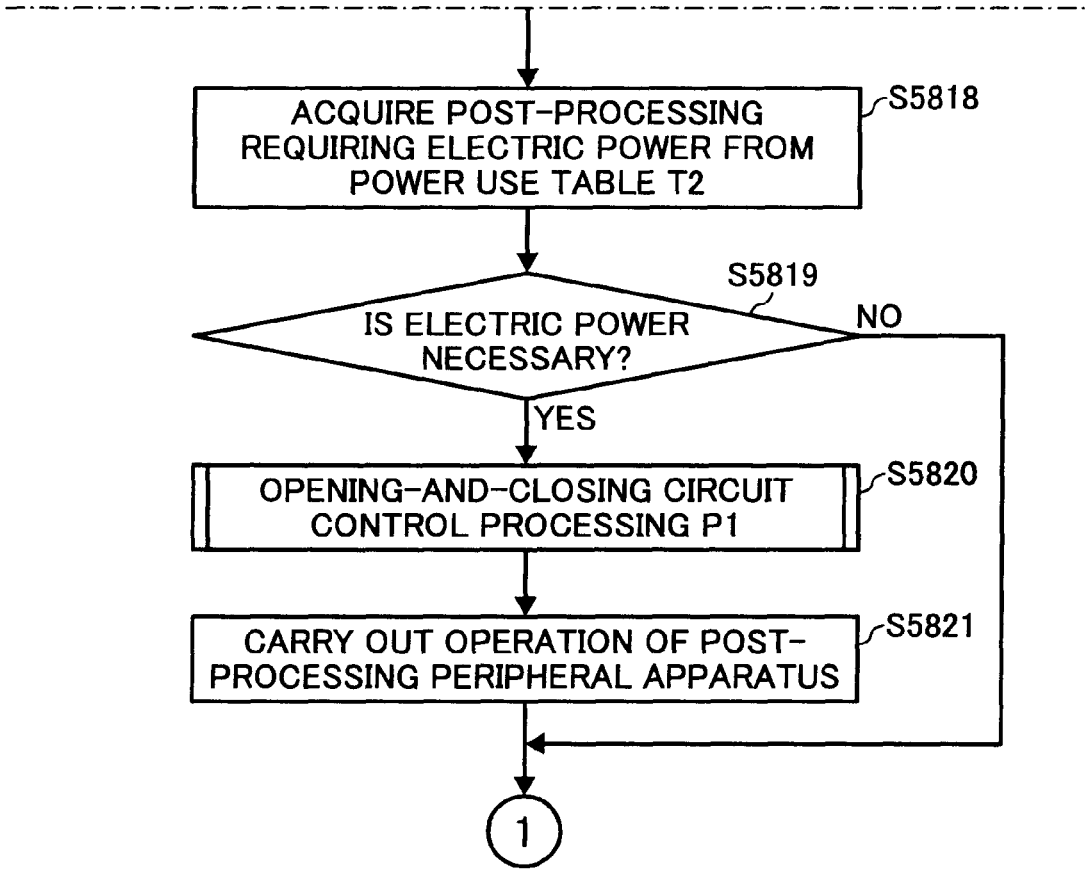

FIGS. 58A and 58B are flowcharts of a procedure of operation mode control processing performed by the engine control unit of the image forming apparatus. Since the operation mode control processing is partially the same as that in the flowcharts shown in FIGS. 45A to 45D explained in the sixth embodiment, only differences are explained. Since the processing before step S5801 is the same as that at steps S4501 to S4510 in FIG. 45A, the explanation with reference to FIG. 45 is referred to and an explanation of the processing is omitted here.

Figure 45A:
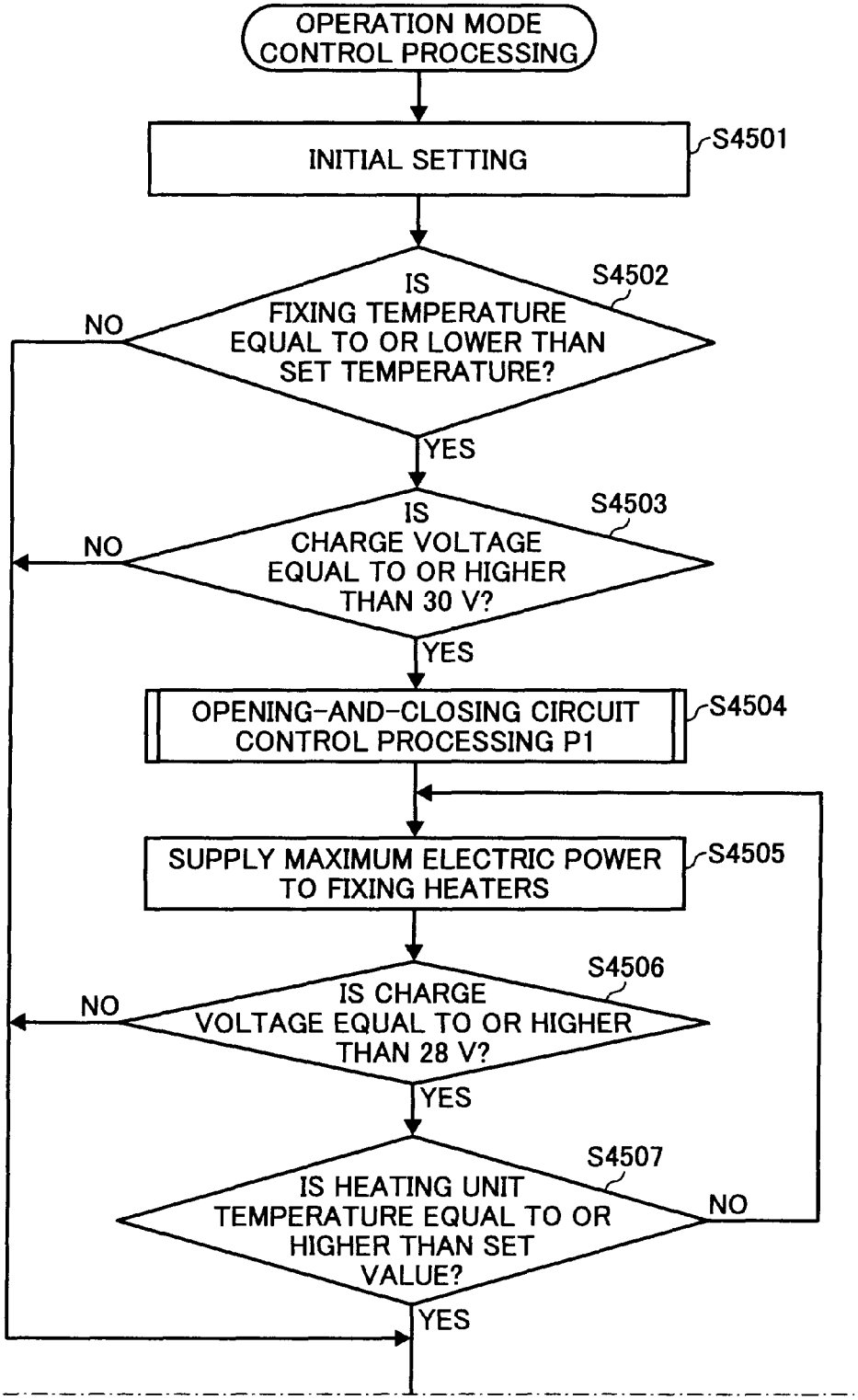
FIG. 45A is a flowchart of a procedure of operation mode control processing performed by an engine control unit of an image forming apparatus according to the sixth embodiment.
Figure 45A:
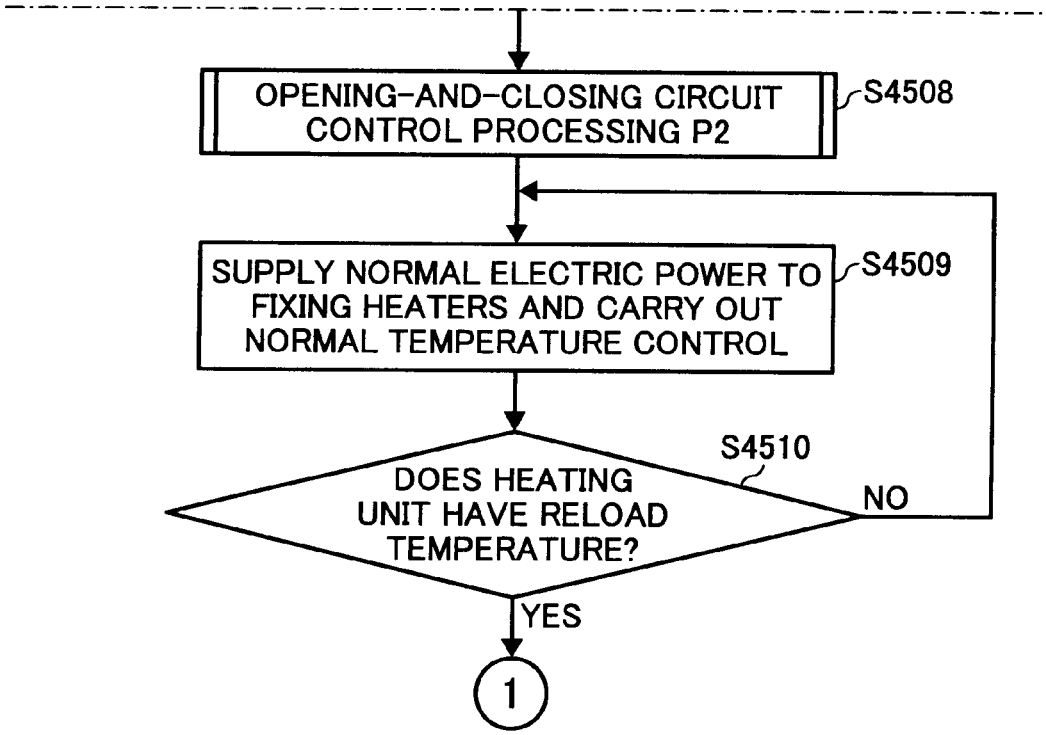
Figure 45B:
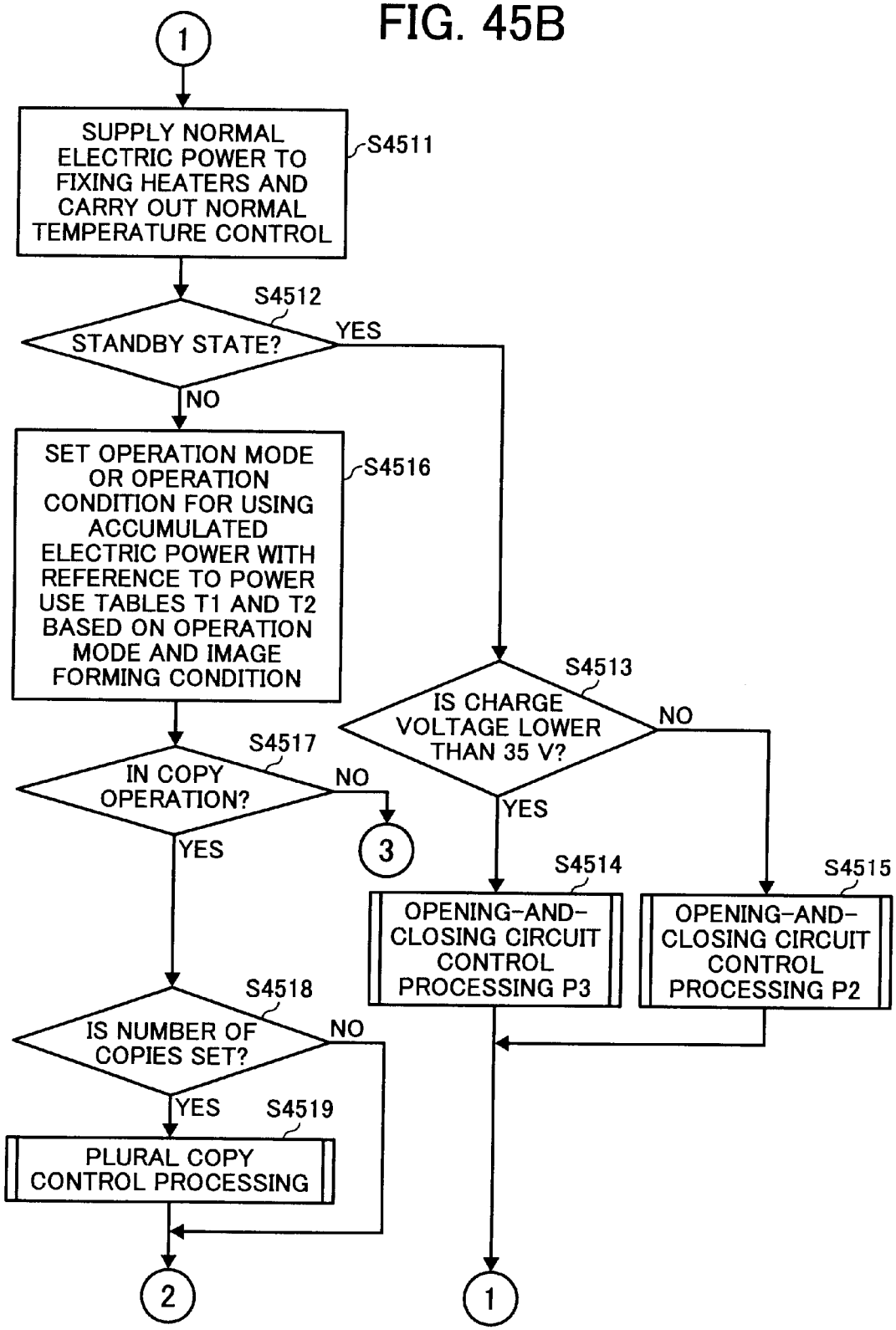
FIG. 45B is a flowchart of the procedure of the operation mode control processing performed by the engine control unit of the image forming apparatus according to the sixth embodiment.
Figure 45C:
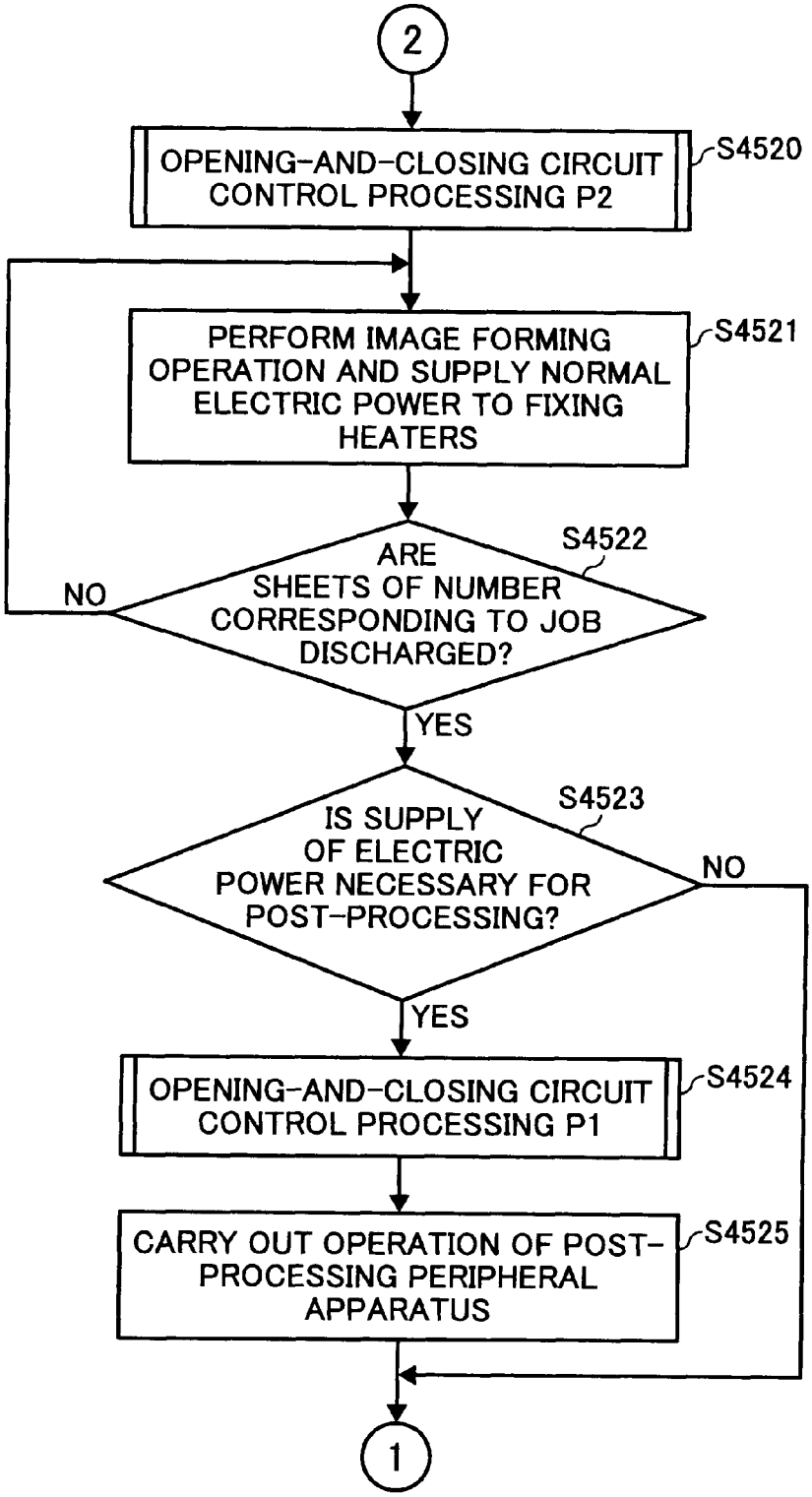
FIG. 45C is a flowchart of the procedure of the operation mode control processing performed by the engine control unit of the image forming apparatus according to the sixth embodiment.

When it is judged at step S4510 in FIG. 45A that the CPU 10*a* of the engine control unit 10 has the reload temperature, the fixing device comes into the standby state, electric power at the normal time set in advance is supplied to the fixing heaters, and normal temperature control is carried out (step S5801).

The CPU 10*a* judges whether the fixing device is in the standby state again (step S5802). When it is judged that the fixing device is in the standby state ("Yes" at step S5802), the CPU 10*a* judges whether a charge voltage is lower than 35 volts (step S5803). When it is judged that the charge voltage is lower than 35 volts ("Yes" at step S5803), the CPU 10*a* performs the opening-and-closing-circuit control processing P3 (step S5804). Consequently, the capacitor bank 9 is charged. Thereafter, the CPU 10*a* returns to step S5801. When it is judged that the charge voltage is not lower than 35 volts ("No" at step S5803), the CPU 10*a* performs the opening-and-closing-circuit control processing P2 (step S5805). Consequently, electric power inputted from the commercial power supply is supplied to the load via the constant-voltage generating circuit 13. Thereafter, the CPU 10*a* returns to step S5801.

When it is judged at step S5802 that the fixing device is not in the standby state ("No" at step S5802), the CPU 10*a* judges whether the image forming apparatus is performing a copy operation (step S5806). When it is judged that the image forming apparatus is performing the copy operation ("Yes" at step S5806), the CPU 10*a* performs the opening-and-closing-circuit control processing P2 (step S5807). Consequently, electric power inputted from the commercial power supply is supplied to the load via the constant-voltage generating circuit 13. The load performs an image forming operation and normal electric power is supplied to the AC fixing heaters 29 and 30 (step S5808).

The CPU 10*a* judges whether a job has been finished (step S5809). When it is judged that the job has been finished ("Yes" at step S5809), the CPU 10*a* carries out processing of the energy saving mode described later. When it is judged that the job has not been finished ("No" at step S5809), the CPU 10*a* acquires, from the power use table T1, the number of copies N and an accumulated electric power use time M corresponding to a present sheet size with which use power is equal to or larger than normal electric power (step S5810).

The CPU 10*a* judges whether a present number of copies is N (step S5811). When it is judged that the present number of copies is not N ("No" at step S5811), the CPU 10*a* returns to step S5808 and the image forming operation is continued. When it is judged that the present number of copies is N ("Yes" at step S5811), to prevent the temperature of the heating unit from falling to be lower than a fixed image guarantee temperature, the CPU 10*a* performs the opening-and-closing-circuit control processing P1 (step S5812). Consequently, the supply of electric power from the commercial power supply is stopped. Moreover, electric power accumulated in the capacitor bank 9 is supplied to the constant-voltage generating circuit 13. It is possible to supply excess electric power to the heating unit of the fixing device. As a result, it is possible to supply maximum electric power of the heater rating to the AC fixing heaters 29 and 30.

The CPU 10*a* continues the state in which the maximum electric power is supplied to the AC fixing heaters 29 and 30 and continues the copy operation (step S5813). The temperature fall in the heating unit of the fixing device occurs because heat of a fixing pressure roller moves to a sheet when sheet supply is started. Therefore, when this pressure roller is warmed, the temperature fall is solved. The CPU 10*a* counts the accumulated electric power use time M, which is time until the pressure roller is warmed, with the timer (step S5814). When it is judged that a timer count is not M ("No" at step S5814), the CPU 10*a* returns to step S5813. The maximum electric power of the heater rating is supplied to the fixing heaters until the accumulated electric power use time M elapses.

When it is judged that the timer count is M ("Yes" at step S5814), the CPU 10*a* performs the opening-and-closing-circuit control processing P2 (step S5815). Consequently, the electric power inputted from the commercial power supply is supplied to the load. The load continuously performs the image forming operation and the CPU 10*a* supplies normal electric power to the fixing heaters (step S5816). The CPU 10*a* judges whether sheets of a number that should be discharged in one job have been discharged (step S5817). When it is judged that the sheets of the number that should be discharged in one job have not been discharged ("No" at step S5817), the CPU 10*a* returns to step S5816 and continues the image forming operation. When it is judged that the sheets of the number that should be discharged in one job have been discharged ("Yes" at step S5817), the CPU 10*a* acquires, from the power use table T2, post-processing that requires supply of electric power (step S5818).

The CPU 10*a* judges whether supply of electric power is necessary for the post-processing to be carried out (step S5819). When it is judged that supply of electric power is necessary for the post-processing ("Yes" at step S5819), the CPU 10*a* performs the opening-and-closing-circuit control processing P1 (step S5820). Consequently, electric power accumulated in the capacitor bank 9 is supplied to the constant-voltage generating circuit 13. It is possible to increase an output of a DC power supply. For example, supply of electric power is performed when a binding operation of staple processing is performed as the post-processing. A post-processing peripheral apparatus supplied with the electric power carries out a post-processing operation (step S5821). Thereafter, the CPU 10*a* returns to step S5801. When it is judged that supply of electric power is not necessary for the post-processing ("No" at step S5819), since the copy operation has been finished, the CPU 10*a* returns to step S5801.

Figure 45D:
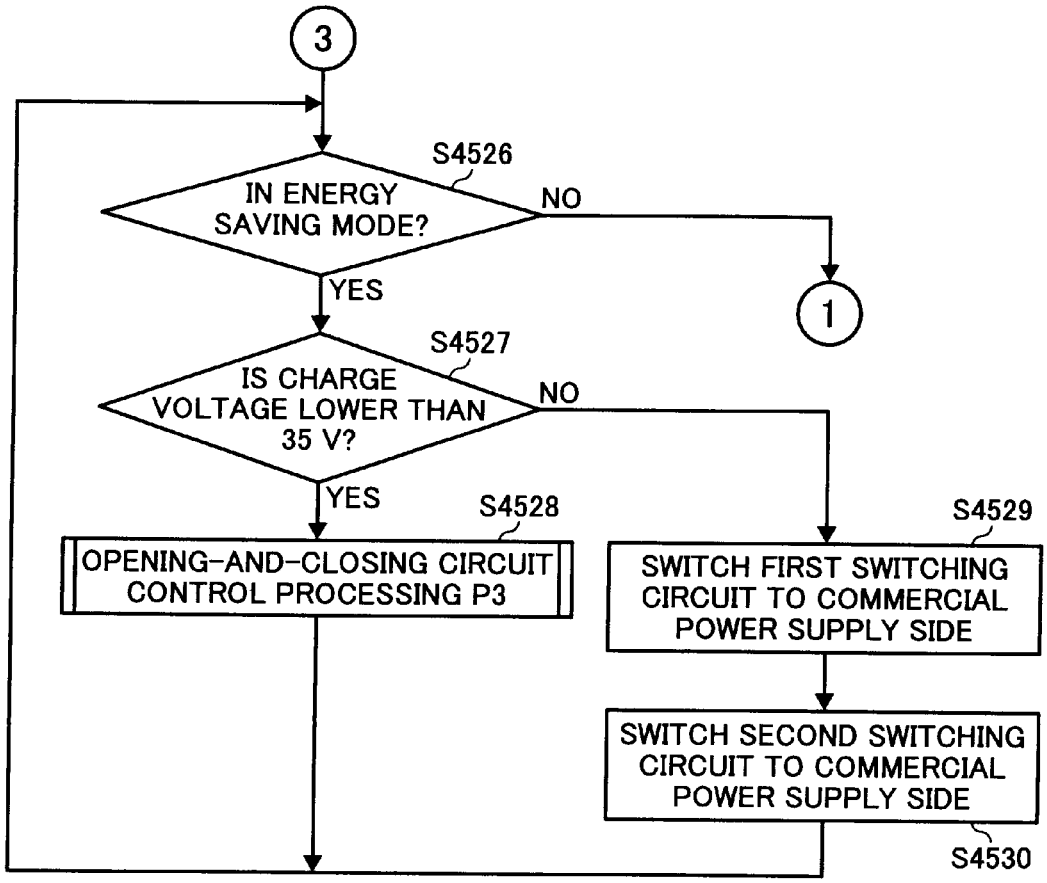
FIG. 45D is a flowchart of the procedure of the operation mode control processing performed by the engine control unit of the image forming apparatus according to the sixth embodiment.

When it is judged at step S5806 that the image forming apparatus is not performing the copy operation ("No" at step S5806) or when it is judged at step S5809 that the job has been finished ("Yes" at step S5809), the CPU 10*a* judges whether the image forming apparatus is in the energy saving mode and performs processing. A procedure of the processing is substantially the same as that of steps S4526 to S4530 of the flowcharts in FIG. 45D. Thus, the explanation with reference to FIG. 45D is referred to. An explanation of the procedure is omitted here and only differences are explained below.

In this embodiment, processing for transmitting a step-down output stop signal to the CPU 7*a* of the step-down-output control and charge control circuit 7 is performed instead of steps S4529 and S4530.

Figure 59:
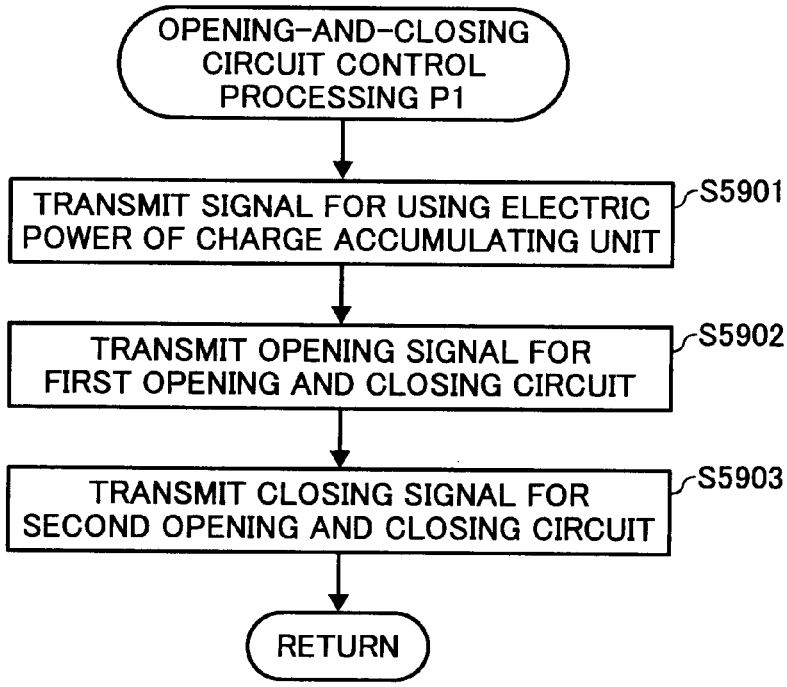
FIG. 59 is a flowchart of a procedure of opening-and-closing-circuit control processing P1 performed by the engine control unit of the image forming apparatus according to the eighth embodiment.

The opening-and-closing-circuit control processing P1 in the flowcharts shown in FIGS. 58A and 58B is replaced with opening-and-closing-circuit control processing P1 shown in FIG. 59. The opening-and-closing-circuit control processing P2 is replaced with opening-and-closing-circuit control processing P2 shown in FIG. 60. The opening-and-closing-circuit control processing P3 is replaced with opening-and-closing-circuit control processing P3 shown in FIG. 61.

FIG. 21 is a flowchart of a procedure of the opening-and-closing-circuit control processing P1 performed by the engine control unit of the image forming apparatus. According to this processing, the constant-voltage generating circuit 13 generates a constant voltage using accumulated electric power of the capacitor bank 9 and supplies electric power to the load.

The CPU 10*a* transmits a signal for using electric power of the charge accumulating unit to the CPU 7*a* of the step-down-output control and charge control circuit 7 (step S5901). The CPU 10*a* transmits an opening signal for the first opening and closing circuit to the CPU 7*a* of the step-down-output control and charge control circuit 7 (step S5902) and transmits a closing signal for the second opening and closing circuit to the CPU 7*a* of the step-down-output control and charge control circuit 7 (step S5903).

Figure 60:
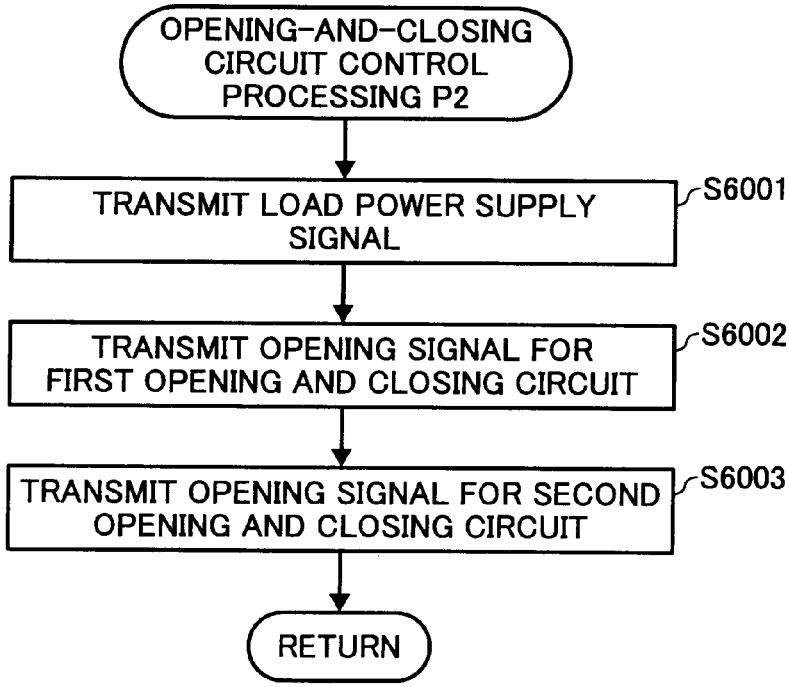
FIG. 60 is a flowchart of a procedure of opening-and-closing-circuit control processing P2 performed by the engine control unit of the image forming apparatus according to the eighth embodiment.

FIG. 60 is a flowchart of a procedure of the opening-and-closing-circuit control processing P2 performed by the engine control unit of the image forming apparatus. According to this processing, the constant-voltage generating circuit 13 generates a constant voltage using a voltage outputted from the commercial power supply and supplies electric power to the load.

The CPU 10*a* transmits a load power supply signal to the CPU 7*a* of the step-down-output control and charge control circuit 7 (step S6001). The CPU 10*a* transmits an opening signal for the first opening and closing circuit to the CPU 7*a* of the step-down-output control and charge control circuit 7 (step S6002). The CPU 10*a* transmits an opening signal for the second opening and closing circuit to the CPU 7*a* of the step-down-output control and charge control circuit 7 (step S6003).

Figure 61:
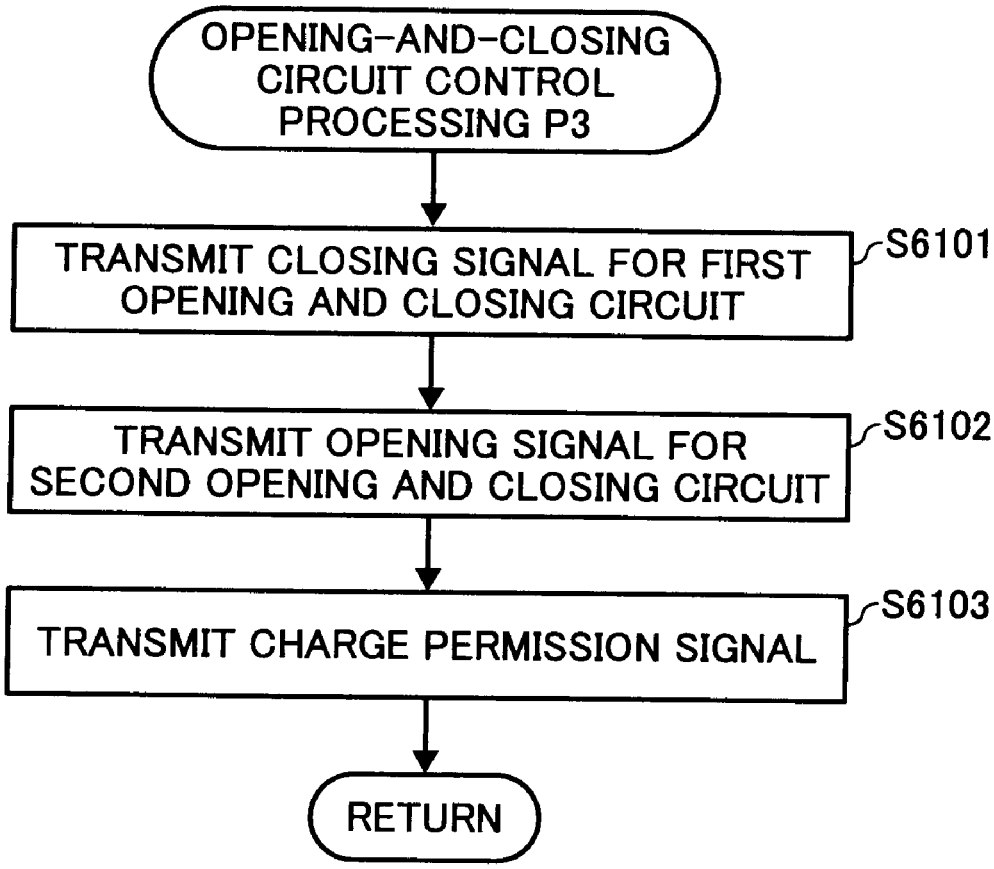
FIG. 61 is a flowchart of a procedure of opening-and-closing-circuit control processing P3 performed by the engine control unit of the image forming apparatus according to the eighth embodiment.

FIG. 61 is a flowchart of a procedure of the opening-and-closing-circuit control processing P3 performed by the engine control unit of the image forming apparatus. According to this processing, a voltage outputted from the commercial power supply is stepped down and the charge accumulating unit is charged with the step-down voltage.

The CPU 10*a* transmits a closing signal for the first opening and closing circuit to the CPU 7*a* of the step-down-output control and charge control circuit 7 (step S6101) and transmits an opening signal for the second opening and closing circuit to the CPU 7*a* of the step-down-output control and charge control circuit 7 (step S6102). The CPU 10*a* transmits a charge permission signal to the CPU 7*a* of the step-down-output control and charge control circuit 7 (step S6103).

As described above, in the power supply device 900 according to this embodiment, in addition to the effects described above, opening and closing circuits are reduced by setting a voltage at the step-down circuit lower than a charge voltage at the capacitor bank 9 when the second opening and closing circuit is closed. When a voltage at the capacitor bank 9 falls because of discharge, the input of the constant-voltage generating circuit 13 is automatically switched to the step-down chopper circuit 50 side.

Figure 62:
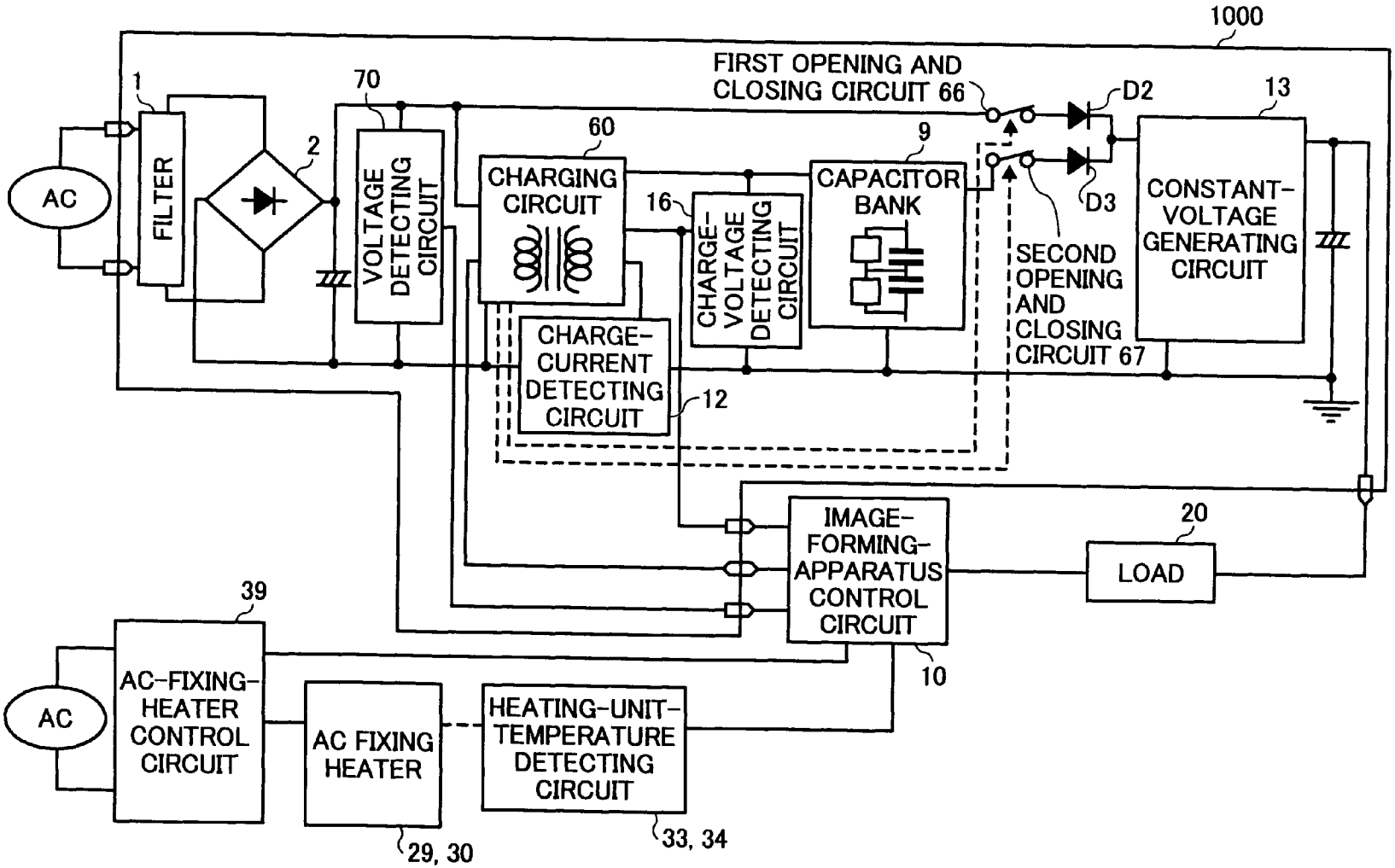
FIG. 62 is a circuit diagram of a circuit configuration of a power supply device according to another embodiment of the present invention.
Figures 63, 63A, 63B:
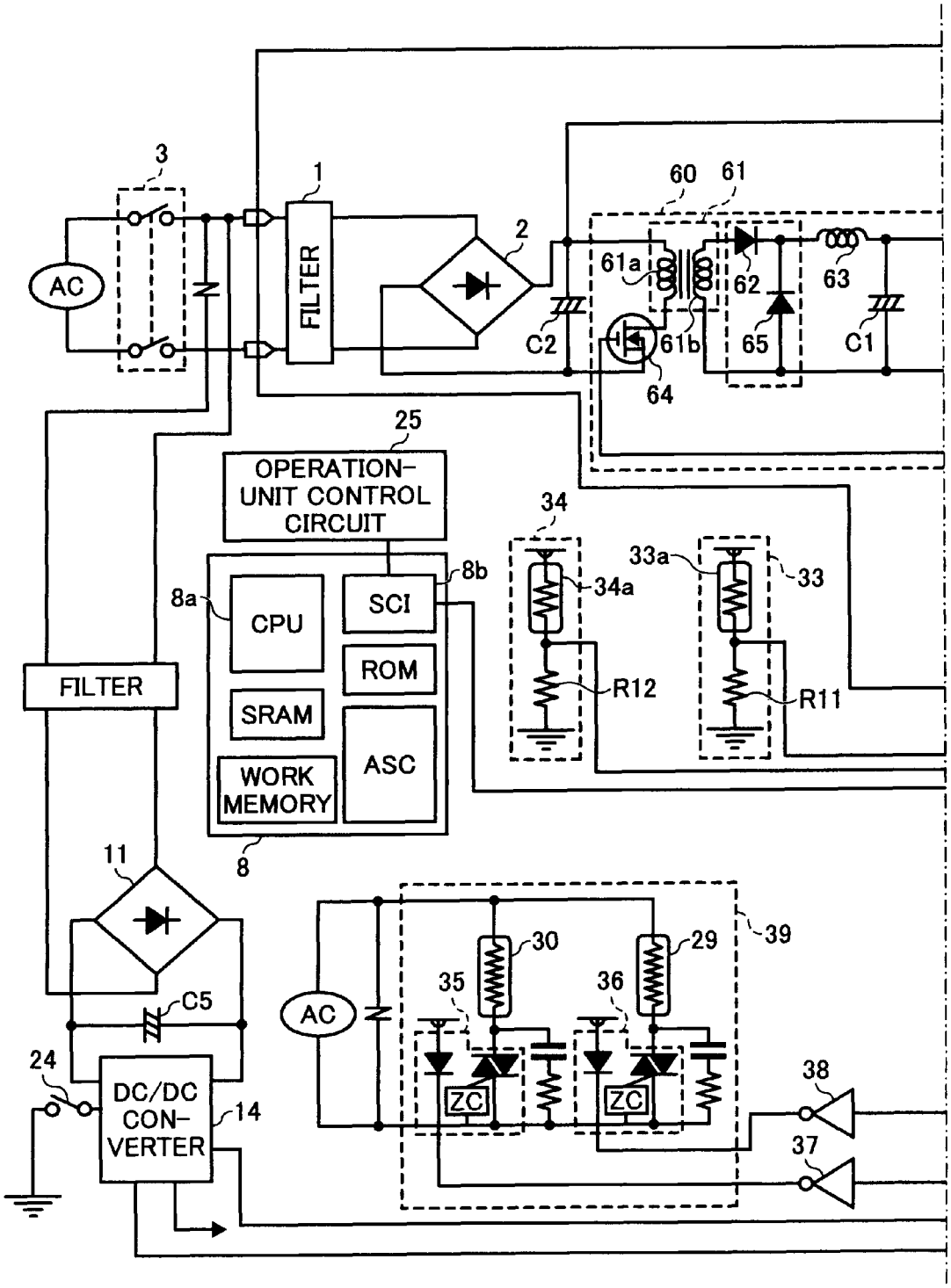
FIG. 63 is a detailed circuit diagram of a detailed circuit configuration of the power supply device according to the another embodiment of the present invention.
Figure 63B:
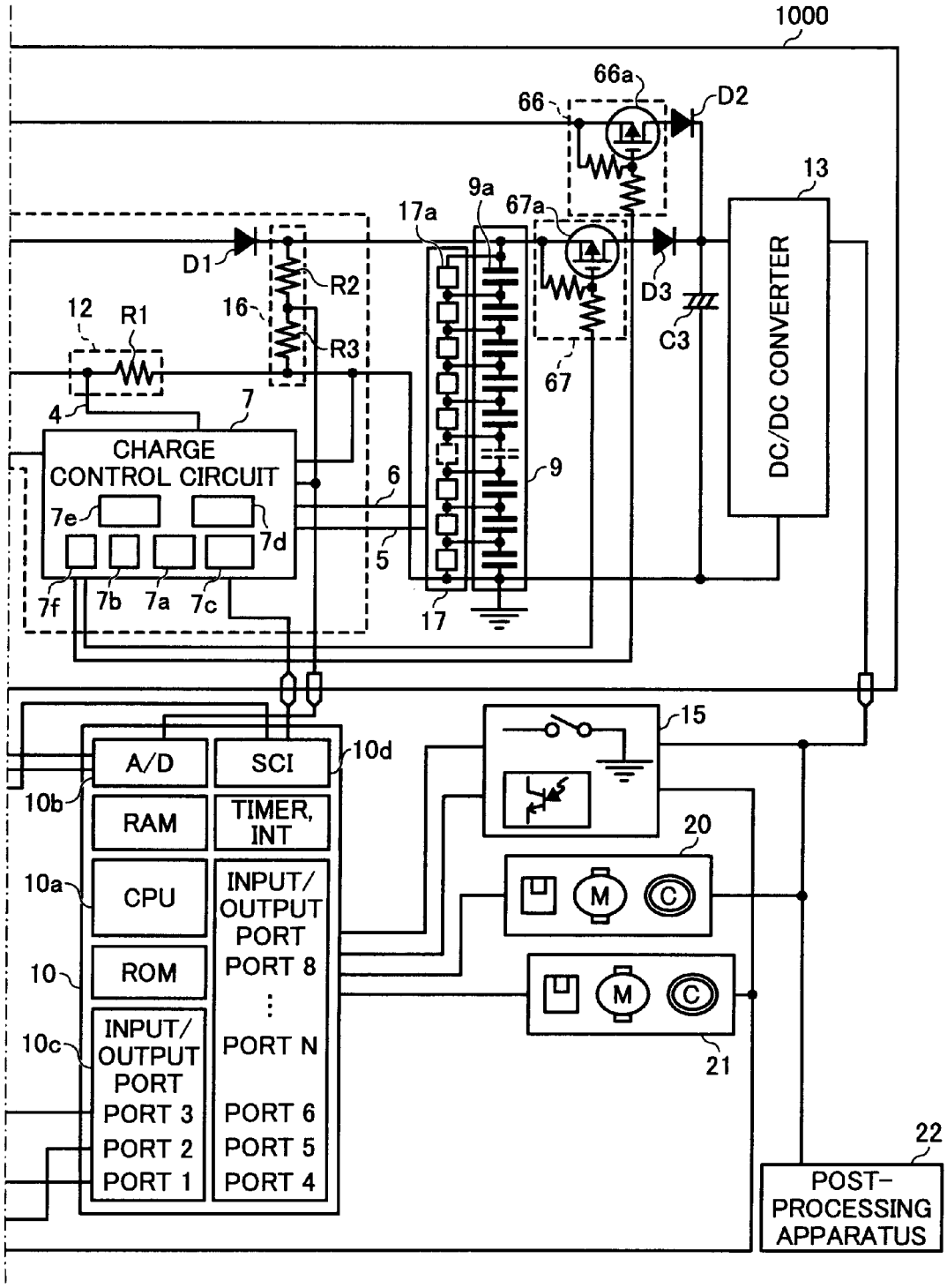

FIG. 62 is a circuit diagram of a circuit configuration of a power supply device according to another embodiment. FIG. 63 is a detailed circuit diagram of a detailed circuit configuration of the power supply device according to the another embodiment. The power supply device shown in FIGS. 62 and 63 is mounted on an engine unit of a printer.

A power supply device 1000 shown in FIGS. 62 and 63 charges a charge accumulating unit with a voltage outputted from the commercial power supply using a charging circuit and changes a voltage outputted from the commercial power supply and a voltage outputted from the charge accumulating unit to constant voltages with a constant-voltage generating circuit to supply the voltages to load. This embodiment is different from the sixth embodiment in that the step-down circuit is not provided, the charge accumulating unit is charged by a charge and control circuit, and opening and closing circuits are controlled.

In the same manner as the conventional power supply, the power supply device 1000 according to this embodiment supplies an output of the full-wave rectifying circuit 2 to the constant-voltage generating circuit 13, divides the output of the full-wave rectifying circuit 2, connects the output to the charging circuit 60, and charges the capacitor bank 9 with the output. Thus, it is possible to easily add an auxiliary charge accumulating function to the structure of the conventional power supply. It is possible to reduce the number of capacitor cells in use by increasing a control input voltage range of the constant-voltage generating circuit 13.

When a load is light at the time of standby or the like, it is possible to supply electric power to the load even at the time of charge by closing the first opening and closing circuit 66. When it is unnecessary to supply electric power to the load at the time of the energy saving mode or the like, it is possible to reduce electric power by opening the opening and closing circuit.

In the power supply device 1000 according to this embodiment, by adopting a voltage transformer in the charging circuit 60, an opening and closing circuit that connects the commercial power supply to a charging circuit is made unnecessary.

Figure 64:
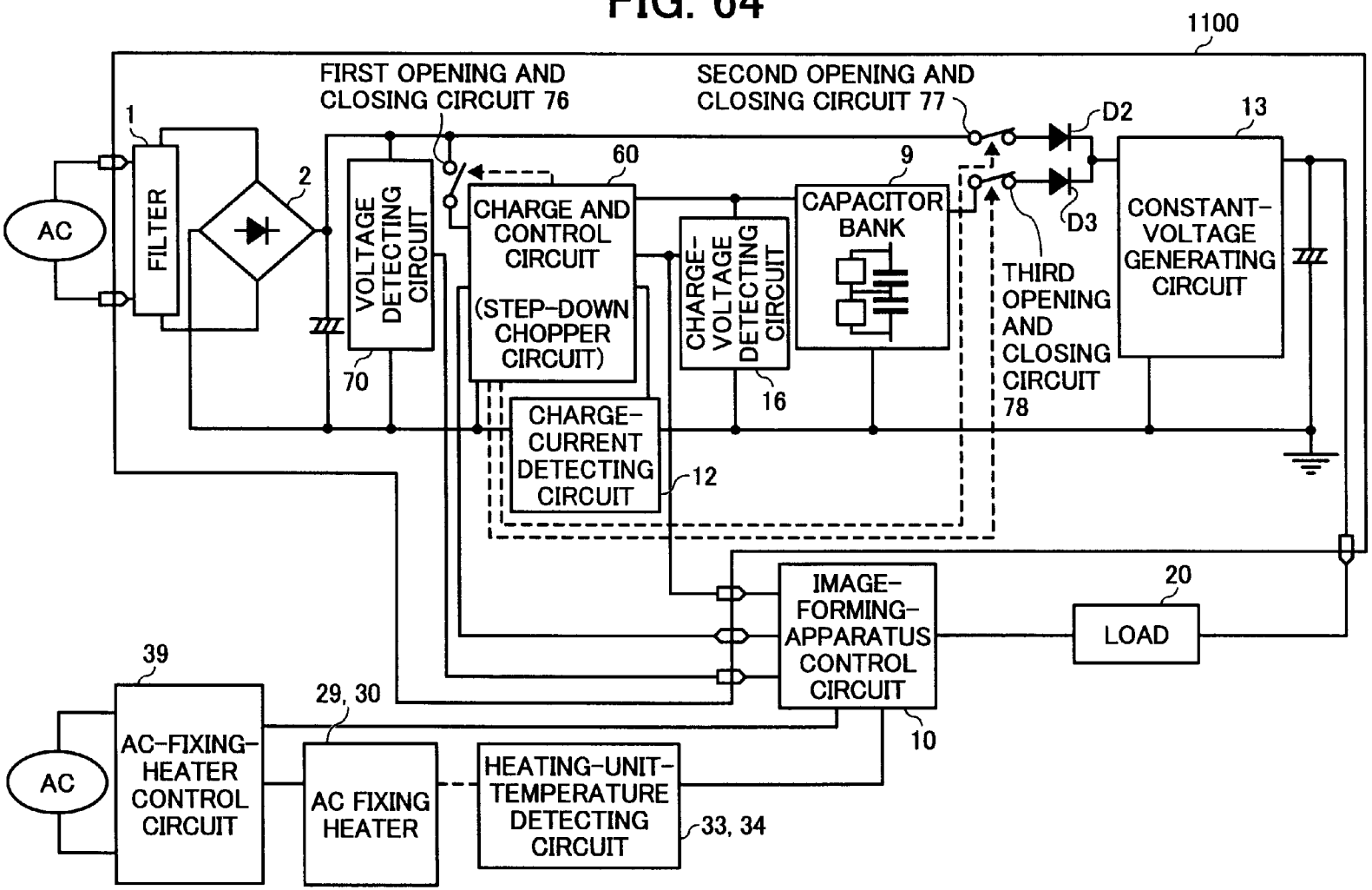
FIG. 64 is a circuit diagram of a circuit configuration of a power supply device according to still another embodiment of the present invention.
Figures 65, 65A, 65B:
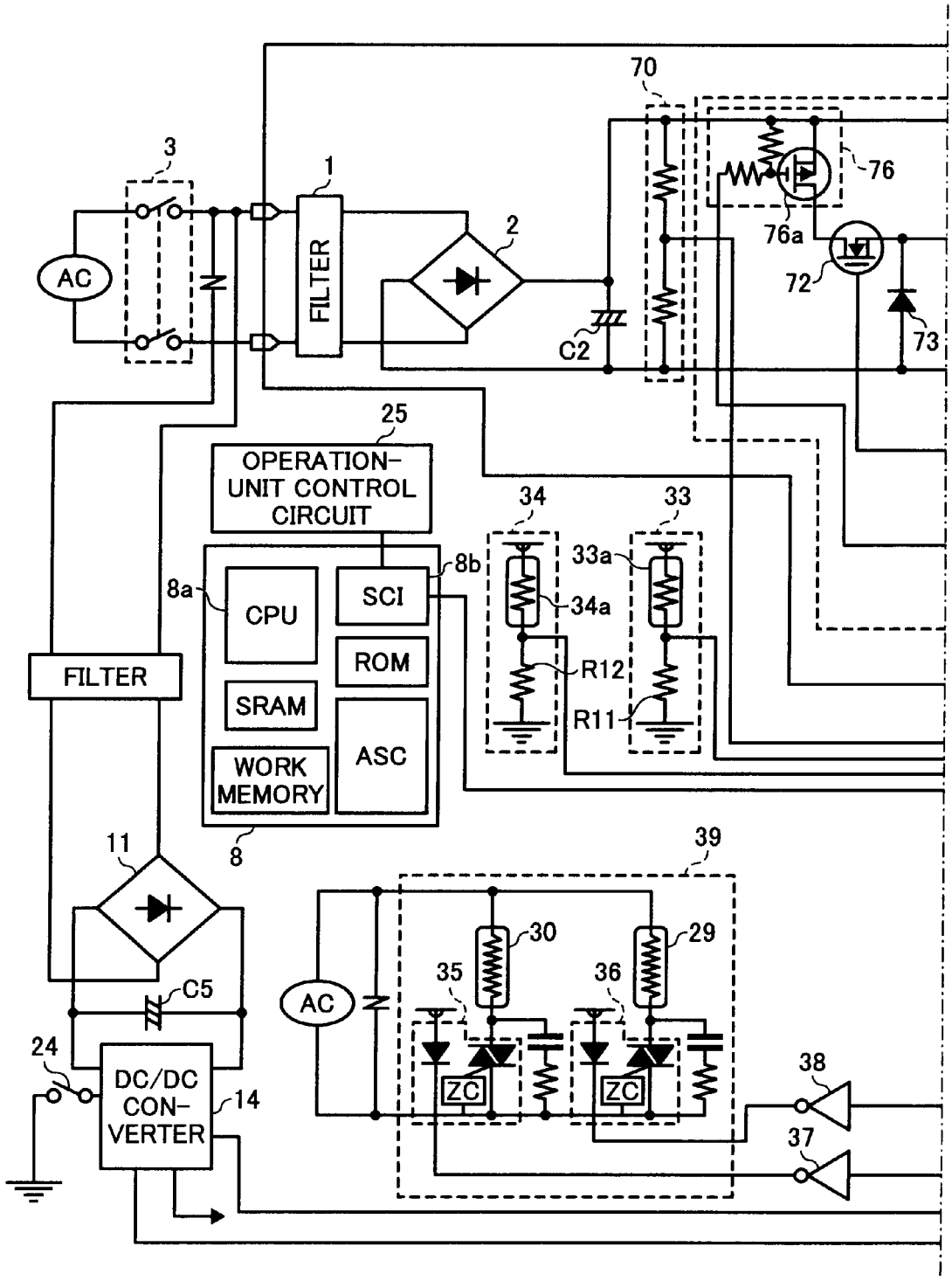
FIG. 65 is a detailed circuit diagram of a detailed circuit configuration of the power supply device according to the still another embodiment of the present invention.
Figure 65B:
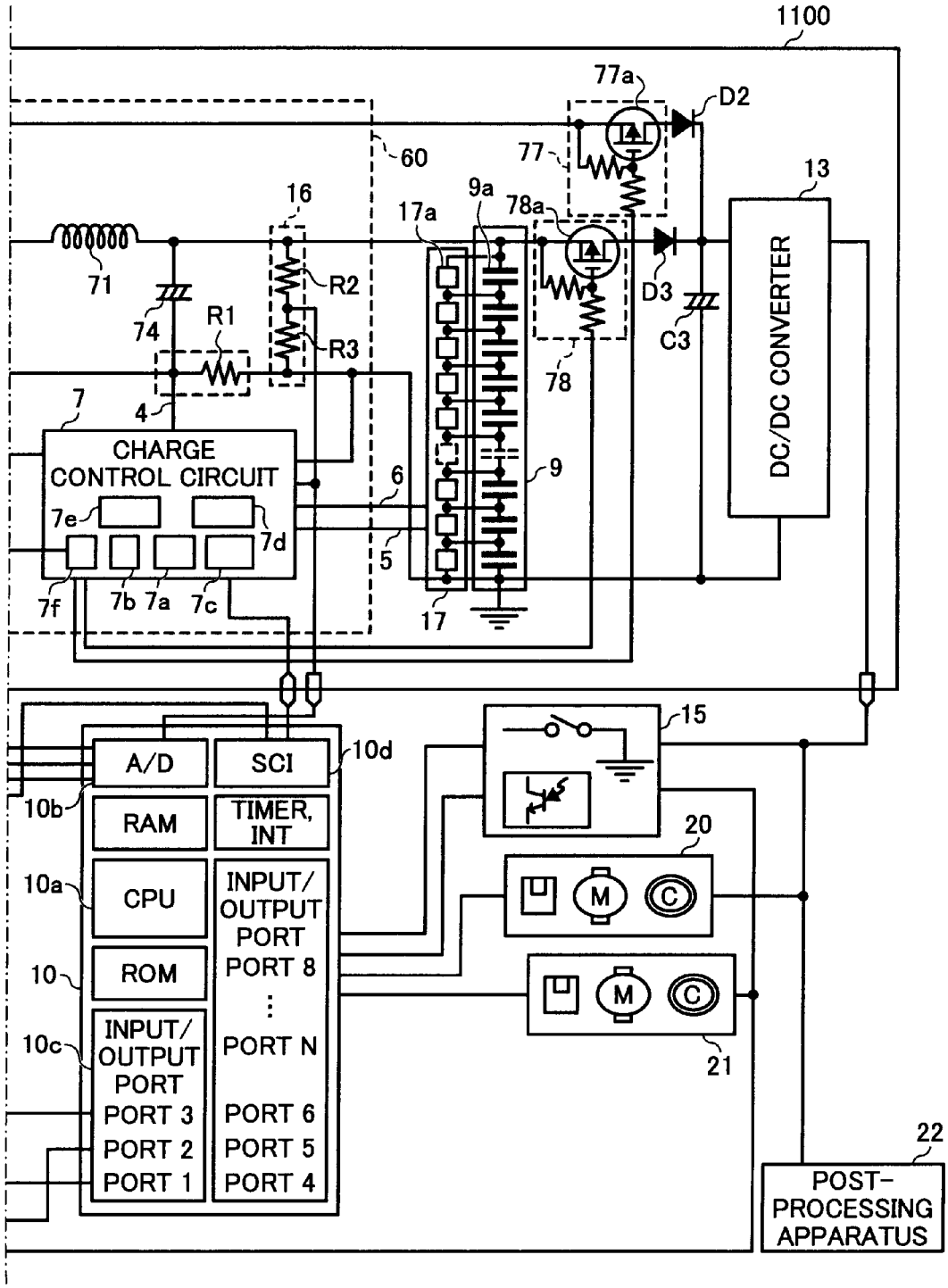

FIG. 64 is a circuit diagram of a circuit configuration of the power supply device according to still another embodiment. FIG. 65 is a detailed circuit diagram of a detailed circuit configuration of the power supply device according to the still another embodiment. The power supply device shown in FIGS. 64 and 65 is mounted on an engine unit of a printer.

A power supply device 1100 shown in FIGS. 64 and 65 has substantially the same structure as the power supply device 1000. The power supply device 1100 is different from the power supply device 1000 in that the power supply device

1100 includes the first opening and closing circuit 76, the second opening and closing circuit 77, and the third opening and closing circuit 78 instead of the first opening and closing circuit 66 and the second opening and closing circuit 67.

In the power supply device 1100 according to this embodiment, in addition to the effects described above, when a load is light at the time of standby or the like, it is possible to supply electric power to the load even at the time of charge by closing the first opening and closing circuit 76 and the second opening and closing circuit 77. When it is unnecessary to supply electric power to the load at the time of the energy saving mode or the like, it is possible to reduce electric power by opening the opening and closing circuits.

In the power supply device 1100 according to this embodiment, although the opening and closing circuits that connect the commercial power supply to the charging circuit 60 are necessary, it is possible to simplify a circuit configuration of a charging circuit by using a step-down chopper circuit.

According to the embodiments, the step-down unit steps down a voltage outputted from the commercial power supply, the step-down/charge control unit controls a step-down voltage, the charge accumulating unit is charged based on the step-down voltage outputted, the constant-voltage generating unit generates a constant voltage based on the output of the charge accumulating unit or the output of the step-down unit, and the voltage-supply control unit supplies the constant voltage to the load that performs an image forming operation. This makes it possible to supply a voltage from the charge accumulating unit charged by the commercial power supply to the load. Therefore, there is an effect that it is possible to reduce a warm-up time of the load, which performs an image forming operation, using the commercial power supply generally used in offices in Japan. Further, it is possible to generate a constant voltage with one constant-voltage generating unit based on a voltage outputted the charge accumulating unit or a voltage outputted from the commercial power supply. Therefore, there is an effect that it is possible to simplify structures of an image forming apparatus and a power supply device including a power supply unit. Moreover, since it is possible to simplify the structures of the image forming apparatus and the power supply device, there is an effect that it is possible to reduce manufacturing cost for the image forming apparatus and the power supply device.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a step-down unit that steps down a voltage based on a commercial power supply;

a charge accumulating unit that is chargeable and dischargeable and is charged by electric power output from the step-down unit;

a load that one of electric power output from the charge accumulating unit and the electric power output from the step-down unit is supplied;

a first switching unit that switches whether to supply the electric power output from the charge accumulating unit to the load or to supply the electric power output from the step-down unit to the load;

a storing unit that stores a condition of an output sheet to which an image is formed and an accumulated power use time for a plurality of image forming operation modes or image forming operation conditions, the plurality of image forming operation modes or image forming operation conditions each requiring output of electric power from the charge accumulating unit; and a control unit that controls the load and the first switching unit based on the condition of the output sheet and the accumulated power use time corresponding to a predetermined image forming operation mode or image forming operation condition.

2. The image forming apparatus according to claim 1, wherein the storing unit stores control data indicating that the predetermined image forming operation mode or image forming operation condition requires more electric power than an amount of the electric power which is supplied from the commercial power supply and indicating an amount of electric power to be outputted from the charge accumulating unit, when the predetermined image forming operation mode or image forming operation condition is operated, and the control unit controls the first switching unit such that the amount of electric power is outputted from the charge accumulating unit, when the predetermined image forming operation mode or image forming operation condition is operated.

3. The image forming apparatus according to claim 1, further comprising:

a post processing unit that performs post processing for an output sheet, wherein the storing unit stores operation control data associated with a predetermined post processing operation that requires an output of the charge accumulating unit, and the control unit controls the first switching unit such that electric power is output from the charge accumulating unit, when the predetermined post processing operation is operated.

4. The image forming apparatus according to claim 1, further comprising:

a second switching unit that switches whether to output electric power from the step-down unit to the charge accumulating unit or to output electric power from the step-down unit to the load, wherein the control unit controls the second switching unit such that the electric power is output to the load, when the charge accumulating unit is charged.

5. The image forming apparatus according to claim 1, further comprising:

a constant-voltage generating unit at a post stage of the first switching unit.

6. The image forming apparatus according to claim 1, wherein the first switching unit is connected to the step-down unit when a power supply of the image forming apparatus is switched to OFF.

7. The image forming apparatus according to claim 4, wherein the second switching unit is connected to the load when a power supply of the image forming apparatus is switched to OFF.

8. The image forming apparatus according to claim 1, wherein the first switching unit includes a first opening-closing unit that opens and closes a current path between the charge accumulating unit and the load and a second opening-closing unit that opens and closes a current path between the step-down unit and the load.

* * * * *